US012458853B2

(12) United States Patent
Breier et al.

(10) Patent No.: US 12,458,853 B2
(45) Date of Patent: Nov. 4, 2025

(54) GOLF CLUB HAVING A DAMPING ELEMENT FOR BALL SPEED CONTROL

(71) Applicant: Acushnet Company, Fairhaven, MA (US)

(72) Inventors: Joshua G. Breier, Vista, CA (US); Marni D. Ines, San Marcos, CA (US); Charles E. Golden, Encinitas, CA (US); Richard L. Cleghorn, Oceanside, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 54 days.

(21) Appl. No.: 17/946,994

(22) Filed: Sep. 16, 2022

(65) Prior Publication Data

US 2023/0018341 A1 Jan. 19, 2023

Related U.S. Application Data

(63) Continuation of application No. 17/565,895, filed on Dec. 30, 2021, which is a continuation-in-part of (Continued)

(51) Int. Cl.

| | |
|---|---|
| ***A63B 53/04*** | (2015.01) |
| ***A63B 60/54*** | (2015.01) |
| *A63B 102/32* | (2015.01) |

(52) U.S. Cl.

CPC ..... *A63B 60/54* (2015.10); *A63B 53/047* (2013.01); *A63B 53/0416* (2020.08); *A63B 2102/32* (2015.10); *A63B 2209/00* (2013.01)

(58) Field of Classification Search

CPC ..... A63B 53/0454; A63B 53/54

See application file for complete search history.

(56) References Cited

U.S. PATENT DOCUMENTS 1,133,129 A 3/1915 Govan
1,665,523 A * 4/1928 Boyce ..... A63B 53/0466 473/245

(Continued)

FOREIGN PATENT DOCUMENTS

JP 03007178 A 1/1991
JP H11-192329 5/2001

(Continued)

OTHER PUBLICATIONS

KR Action issued for KR 20-2021-0000940 mailed on Nov. 24, 2022 with translation (12 pages).

(Continued)

*Primary Examiner* — Eugene L Kim
*Assistant Examiner* — Matthew B Stanczak
(74) *Attorney, Agent, or Firm* — Womble Bond Dickinson (US) LLP

(57) ABSTRACT

A golf club head including a striking face, a periphery portion surrounding and extending rearwards from the striking face, wherein the striking face comprises a front surface configured to strike a golf ball and a rear surface opposite the front surface, a support arm spaced from the rear surface of the striking face, the support arm extending from the periphery portion, wherein the support arm extends from the sole to the topline, a first damping element residing between the support arm and the rear surface of the striking face, a second damping element located between the support arm and the striking face, the second damping element in contact with the rear surface of the striking face and the support arm, and wherein the second damping element wraps around the support arm.

18 Claims, 103 Drawing Sheets

Related U.S. Application Data application No. 17/543,459, filed on Dec. 6, 2021, now Pat. No. 11,938,387, which is a continuation-in-part of application No. 17/532,222, filed on Nov. 22, 2021, which is a continuation-in-part of application No. 17/377,696, filed on Jul. 16, 2021, now Pat. No. 11,826,620, which is a continuation-in-part of application No. 17/349,519, filed on Jun. 16, 2021, now Pat. No. 11,786,789, said application No. 17/543,459 is a continuation-in-part of application No. 17/337,151, filed on Jun. 2, 2021, now abandoned, said application No. 17/349,519 is a continuation-in-part of application No. 17/138,618, filed on Dec. 30, 2020, now Pat. No. 11,794,080, which is a continuation-in-part of application No. 17/127,061, filed on Dec. 18, 2020, now Pat. No. 11,433,284, which is a continuation-in-part of application No. 17/085,474, filed on Oct. 30, 2020, now Pat. No. 11,202,946, which is a continuation-in-part of application No. 16/833,054, filed on Mar. 27, 2020, now Pat. No. 11,020,639, and a continuation of application No. 16/592,170, filed on Oct. 3, 2019, now Pat. No. 10,821,344, and a continuation-in-part of application No. 16/401,926, filed on May 2, 2019, now Pat. No. 10,821,338, said application No. 16/833,054 is a continuation-in-part of application No. 16/286,412, filed on Feb. 26, 2019, now Pat. No. 10,625,127, which is a continuation-in-part of application No. 16/225,577, filed on Dec. 19, 2018, now abandoned, said application No. 16/592,170 is a continuation of application No. 16/214,405, filed on Dec. 10, 2018, now Pat. No. 10,471,319, said application No. 16/225,577 is a continuation-in-part of application No. 16/158,578, filed on Oct. 12, 2018, now Pat. No. 10,293,226, which is a continuation-in-part of application No. 16/027,077, filed on Jul. 3, 2018, now abandoned, said application No. 16/401,926 is a continuation-in-part of application No. 15/848,697, filed on Dec. 20, 2017, now abandoned, which is a continuation-in-part of application No. 15/359,206, filed on Nov. 22, 2016, now Pat. No. 10,150,019, which is a continuation-in-part of application No. 15/220,107, filed on Jul. 26, 2016, now Pat. No. 9,993,704, said application No. 16/027,077 is a continuation-in-part of application No. 15/220,122, filed on Jul. 26, 2016, now Pat. No. 10,086,244.

(60) Provisional application No. 63/065,310, filed on Aug. 13, 2020.

(56) References Cited

U.S. PATENT DOCUMENTS 2,040,252 A * 5/1936 Farrington ..... A63B 60/00 473/329
2,077,377 A 4/1937 Link
2,111,249 A 3/1938 Plese
2,175,598 A * 10/1939 Fedak ..... A63B 53/0466 473/245
2,214,356 A * 9/1940 Wettlaufer ..... A63B 53/0466 473/233
3,212,783 A * 10/1965 Bradley ..... A63B 60/54 473/337
3,567,228 A * 3/1971 Lynn ..... A63B 53/04 473/332
3,817,522 A 6/1974 Simmons
4,195,842 A 4/1980 Coleman
4,313,607 A * 2/1982 Thompson ..... A63B 53/0466 473/328
4,398,965 A 8/1983 Campau
4,754,977 A 7/1988 Sahm
4,811,949 A * 3/1989 Kobayashi ..... A63B 53/04 473/337
4,811,950 A 3/1989 Kobayashi
4,826,172 A 5/1989 Antonious
4,928,972 A 5/1990 Nakanishi
4,938,470 A 7/1990 Antonious
4,944,515 A * 7/1990 Shearer ..... A63B 53/04 473/337
5,000,454 A * 3/1991 Soda ..... A63B 60/00 473/346
5,048,835 A 9/1991 Gorman
5,056,788 A 10/1991 Katayama
5,118,086 A * 6/1992 Stevenson ..... F16F 13/08 267/141.1
5,121,922 A 6/1992 Harsh, Sr.
5,184,823 A 2/1993 Desboilles
5,261,664 A 11/1993 Anderson
5,290,032 A 3/1994 Fenton
5,316,298 A 5/1994 Hutin
5,326,047 A 7/1994 Shaw et al.
5,328,184 A 7/1994 Antonious
5,346,213 A 9/1994 Yamada
5,398,929 A 3/1995 Kitaichi
5,403,007 A 4/1995 Chen
5,464,211 A * 11/1995 Atkins, Sr. ..... A63B 60/00 473/346
5,492,327 A 2/1996 Biafore, Jr.
5,499,814 A 3/1996 Lu
5,505,453 A 4/1996 Mack
5,529,543 A 6/1996 Beaumont, Sr.
5,547,194 A 8/1996 Aizawa
5,547,427 A 8/1996 Rigal
5,586,947 A 12/1996 Hutin
5,586,948 A 12/1996 Mick
5,588,923 A 12/1996 Schmidt
5,626,530 A 5/1997 Schmidt
5,628,697 A 5/1997 Gamble
5,669,829 A 9/1997 Lin
5,697,855 A 12/1997 Aizawa
5,766,092 A 6/1998 Mimeur
5,830,084 A 11/1998 Kosmatka
5,833,551 A 11/1998 Vincent
5,873,791 A * 2/1999 Allen ..... A63B 53/04 473/332
5,888,148 A * 3/1999 Allen ..... A63B 60/00 473/290
5,890,973 A * 4/1999 Gamble ..... A63B 21/0603 473/332
5,899,821 A 5/1999 Hsu
5,911,637 A * 6/1999 Yamagata ..... A63B 53/04 473/333
5,971,868 A 10/1999 Kosmatka
6,001,030 A 12/1999 Delaney
6,015,354 A 1/2000 Ahn
6,042,486 A 3/2000 Gallagher
6,162,133 A 12/2000 Peterson
6,165,081 A 12/2000 Chou
6,200,228 B1 3/2001 Takeda
D444,195 S 6/2001 Wahl
6,299,547 B1 10/2001 Kosmatka
6,299,549 B1 10/2001 Shieh
6,306,048 B1 10/2001 McCabe
6,309,311 B1 10/2001 Lu
6,354,961 B1 * 3/2002 Allen ..... A63B 53/0466 473/282
6,364,789 B1 4/2002 Kosmatka
6,508,722 B1 1/2003 McCabe
6,595,870 B2 7/2003 Stites
6,695,715 B1 2/2004 Chikaraishi
D489,106 S 4/2004 Wahl
6,719,641 B2 4/2004 Dabbs
6,832,961 B2 12/2004 Sano
6,835,144 B2 12/2004 Best
6,855,066 B2 2/2005 Best

(56) References Cited

U.S. PATENT DOCUMENTS 6,872,148 B2 * 3/2005 Lee ..... A63B 65/122 473/131
6,887,164 B2 5/2005 Danwanjee
6,902,495 B2 6/2005 Pergande
6,921,344 B2 7/2005 Gilbert
6,964,620 B2 11/2005 Gilbert
6,976,924 B2 12/2005 Gilbert
6,991,559 B2 1/2006 Yabu
7,008,331 B2 3/2006 Chen
7,056,229 B2 6/2006 Chen
7,096,558 B2 8/2006 Sano
7,140,977 B2 * 11/2006 Atkins, Sr. ..... A63B 60/00 473/333
7,160,204 B2 1/2007 Huang
7,169,057 B2 1/2007 Wood et al.
7,192,362 B2 * 3/2007 Gilbert ..... A63B 53/00 473/332
7,211,006 B2 5/2007 Chang
7,247,104 B2 7/2007 Poynor
7,371,190 B2 5/2008 Gilbert
7,387,579 B2 6/2008 Lin
7,476,162 B2 1/2009 Stites
7,559,853 B2 7/2009 Hirano
7,575,523 B2 * 8/2009 Yokota ..... A63B 53/0466 473/332
7,578,755 B2 8/2009 Oyama
7,582,024 B2 9/2009 Shear
7,588,502 B2 * 9/2009 Nishino ..... A63B 60/02 473/332
7,588,503 B2 9/2009 Roach
7,591,735 B2 9/2009 Matsunaga
7,597,633 B2 10/2009 Shimazaki
7,604,550 B1 10/2009 Currie
7,662,051 B2 2/2010 Chen
7,686,706 B2 3/2010 Matsunaga
7,713,141 B2 5/2010 Yamamoto
7,731,604 B2 6/2010 Wahl
7,749,100 B2 7/2010 Tavares
7,753,806 B2 7/2010 Beach
7,785,212 B2 8/2010 Lukasiewicz, Jr.
7,798,913 B2 9/2010 Noble
7,871,338 B2 1/2011 Nakano
7,878,920 B2 2/2011 Clausen
7,892,106 B2 2/2011 Matsunaga
7,935,000 B2 5/2011 Stites
7,967,700 B2 6/2011 Stites
8,088,019 B1 * 1/2012 Long ..... A63B 53/0466 473/307
8,088,025 B2 1/2012 Wahl
8,157,673 B2 4/2012 Gilbert
8,187,116 B2 5/2012 Boyd
8,202,174 B2 6/2012 Breier
8,210,961 B2 * 7/2012 Finn ..... A63B 53/0466 473/345
8,210,965 B2 7/2012 Roach
8,267,807 B2 9/2012 Takechi
8,277,337 B2 10/2012 Shimazaki
8,328,663 B2 12/2012 Wahl
8,333,667 B2 12/2012 Kumamoto
8,342,982 B2 * 1/2013 Clausen ..... G01N 29/045 473/345
8,348,782 B2 1/2013 Park
8,353,784 B2 1/2013 Boyd
8,403,771 B1 3/2013 Rice
8,403,774 B2 3/2013 Stites
8,475,293 B2 7/2013 Morin
8,517,863 B2 8/2013 Wahl
8,535,176 B2 9/2013 Bazzel
8,562,452 B2 * 10/2013 Finn ..... A63B 53/0466 473/345
8,562,652 B2 10/2013 Biedermann
8,608,585 B2 12/2013 Stites
8,696,489 B2 4/2014 Gibbs
8,753,219 B2 6/2014 Gilbert
8,753,228 B2 6/2014 Golden
8,758,159 B2 6/2014 Morin
8,814,725 B2 8/2014 Wahl
8,821,307 B2 9/2014 Park
8,864,603 B2 * 10/2014 Kumamoto ..... A63B 53/06 473/332
8,876,630 B2 11/2014 Takechi
8,920,261 B2 12/2014 Taylor et al.
8,961,336 B1 2/2015 Parsons et al.
9,011,266 B2 4/2015 Brunski
9,039,543 B2 5/2015 Mizutani
9,101,809 B2 8/2015 Gibbs
9,265,995 B2 2/2016 Wahl
9,433,834 B2 * 9/2016 Stites ..... A63B 53/0466
9,457,241 B2 10/2016 Hebreo
9,480,889 B1 * 11/2016 Abbott ..... A63B 53/065
9,517,394 B1 * 12/2016 Dacey ..... A63B 53/0487
9,566,478 B2 * 2/2017 Boyd ..... A63B 53/04
9,597,562 B2 3/2017 Dipert
9,662,549 B2 5/2017 Vrska, Jr
9,750,992 B2 * 9/2017 Knutson ..... A63B 53/0466
9,849,354 B2 12/2017 Stokke
9,993,699 B2 6/2018 Larson
9,993,704 B2 6/2018 Hebreo
10,039,965 B1 8/2018 Seluga
10,086,244 B2 * 10/2018 Morin ..... A63B 53/08
10,150,019 B2 * 12/2018 Ines ..... A63B 60/00
10,220,272 B2 3/2019 Gonzalez
10,293,226 B2 * 5/2019 Hebreo ..... A63B 53/08
10,413,789 B1 9/2019 Seluga
10,471,319 B1 11/2019 Mata
10,625,127 B2 * 4/2020 Golden ..... A63B 53/06
10,821,338 B2 * 11/2020 Hebreo ..... A63B 53/047
10,821,344 B2 11/2020 Mata
11,020,639 B2 * 6/2021 Golden ..... A63B 53/047
11,045,693 B1 * 6/2021 Allen ..... A63B 53/042
11,090,532 B2 8/2021 Wahl
11,090,534 B2 8/2021 Westrum
11,135,484 B2 * 10/2021 Kitagawa ..... A63B 53/06
11,338,179 B2 * 5/2022 Takechi ..... A63B 53/0466
11,465,018 B2 10/2022 Stokke
11,801,428 B2 10/2023 Golden
11,806,592 B2 * 11/2023 Wada ..... A63B 53/0408
11,826,620 B2 11/2023 Ines
2003/0092502 A1 5/2003 Pergande
2003/0190975 A1 10/2003 Fagot
2003/0203764 A1 10/2003 Dabbs
2005/0009624 A1 1/2005 Long
2005/0107183 A1 5/2005 Takeda
2005/0239572 A1 10/2005 Roach
2005/0272523 A1 * 12/2005 Atkins ..... A63B 60/00 473/334
2005/0277485 A1 12/2005 Hou
2006/0025236 A1 * 2/2006 Tseng ..... A63B 60/54 473/345
2007/0026961 A1 2/2007 Hou
2007/0135233 A1 6/2007 Perras
2007/0149316 A1 * 6/2007 Nishino ..... A63B 60/02 473/335
2008/0004131 A1 1/2008 Lin
2008/0305888 A1 12/2008 Tseng
2009/0163295 A1 6/2009 Tseng
2009/0247314 A1 10/2009 Matsunaga
2010/0056296 A1 3/2010 Kumamoto
2010/0056297 A1 3/2010 Roach
2010/0113178 A1 * 5/2010 Stites ..... A63B 53/06 473/282
2010/0261539 A1 * 10/2010 Stites ..... A63B 53/0466 473/409
2010/0273565 A1 * 10/2010 Stites ..... A63B 53/047 473/282
2011/0124432 A1 5/2011 Oldknow
2011/0159981 A1 6/2011 Bazzel
2011/0207552 A1 * 8/2011 Finn ..... A63B 53/0466 473/346
2011/0250985 A1 * 10/2011 Stites ..... A63B 53/06 473/332

(56) References Cited

U.S. PATENT DOCUMENTS

| | | | | |
|---|---|---|---|---|
| 2011/0312437 | A1* | 12/2011 | Sargent | A63B 53/06 473/335 |
| 2012/0064997 | A1 | 3/2012 | Sato | |
| 2012/0172144 | A1 | 7/2012 | Mazutani | |
| 2013/0130827 | A1 | 5/2013 | Boyd | |
| 2013/0281227 | A1* | 10/2013 | Roach | A63B 69/0002 473/332 |
| 2013/0324297 | A1 | 12/2013 | Larson | |
| 2015/0165280 | A1 | 6/2015 | Hebreo | |
| 2015/0343281 | A1 | 12/2015 | Ban | |
| 2015/0360099 | A1* | 12/2015 | Ban | A63B 53/06 473/324 |
| 2017/0014691 | A1* | 1/2017 | Takechi | A63B 53/04 |
| 2017/0144037 | A1 | 5/2017 | Dipert | |
| 2017/0333765 | A1 | 11/2017 | Parsons | |
| 2018/0021637 | A1* | 1/2018 | DeMille | A63B 53/047 473/345 |
| 2018/0028882 | A1* | 2/2018 | Hebreo | A63B 53/047 |
| 2018/0028883 | A1* | 2/2018 | Morin | A63B 53/06 |
| 2018/0133565 | A1* | 5/2018 | Hebreo | A63B 53/047 |
| 2018/0345106 | A1* | 12/2018 | Kitagawa | A63B 60/52 |
| 2019/0070470 | A1 | 3/2019 | Hebreo et al. | |
| 2019/0151722 | A1 | 5/2019 | Gonzalez | |
| 2019/0201760 | A1 | 7/2019 | Golden et al. | |
| 2020/0222767 | A1* | 7/2020 | Golden | A63B 60/54 |
| 2021/0046363 | A1 | 2/2021 | Golden | |
| 2021/0106887 | A1 | 4/2021 | Gonzalez | |
| 2021/0121748 | A1* | 4/2021 | Ines | A63B 53/06 |
| 2021/0236887 | A1 | 8/2021 | Demkowski | |
| 2021/0275881 | A1 | 9/2021 | Halberg | |
| 2021/0308539 | A1 | 10/2021 | Morin | |
| 2021/0331045 | A1 | 10/2021 | Halberg | |
| 2022/0111268 | A1 | 4/2022 | Johnson | |
| 2022/0118326 | A1 | 4/2022 | Halberg | |
| 2022/0152465 | A1* | 5/2022 | Martens | A63B 53/047 |

FOREIGN PATENT DOCUMENTS

| | | | |
|---|---|---|---|
| JP | 2001-170222 | | 6/2001 |
| JP | 2003284794 | | 10/2003 |
| JP | 2006-000139 | | 1/2006 |
| JP | 2007-21171 | | 1/2007 |
| JP | 2009-61317 | | 3/2009 |
| JP | 4291836 | B2 | 7/2009 |
| JP | 2009240365 | | 10/2009 |
| JP | 2015-517882 | | 6/2015 |
| JP | 2017176607 | A | 10/2017 |
| JP | 3222914 | A | 8/2019 |
| KR | 2017-0008275 | A | 1/2017 |

OTHER PUBLICATIONS

JP Preliminary Report for JP Application No. 2021-128644 mailed Jul. 30, 2024.

* cited by examiner

GOLF CLUB HAVING A DAMPING ELEMENT FOR BALL SPEED CONTROL

RELATED APPLICATIONS

This application is a continuation-in-part of U.S. application Ser. No. 17/565,895, filed on Dec. 30, 2021, which is a continuation-in-part of U.S. application Ser. No. 17/543,459, filed on Dec. 6, 2021, which is a continuation-in-part of U.S. patent application Ser. No. 17/532,222, filed on Nov. 22, 2021, which is a continuation-in-part of U.S. patent application Ser. No. 17/377,696 filed on Jul. 16, 2021, which is a continuation-in-part of U.S. patent application Ser. No. 17/349,519, filed on Jun. 16, 2021, which is a continuation-in-part of U.S. patent application Ser. No. 17/138,618, filed on Dec. 30, 2020, which is a continuation in-part of U.S. patent application Ser. No. 17/127,061, filed Dec. 18, 2020, now U.S. Pat. No. 11,433,284, which is a continuation-in-part of U.S. patent application Ser. No. 17/085,474, filed Oct. 30, 2020, now U.S. Pat. No. 11,202,946, which is a continuation-in-part of U.S. patent application Ser. No. 16/833,054, filed Mar. 27, 2020 now U.S. Pat. No. 11,020,639, which is a continuation-in-part of U.S. patent application Ser. No. 16/286,412, filed Feb. 26, 2019, now U.S. Pat. No. 10,625,127, which is a continuation-in-part of U.S. patent application Ser. No. 16/225,577, filed Dec. 19, 2018, which is a continuation-in-part of U.S. patent application Ser. No. 16/158,578, filed Oct. 12, 2018, now U.S. Pat. No. 10,293,226, which is a continuation-in-part of U.S. patent application Ser. No. 16/027,077, filed Jul. 3, 2018, which is a continuation-in-part of U.S. patent application Ser. No. 15/220,122, filed Jul. 26, 2016, now U.S. Pat. No. 10,086,244, and U.S. patent application Ser. No. 17/085,474 is a continuation-in-part of U.S. patent application Ser. No. 16/592,170, filed Oct. 3, 2019, now U.S. Pat. No. 10,821,344, which is a continuation of U.S. patent application Ser. No. 16/214,405, filed Dec. 10, 2018, now U.S. Pat. No. 10,471,319, and U.S. patent application Ser. No. 17/085,474 is a continuation-in-part of U.S. patent application Ser. No. 16/401,926, filed May 2, 2019, now U.S. Pat. No. 10,821,338, which is a continuation-in-part of U.S. patent application Ser. No. 15/848,697, filed Dec. 20, 2017, which is a continuation-in-part of U.S. patent application Ser. No. 15/359,206, filed Nov. 22, 2016, now U.S. Pat. No. 10,150,019, which is a continuation-in-part of U.S. patent application Ser. No. 15/220,107, filed Jul. 26, 2016, now U.S. Pat. No. 9,993,704, and U.S. application Ser. No. 17/543,459 is a continuation in part of U.S. patent application Ser. No. 17/337,151, filed Jun. 2, 2021, which claims the benefit of U.S. Provisional Patent Application Ser. No. 63/065,310, filed on Aug. 13, 2020, which are hereby incorporated by reference in their entirety. To the extent appropriate, the present application claims priority to the above-referenced applications.

BACKGROUND

It is a goal for golfers to reduce the total number of swings needed to complete a round of golf, thus reducing their total score. To achieve that goal, it is generally desirable to for a golfer to have a ball fly a consistent distance when struck by the same golf club and, for some clubs, also to have that ball travel a long distance. For instance, when a golfer slightly mishits a golf ball, the golfer does not want the golf ball to fly a significantly different distance. At the same time, the golfer also does not want to have a significantly reduced overall distance every time the golfer strikes the ball, even when the golfer strikes the ball in the "sweet spot" of the golf club. Additionally, it is also preferable for a golf club head to produce a pleasant sound to the golfer when the golf club head strikes the golf ball.

SUMMARY

According to an aspect of the technology, a golf club head, includes: a striking face having a bottom edge, a top edge opposite to the bottom edge, a front surface configured to strike a golf ball, and a rear surface opposite to the front surface; a sole extending rearward from the bottom edge of the striking face; a crown extending rearward from the top edge of the striking face and joined to the sole along a skirt of the golf club head; a cavity at least partially enclosed by the striking face, the sole, and the crown; a support arm extending at least partially through the cavity from at least one of the sole, the crown, or a hosel, and spaced apart from the striking face; and a damping element positioned between the support arm and the rear surface of the striking face; and an adjustment mechanism configured to adjust a compression of the damping element against the rear surface of the striking face.

In an example, the adjustment mechanism includes an adjustable driver. In another example, the support arm has an aperture hole shaped and sized to receive at least part of the adjustable driver. In another example, the golf club head further includes a compression plate between the damping element and the support arm, wherein the adjustment driver is selectively positionable to apply a controllable force to the compression plate. In another example, the support arm includes a base arm member and a flat support member attached to the base arm member, positioned between the compression plate and the base arm member, and having an aperture hole shaped and sized to receive at least part of the adjustable driver. In another example, the damping element covers a center of the striking face. In another example, a thickness of the striking face is less than 3.0 mm.

According to another aspect of the technology, a golf club head, includes: a heel; a toe; a striking face coupled between the heel and the toe, and having a front surface configured to strike a golf ball, and a rear surface opposite to the front surface; a sole extending rearward from the striking face; a crown extending rearward from the striking face and joined to the sole along a skirt of the golf club head; a cavity at least partially enclosed by the striking face, the sole, and the crown; a hosel disposed at the heel and at least partially inside the cavity; a support arm extending at least partially through the cavity from the hosel, and spaced apart from the striking face; and a damping element positioned between the support arm and the rear surface of the striking face.

In an example, the support arm is cantilevered in the cavity. In another example, the support arm extends entirely through the cavity. In another example, a front surface of the damping element is in contact with the rear surface of the striking face and has a circular shape. In another example, the golf club head further includes a compression plate between the damping element and the support arm. In another example, the compression plate includes titanium. In another example, the support arm includes a base arm member and a flat support member attached to the support arm and positioned between the compression plate and the base arm member, wherein the golf club head further includes a gasket between the flat support member and the compression plate to secure the flat support member to the compression plate. In another example, a thickness of the striking face is within a range of 2.5 mm to 3.0 mm.

According to another aspect of the technology, a golf club head, includes: a heel; a toe; a striking face coupled between the heel and the toe, and having a front surface configured to strike a golf ball and a rear surface opposite to the front surface; a sole extending rearward from the striking face; a crown coupled between the striking face and the sole; a cavity at least partially enclosed by the striking face, the sole, and the crown; a hosel disposed at the heel and at least partially inside the cavity; a support arm extending at least partially through the cavity from the hosel; and a damping element positioned between the support arm and the rear surface of the striking face; and an adjustable driver configured to adjust compression of the damping element against the rear surface of the striking face.

In an example, a thickness of the striking face is less than 3.0 mm. In another example, the damping element includes a polymer. In another example, the golf club head includes a body including the toe, the heel, the striking face, the sole, the crown, and the hosel, and has an opening shaped and sized to at least partially receive a tool configured to adjust the adjustable driver. In another example, the opening is in at least one of the hosel, the sole, or the crown, and the opening is at least partially covered by a cap, a weight, or a medallion.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

FIG. 83 depicts a perspective view of the support arm and weight members of the golf club head of FIG. 79.

FIG. 84 depicts a cross sectional view of the golf club head with an additional embodiment of a damping element.

FIG. 85 depicts a perspective view of the damping element of the golf club head of FIG. 84.

FIG. 86 depicts a perspective view of a golf club head.

FIG. 87 depicts an additional perspective view of the golf club head of FIG. 86.

FIG. 88 depicts a perspective view of the golf club head of FIG. 86 missing the striking face.

FIG. 89 depicts an additional perspective view of the golf club head of FIG. 86 missing the striking face.

FIG. 90 depicts a cross sectional view T-T of the golf club head of FIG. 86.

FIG. 91 depicts a perspective view of the golf club head of FIG. 86 including a back cover.

FIG. 92 depicts a perspective view of the back cover.

FIG. 93 depicts an additional perspective view of the back cover.

FIG. 94 depicts a cross sectional view V-V of the golf club head of FIG. 92.

Figure 93:
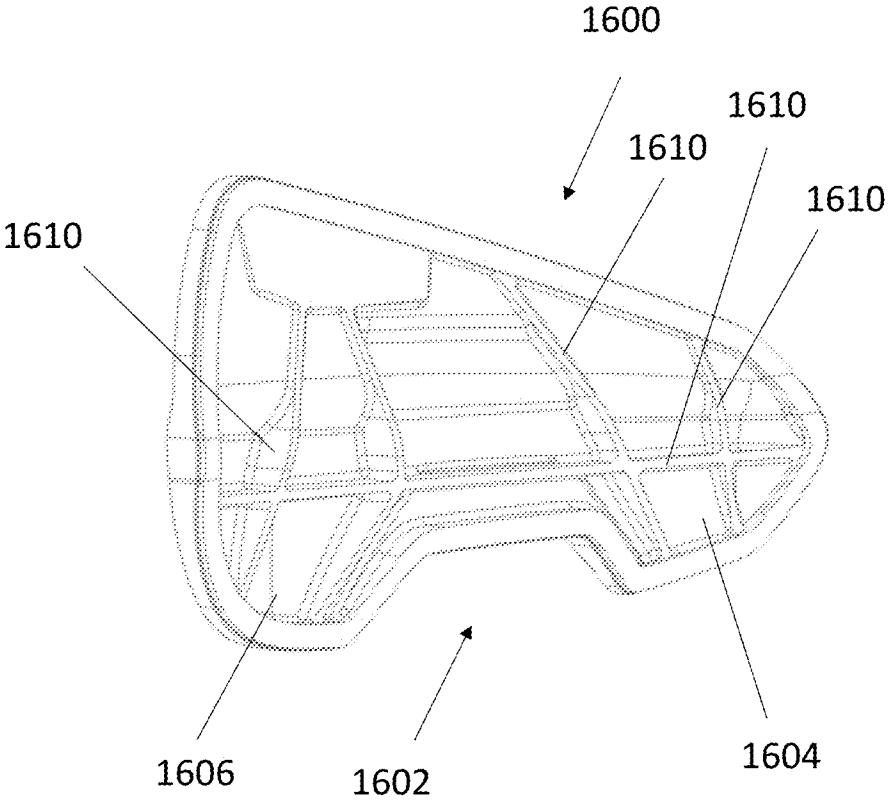
Figure 94:
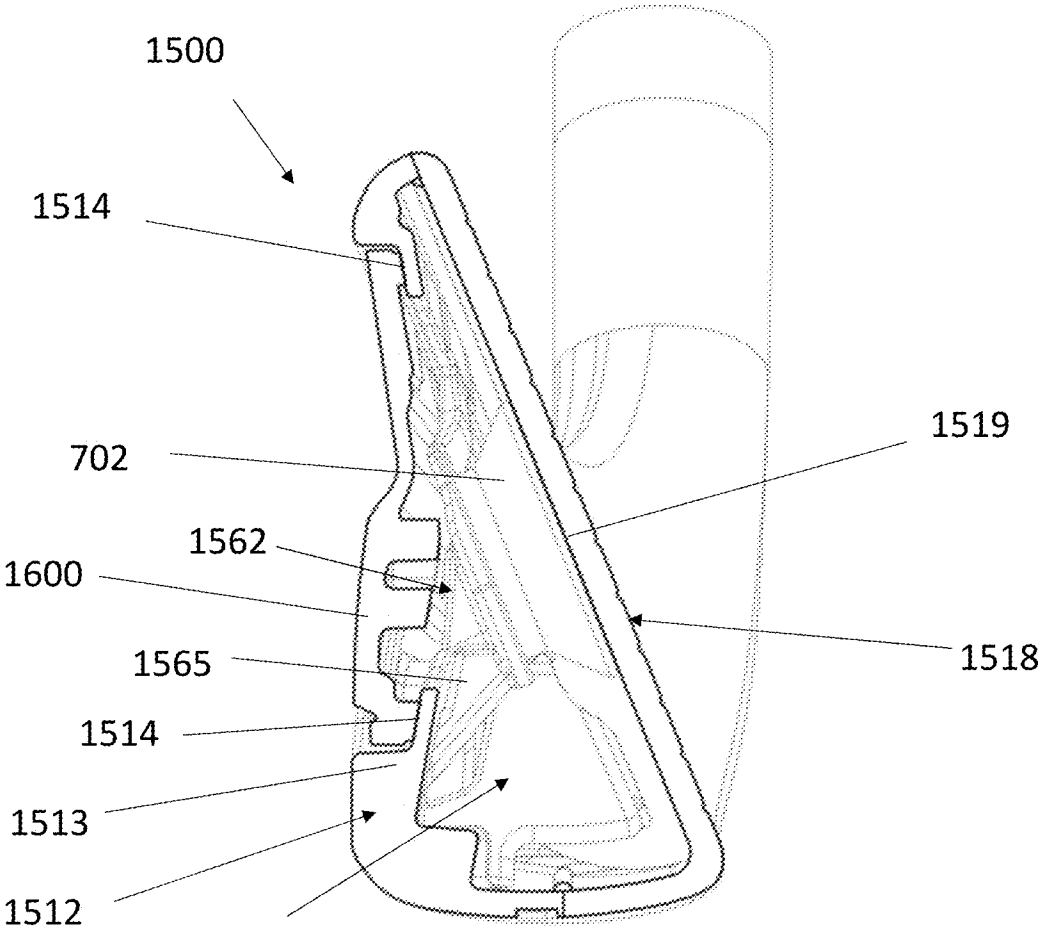
Figure 95:
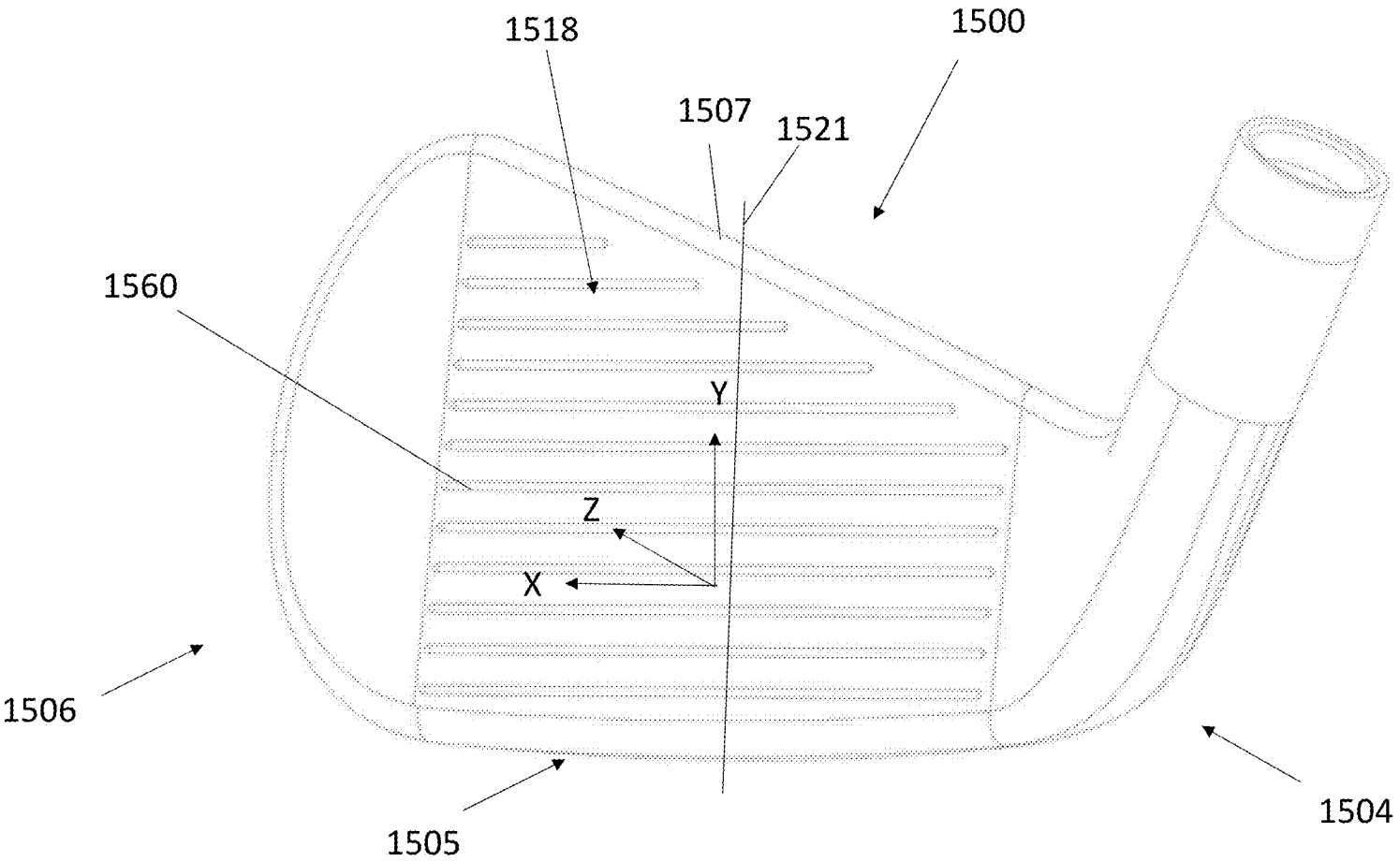

FIG. 95 depicts the golf club head of FIGS. 86-94 having a tapered heel portion.

Figure 96:
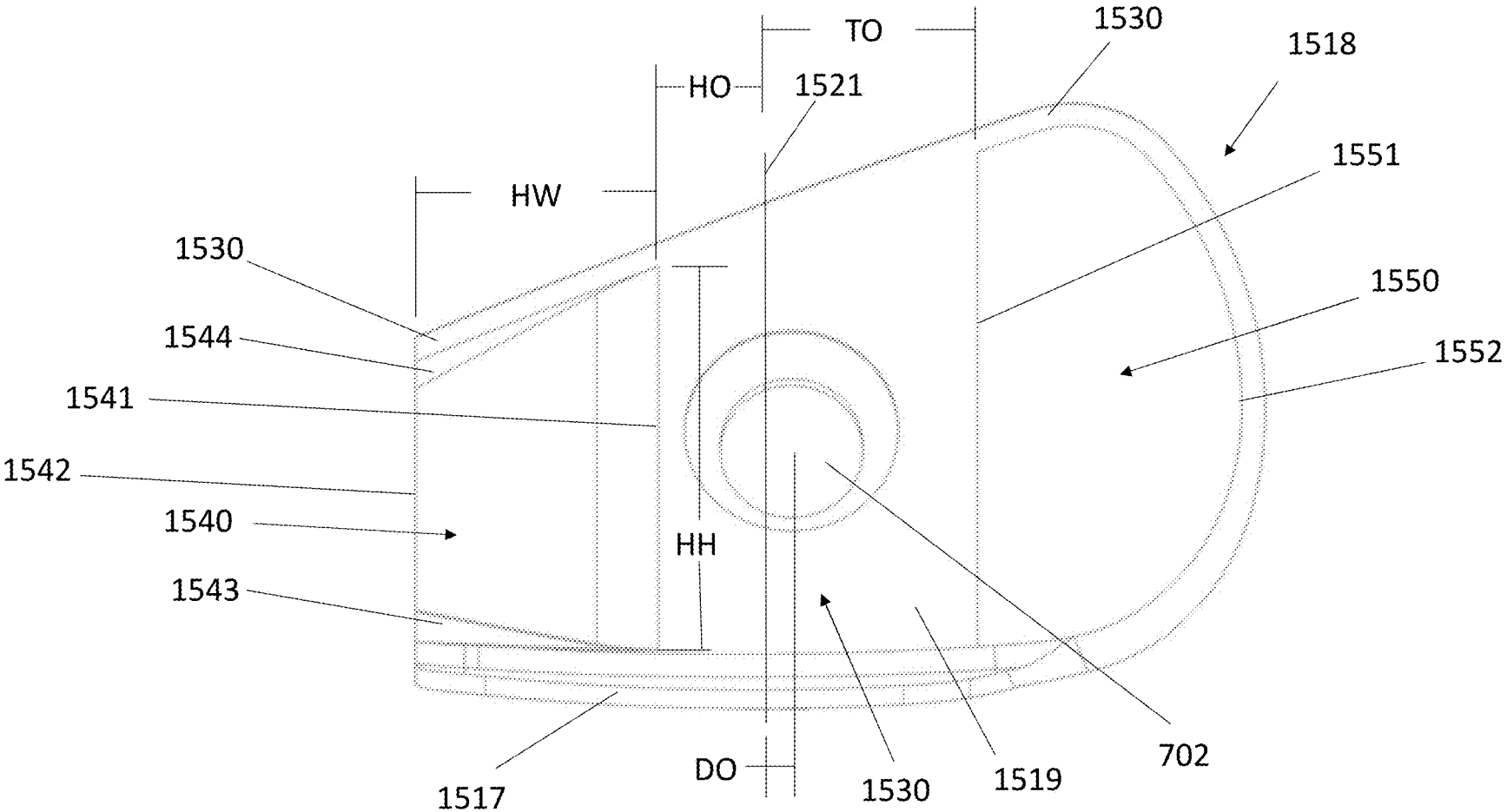

FIG. 96 depicts a rear view of the striking face and damping element of the golf club head of FIG. 95.

Figure 97:
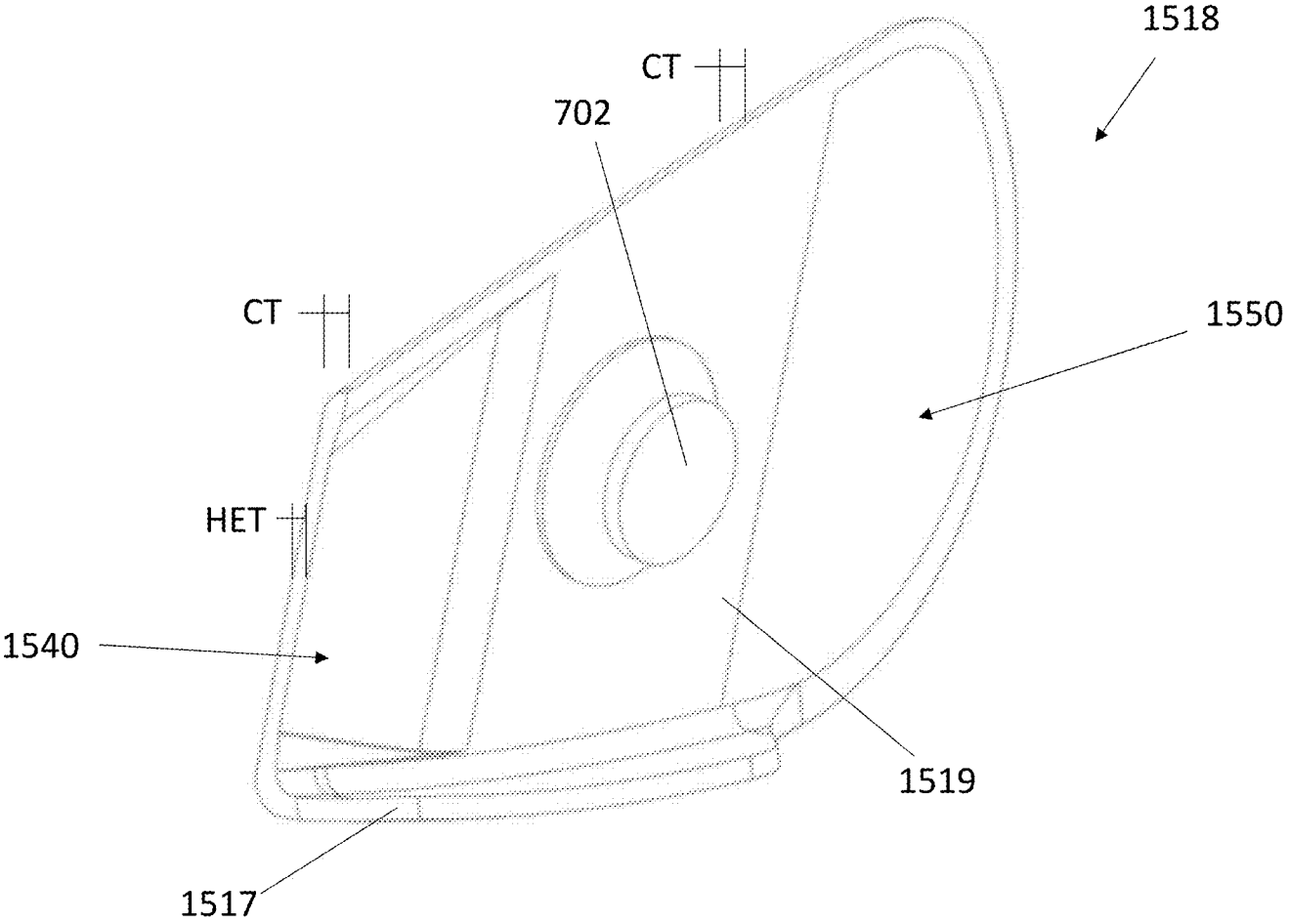

FIG. 97 depicts a perspective view of the striking face and damping element of FIG. 96.

Figure 98:
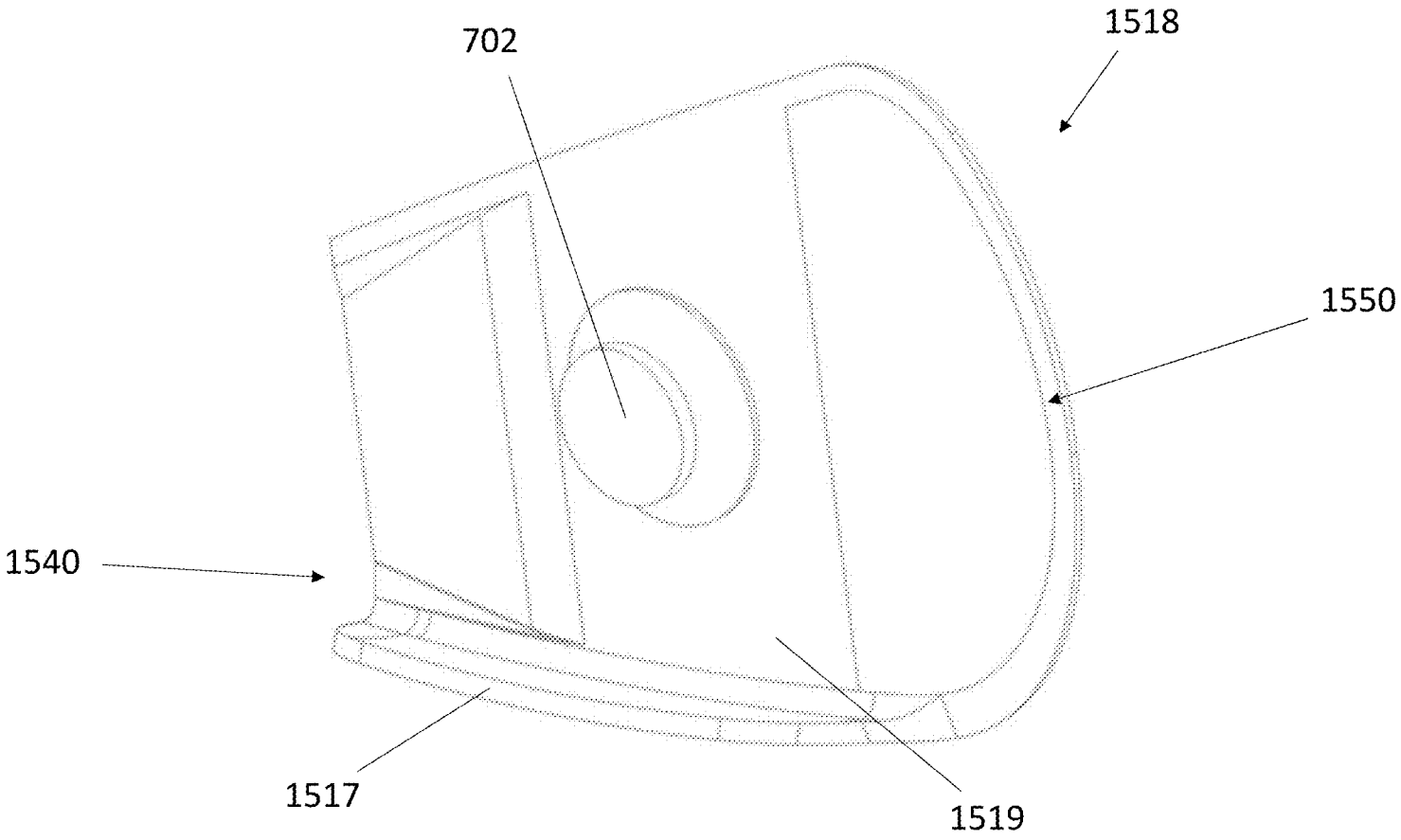

FIG. 98 depicts an additional perspective view of the striking face and damping element of FIG. 96.

Figure 99:
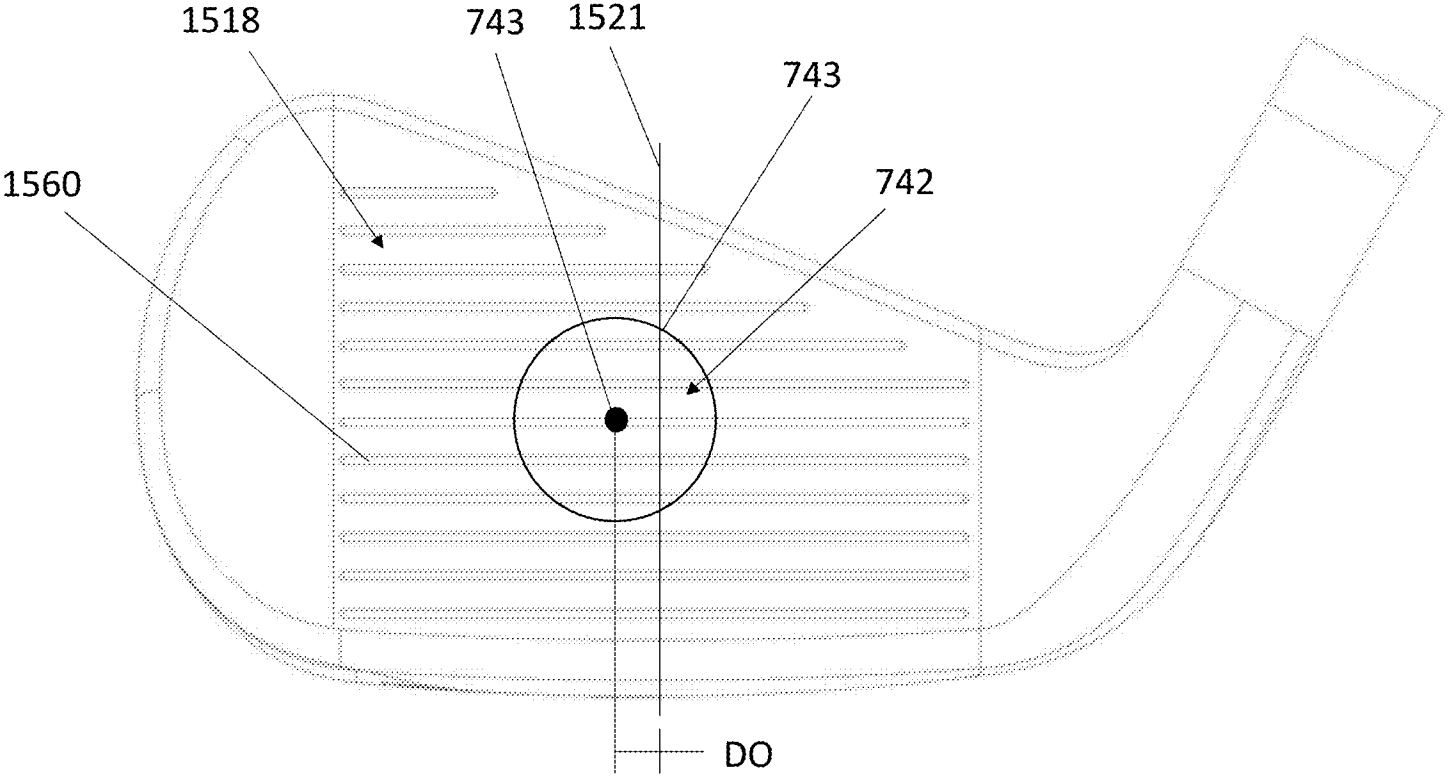

FIG. 99 depicts a front view of the golf club head of FIG. 95 including the supported region.

Figure 100:
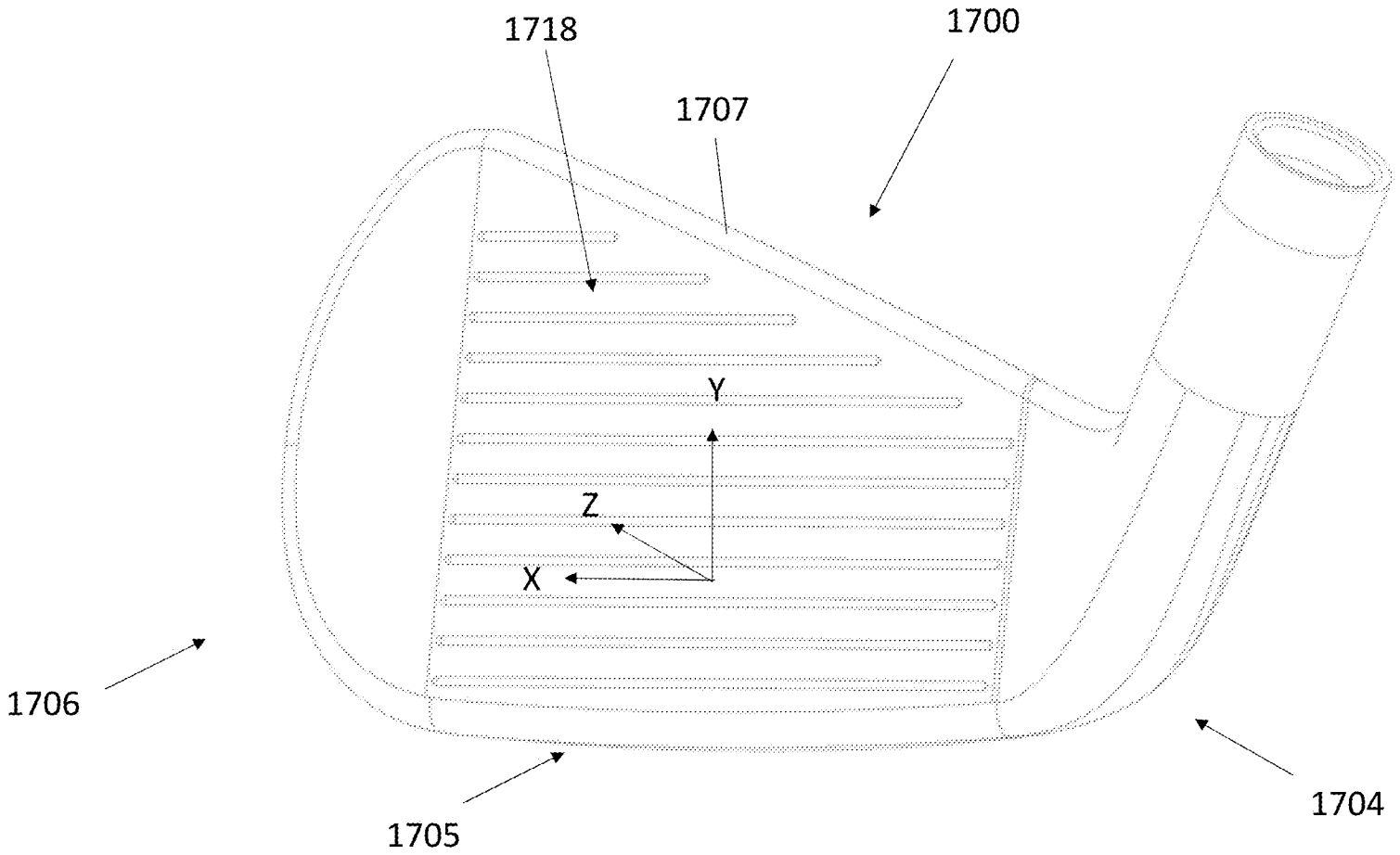

FIG. 100 depicts a perspective view of the golf club head.

Figure 101:
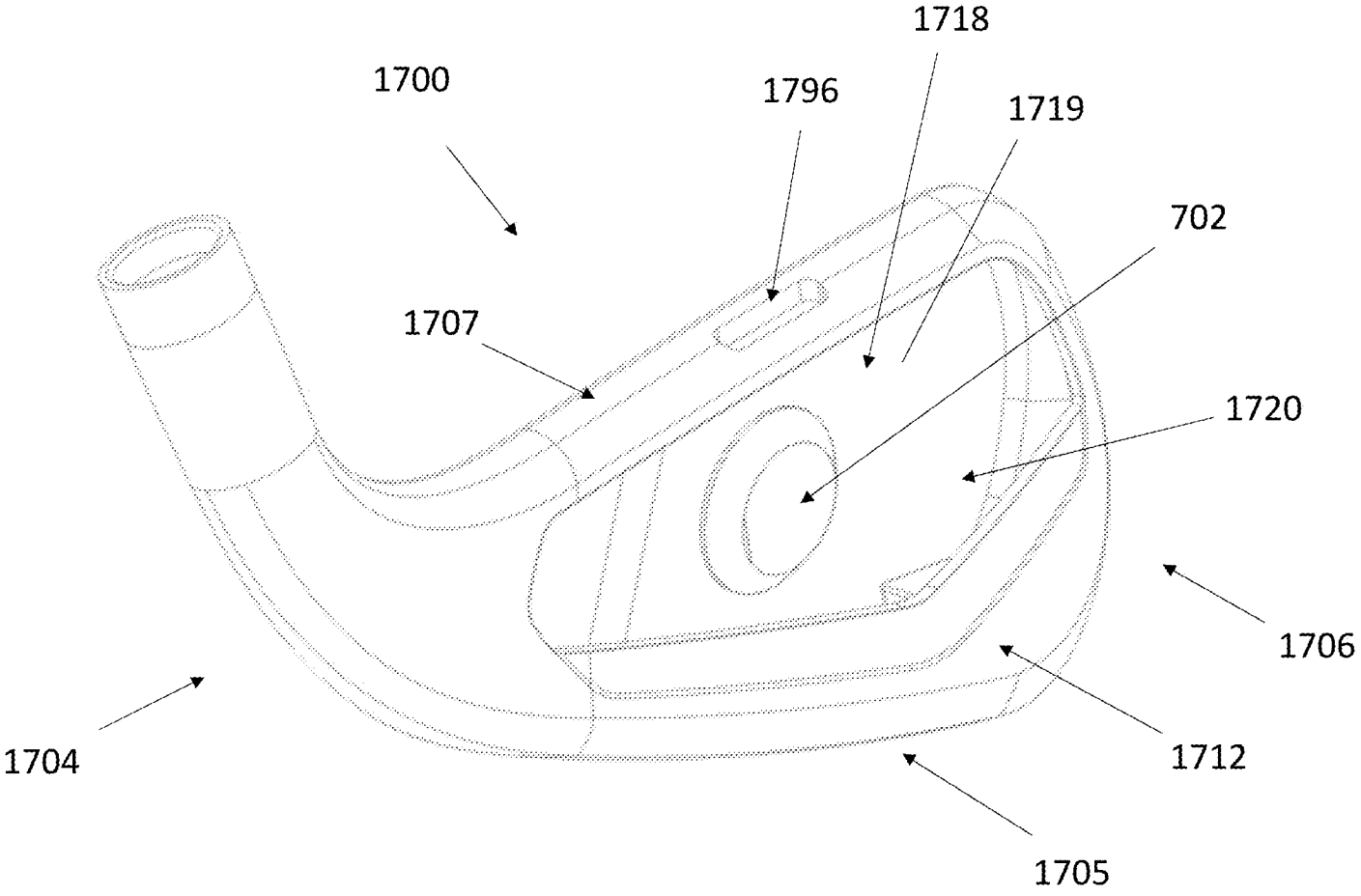

FIG. 101 depicts a perspective view of the golf club head of FIG. 100 having a first damping element and missing the support arm.

Figure 102:
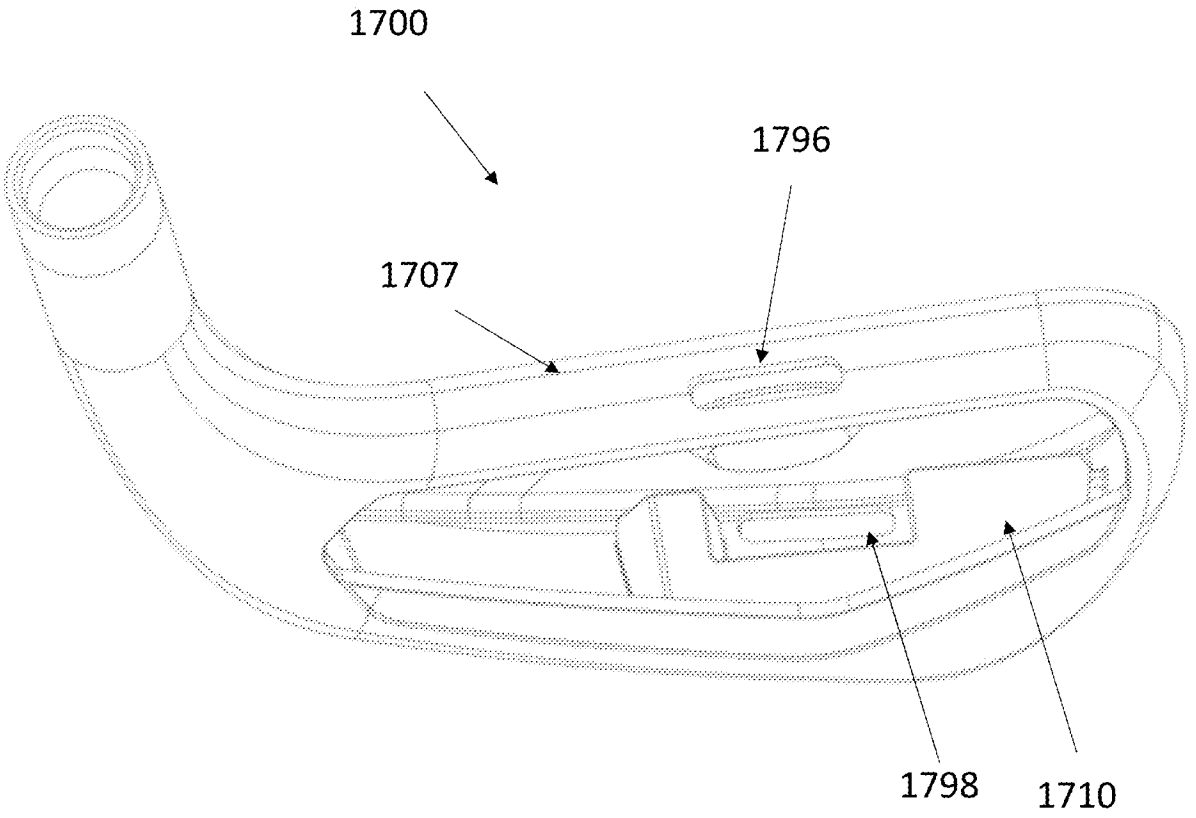

FIG. 102 depicts a perspective view of the golf club head of FIG. 101.

Figure 103:
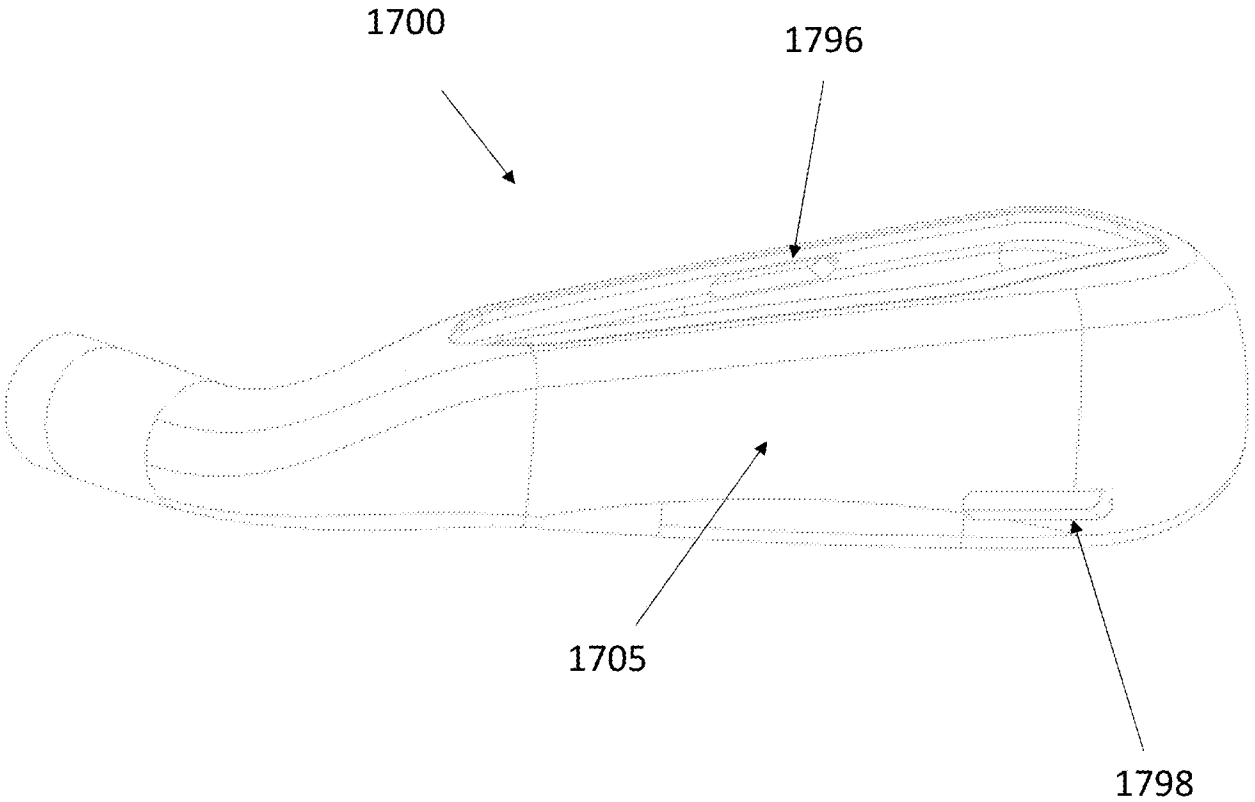

FIG. 103 depicts an additional perspective view of the golf club head of FIG. 101.

Figure 104:
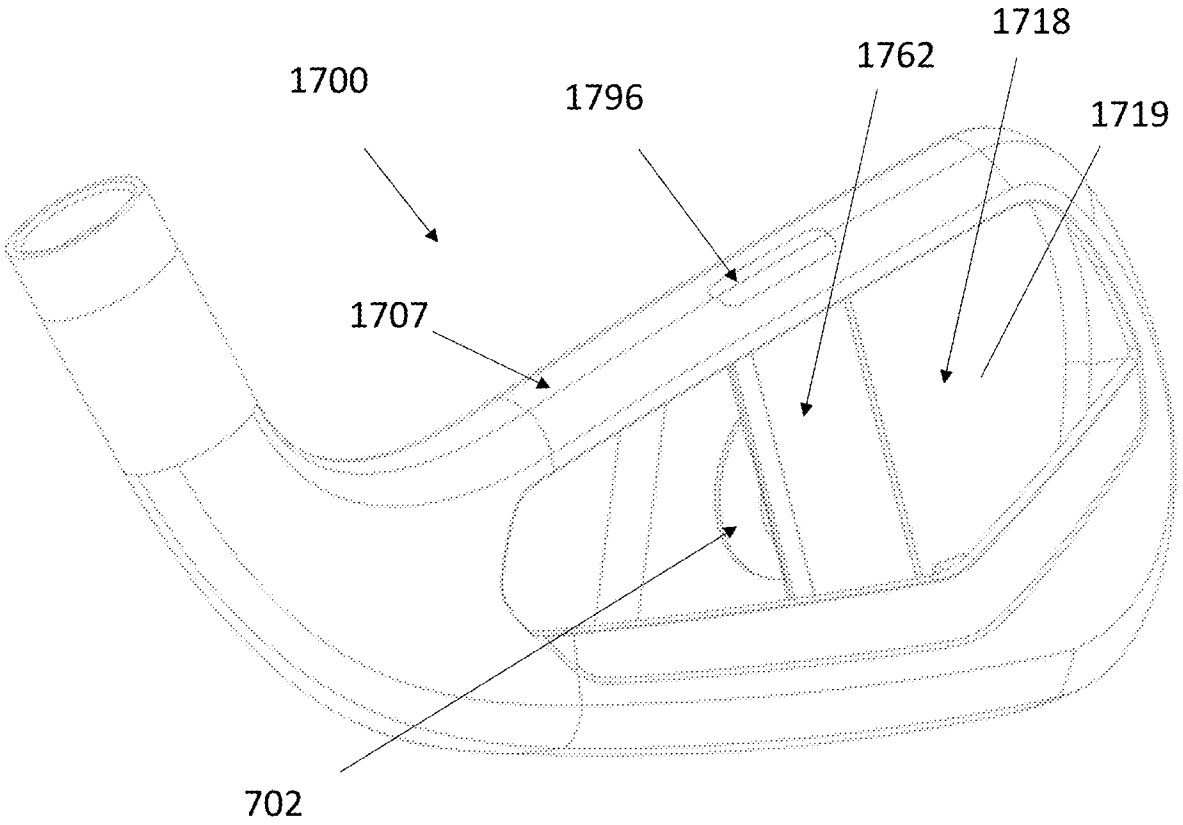

FIG. 104 depicts a perspective view of the golf club head of FIG. 100 including a first damping element and a support arm.

Figure 105:
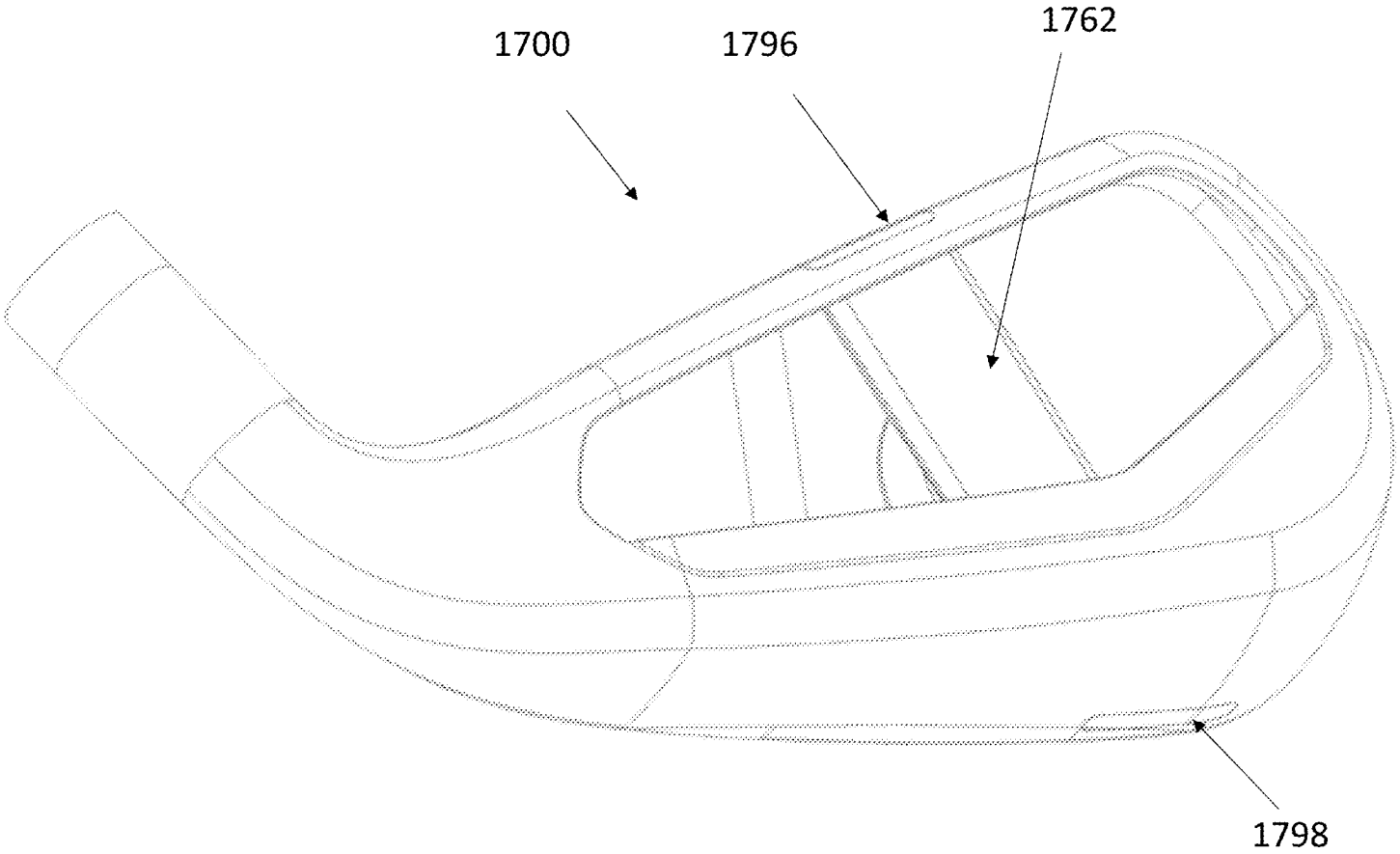

FIG. 105 depicts an additional perspective view of the golf club head of FIG. 104.

Figure 106:
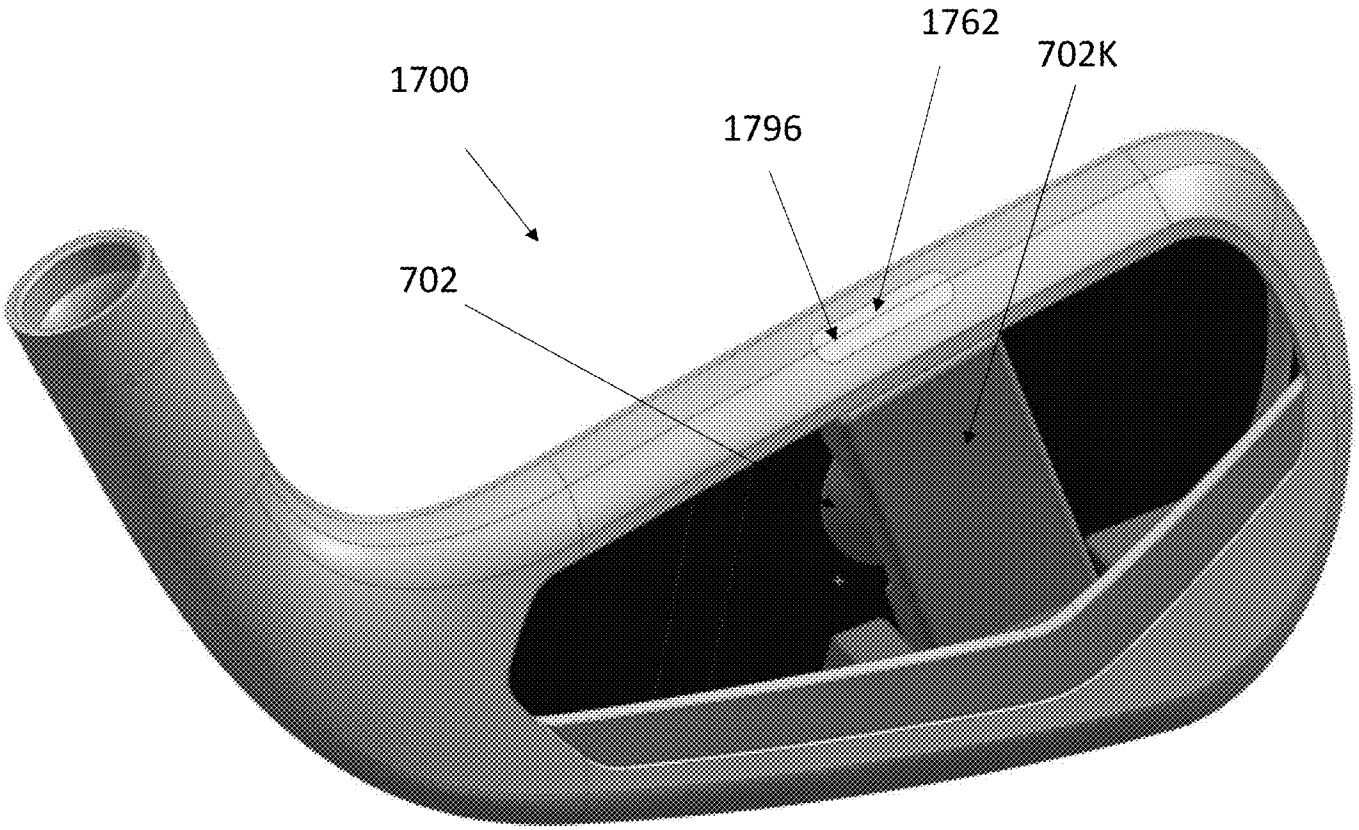

FIG. 106 depicts a perspective view of the golf club head of FIG. 100 including a first damping element, a support arm, and a second damping element.

Figure 107:
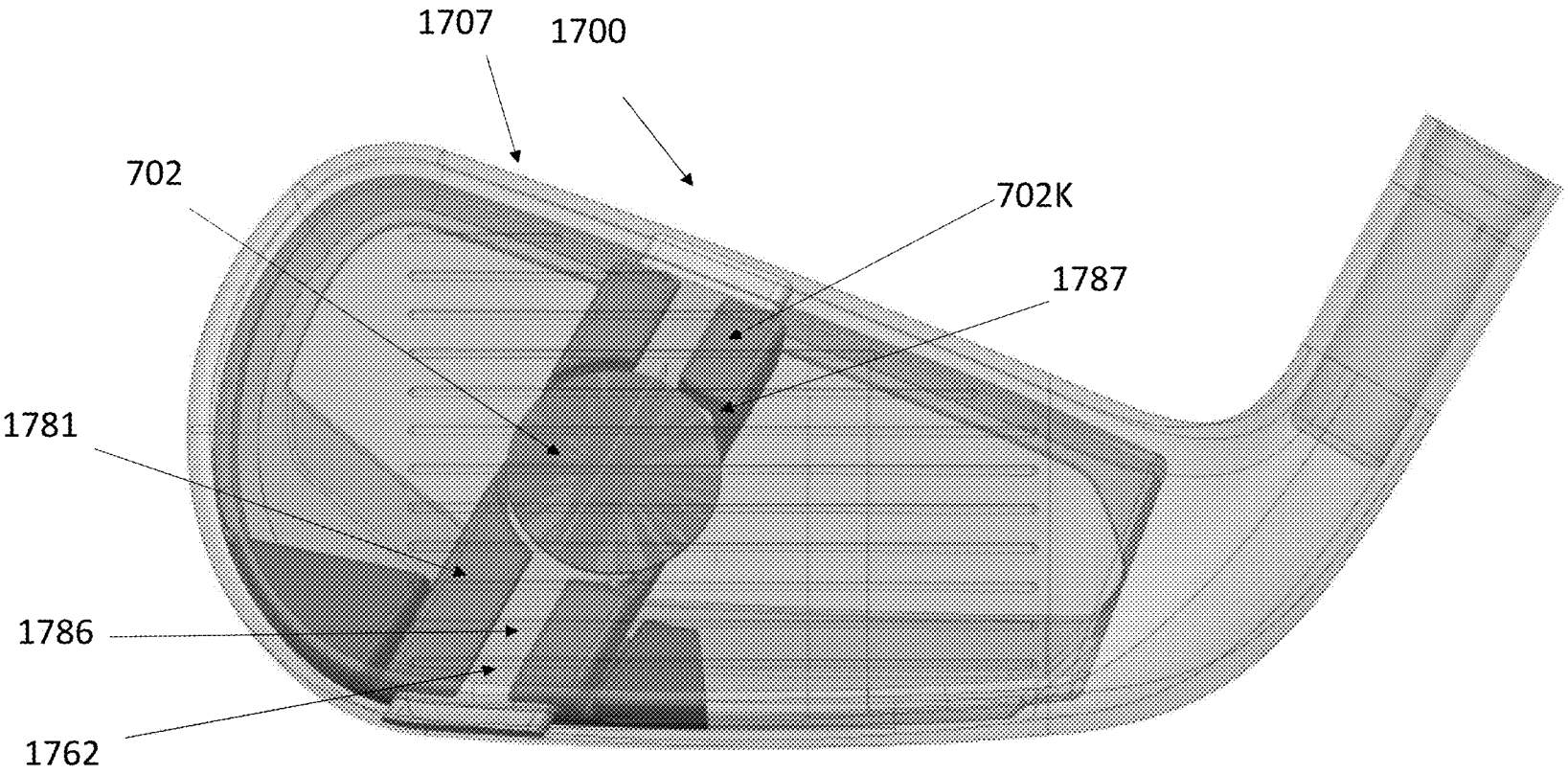

FIG. 107 depicts an additional perspective view of the golf club head of FIG. 106 missing the striking face.

Figure 108:
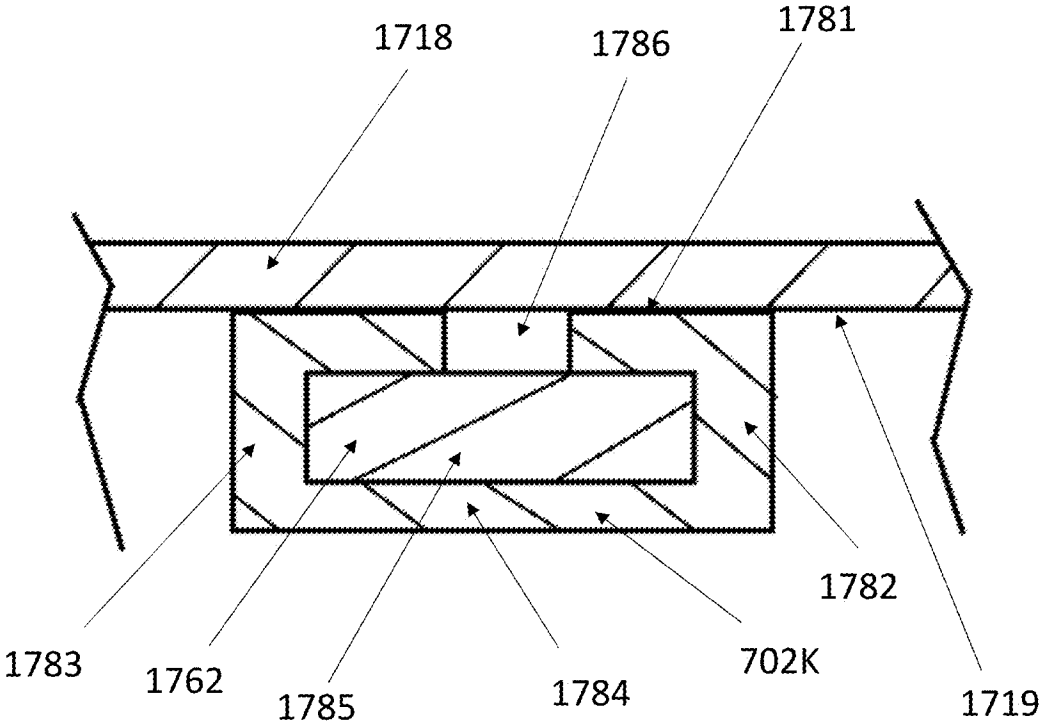

FIG. 108 depicts a cross sectional view of the support arm and second damping element of FIG. 106.

Figure 109:
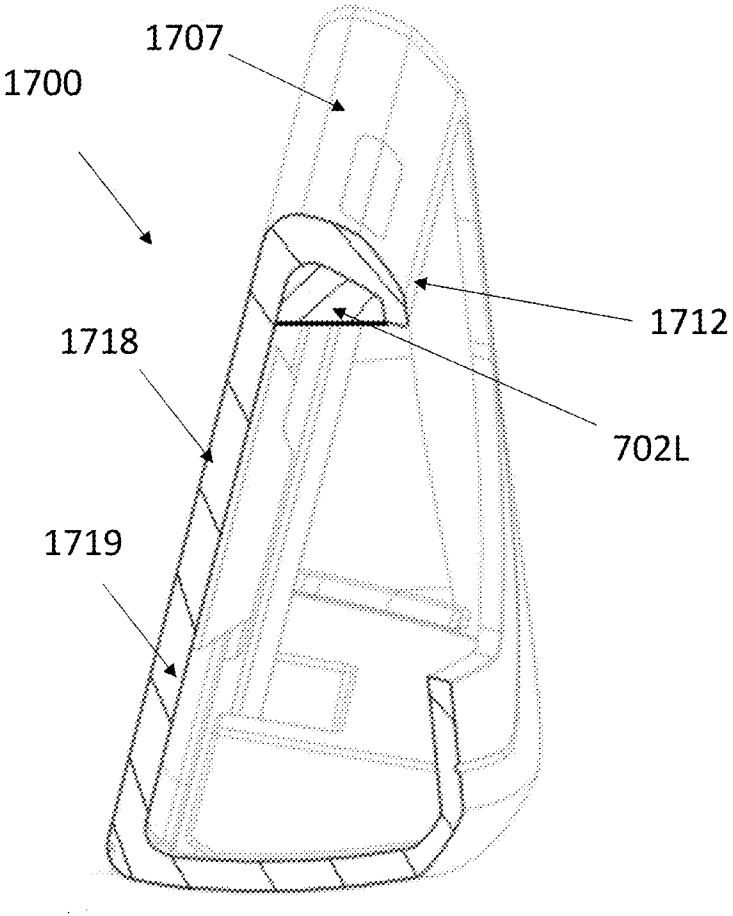

FIG. 109 depicts cross section view of an additional embodiment of the golf club head of FIG. 104.

Figure 110:
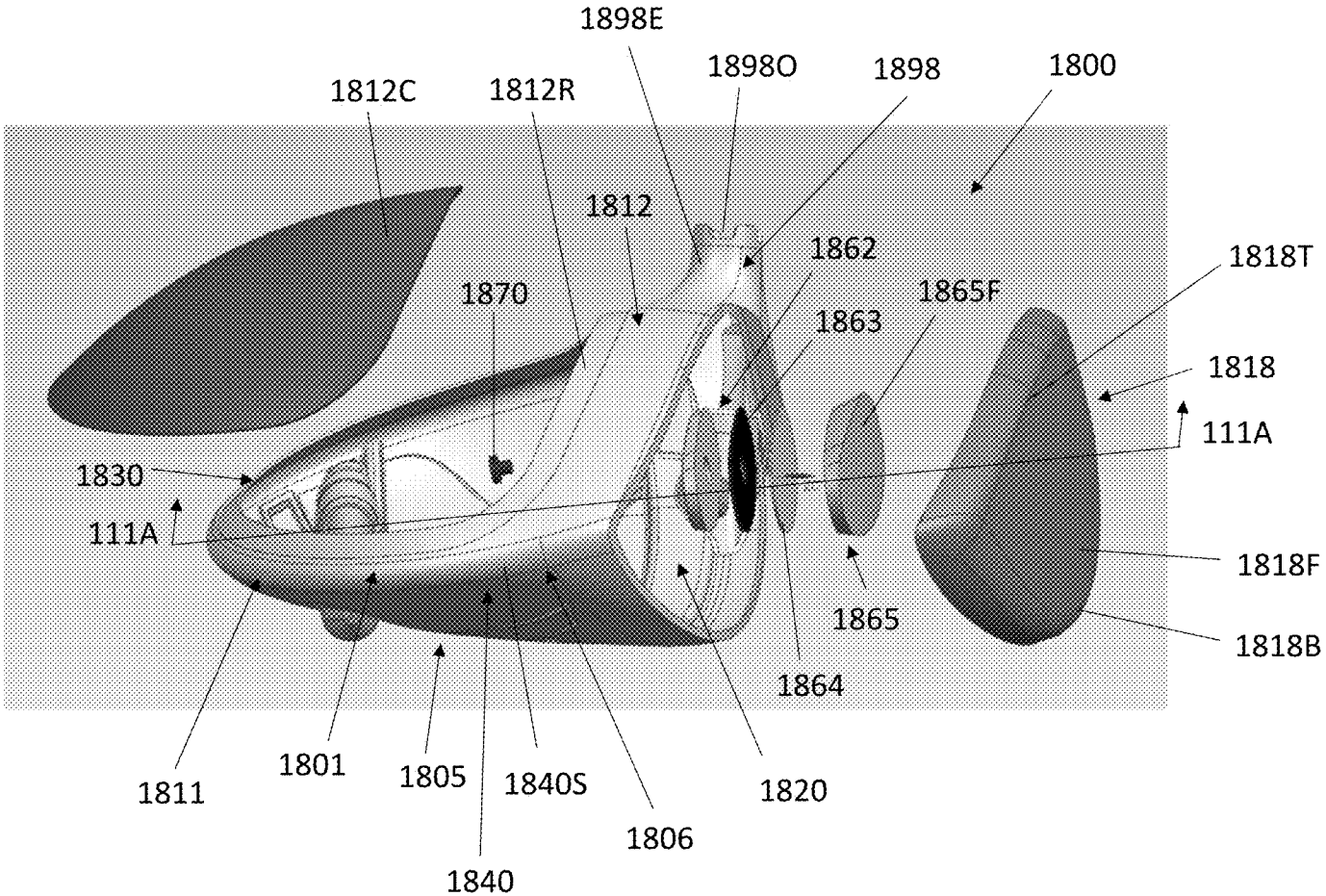

FIG. 110 depicts a front toe-side perspective exploded view of a golf club head according to some examples.

Figure 111:
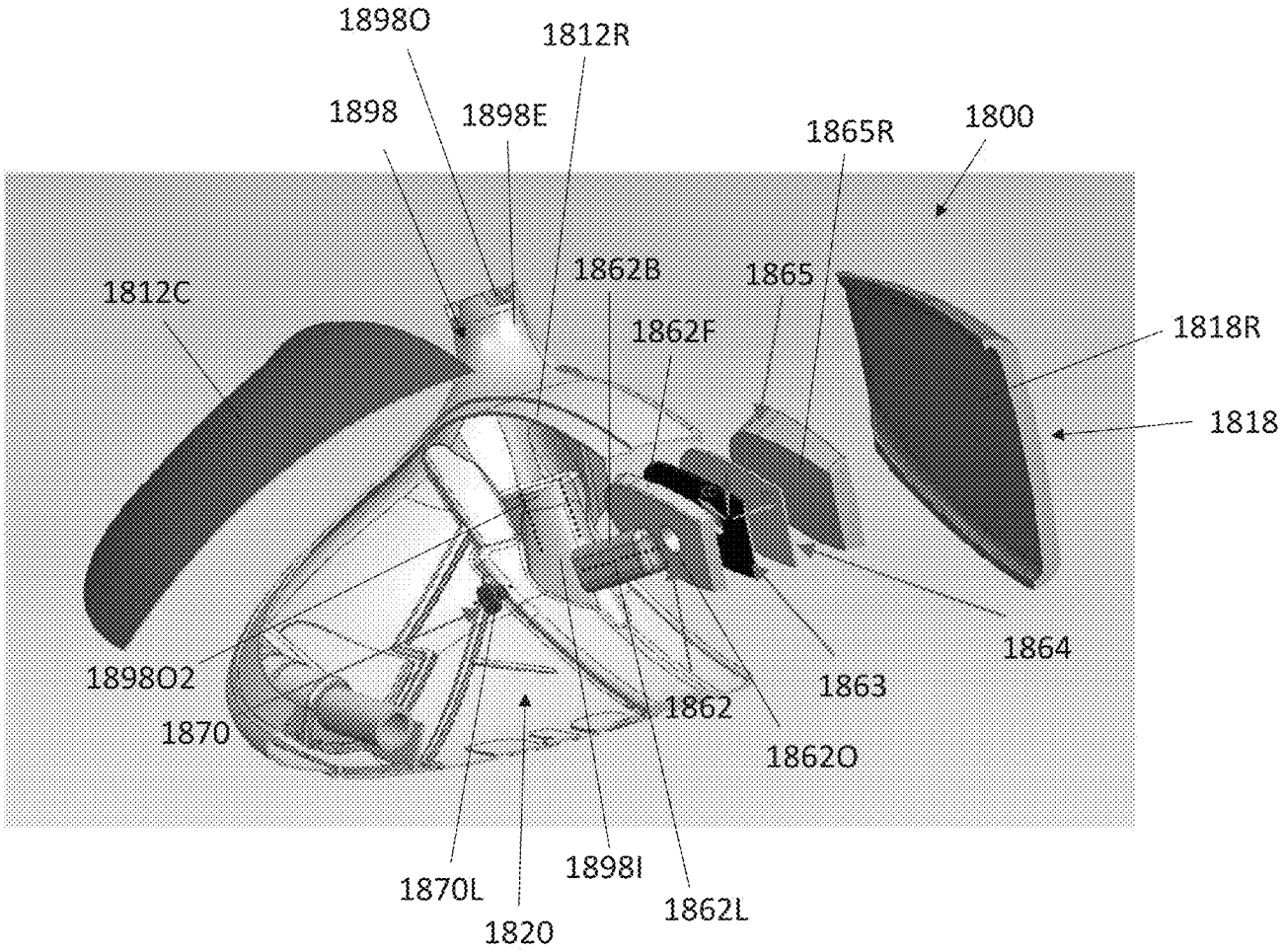

FIG. 111 depicts a rear toe-side perspective exploded view of a cross-section of the golf club head of FIG. 110 along line 111A-111A in FIG. 110.

Figure 112:
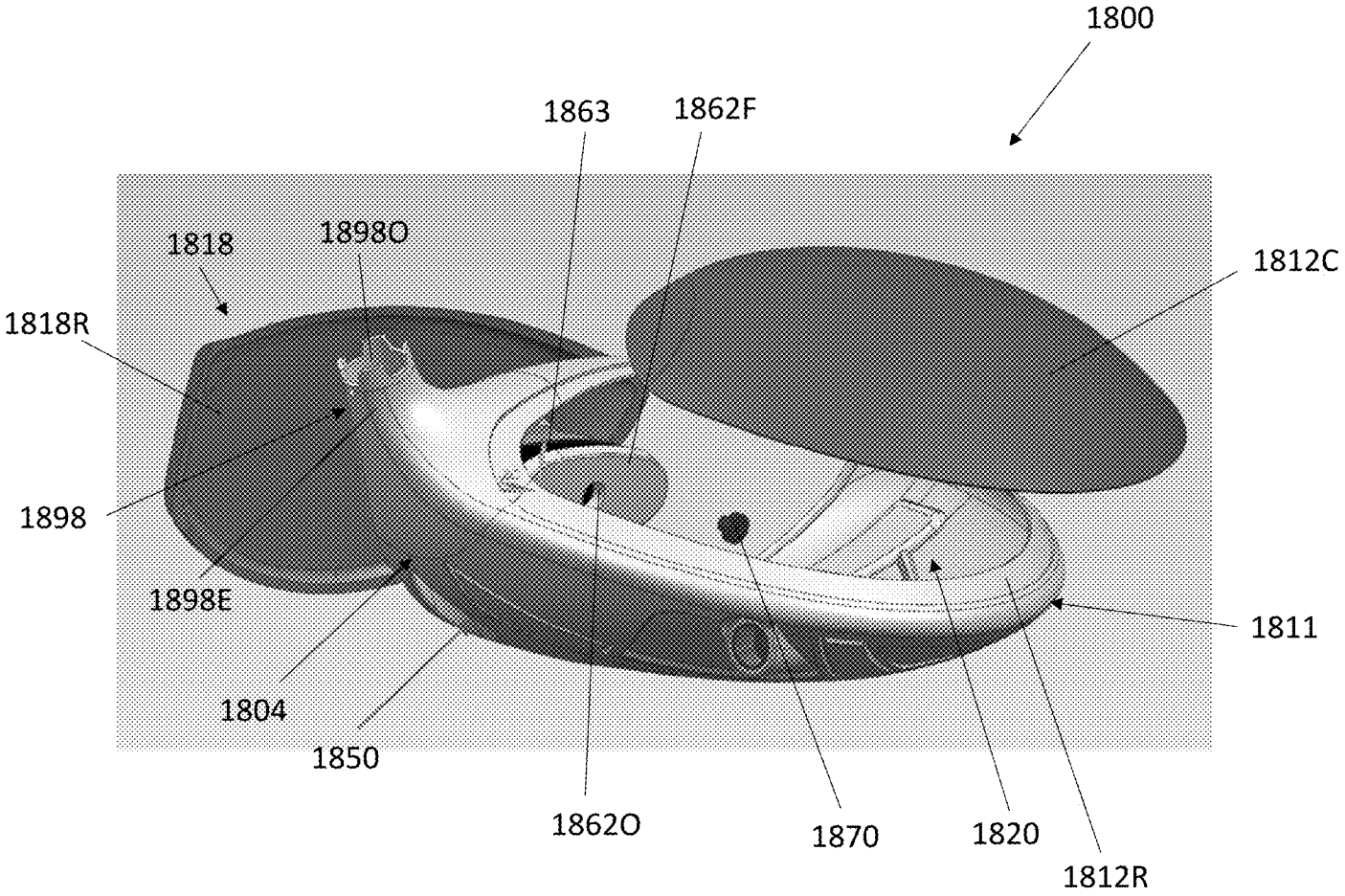

FIG. 112 depicts a rear heel-side perspective exploded view of the golf club head of FIG. 110.

DETAILED DESCRIPTION

The technologies described herein contemplate an iron-type golf club head that incorporates an elastomer element to promote more uniform ball speed across the striking face of the golf club. Traditional thin-faced iron-type golf clubs generally produce less uniform launch velocities across the striking face due to increased compliance at the geometric center of the striking face. For example, when a golf club strikes a golf ball, the striking face of the club deflects and then springs forward, accelerating the golf ball off the striking face. While such a design may lead to large flight distances for a golf ball when struck in the center of the face, any off-center strike of golf ball causes significant losses in flight distance of the golf ball. In comparison, an extremely thick face causes more uniform ball flight regardless of impact location, but a significant loss in launch velocities. The present technology incorporates an elastomer element between a back portion of the hollow iron and the rear surface of the striking face. By including the elastomer element, the magnitude of the launch velocity may be reduced for strikes at the center of the face while improving uniformity of launch velocities across the striking face. In some examples, the compression of the elastomer element between the back portion and the striking face may also be adjustable to allow for a golfer or golf club fitting professional to alter the deflection of the striking face when striking a golf ball.

Figure 1B:
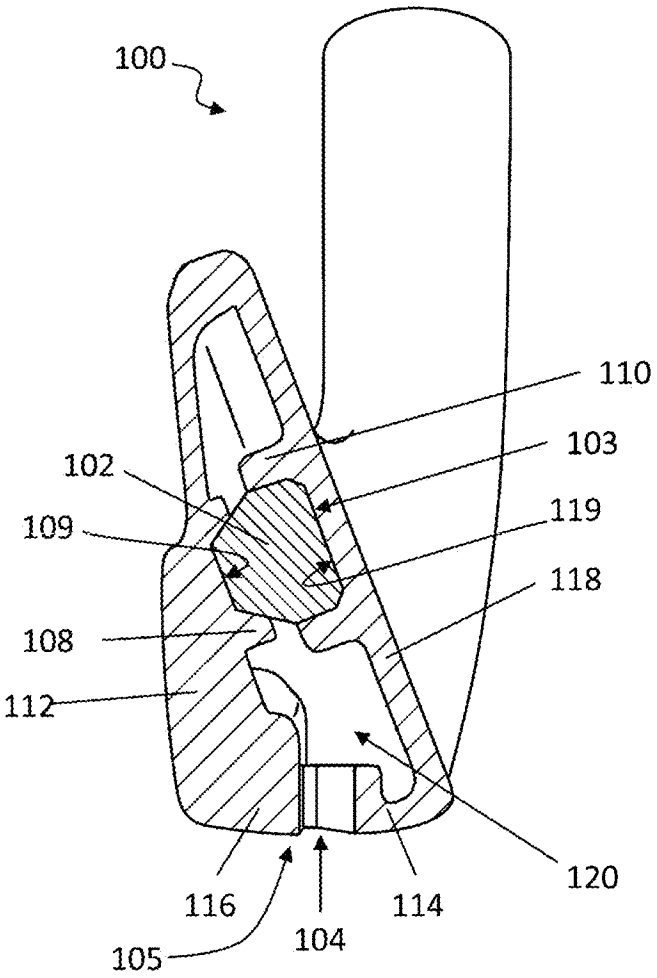
FIGS. 1A-1B depict section views of a golf club head having an elastomer element.
Figure 1A:
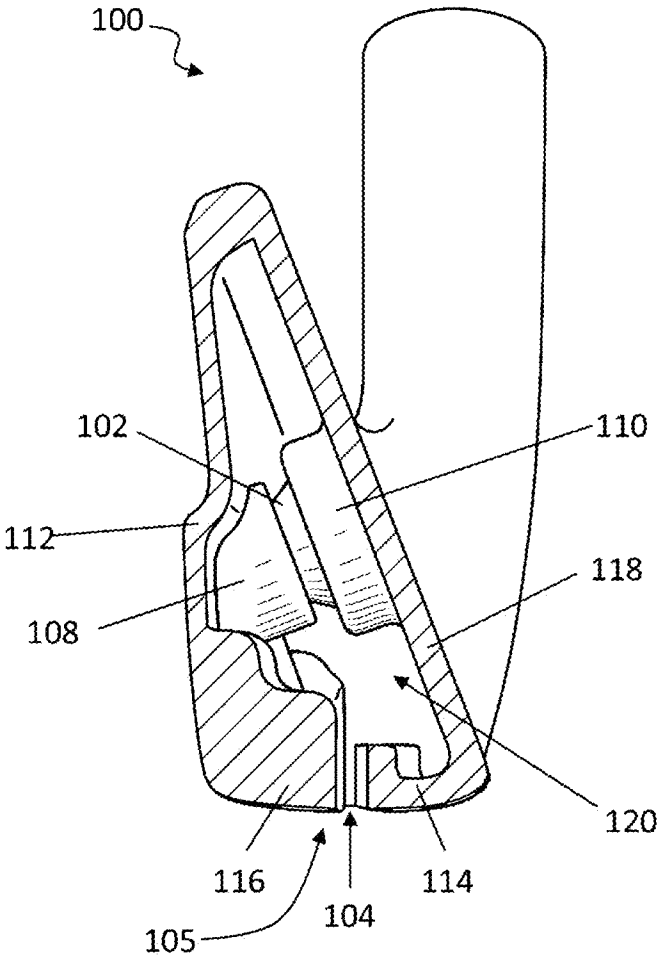
Figure 1C:
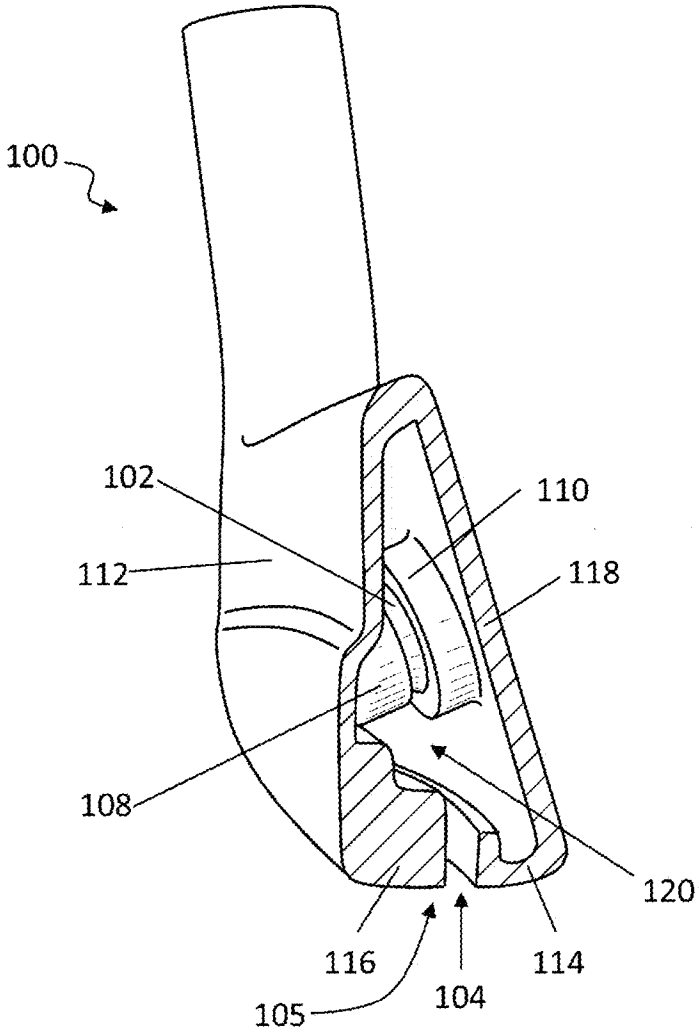
FIG. 1C depicts a perspective section view of the golf club head depicted in FIGS. 1A-1B.

FIGS. 1A-1B depict section views depict section views of a golf club head 100 having an elastomer element 102. FIG. 1C depicts a perspective section view of the golf club head 100. FIGS. 1A-1C are described concurrently. The club head 100 includes a striking face 118 and a back portion 112. A cavity 120 is formed between the striking face 118 and the back portion 112. An elastomer element 102 is disposed in the cavity 120 between the striking face 118 and the back portion 112. A rear portion of the elastomer element 102 is held in place by a cradle 108. The cradle 108 is attached to the back portion 112 of the golf club head 100, and the cradle 108 includes a recess 109 to receive the rear portion of the elastomer element 102. The lip of the cradle 108 prevents the elastomer element 102 from sliding or otherwise moving out of position. The elastomer element 102 may have a generally frustoconical shape, as shown in FIGS. 1A-1B. In other examples, the elastomer element 102 may have a cylindrical, spherical, cuboid, or prism shape. The recess 109 of the cradle 108 is formed to substantially match the shape of the rear portion of the elastomer element 102. For example, with the frustoconical elastomer element 102, the recess 109 of the cradle 108 is also frustoconical such that the surface of the rear portion of the elastomer element 102 is in contact with the interior walls of the recess 109 of the cradle 108. The cradle 108 may be welded or otherwise attached onto the back portion 112, or the cradle 108 may be formed as part of the back portion 112 during a casting or forging process. The back portion 112 may also be machined to include the cradle 108.

A front portion 103 of the elastomer element 102 contacts the rear surface 119 of the striking face 118. The front portion 103 of the elastomer element 102 may be held in place on the rear surface 119 of the striking face 118 by a securing structure, such as flange 110. The flange 110 protrudes from the rear surface 119 of the striking face 118 into the cavity 120. The flange 110 receives the front portion 103 of the elastomer element 102 to substantially prevent the elastomer element 102 from sliding along the rear surface 119 of the striking face 118. The flange 110 may partially or completely surround the front portion 103 of the elastomer element 102. Similar to the cradle 108, the flange 110 may be shaped to match the shape of the front portion 103 of the elastomer element 102 such that the surface of the front portion 103 of the elastomer element 102 is in contact with the interior surfaces of the flange 110. The flange 110 may be welded or otherwise attached to the rear surface 119 of the striking face 118. The flange 110 may also be cast or forged during the formation of the striking face 118. For instance, where the striking face 118 is a face insert, the flange 110 may be incorporated during the casting or forging process to make the face insert. In another example, the flange 110 and the striking face 118 may be machined from a thicker face plate. Alternative securing structures other than the flange 110 may also be used. For instance, two or more posts may be included on rear surface 119 of the striking face 118 around the perimeter of the front portion 103 of the elastomer element 102. As another example, an adhesive may be used to secure the elastomer element 102 to the rear surface 119 of the striking face 118. In other embodiments, no securing structure is utilized and the elastomer element 102 is generally held in place due to the compression of the elastomer element 102 between the cradle 108 and the rear surface 119 of the striking face 118.

In the example depicted in FIGS. 1A-1C, the elastomer element 102 is disposed behind the approximate geometric center of the striking face 118. In traditional thin face golf clubs, strikes at the geometric center of the striking face 118 display the largest displacement of the striking face 118, and thus the greatest ball speeds. By disposing the elastomer element 102 at the geometric center of the striking face 118, the deflection of the striking face 118 at that point is reduced, thus reducing the ball speed. Portions of the striking face 118 not backed by the elastomer element 102, however, continue to deflect into the cavity 120 contributing to the speed of the golf ball. As such, a more uniform distribution of ball speeds resulting from ball strikes across the striking face 118 from the heel to the toe may be achieved. In other examples, the elastomer element 102 may be disposed at other locations within the club head 100.

The elasticity of the elastomer element 102 also affects the deflection of the striking face 118. For instance, a material with a lower elastic modulus allows for further deflection of the striking face 118, providing for higher maximum ball speeds but less uniformity of ball speeds. In contrast, a material with a higher elastic modulus further prevents deflection of the striking face 118, providing for lower maximum ball speeds but more uniformity of ball speeds. Different types of materials are discussed in further detail below with reference to Tables 2-3.

The golf club head 100 also includes a sole 105 having a sole channel 104 in between a front sole portion 114 and a rear sole portion 116. The sole channel 104 extends along the sole 105 of the golf club head 100 from a point near the heel to a point near the toe thereof. While depicted as being a hollow channel, the sole channel 104 may be filled or spanned by a plastic, rubber, polymer, or other material to prevent debris from entering the cavity 120. The sole channel 104 allows for additional deflection of the lower portion of the striking face 118. By allowing for further deflection of the lower portion of the striking face 118, increased ball speeds are achieved from ball strikes at lower portions of the striking face 118, such as ball strikes off the turf. Accordingly, the elastomer element 102 and the sole channel 104 in combination with one another provide for increased flight distance of a golf ball for turf strikes along with more uniform ball speeds across the striking face 118.

Figure 2B:
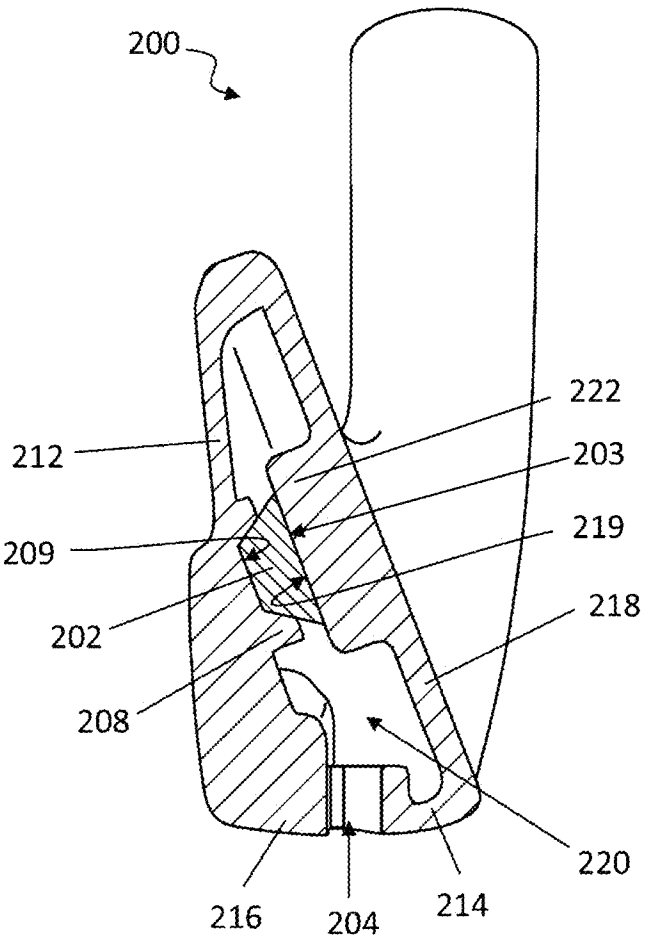
FIGS. 2A-2B depict section views of a golf club head having an elastomer element and a striking face with a thickened center portion.
Figure 2A:
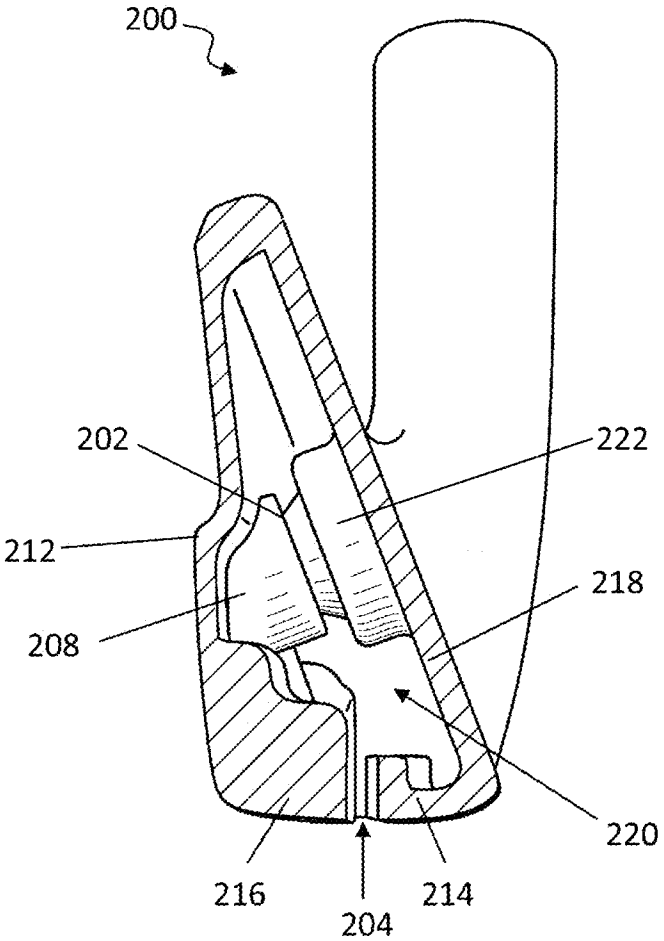

FIGS. 2A-2B depict sections views of a golf club head 200 having an elastomer element 202 and a striking face 218 with a thickened center portion 222. Golf club head 200 is similar to golf club head 100 discussed above with reference to FIGS. 1A-1C, except a thickened portion 222 of the striking face 218 is utilized rather than a flange 110. The thickened portion 222 of the striking face 218 protrudes into the cavity 220. The front portion 203 of the elastomer element 202 contacts the rear surface 219 of the thickened portion 222. The rear portion of the elastomer element 202 is received by a recess 209 in a cradle 208, which is attached to the back portion 212 and substantially similar to the cradle 108 discussed above with reference to FIGS. 1A-1C. Due the thickened portion 222 of the striking face 218, the elastomer element 202 may be shorter in length than the elastomer element 102 in FIGS. 1A-1C. The golf club head 200 also includes a sole channel 204 disposed between a front sole portion 214 and a rear sole portion 216. The sole channel 204 also provides benefits similar to that of sole channel 104 described in FIGS. 1A-1C and may also be filled with or spanned by a material.

Figure 3B:
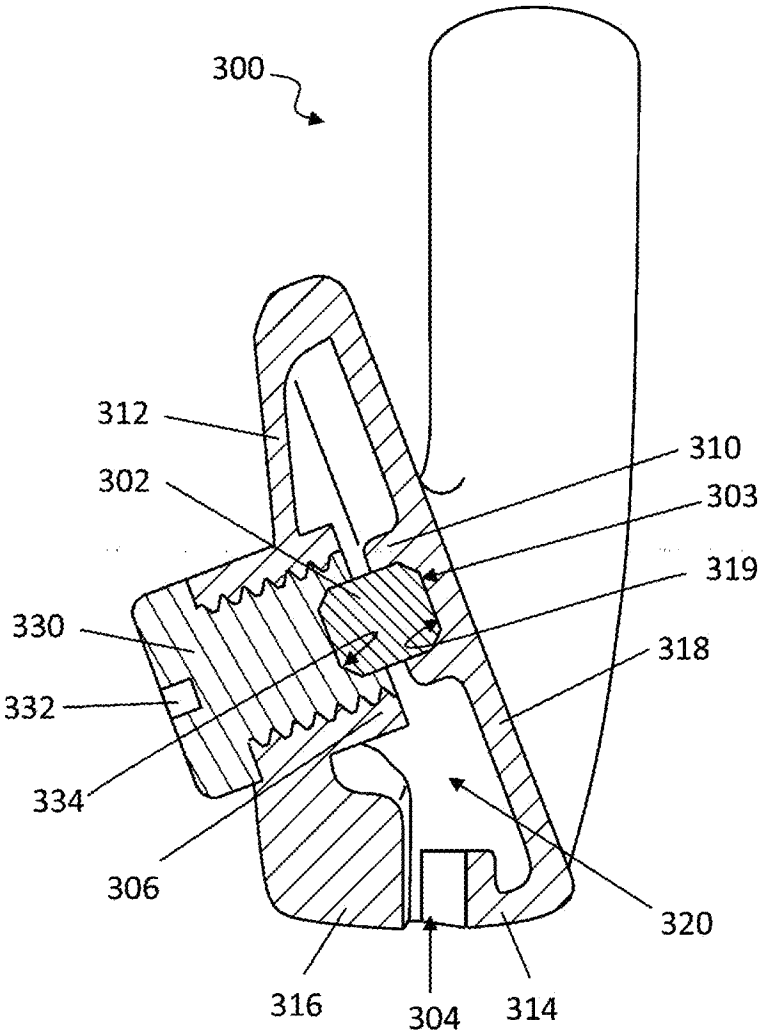
FIGS. 3A-3B depict section views of a golf club head having an elastomer element and an adjustment mechanism to adjust the compression of the elastomer element.
Figure 3A:
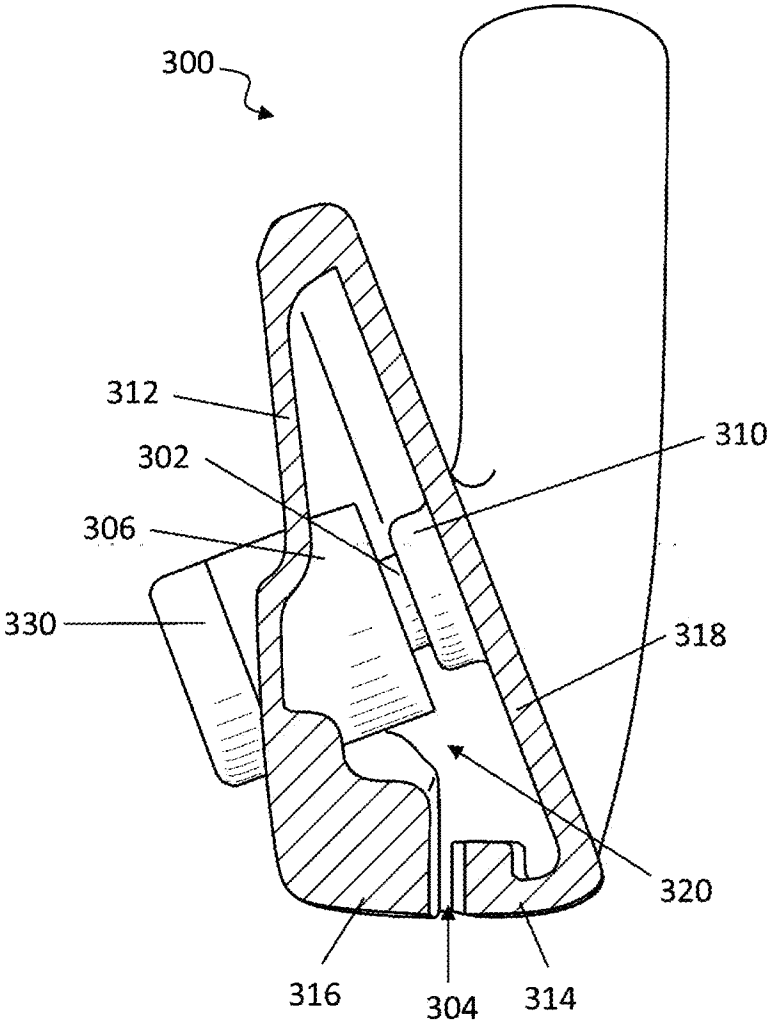

FIGS. 3A-3B depict section views of a golf club head 300 having an elastomer element 302 and an adjustment mechanism to adjust the compression of the elastomer element 302. The golf club head 300 includes a striking face 318 and a back portion 312, and a cavity 320 is formed between the back portion 312 and the striking face 318. Similar to the golf club head 100 described above with reference to FIGS. 1A-1C, a flange 310 is disposed on the rear surface 319 of the striking face 318, and the flange 310 receives the front portion 303 of the elastomer element 302. In the example depicted in FIGS. 3A-3B, the elastomer element 302 has a generally cylindrical shape. In other examples, however, the elastomer element 302 may have a conical, frustoconical, spherical, cuboid, or prism shape.

The golf club head 300 also includes an adjustment mechanism. The adjustment mechanism is configured to adjust the compression of the elastomer element 302 against the rear surface 319 of the striking face 318. In the embodiment depicted in FIGS. 3A-3B, the adjustment mechanism includes an adjustment receiver 306 and an adjustment driver 330. The adjustment receiver 306 may be a structure with a through-hole into the cavity 320, and the adjustment driver 330 may be a threaded element or screw, as depicted. The through-hole of the adjustment receiver 306 includes a threaded interior surface for receiving the threaded element 330. The adjustment receiver 306 may be formed as part of the forging or casting process of the back portion 312 or may also be machined and tapped following the forging and casting process. The threaded element 330 includes an interface 334, such as a recess, that contacts or receives a rear portion of the elastomer element 302. The threaded element 330 also includes a screw drive 332 that is at least partially external to the golf club head 300 such that a golfer can access the screw drive 332. When the threaded element 330 is turned via screw drive 332, such as by a screwdriver, Allen wrench, or torque wrench, the threaded element 330 moves further into or out of the cavity 320. In some examples, the interface 334 that contacts or receives the rear portion of the elastomer element 302 may be lubricated so as to prevent twisting or spinning of the elastomer element 302 when the threaded element 330 is turned. As the threaded element 330 moves further into the cavity 320, the compression of the elastomer element 302 against the rear surface 319 of the striking face 318 increases, thus altering a performance of the elastomer element 302.

A higher compression of the elastomer element 302 against the rear surface 319 of the striking face 318 further restricts the deflection of the striking face 318. In turn, further restriction of the deflection causes more uniform ball speeds across the striking face 318. However, the restriction on deflection also lowers the maximum ball speed from the center of the striking face 318. By making the compression of the elastomer element 302 adjustable with the adjustment mechanism, the golfer or a golf-club-fitting professional may adjust the compression to fit the particular needs of the golfer. For example, a golfer that desires further maximum distance, but does not need uniform ball speed across the striking face 318, can reduce the initial set compression of the elastomer element 302 by loosening the threaded element 330. In contrast, a golfer that desires uniform ball speed across the striking face 318 can tighten the threaded element 330 to increase the initial set compression of the elastomer element 302.

While the adjustment mechanism is depicted as including a threaded element 330 and a threaded through-hole in FIGS. 3A-3B, other adjustment mechanisms could be used to adjust the compression of the elastomer element 302 against the rear surface 319 of the striking face 318. For instance, the adjustment mechanism may include a lever where rotation of the lever alters the compression of the elastomer element 302. The adjustment mechanism may also include a button that may be depressed to directly increase the compression of the elastomer element 302. Other types of adjustment mechanisms may also be used.

The golf club head 300 also includes a sole channel 304 between a front sole portion 314 and a rear sole portion 316, similar to the sole channel 104 discussed above with reference to FIGS. 1A-1C. The sole channel 304 also provides benefits similar to that of sole channel 104 and may also be filled with or spanned by a material.

The golf club head 300 may also be created or sold as a kit. In the example depicted where the adjustment mechanism is a threaded element 330, such as a screw, the kit may include a plurality of threaded elements 330. Each of the threaded elements 330 may have a different weight, such that the golfer can select the desired weight. For example, one golfer may prefer an overall lighter weight for the head of an iron, while another golfer may prefer a heavier weight. The plurality of threaded elements 330 may also each have different weight distributions. For instance, different threaded elements 330 may be configured so as to distribute, as desired, the weight of each threaded element 330 along a length thereof. The plurality of threaded elements 330 may also have differing lengths. By having differing lengths, each threaded elements 330 may have a maximum compression that it can apply to the elastomer element 302. For instance, a shorter threaded elements 330 may not be able to apply as much force onto the elastomer element 302 as a longer threaded elements 330, depending on the configuration of the adjustment receiver 306. The kit may also include a torque wrench for installing the threaded elements 330 into the adjustment receiver 306. The torque wrench may include preset settings corresponding to different compression or performance levels.

Figure 4B:
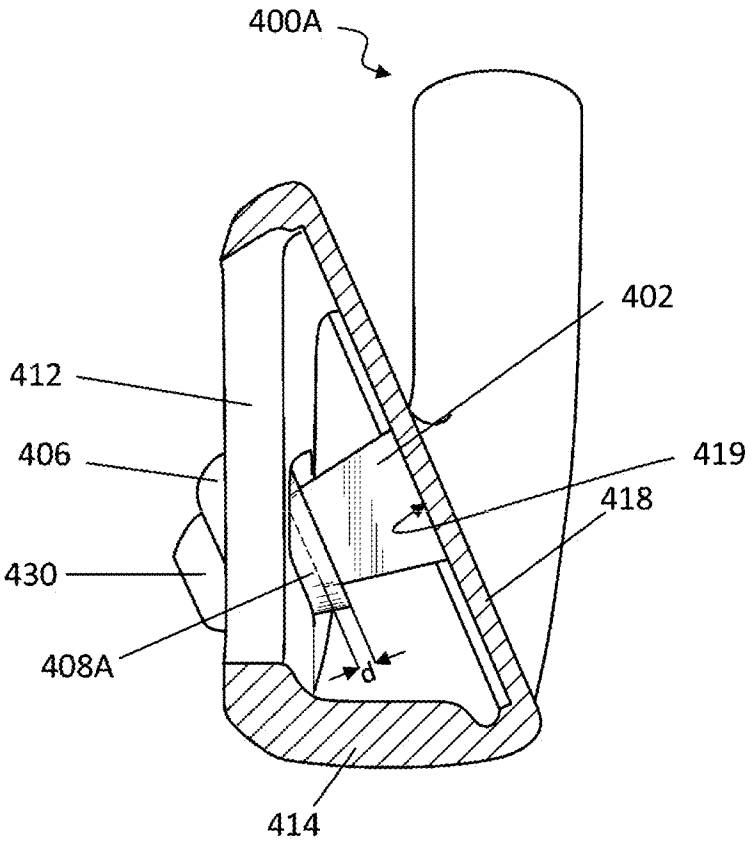
FIG. 4B depicts a section view of the golf club head of FIG. 4A.
Figure 4A:
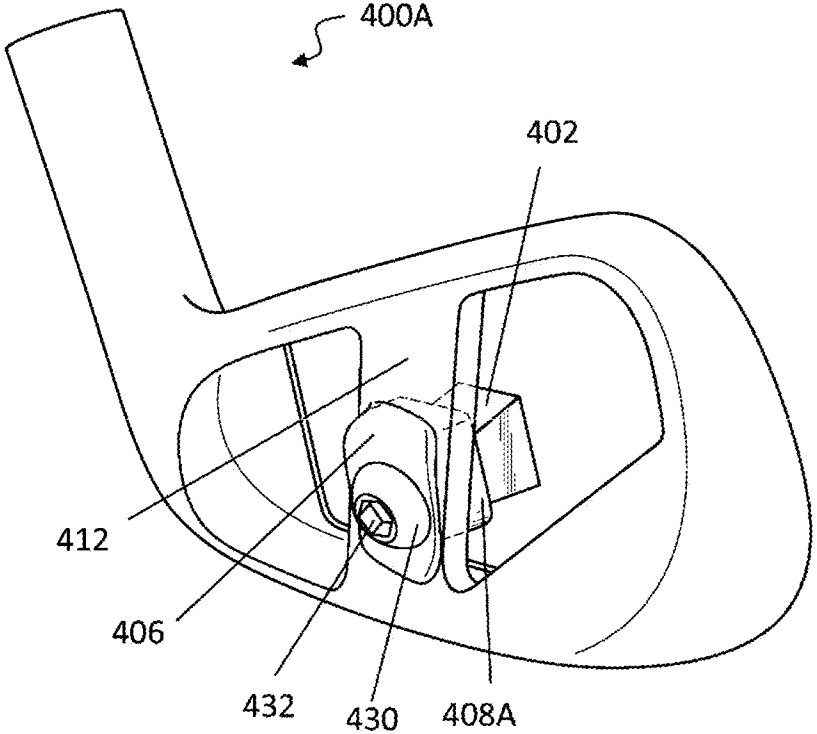
FIG. 4A depicts a perspective view of another example of a golf club head having an elastomer element and an adjustment mechanism to adjust the compression of the elastomer element.

FIG. 4A depicts a perspective view of another example of a golf club head 400A having an elastomer element 402 and an adjustment mechanism to adjust the compression of the elastomer element 402. FIG. 4B depicts a section view of the golf club head 400A. The golf club head 400A includes striking face 418 and a back portion 412 with a cavity 420 formed there between. Like the adjustment mechanism in FIGS. 3A-3B, the adjustment mechanism in golf club head 400A includes an adjustment receiver 406 and an adjustment driver 430. In the example depicted, the adjustment receiver 406 is a structure having a threaded through-hole for accepting the adjustment driver 430, and the adjustment driver 430 is a screw. In some embodiments, the adjustment receiver 406 may be defined by a threaded through-hole through the back portion 412, without the need for any additional structure.

The tip of the screw 430 is in contact with a cradle 408A that holds a rear portion of the elastomer element 402. As the screw 430 is turned, the lateral movement of the screw 430 causes the cradle 408A to move towards or away from the striking face 418. Accordingly, in some examples, the screw 430 extends substantially orthogonal to the rear surface 419 of the striking face 418. Because the cradle 408A holds the rear portion of the elastomer element 402, movement of the cradle 408A causes a change in the compression of the elastomer element 402 against the rear surface 419 of the striking face 418. As such, the compression of the elastomer element 402 may be adjusted by turning the screw 430 via screw drive 432, similar to manipulation of the threaded element 330 in golf club head 300 depicted in FIGS. 3A-3B.

Figure 4C:
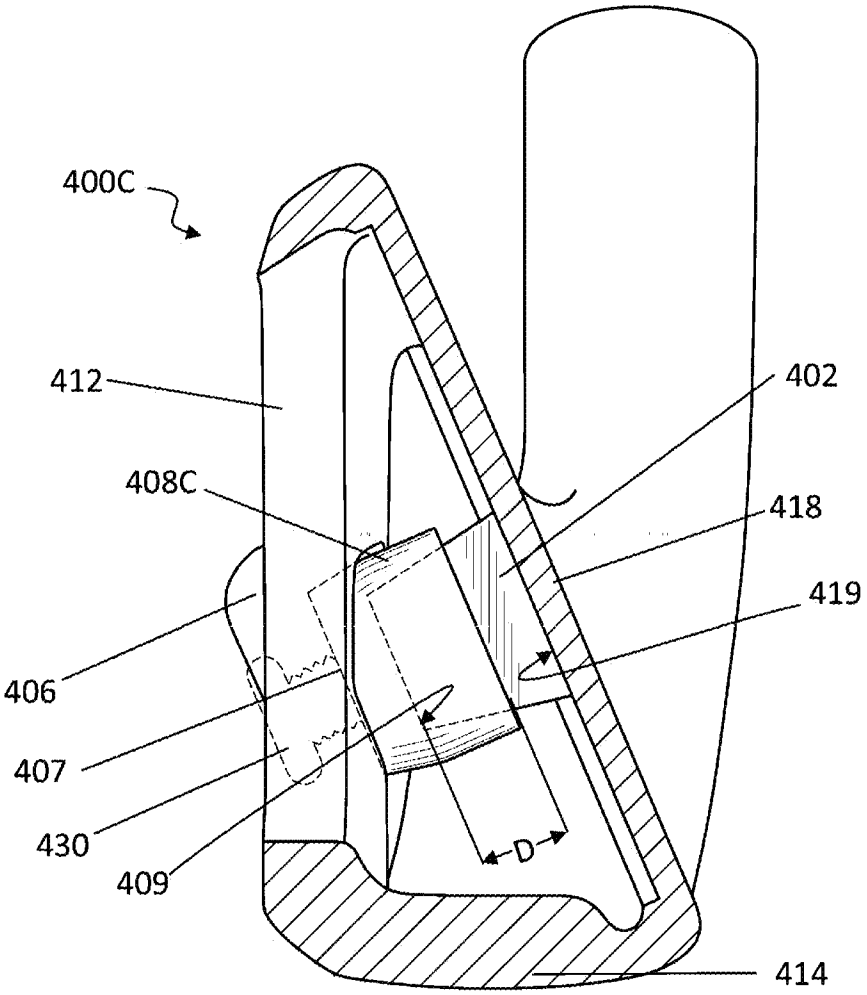
FIG. 4C depicts a section view of another example of a golf club having an elastomer element and an adjustment mechanism to adjust the compression of the elastomer element.

FIG. 4C depicts a section view of another example of a golf club head 400C having an elastomer element 402 and an adjustment mechanism to adjust the compression of the elastomer element 402. The golf club head 400C is substantially similar to the golf club head 400A depicted in FIGS. 4A-4B, except golf club head 400C includes a larger cradle 408C having a depth D greater than a depth of a comparatively smaller cradle (e.g., the cradle 408A of FIGS. 4A-4B having a depth d). The larger cradle 408C encompasses more the elastomer element 402 than a smaller cradle. By encompassing a larger portion of the elastomer element 402, the cradle 408C further limits the deformation of the elastomer element 402 upon a strike of a golf ball by golf club head 400C. Limitation of the deformation of the elastomer element 402 also may limit the potential maximum deflection of the striking face 418, and therefore may reduce the maximum ball speed for the golf club head 400C while increasing the uniformity of speeds across the striking face 418. The larger cradle 408C does not come into contact with the rear surface 419 of the striking face 418 at maximum deflection thereof. The cradle 408C itself may be made of the same material as the back portion 412, such as a steel. The cradle 408C may also be made from a titanium, a composite, a ceramic, or a variety of other materials.

The size of the cradle 408C may be selected based on the desired ball speed properties. For instance, the cradle 408C may encompass approximately 25% or more of the volume of the elastomer element 402, as shown in FIG. 4C. In other examples, the cradle 408C may encompass between approximately 25%-50% of the volume of the elastomer element 402. In yet other examples, the cradle 408C may encompass approximately 10%-25% or less than approximately 10% of the volume of the elastomer element 402. In still other examples, the cradle 408C may encompass more than 50% of the volume of the elastomer element 402. For the portion of the elastomer element 402 encompassed by the cradle 408C, substantially the entire perimeter surface of that portion of elastomer element 402 may contact the interior surfaces of the recess 409 of the cradle 408C.

The connection between the cradle 408C and the adjustment driver 430 can also be seen more clearly in FIG. 4C. The tip of the adjustment driver 430, which may be a flat surface, contacts the rear surface 407 of the cradle 408C. Thus, as the adjustment driver 430 moves into the cavity 420, the cradle 408C and the elastomer element 402 are pushed towards the striking face 418. Conversely, as the adjustment driver 430 is backed out of the cavity 420, the cradle 408C maintains contact with the adjustment driver 430 due to the force exerted from the elastomer element 402 resulting from the compression thereof. In some embodiments, the surface of the tip of the screw 430 and/or the rear surface 407 of the cradle 408C may be lubricated so as to prevent twisting of the cradle 408C. In other examples, the tip of the adjustment driver 430 may be attached to the cradle 408C such that the cradle 408C twists with the turning of the adjustment driver 430. In such an embodiment, the elastomer element 402 may be substantially cylindrical, conical, spherical, or frustoconical, and the recess 409 of the cradle 408C may be lubricated to prevent twisting of the elastomer element 402. In another example, the rear surface 419 of the striking face 418 and/or the front surface of the elastomer element 402 in contact with the rear surface 419 of the striking face 418 may be lubricated so as to allow for spinning of the elastomer element 402 against the rear surface 419 of the striking face 418.

While the golf club heads 400A and 400C are depicted with a continuous sole 414 rather than a sole channel like the golf club head 300 of FIGS. 3A-3B, other embodiments of golf club heads 400A and 400C may include a sole channel. In addition, golf club heads 400A and 400C may also be sold as kits with a plurality of screws and/or a torque wrench, similar to the kit discussed above for golf club head 300. An additional back plate may be added to the aft portion of the golf club heads 400A and 400C, while still leaving a portion of the screw exposed for adjustment.

Simulated results of different types of golf club heads further demonstrate ball speed uniformity across the face of the golf club heads including an elastomer element. Table 1 indicates ball speed retention across the face of a golf club head for several different example golf club heads. Example 1 is a baseline hollow iron having a 2.1 mm face thickness with a sole channel. Example 2 is a hollow iron with a 2.1 mm face with a rigid rod extending from the back portion to the striking face, also including a sole channel. Example 3 is a hollow iron with a striking face having a thick center (6.1 mm) and a thin perimeter (2.1 mm), also having a sole channel. Example 4 is a golf club head having an elastomer element similar to golf club head 100 depicted in FIGS. 1A-1C. The "Center" row indicates ball speeds resulting from a strike in the center of the golf club head, the "½" Heel" row indicates the loss of ball speed from a strike a half inch from the center of the club head towards the heel, and the "½" Toe" row indicates the loss of ball speed from a strike a half inch from the center of the club head towards the toe. All values in Table 1 are in miles per hour (mph).

TABLE 1

| Impact Location | Example 1 | Example 2 | Example 3 | Example 4 |
|---|---|---|---|---|
| Center | 134.1 | 132.8 | 133.8 | 133.6 |
| ½" Heel (drop from center) | −1.0 | −0.4 | −0.9 | −0.7 |
| ½" Toe (drop from center) | −6.9 | −6.5 | −6.8 | −6.7 |

From the results in Table 1, the golf club head with the elastomer (Example 4) displays a relatively high ball speed from the center of the face, while also providing a reduced loss of ball speed from strikes near the toe or the heel of the golf club.

In addition, as mentioned above, the type of material utilized for any of the elastomer elements discussed herein has an effect on the displacement of the striking face. For instance, an elastomer element with a greater elastic modulus will resist compression and thus deflection of the striking face, leading to lower ball speeds. For example, for a golf club head similar to golf club head 400A, Table 2 indicates ball speeds achieved from using materials with different elasticity properties. All ball speeds were the result of strikes at the center of the face.

TABLE 2

| Material | Elastic Modulus (GPa) | Ball Speed (mph) |
|---|---|---|
| Material A | 0.41 | 132.2 |
| Material B | 0.58 | 132.2 |
| Material C | 4.14 | 132.0 |
| Material D | 41.4 | 131.0 |

From the results in Table 2, a selection of material for the elastomer element can be used to fine tune the performance of the golf club. Any of the materials listed in Table 2 are acceptable for use in forming an elastomer element to be used in the present technology.

The different types of materials also have effect on the ball speed retention across the striking face. For example, for a golf club head similar to golf club head 400A, Table 3 indicates ball speeds achieved across the striking face from heel to toe for the different materials used as the elastomer element. The materials referenced in Table 3 are the same materials from Table 2. All speeds in Table 3 are in mph.

TABLE 3

| Material | ½" Toe Impact | Center Impact | ½" Heel Impact |
|---|---|---|---|
| No Elastomer Element | 128.7 | 132.2 | 129.4 |
| Material A (0.41 GPa) | 128.7 | 132.2 | 129.4 |
| Material C (4.1 GPa) | 128.7 | 132.0 | 129.3 |
| Material D (41 GPa) | 127.9 | 131.0 | 128.7 |

From the results in Table 3, materials having a higher elastic modulus provide for better ball speed retention across the striking face, but lose maximum ball speed for impacts at the center of the face. For some applications, a range of elastic moduli for the elastomer element from about 4 to about 15 GPa may be used. In other applications, a range of elastic moduli for the elastomer element from about 1 to about 40 or about 50 GPa may be used.

As mentioned above with reference to FIGS. 4A-4C, the size of the cradle may also have an impact on the ball speed. For a smaller cradle, such as cradle 408A in FIGS. 4A-4B, and an elastomer element made of a 13 GPa material, a loss of about 0.2 mph is observed for a center impact as compared to the same club with no elastomer element. For a larger cradle that is about 5 mm deeper, such as cradle 408C in FIG. 4C, and an elastomer element also made of a 13 GPa material, a loss of about 0.4 mph is observed for a center impact as compared to the same club with no elastomer element. For the same larger cradle and an elastomer element made of a 0.4 GPa material, a loss of only about 0.2 mph is observed for a center impact as compared to the same club with no elastomer element.

San Diego Plastics, Inc. of National City, CA offers several plastics having elastic moduli ranging from 2.6 GPa to 13 GPa that would all be acceptable for use. The plastics also have yield strengths that are also acceptable for use in the golf club heads discussed herein. Table 4 lists several materials offered by San Diego Plastics and their respective elastic modulus and yield strength values.

TABLE 4

| | ABS | Tecaform Acetal | PVC | Tecapeek | Tecapeek 30% Carbon Fiber |
|---|---|---|---|---|---|
| Thermoplastic Elastic Modulus (GPa) | 2.8 | 2.6 | 2.8 | 3.6 | 13 |
| Thermoplastic Compressive Yield Strength (GPa) | 0.077 | 0.031 | 0.088 | 0.118 | 0.240 |

Figure 5B:
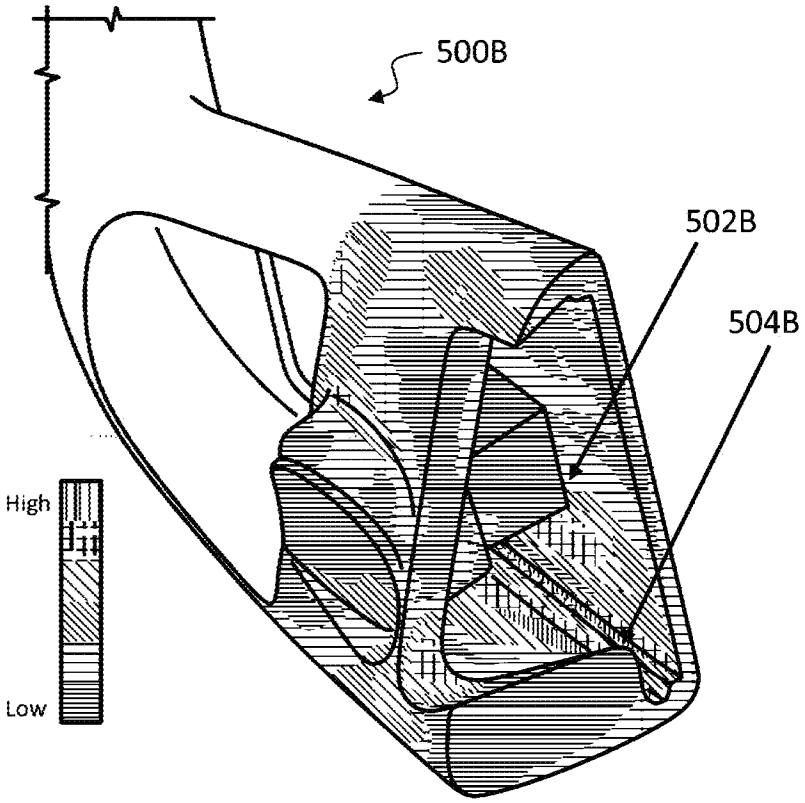
FIG. 5B depicts a stress contour diagram for a golf club head with an elastomer element.
Figure 5A:
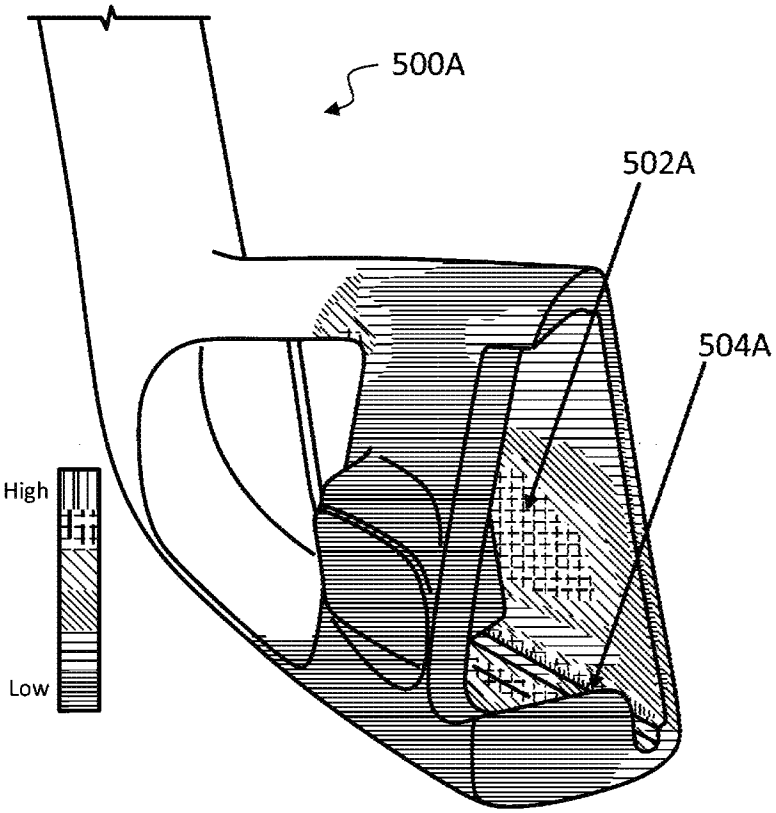
FIG. 5A depicts a stress contour diagram for a golf club head without an elastomer element.

The inclusion of an elastomer element also provide benefits in durability for the club face by reducing stress values displayed by the striking face upon impact with a golf ball. FIG. 5A depicts a stress contour diagram for a golf club head 500A without an elastomer element, and FIG. 5B depicts a stress contour diagram for a golf club head 500B with an elastomer element. In the golf club head 500A, the von Mises stress at the center of the face 502A is about 68% of the maximum von Mises stress, which occurs at the bottom face edge 504A. Without an elastomer element, the von Mises stress levels are high and indicate that the club face may be susceptible to failure and/or early deterioration. In the golf club head 500B, for an elastomer element having an elastic modulus of 0.41 GPa, the von Mises stress for the face near the edge of the elastomer element 502B is reduced by about 16% and the maximum von Mises stress occurring at the bottom face edge 504B is reduced by about 18%. These von Mises stresses are still relatively high, but are significantly reduced from those of the golf club head 500A. For a golf club head 500B with an elastomer element having an elastic modulus of about 13 GPa, the von Mises stress for the face near the edge of the elastomer element 502B is reduced by about 50% and the maximum von Mises stress occurring at the bottom face edge 504B is reduced by about 56%. Such von Mises stress values are lower and are indicative of a more durable golf club head that may be less likely to fail.

Figure 6A:
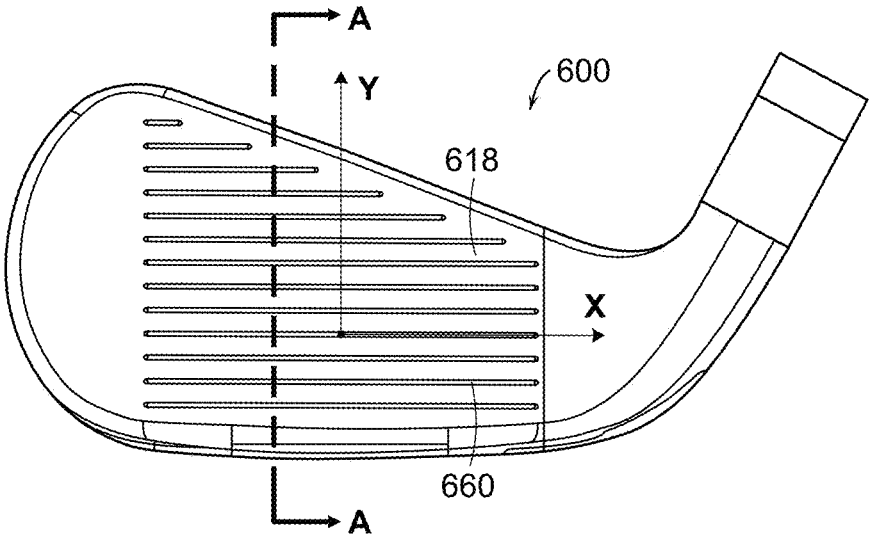
FIG. 6A depicts a front view of the golf club head.
Figure 6B:
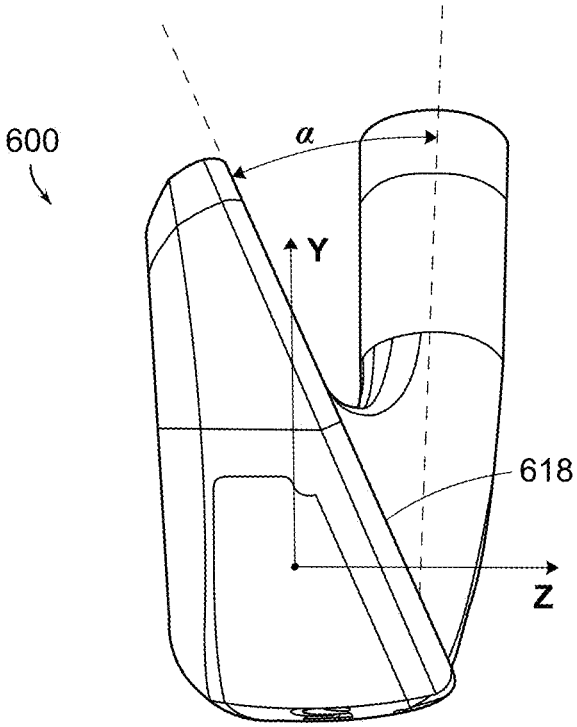
FIG. 6B depicts a toe view of the golf club head of FIG. 6A.
Figure 6C:
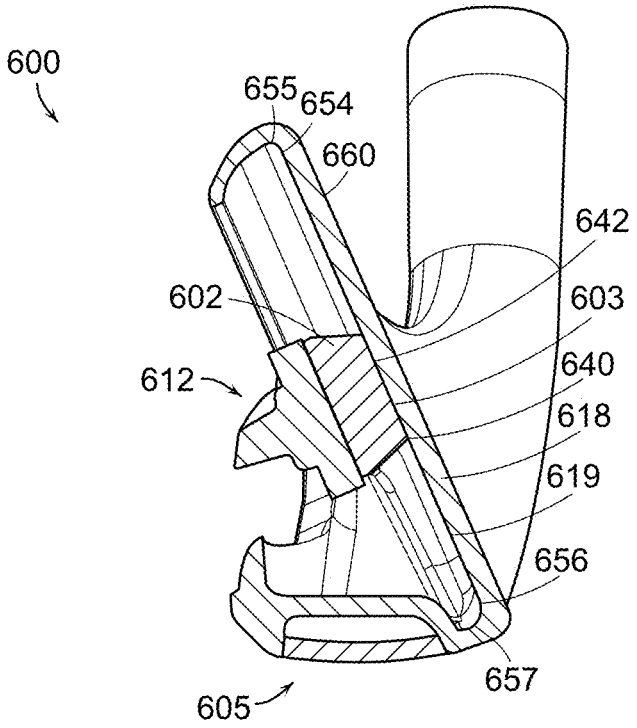
FIG. 6C depicts a section view A-A of the golf club head of FIG. 6A.
Figure 6D:
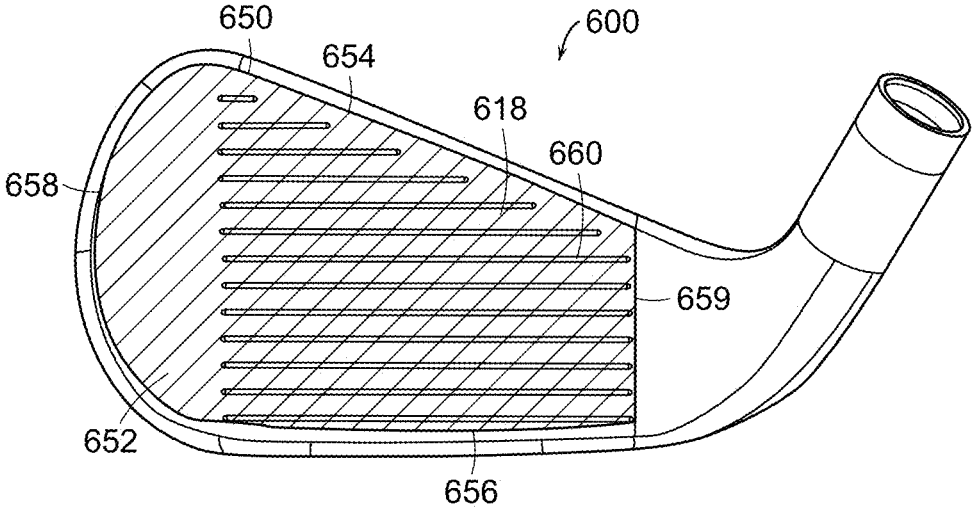
FIG. 6D depicts a perspective view of the golf club head of FIG. 6A oriented perpendicular to the striking face.
Figure 6E:
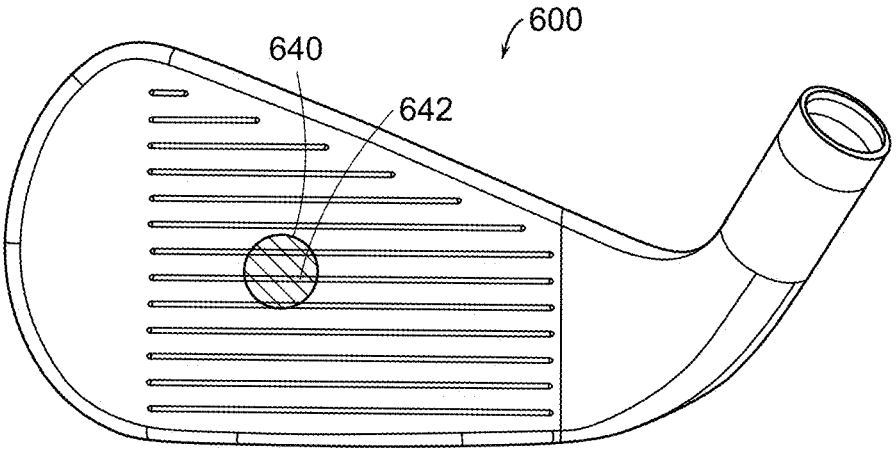
FIG. 6E depicts a perspective view of the golf club head of FIG. 6A oriented perpendicular to the striking face including the supported region.

FIGS. 6A-6E depict a golf club head 600 having an elastomer element 602. FIG. 6A depicts a front view of the golf club head 600. FIG. 6B depicts a toe view of the golf club head 600 of FIG. 6A. FIG. 6C depicts a section view A-A of the golf club head 600 of FIG. 6A. FIG. 6D depicts a perspective view of the golf club head 600 of FIG. 6A oriented perpendicular to the striking face 618. FIG. 6E depicts a perspective view of the golf club head 600 of FIG. 6A oriented perpendicular to the striking face 618 including the supported region 642. The golf club head 600 includes a striking face 618 configured to strike a ball, a sole 605 located at the bottom of the golf club head 600, and a back portion 612.

As illustrated in FIGS. 6A and 6B, the golf club head 600 includes a coordinate system centered at the center of gravity (CG) of the golf club head 600. The coordinate system includes a y-axis which extends vertically, perpendicular to a ground plane when the golf club head 600 is in an address position at prescribed lie and loft $\alpha$. The coordinate system includes an x-axis, perpendicular to the y-axis, parallel to the striking face 618, and extending towards the heel of the golf club head 600. The coordinate system includes a z-axis, perpendicular to the y-axis and x-axis and extending through the striking face 618. The golf club head 600 has a rotational moment of inertia about the y-axis (MOI-Y), a value which represents the golf club head's resistance to angular acceleration about the y-axis.

An elastomer element 602 is disposed between the striking face 618 and the back portion 612. The striking face 618 includes a rear surface 619. The front portion 603 of the elastomer element 602 contacts the rear surface 619 of the striking face 618. As illustrated in FIGS. 6C and 6E, the striking face 618 includes a supported region 642, the portion of the rear surface 619 supported by the elastomer element 602, which is defined as the area inside the supported region perimeter 640 defined by the outer extent of the front portion 603 of the elastomer element 602 in contact with the rear surface 619 of the striking face 618. The supported region 642 is illustrated with hatching in FIG. 6E. The supported region 642 wouldn't normally be visible from the front of the golf club head 600 but was added for illustrative purposes.

The striking face 618 includes a striking face area 652, which is defined as the area inside the striking face perimeter 650 as illustrated in FIG. 6D. As illustrated in FIG. 6C, the striking face perimeter is delineated by an upper limit 654 and a lower limit 656. The upper limit 654 is located at the intersection of the substantially flat rear surface 619 and the upper radius 655 which extends to the top line of the golf club head 600. The lower limit 656 is located at the intersection of the substantially flat rear surface 619 and the lower radius 657 which extends to the sole 605 of the golf club head 600. The striking face perimeter is similarly delineated 658 (as illustrated in FIG. 6D) at the toe of the golf club head 600 (not illustrated in cross section). The heel portion of the striking face perimeter is defined by a plane 659 extending parallel to the y-axis and the x-axis offset 1 millimeter (mm) towards the heel from the heel-most extent of the scorelines 660 formed in the striking face 618. The striking face area 652 is illustrated with hatching in FIG. 6D. The limits 654, 656 of the striking face perimeter have been projected onto the striking face 618 in FIG. 6D for ease of illustration and understanding.

A plurality of golf club heads much like golf club head 600 described herein can be included in a set, each golf club head having a different loft α. Each golf club head can also have additional varying characteristics which may include, for example, MOI-Y, Striking Face Area, Area of Supported Region, and the Unsupported Face Percentage. The Unsupported Face Percentage is calculated by dividing the Area of Supported Region by the Striking Face Area and multiplying by 100% and subtracting it from 100%. An example of one set of iron type golf club heads is included in Table 5 below. The set in Table 5 includes the following lofts: 21, 24, 27, and 30. Other sets may include a greater number of golf club heads and/or a wider range of loft α values, or a smaller number of golf club heads and/or a smaller range of loft α values. Additionally, a set may include one or more golf club heads which include an elastomer element and one or more golf club heads which do not include an elastomer element.

TABLE 5

| Loft of Iron (Degrees) | MOI-Y (kg*mm$^2$) | Striking Face Area (mm$^2$) | Area of Supported Region (mm$^2$) | Unsupported Face Percentage (%) |
|---|---|---|---|---|
| 21 | 270 | 2809 | 74 | 97.37 |
| 24 | 272 | 2790 | 74 | 97.35 |
| 27 | 276 | 2777 | 74 | 97.34 |
| 30 | 278 | 2742 | 74 | 97.30 |

An example of an additional embodiment of set of iron type golf club heads is included in Table 6 below.

TABLE 6

| Loft of Iron (Degrees) | MOI-Y (kg* mm$^2$) | Striking Face Area (mm$^2$) | Area of Supported Region (mm$^2$) | Unsupported Face Percentage (%) |
|---|---|---|---|---|
| 21 | 272 | 2897 | 74 | 97.45 |
| 24 | 278 | 2890 | 74 | 97.44 |
| 27 | 289 | 2878 | 74 | 97.43 |
| 30 | 294 | 2803 | 74 | 97.36 |

If all other characteristics are held constant, a larger the MOI-Y value increases the ball speed of off-center hits. For clubs with a smaller MOI-Y, the decrease in off-center ball speed can be mitigated with a greater unsupported face percentage. By supporting a smaller percentage of the face, more of the face is able to flex during impact, increasing off-center ball speed. Thus, for the inventive golf club set described in Table 5 above, the MOI-Y increases through the set as loft α increases and the unsupported face percentage decreases through the set as loft α increases. This relationship creates consistent off-center ball speeds through a set of golf clubs.

A set of golf clubs can include a first golf club head with a loft greater than or equal to 20 degrees and less than or equal to 24 degrees and a second golf club head with a loft greater than or equal to 28 degrees and less than or equal to 32 degrees. In one embodiment, the set can be configured so that the first golf club head has a larger unsupported face percentage than the second golf club head and the first golf club head has a lower MOI-Y than the second golf club head.

More particular characteristics of embodiments described herein are described below. In some embodiments, the area of the supported region can be greater than 30 millimeters$^2$. In some embodiments, the area of the supported region can be greater than 40 millimeters$^2$. In some embodiments, the area of the supported region can be greater than 60 millimeters$^2$. In some embodiments, the area of the supported region can be greater than 65 millimeters$^2$. In some embodiments, the area of the supported region can be greater than 70 millimeters$^2$. In some embodiments, the area of the supported region can be greater than 73 millimeters$^2$.

In some embodiments, the area of the supported region can be less than 140 millimeters$^2$. In some embodiments, the area of the supported region can be less than 130 millimeters$^2$. In some embodiments, the area of the supported region can be less than 120 millimeters$^2$. In some embodiments, the area of the supported region can be less than 110 millimeters$^2$. In some embodiments, the area of the supported region can be less than 100 millimeters$^2$. In some embodiments, the area of the supported region can be less than 90 millimeters$^2$. In some embodiments, the area of the supported region can be less than 85 millimeters$^2$. In some embodiments, the area of the supported region can be less than 80 millimeters$^2$. In some embodiments, the area of the supported region can be less than 75 millimeters$^2$.

In some embodiments, the unsupported face percentage is greater than 70%. In some embodiments, the unsupported face percentage is greater than 75%. In some embodiments, the unsupported face percentage is greater than 80%. In some embodiments, the unsupported face percentage is greater than 85%. In some embodiments, the unsupported face percentage is greater than 90%. In some embodiments, the unsupported face percentage is greater than 95%. In some embodiments, the unsupported face percentage is greater than 96%. In some embodiments, the unsupported face percentage is greater than 97%.

In some embodiments, the unsupported face percentage is less than 99.75%. In some embodiments, the unsupported face percentage is less than 99.50%. In some embodiments, the unsupported face percentage is less than 99.25%. In some embodiments, the unsupported face percentage is less than 99.00%. In some embodiments, the unsupported face percentage is less than 98.75%. In some embodiments, the unsupported face percentage is less than 98.50%. In some embodiments, the unsupported face percentage is less than 98.25%. In some embodiments, the unsupported face percentage is less than 98.00%. In some embodiments, the unsupported face percentage is less than 97.75%. In some embodiments, the unsupported face percentage is less than 97.50%. In some embodiments, the unsupported face percentage is less than 97.25%. In some embodiments, the unsupported face percentage is less than 97.00%.

Figure 7A:
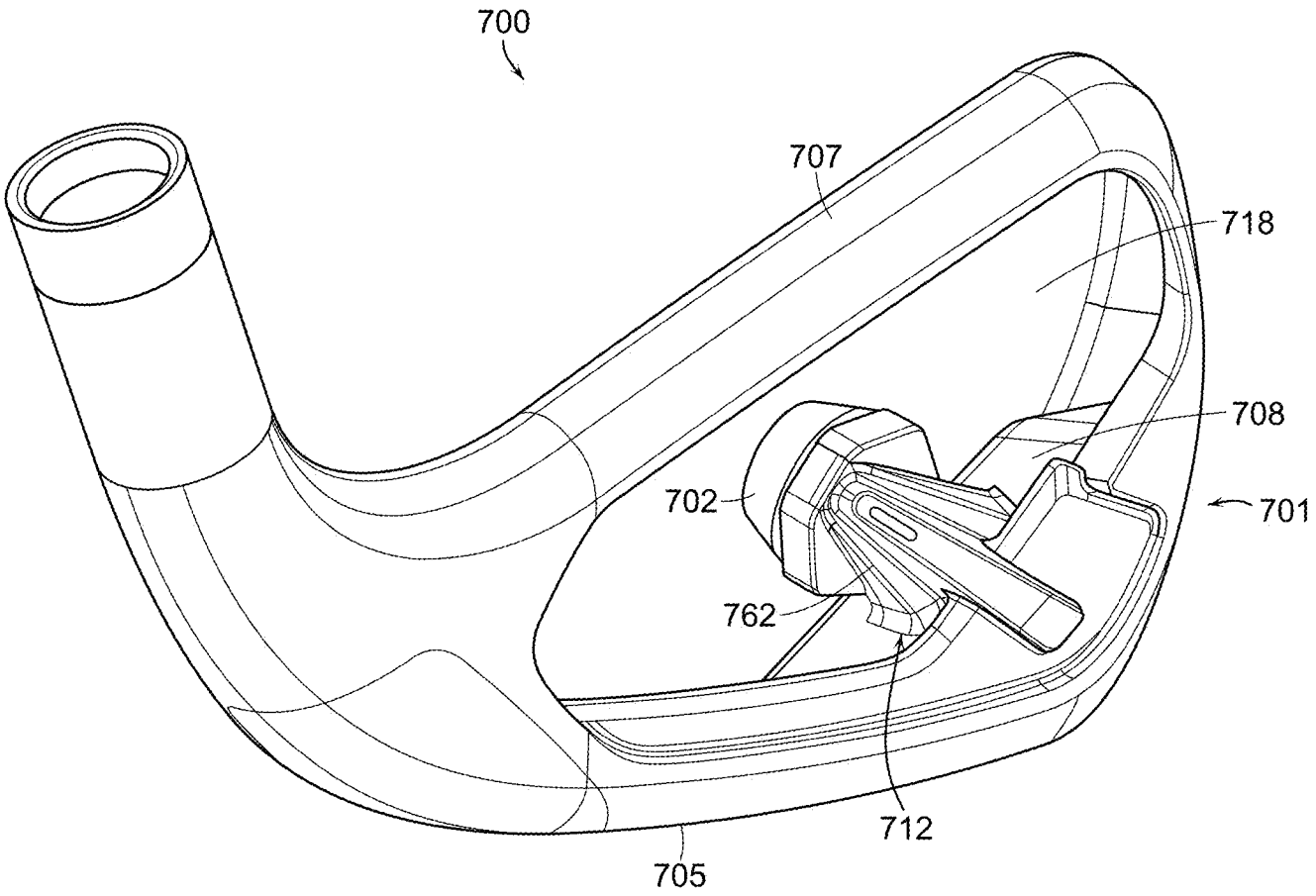
FIG. 7A depicts a perspective view of the golf club head.
Figure 7B:
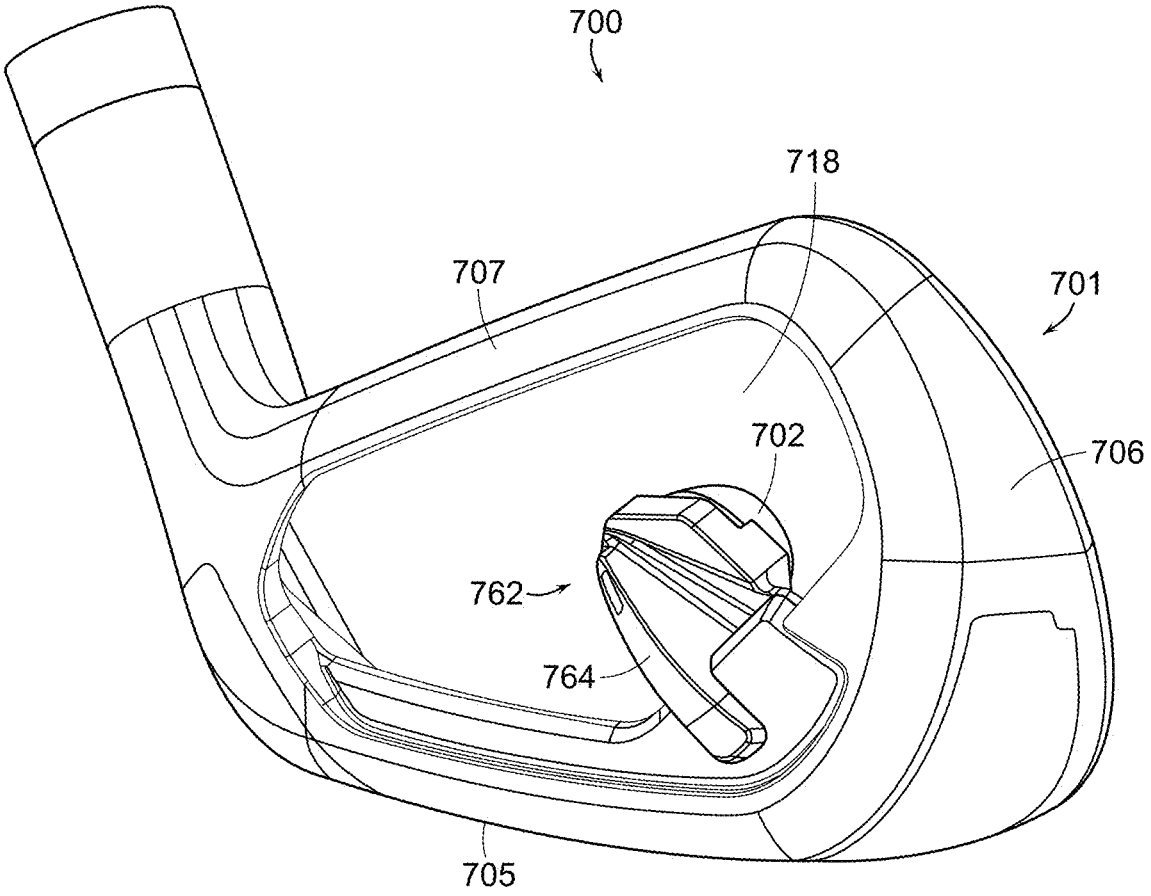
FIG. 7B depicts an additional perspective view of the golf club head of FIG. 7A.
Figure 7C:
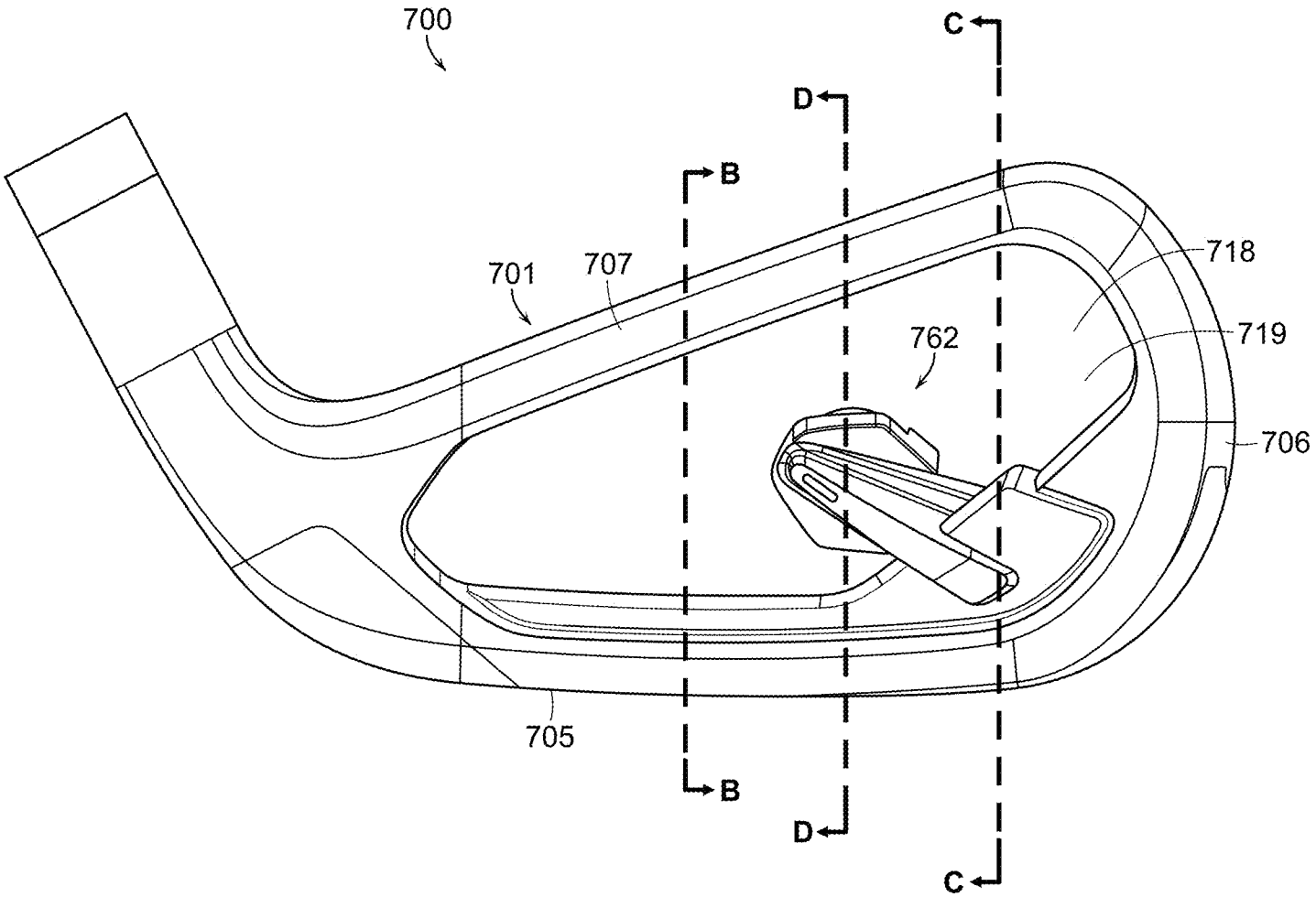
FIG. 7C depicts a rear view of the golf club head of FIG. 7A.
Figure 10:
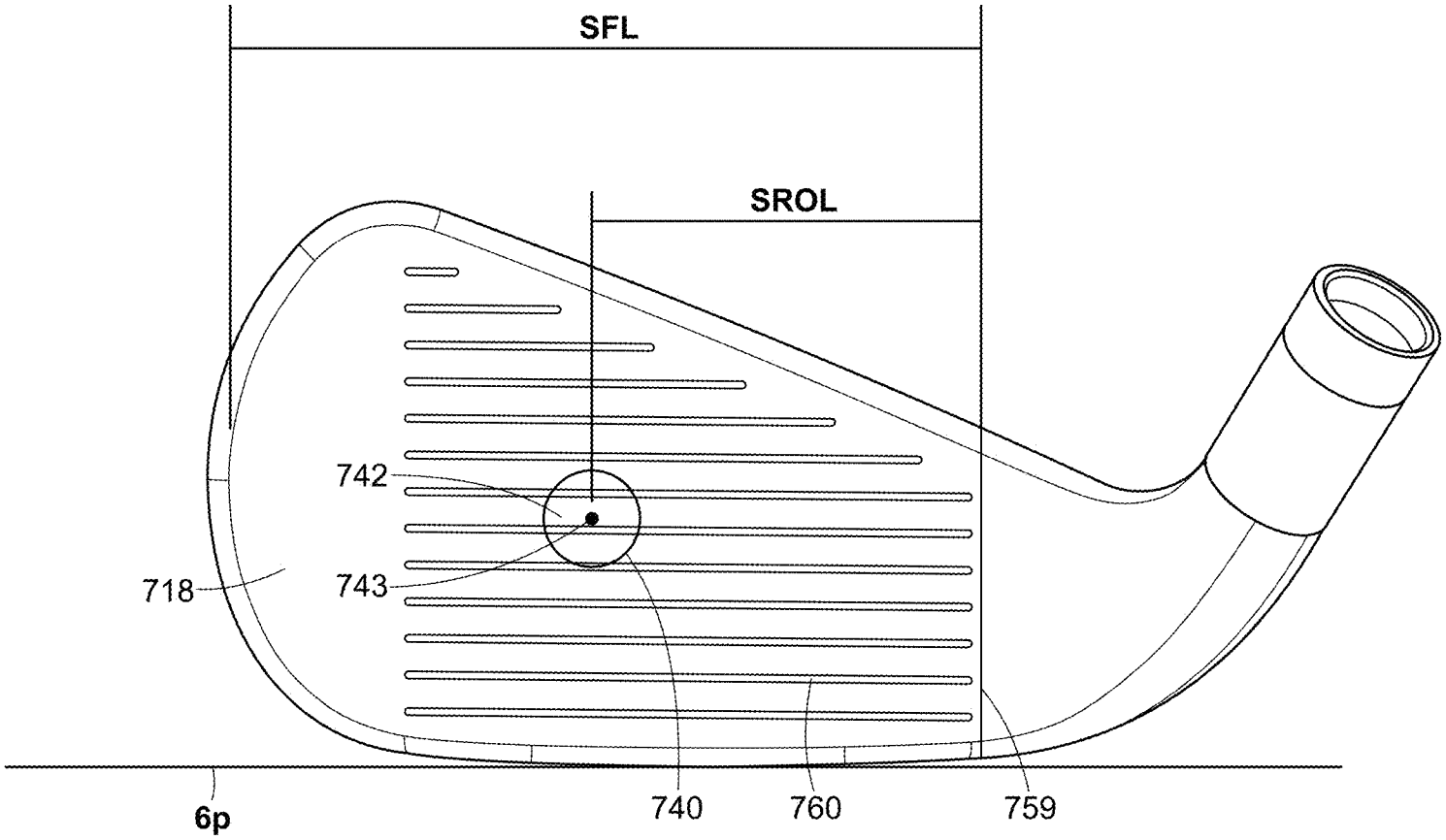
FIG. 10 depicts a perspective view of the golf club head of FIG. 7A oriented perpendicular to the striking face including the supported region.

FIGS. 7A-10 depict a golf club head 700 having an elastomer element 702. FIG. 7A depicts a perspective view of the golf club head 700. FIG. 7B depicts an additional perspective view of the golf club head 700 of FIG. 7A. FIG. 7C depicts a rear view of the golf club head 700 of FIG. 7A. FIG. 8A depicts a section view B-B of the golf club head 700 of FIG. 7C. FIG. 8B depicts a section view C-C of the golf club head 700 of FIG. 7C. FIG. 8C depicts a section view D-D of the golf club head 700 of FIG. 7C. FIG. 9A depicts an additional section view of the front of the golf club head 700 of FIG. 7A missing the striking face. FIG. 9B depicts the section view from FIG. 9A with the elastomer element removed. FIG. 10. Depicts a perspective view of the golf club head 700 of FIG. 7A oriented perpendicular to the striking face 718 including the supported region 742. Please note that the golf club head 700 illustrated in FIGS. 7A-10 is an iron-type cavity back golf club but the inventions described herein are applicable to other types of golf club heads as well.

The golf club head 700 includes a deformable member 702 disposed between the striking face 718 and the back portion 712. In one embodiment, the deformable member 702 is formed from an elastomer. The front portion 703 of the elastomer element 702 contacts the rear surface 719 of the striking face 718. The striking face 718 includes a supported region 742, the portion of the rear surface 719 supported by the elastomer element 702, which is defined as the area inside the supported region perimeter 740 defined by the outer extent of the front portion 703 of the elastomer element 702 in contact with the rear surface 719 of the striking face 718. The supported region 742 wouldn't normally be visible from the front of the golf club head 700 but was added in FIG. 10 for illustrative purposes.

The golf club head 700 illustrated in FIGS. 7A-10 is a cavity back construction and includes a periphery portion 701 surrounding and extending rearward from the striking face 718. The periphery portion 701 includes the sole 705, the toe 706, and the topline 707. The periphery portion 701 can also include a weight member 710. The golf club head 700 also includes a back portion 712 configured to support the elastomer element 702.

The back portion 712 includes a cantilever support arm 762 affixed to the periphery portion 701. The support arm 762 can include a cradle 708 configured to hold the elastomer element 702 in place. The cradle 708 can include a lip 709 configured to locate the elastomer element 702 on the cradle 708 and relative to the striking face 718. The lip 709 can surround a portion of the elastomer element 702. Additionally, an adhesive can be used between the elastomer element 702 and the cradle 708 to secure the elastomer element 702 to the cradle 708.

The support arm 762 extends from the weight member 710 located at the intersection of the sole 705 and the toe 706 of the periphery portion 701 towards the supported region 742. The support arm 762 is oriented substantially parallel to the rear surface 719 of the striking face 718. The support arm 762 can include a rib 764 to increase the stiffness of the support arm 762. The rib 764 can extend rearwards from the support arm 762 substantially perpendicularly to the rear surface 719 of the striking face 718. One benefit of a cantilever support arm 762 is it provides a lower CG height than an alternative beam design, such as the embodiment illustrated in FIG. 4A, which supported at both ends by the periphery portion.

In order to provide a low CG height the support arm 762 is cantilevered which means it is only affixed to the periphery portion 701 at one end of the support arm 762. The support arm is designed such that the distance H between the highest portion of the support arm 762 and the ground plane GP when the golf club head 700 is in an address position, as illustrated in FIG. 8C, is minimized, while locating the elastomer element 702 in the optimal position. In one embodiment, H is less than or equal to 50 mm. In an additional embodiment, H is less than 45 mm. In an additional embodiment, H is less than or equal to 40 mm. In an additional embodiment, H is less than or equal to 35 mm. In an additional embodiment, H is less than or equal to 30 mm. In an additional embodiment, H is less than or equal to 29 mm. In an additional embodiment, H is less than or equal to 28 mm.

In one embodiment, the golf club head 700 can have a CG height CGH of less than or equal to 25 mm. In an additional embodiment, the golf club head 700 can have a CG height CGH of less than or equal to 24 mm. In an additional embodiment, the golf club head 700 can have a CG height CGH of less than or equal to 23 mm. In an additional embodiment, the golf club head 700 can have a CG height CGH of less than or equal to 22 mm. In an additional embodiment, the golf club head 700 can have a CG height CGH of less than or equal to 21 mm. In an additional embodiment, the golf club head 700 can have a CG height CGH of less than or equal to 20 mm. In an additional embodiment, the golf club head 700 can have a CG height CGH of less than or equal to 19 mm. In an additional embodiment, the golf club head 700 can have a CG height CGH of less than or equal to 18 mm.

Another advantage to the illustrated support arm 762 is it provides a high MOI-Y due to its orientation. By concentrating mass at the heel end and toe end of the golf club head 700 the MOI-Y can be increased. The support arm 762 is angled to concentrate much of its mass near the toe 706, increasing MOI-Y compared with a back portion located more centrally on the golf club head 700. In one embodiment, the MOI-Y of the golf club head 700 is greater than or equal to 200 kg-mm$^2$. In an additional embodiment, the MOI-Y of the golf club head 700 is greater than or equal to 210 kg-mm$^2$. In an additional embodiment, the MOI-Y of the golf club head 700 is greater than or equal to 220 kg-mm$^2$. In an additional embodiment, the MOI-Y of the golf club head 700 is greater than or equal to 230 kg-mm$^2$. In an additional embodiment, the MOI-Y of the golf club head 700 is greater than or equal to 240 kg-mm$^2$. In an additional embodiment, the MOI-Y of the golf club head 700 is greater than or equal to 250 kg-mm$^2$. In an additional embodiment, the MOI-Y of the golf club head 700 is greater than or equal to 260 kg-mm$^2$. In an additional embodiment, the MOI-Y of the golf club head 700 is greater than or equal to 270 kg-mm$^2$.

Figure 8A:
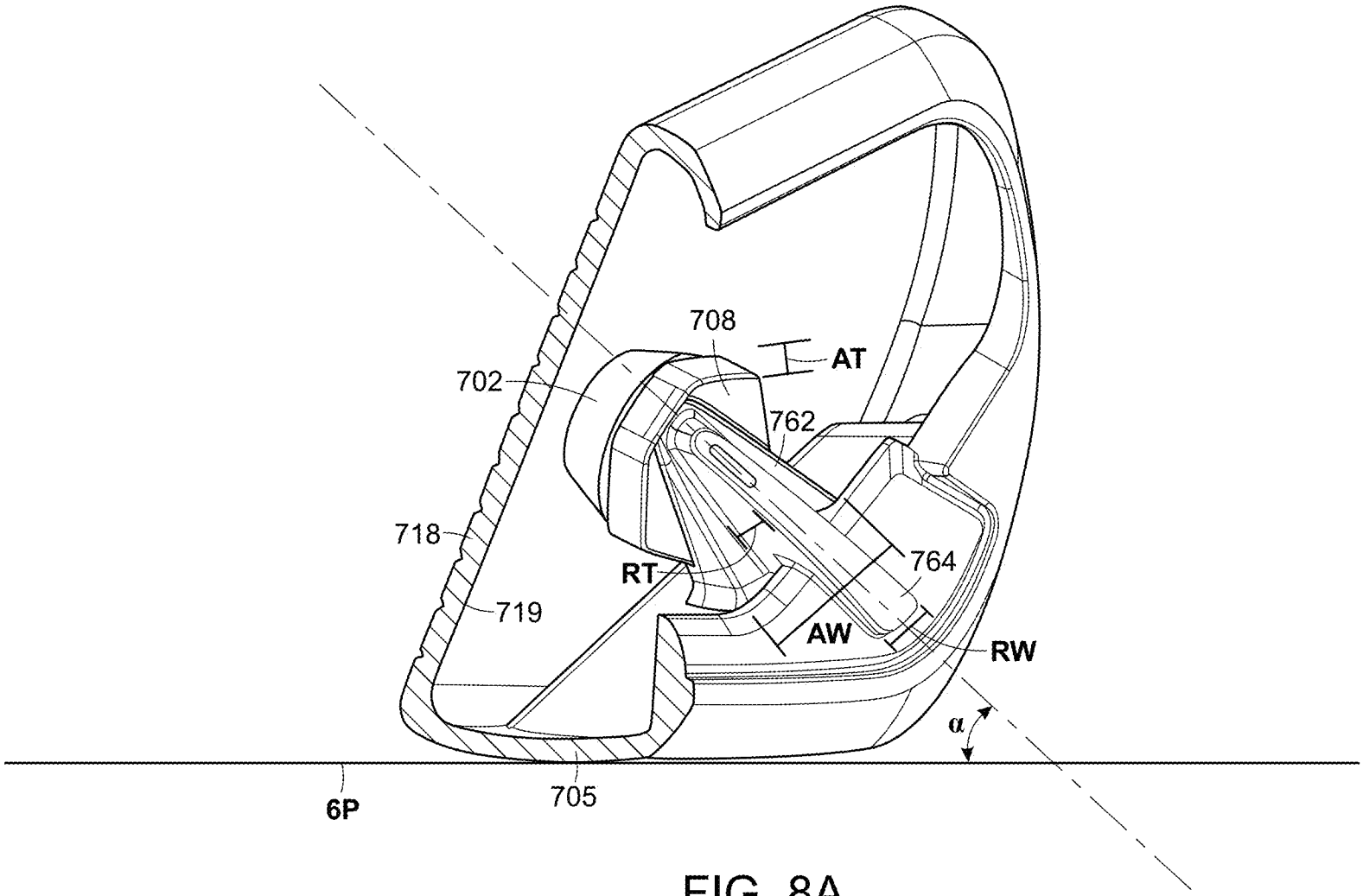
FIG. 8A depicts a section view B-B of the golf club head of FIG. 7C.
Figure 8C:
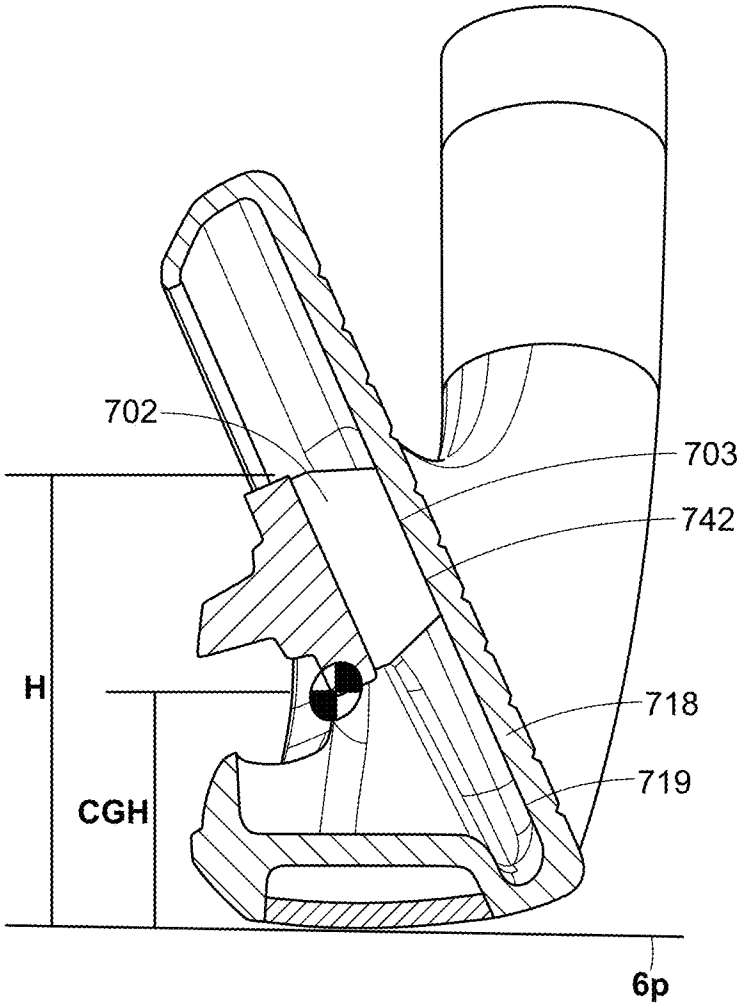
FIG. 8C depicts a section view D-D of the golf club head of FIG. 7C.
Figure 8B:
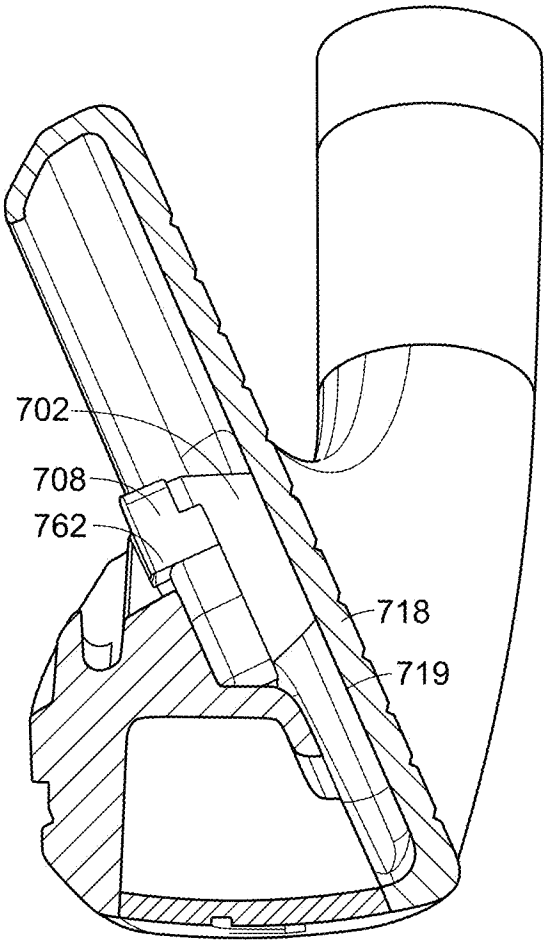
FIG. 8B depicts a section view C-C of the golf club head of FIG. 7C.
Figure 9A:
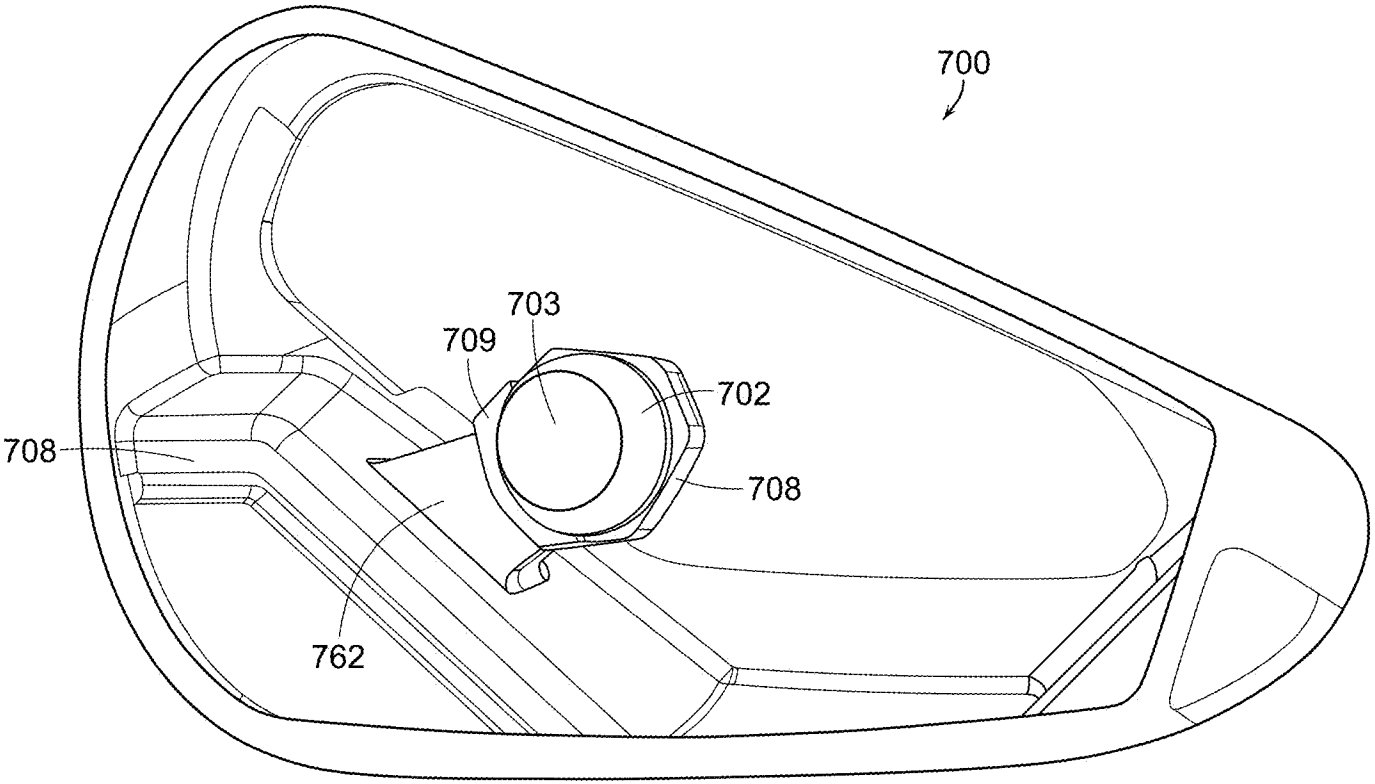
FIG. 9A depicts an additional section view of the front of the golf club head of FIG. 7A missing the striking face.
Figure 9B:
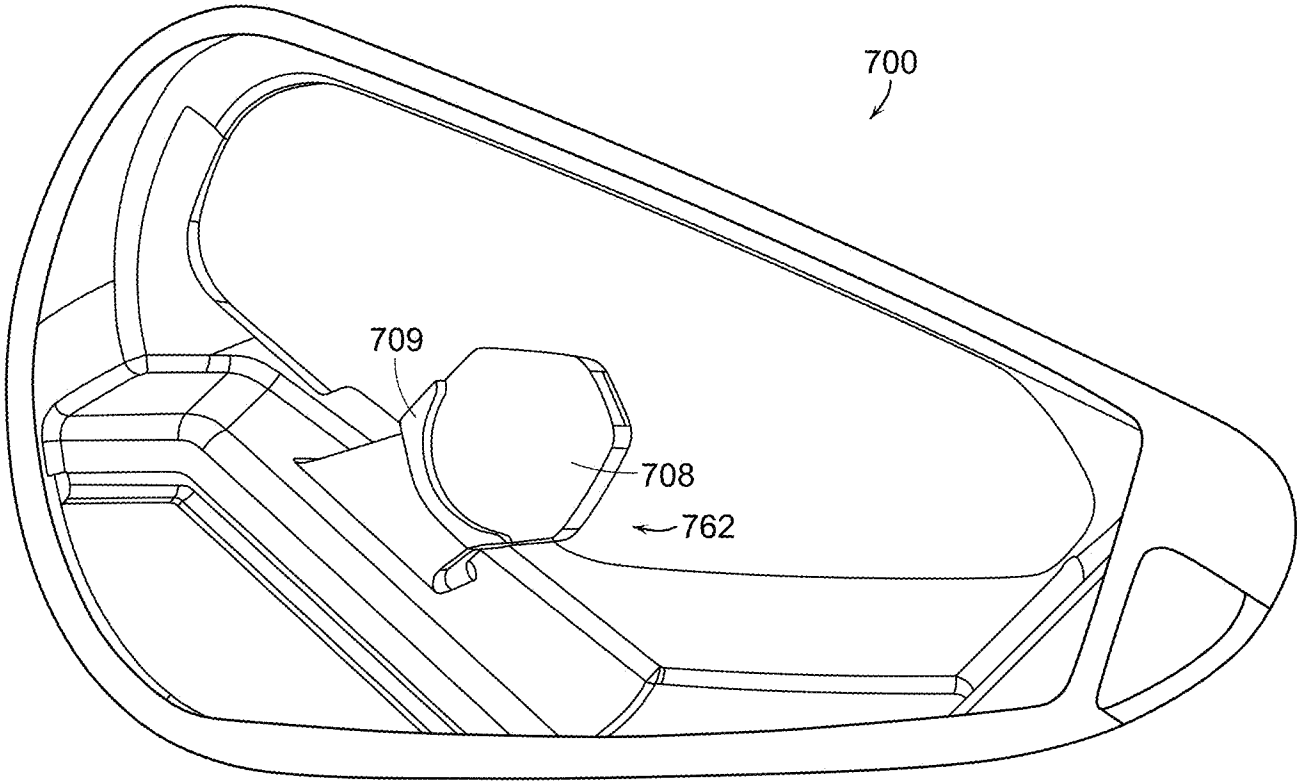
FIG. 9B depicts the section view from FIG. 9A with the deformable member removed.

The support arm 762 can include an arm centerline CL, as illustrated in FIG. 8A, which is oriented parallel to the rear surface 719 of the striking face 718 and extends along the center of the support arm 762 from the periphery portion 701 towards the supported region 742. The angle $\alpha$ is measured between the ground plane GP and the centerline CL. In one embodiment, the angle $\alpha$ is greater than or equal to 5 degrees and less than or equal to 45 degrees. In an additional embodiment, the angle $\alpha$ is greater than or equal to 10 degrees and less than or equal to 40 degrees. In an additional embodiment, the angle $\alpha$ is greater than or equal to 15 degrees and less than or equal to 35 degrees. In an additional embodiment, the angle $\alpha$ is greater than or equal to 20 degrees and less than or equal to 30 degrees. In an additional embodiment, the angle $\alpha$ is greater than or equal to 23 degrees and less than or equal to 28 degrees.

The support arm 762 can have an arm width AW measured perpendicularly to the arm centerline CL and parallel to the rear surface 719 of the striking face 718. The arm width AW can vary along the length of the support arm 762. In one embodiment the arm width of at least one portion of the support arm is greater than or equal to 6 mm. In an additional embodiment the arm width of at least one portion of the support arm is greater than or equal to 8 mm. In an additional embodiment the arm width of at least one portion of the support arm is greater than or equal to 10 mm.

The support arm 762 can have an arm thickness AT measured perpendicular to the rear surface 719 of the striking face 718. The arm thickness AT can vary along the length of the support arm 762. In one embodiment the arm thickness AT of at least one portion of the support arm is greater than or equal to 2 mm. In an additional embodiment the arm thickness AT of at least one portion of the support arm is greater than or equal to 3 mm. In an additional embodiment the arm thickness AT of at least one portion of the support arm is greater than or equal to 4 mm. In an additional embodiment the arm thickness AT of at least one portion of the support arm is greater than or equal to 5 mm. In an additional embodiment the arm thickness AT of at least one portion of the support arm is greater than or equal to 6 mm.

The rib 764 of the support arm 762 can have a rib width RW measured perpendicularly to the arm centerline CL and parallel to the rear surface 719 of the striking face 718. The rib width RW can vary along the length of the rib. In one embodiment, the rib width RW of at least a portion of the rib is greater than or equal to 1 mm. In an additional embodiment, the rib width RW of at least a portion of the rib is greater than or equal to 2 mm. In an additional embodiment, the rib width RW of at least a portion of the rib is greater than or equal to 3 mm. In an additional embodiment, the rib width RW of at least a portion of the rib is greater than or equal to 4 mm.

The rib 764 of the support arm 762 can have a rib thickness RT measured perpendicular to the rear surface 719 of the striking face 718. The rib thickness RT can vary along the length of the rib. In one embodiment, the rib thickness RT of at least a portion of the rib is greater than or equal to 2 mm. In an additional embodiment, the rib thickness RT of at least a portion of the rib is greater than or equal to 3 mm. In an additional embodiment, the rib thickness RT of at least a portion of the rib is greater than or equal to 4 mm. In an additional embodiment, the rib thickness RT of at least a portion of the rib is greater than or equal to 5 mm. In an additional embodiment, the rib thickness RT of at least a portion of the rib is greater than or equal to 6 mm.

The supported region 742, as illustrated in FIG. 10, is specifically located on the rear surface 719 of the striking face 718. The striking face heel reference plane 759 extends parallel to the y-axis and the z-axis and is offset 1 mm towards the heel from the heel-most extent of the scorelines 760 formed in the striking face 718. The geometric center 743 of the supported region 742 is located a supported region offset length SROL toeward from the striking face heel reference plane 759 measured parallel to the ground plane GP and parallel to the striking face 718 with the golf club head 700 in an address position. In one embodiment, the supported region offset length SROL is greater than or equal to 20 mm. In an additional embodiment, the supported region offset length SROL is greater than or equal to 22 mm. In an additional embodiment, the supported region offset length SROL is greater than or equal to 24 mm. In an additional embodiment, the supported region offset length SROL is greater than or equal to 26 mm. In an additional embodiment, the supported region offset length SROL is greater than or equal to 27 mm. In an additional embodiment, the supported region offset length SROL is greater than or equal to 28 mm.

The striking face length SFL is measured from the striking face heel reference plane 759 to the toe-most extent of the striking face 718, measured parallel to the ground plane GP and parallel to the striking face 718 with the golf club head 700 in an address position. In one embodiment, the striking face length SFL is greater than or equal to 60 mm. In an additional embodiment, the striking face length SFL is greater than or equal to 65 mm. In an additional embodiment, the striking face length SFL is greater than or equal to 70 mm. In an additional embodiment, the striking face length SFL is greater than or equal to 71 mm. In an additional embodiment, the striking face length SFL is greater than or equal to 72 mm. In an additional embodiment, the striking face length SFL is greater than or equal to 73 mm. In an additional embodiment, the striking face length SFL is greater than or equal to 74 mm.

In one embodiment, the supported region offset ratio, defined as the supported region offset length SROL divided by the striking face length SFL multiplied by 100%, is greater than or equal to 40%. In an additional embodiment, the supported region offset ratio is greater than or equal to 41%. In an additional embodiment, the supported region offset ratio is greater than or equal to 42%. In an additional embodiment, the supported region offset ratio is greater than or equal to 43%. In an additional embodiment, the supported region offset ratio is greater than or equal to 44%. In an additional embodiment, the supported region offset ratio is greater than or equal to 45%. In an additional embodiment, the supported region offset ratio is greater than or equal to 46%. In an additional embodiment, the supported region offset ratio is greater than or equal to 47%. In an additional embodiment, the supported region offset ratio is greater than or equal to 48%. In an additional embodiment, the supported region offset ratio is greater than or equal to 49%. In an additional embodiment, the supported region offset ratio is greater than or equal to 50%. In an additional embodiment, the supported region offset ratio is greater than or equal to 51%.

An additional benefit of incorporating a supported region 742 is the ability to utilize a thin striking face. In the illustrated embodiments, the striking face 718 has a constant thickness. In other embodiments, the striking face may have a variable thickness. In one embodiment, the thickness of the striking face is less than or equal to 2.5 mm. In an additional embodiment, the thickness of the striking face is less than or equal to 2.4 mm. In an additional embodiment, the thickness of the striking face is less than or equal to 2.3 mm. In an additional embodiment, the thickness of the striking face is less than or equal to 2.2 mm. In an additional embodiment, the thickness of the striking face is less than or equal to 2.1 mm. In an additional embodiment, the thickness of the striking face is less than or equal to 2.0 mm. In an additional embodiment, the thickness of the striking face is less than or equal to 1.9 mm. In an additional embodiment, the thickness of the striking face is less than or equal to 1.8 mm. In an additional embodiment, the thickness of the striking face is less than or equal to 1.7 mm. In an additional embodiment, the thickness of the striking face is less than or equal to 1.6 mm. In an additional embodiment, the thickness of the striking face is less than or equal to 1.5 mm. In an additional embodiment, the thickness of the striking face is less than or equal to 1.4 mm.

Figure 11B:
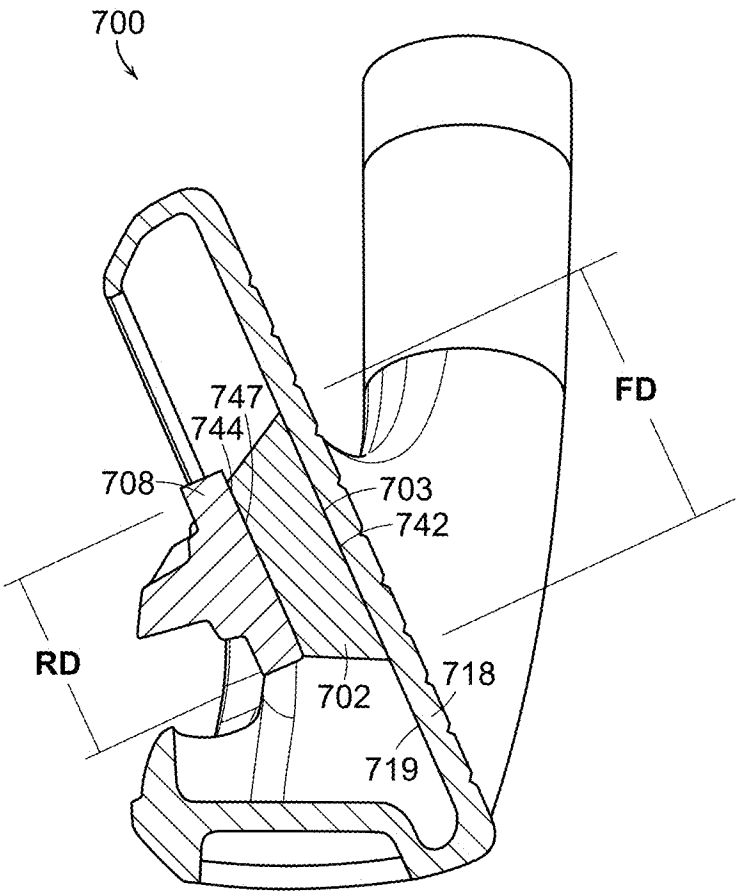
FIG. 11B depicts a cross sectional view of the golf club head of FIG. 7C including an additional embodiment of an elastomer element.
Figure 11A:
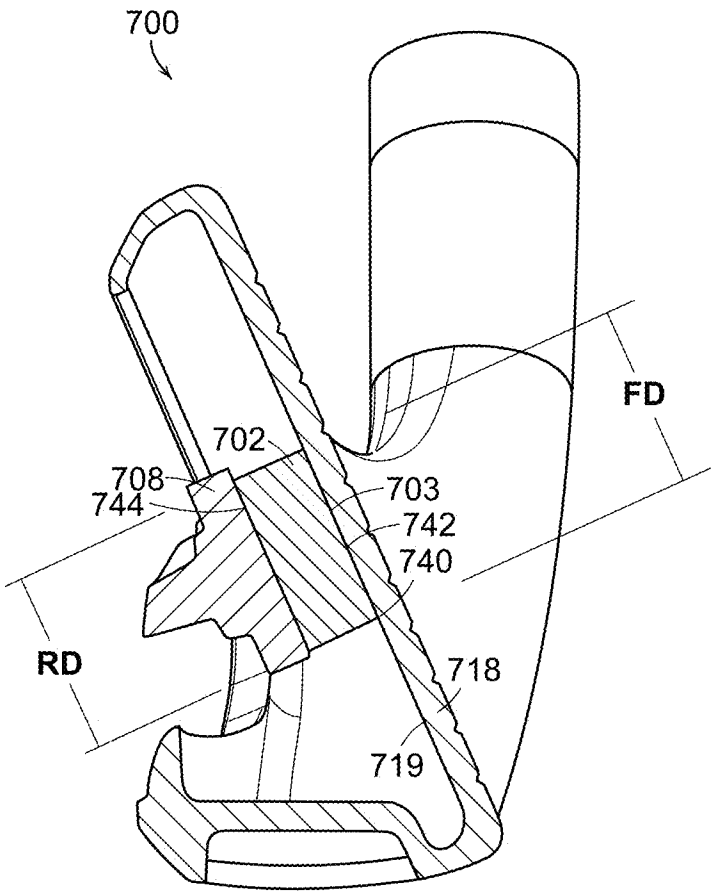
FIG. 11A depicts a cross sectional view of the golf club head of FIG. 7C including an additional embodiment of an elastomer element.

FIGS. 11A-11D depict the golf club head 700 of FIG. 7A having additional embodiments of an elastomer element 702. FIG. 11A illustrates a cross sectional view of the golf club head 700 including an additional embodiment of an elastomer element 702. The elastomer element 702 of FIG. 11A is circular similar to the embodiment illustrated in FIG. 7A. The front portion 703 of the elastomer element 702, which abuts the rear surface 719 of the striking face 718, has a front diameter FD and the rear portion 744, which abuts the cradle 708, has a rear diameter RD. The front diameter FD is substantially similar or equal to the rear diameter RD of the elastomer element 702 illustrated in FIG. 11A.

FIG. 11B illustrates a cross sectional view of the golf club head 700 including an additional embodiment of an elastomer element 702. The elastomer element 702 of FIG. 11B is circular. The front diameter FD is greater than rear diameter RD of the elastomer element 702 illustrated in FIG. 11B. The rear portion 744 of the elastomer element 702 in contact with the cradle 708 has a rear support region 747, which has an area.

Figure 11D:
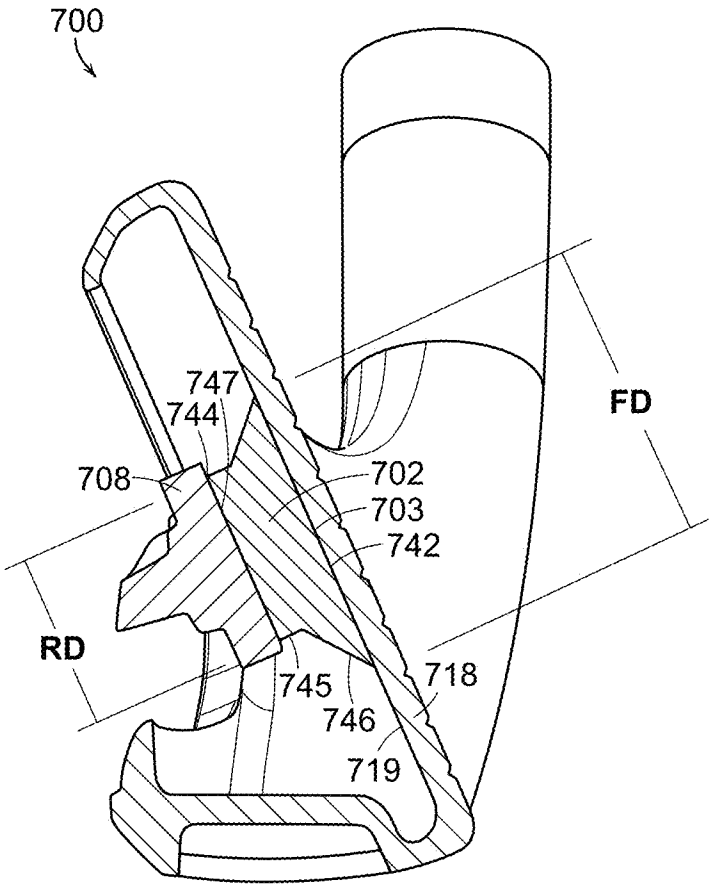
FIG. 11D depicts a cross sectional view of the golf club head of FIG. 7C including an additional embodiment of an elastomer element.
Figure 11C:
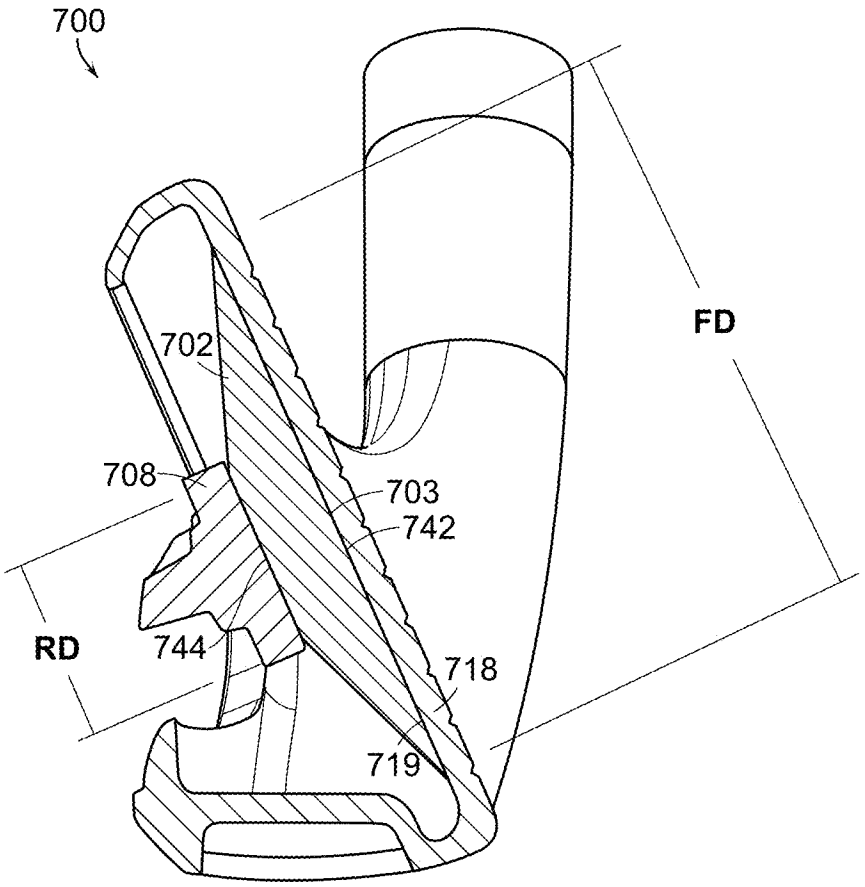
FIG. 11C depicts a cross sectional view of the golf club head of FIG. 7C including an additional embodiment of an elastomer element.

FIG. 11C illustrates a cross sectional view of the golf club head 700 including an additional embodiment of an elastomer element 702. The elastomer element 702 of FIG. 11C is circular. The front diameter FD is greater than rear diameter RD of the elastomer element 702 illustrated in FIG. 11C.

FIG. 11D illustrates a cross sectional view of the golf club head 700 including an additional embodiment of an elastomer element 702. The elastomer element 702 of FIG. 11D is circular. The front diameter FD is greater than rear diameter RD of the elastomer element 702 illustrated in FIG. 11D. Additionally, the rear portion 744 has a constant diameter region 745 aft of the tapered region 746 extending towards the striking face 718. In one embodiment, the rear diameter RD is approximately 12.5 mm and the front diameter FD is approximately 18.5 mm.

The enlarged front portion 703 and thus enlarged supported region 742 offered by the embodiments of the elastomer elements 702 illustrated in FIGS. 11B, 11C, and 11D offer advantages. These advantages include more consistent off-center ball speeds, reduced sound energy, particularly above 3800 Hz.

In one embodiment, the area of the supported region can be greater than 75 millimeters$^2$. In an additional embodiment, the area of the supported region can be greater than 100 millimeters$^2$. In an additional embodiment, the area of the supported region can be greater than 125 millimeters$^2$. In an additional embodiment, the area of the supported region can be greater than 150 millimeters$^2$. In an additional embodiment, the area of the supported region can be greater than 175 millimeters$^2$. In an additional embodiment, the area of the supported region can be greater than 200 millimeters$^2$. In an additional embodiment, the area of the supported region can be greater than 225 millimeters$^2$. In an additional embodiment, the area of the supported region can be greater than 250 millimeters$^2$. In an additional embodiment, the area of the supported region can be greater than 255 millimeters$^2$. In an additional embodiment, the area of the supported region can be greater than 260 millimeters$^2$. In an additional embodiment, the area of the supported region can be greater than 50 millimeters$^2$ and less than 1000 millimeters$^2$. In an additional embodiment, the area of the supported region can be greater than 100 millimeters$^2$ and less than 1000 millimeters$^2$. In an additional embodiment, the area of the supported region can be greater than 150 millimeters$^2$ and less than 1000 millimeters$^2$. In an additional embodiment, the area of the supported region can be greater than 200 millimeters$^2$ and less than 1000 millimeters$^2$. In an additional embodiment, the area of the supported region can be greater than 250 millimeters$^2$ and less than 1000 millimeters$^2$.

In one embodiment, the ratio of the front diameter FD divided by the rear diameter RD is greater than 1.2. In an additional embodiment, the ratio of the front diameter FD divided by the rear diameter RD is greater than 1.4. In an additional embodiment, the ratio of the front diameter FD divided by the rear diameter RD is greater than 1.6. In an additional embodiment, the ratio of the front diameter FD divided by the rear diameter RD is greater than 1.8. In an additional embodiment, the ratio of the front diameter FD divided by the rear diameter RD is greater than 2.0. In an additional embodiment, the ratio of the front diameter FD divided by the rear diameter RD is greater than 3.0. In an additional embodiment, the ratio of the front diameter FD divided by the rear diameter RD is greater than 4.0.

In one embodiment, the area of the supported region 742 is greater than the area of the rear support region 747. In one embodiment, the ratio of the supported region 742 divided by the area of the rear supported region 747 is greater than 1.2. In an additional embodiment, the ratio of the supported region 742 divided by the area of the rear supported region 747 is greater than 1.4. In an additional embodiment, the ratio of the supported region 742 divided by the area of the rear supported region 747 is greater than 1.6. In an additional embodiment, the ratio of the supported region 742 divided by the area of the rear supported region 747 is greater than 1.8. In an additional embodiment, the ratio of the supported region 742 divided by the area of the rear supported region 747 is greater than 2.0. In an additional embodiment, the ratio of the supported region 742 divided by the area of the rear supported region 747 is greater than 2.5. In an additional embodiment, the ratio of the supported region 742 divided by the area of the rear supported region 747 is greater than 3.0. In an additional embodiment, the ratio of the supported region 742 divided by the area of the rear supported region 747 is greater than 3.5. In an additional embodiment, the ratio of the supported region 742 divided by the area of the rear supported region 747 is greater than 4.0. In an additional embodiment, the ratio of the supported region 742 divided by the area of the rear supported region 747 is greater than 5.0. In an additional embodiment, the ratio of the supported region 742 divided by the area of the rear supported region 747 is greater than 6.0. In an additional embodiment, the ratio of the supported region 742 divided by the area of the rear supported region 747 is greater than 7.0. In an additional embodiment, the ratio of the supported region 742 divided by the area of the rear supported region 747 is greater than 8.0. In an additional embodiment, the ratio of the supported region 742 divided by the area of the rear supported region 747 is greater than 9.0. In an additional embodiment, the ratio of the supported region 742 divided by the area of the rear supported region 747 is greater than 10.0.

The contact energy absorption factor is defined as the ratio of the front diameter FD divided by the diameter of a golf ball, which is approximately 42.75 mm. In one embodiment, the contact energy absorption factor is greater than 0.1. In an additional embodiment, the contact energy absorption factor is greater than 0.2. In an additional embodiment, the contact energy absorption factor is greater than 0.3. In an additional embodiment, the contact energy absorption factor is greater than 0.4. In an additional embodiment, the contact energy absorption factor is greater than 0.5. In an additional embodiment, the contact energy absorption factor is greater than 0.6. In an additional embodiment, the contact energy absorption factor is greater than 0.7. In an additional embodiment, the contact energy absorption factor is greater than 0.8. In an additional embodiment, the contact energy absorption factor is greater than 0.9. In an additional embodiment, the contact energy absorption factor is greater than 1.0. In an additional embodiment, the contact energy absorption factor is less than 0.2. In an additional embodiment, the contact energy absorption factor is less than 0.3. In an additional embodiment, the contact energy absorption factor is less than 0.4. In an additional embodiment, the contact energy absorption factor is less than 0.5. In an additional embodiment, the contact energy absorption factor is less than 0.6. In an additional embodiment, the contact energy absorption factor is less than 0.7. In an additional embodiment, the contact energy absorption factor is less than 0.8. In an additional embodiment, the contact energy absorption factor is less than 0.9. In an additional embodiment, the contact energy absorption factor is less than 1.0.

In additional embodiments, the elastomer elements 702 may not be circular. They may have additional shapes which may include square, rectangular, octagonal, etc.

Figure 12A:
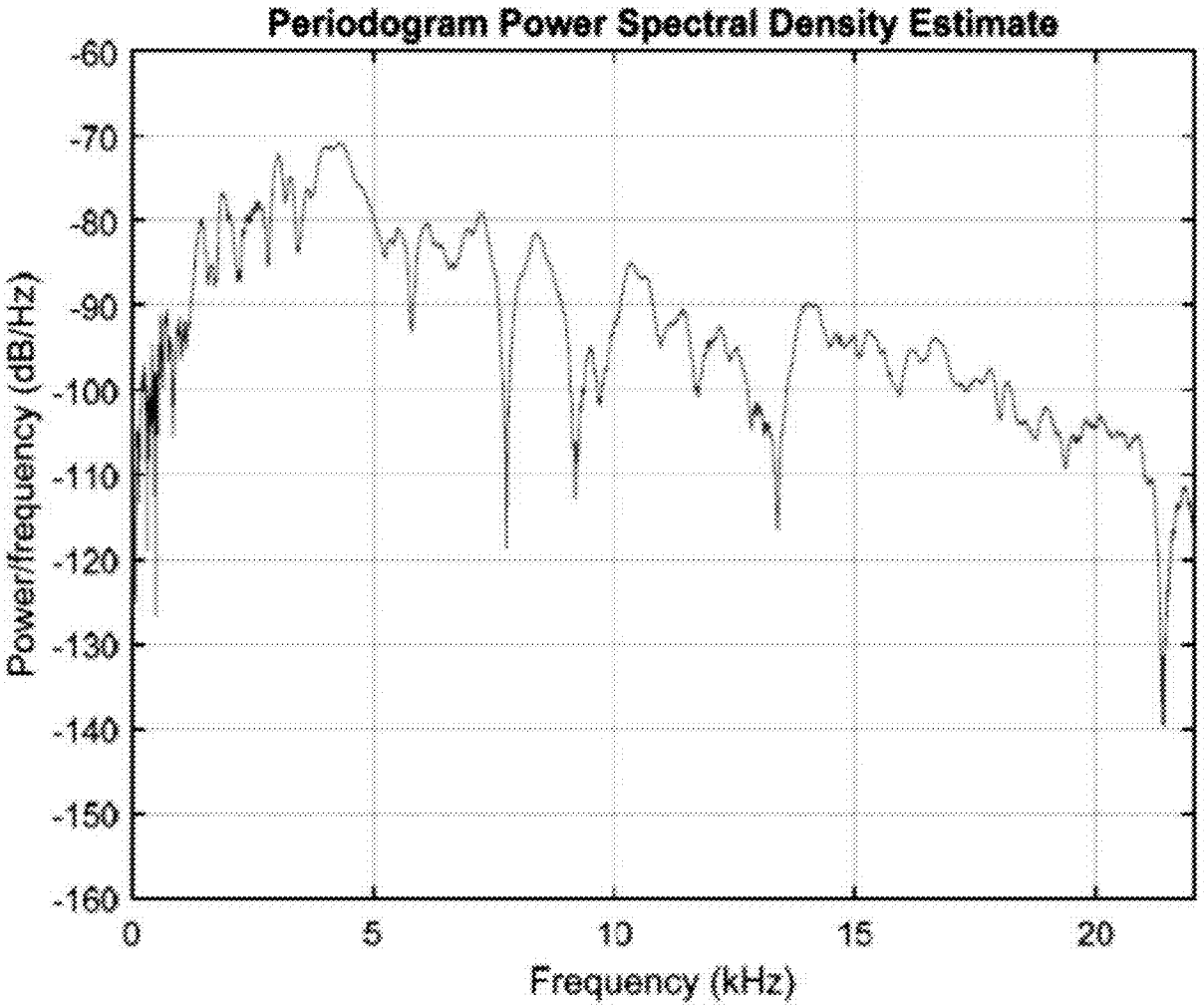
FIG. 12A depicts the periodogram power spectral density estimate of the golf club head depicted in FIG. 11A.
Figure 12B:
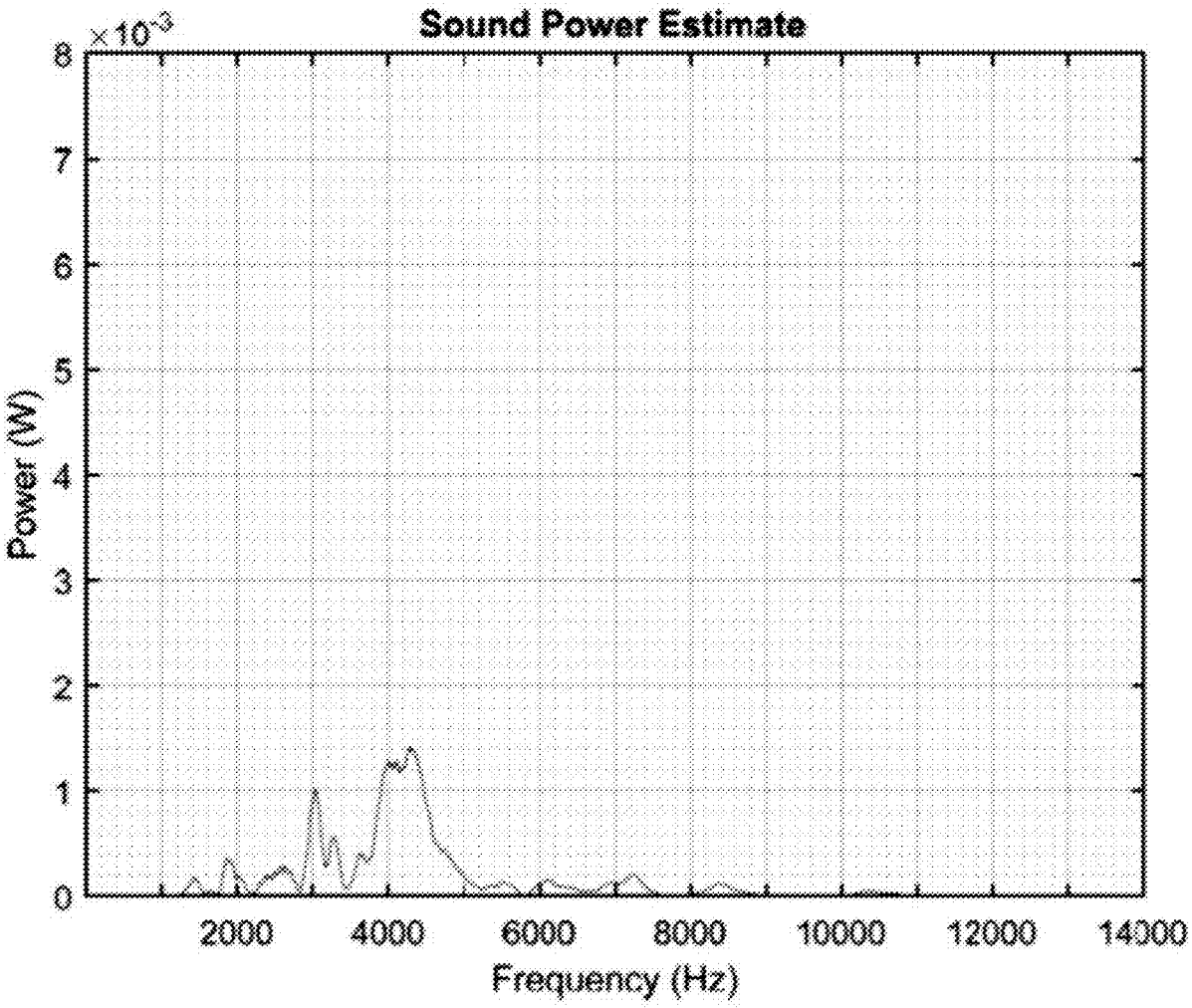
FIG. 12B depicts the sound power estimate of the golf club head depicted in FIG. 11A.
Figure 13A:
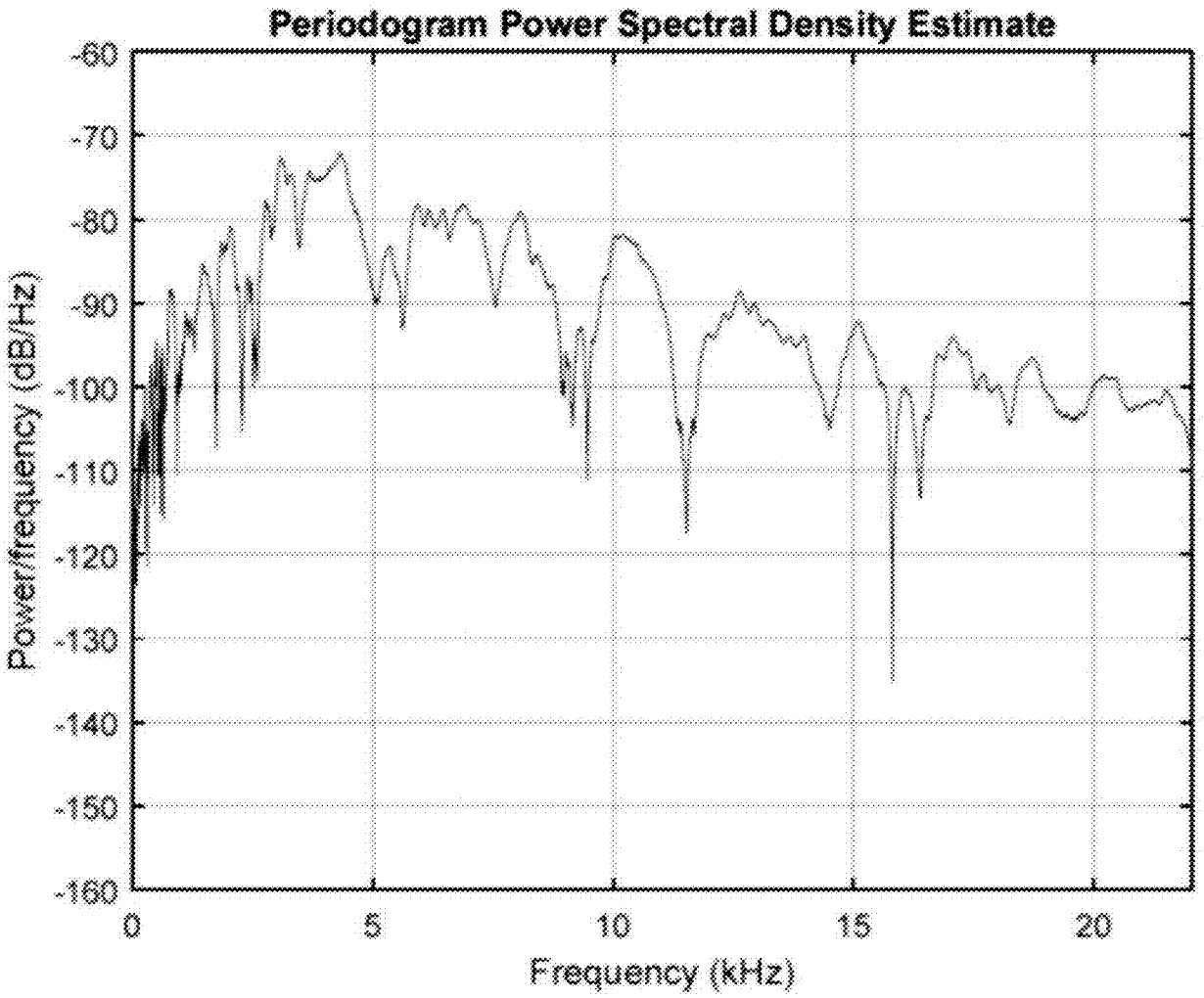
FIG. 13A depicts the periodogram power spectral density estimate of the golf club head depicted in FIG. 11D.
Figure 13B:
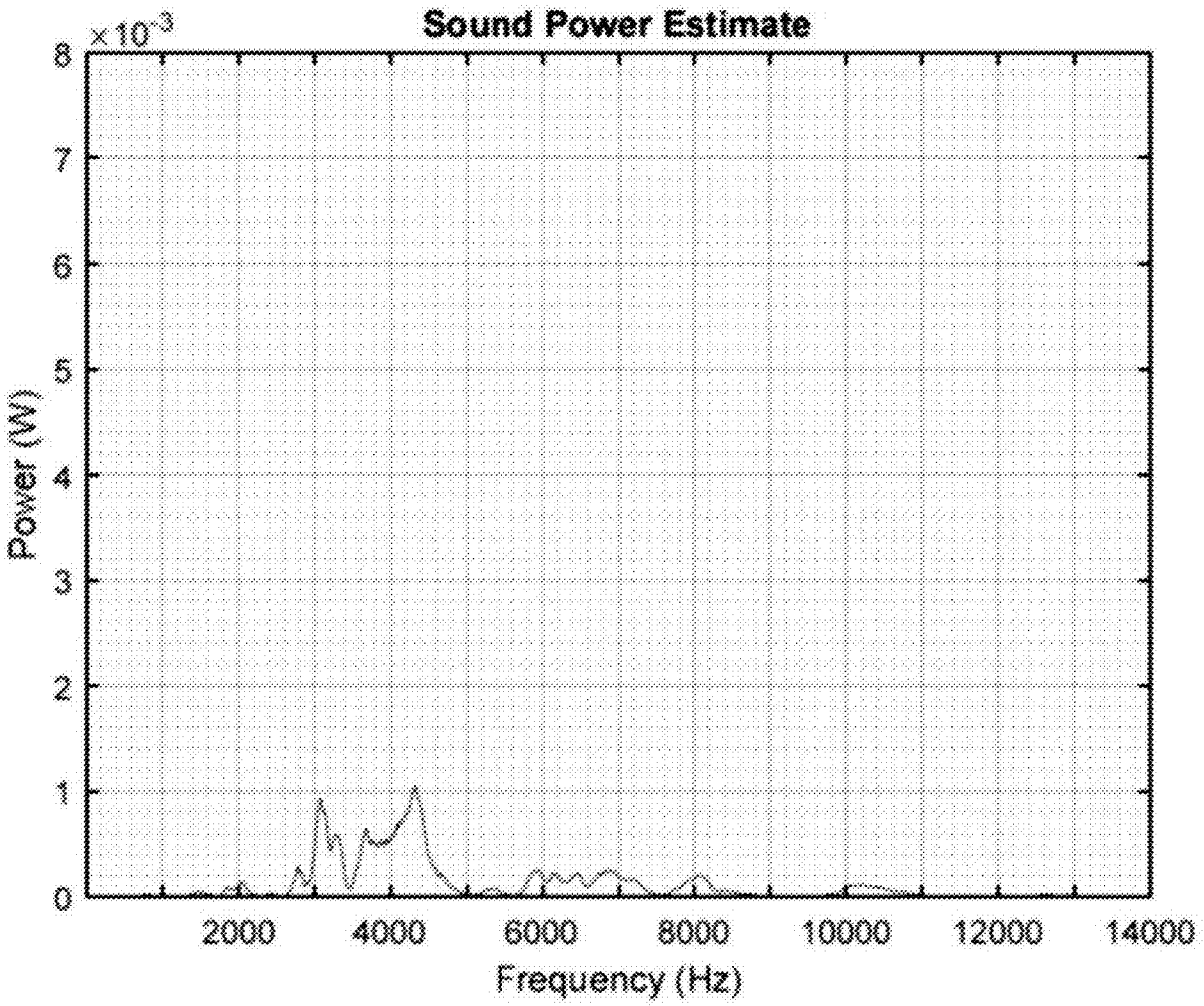
FIG. 13B depicts the sound power estimate of the golf club head depicted in FIG. 11D.

Identical golf club heads with different elastomer elements were subjected to acoustic testing to determine the effectiveness of different embodiments of elastomer elements. The testing was performed with each club head striking a Titleist ProV1 golf ball with a club head speed at impact of approximately 95 miles per hour. The acoustic qualities of the embodiments illustrated in FIGS. 11A and 11D were recorded when each golf club head struck a golf ball. FIGS. 12A and 12B reflect the recording of the golf club head utilizing the cylindrical elastomer element embodiment illustrated in FIG. 11A striking a golf ball and FIGS. 13A and 13B reflect the recording of the golf club head utilizing the tapered elastomer element embodiment illustrated in FIG. 11D striking a golf ball. FIG. 12A illustrates the periodogram power spectral density estimate of the FIG. 11A cylindrical embodiment. FIG. 12B illustrates the sound power estimate of the FIG. 11A cylindrical embodiment. FIG. 13A illustrates the periodogram power spectral density estimate of the FIG. 11D tapered embodiment. FIG. 13B illustrates the sound power estimate of the FIG. 11D tapered embodiment.

As illustrated in FIGS. 12A and 12B, the dominant frequency for the cylindrical elastomer element 702 of FIG. 11A is 4,279.7 HZ. As illustrated in FIGS. 13A and 13B, the dominant frequency for the tapered elastomer element 702 of FIG. 11D is 4317.4 Hz. Generally, when an iron type golf club head strikes a golf ball, sound frequencies produced between approximately 1,000 Hz and 3,800 Hz are produced by golf club and golf ball interaction and golf ball resonances while sound frequencies above approximately 3,800 Hz are produced solely by the golf club head. Thus, the first sound power peak in the sound power estimate graphs of FIGS. 12B and 13B correlates primarily to the golf ball and the subsequent sound power peak correlates to the vibration of the striking face of the golf club head. As illustrated in FIGS. 12B and 13B the peak sound power estimate below 3,800 Hz, corresponding to the golf ball, is approximately $1.00\times10^{-3}$ watts. As illustrated in FIG. 12B, the sound power generated by the golf club head utilizing the cylindrical elastomer element embodiment illustrated in FIG. 11A peaks at approximately $1.40\times10^{-3}$ watts. As illustrated in FIG. 13B, the sound power generated by the golf club head utilizing the tapered elastomer element embodiment illustrated in FIG. 11D peaks at approximately $1.04\times10^{-3}$ watts. Sound power levels correlate directly with the loudness of the sound produced by the golf club striking a golf ball. Therefore, it is evident that the sound produced by the golf club head utilizing the cylindrical elastomer element embodiment illustrated in FIG. 11A is significantly less loud than the golf club head utilizing the tapered elastomer element embodiment illustrated in FIG. 11D.

Additionally, the sound power generated by the golf club head utilizing the cylindrical elastomer element embodiment illustrated in FIG. 11A divided by the sound power generated by the golf ball is approximately 1.40. The sound power generated by the golf club head utilizing the cylindrical elastomer element embodiment illustrated in FIG. 11D divided by the sound power generated by the golf ball is approximately 1.04. In some embodiments, it is preferable to have the sound power generated by the golf club head divided by the sound power generated by the golf ball to be less than 1.50. In some embodiments, it is preferable to have the sound power generated by the golf club head divided by the sound power generated by the golf ball to be less than 1.40. In some embodiments, it is preferable to have the sound power generated by the golf club head divided by the sound power generated by the golf ball to be less than 1.30. In some embodiments, it is preferable to have the sound power generated by the golf club head divided by the sound power generated by the golf ball to be less than 1.20. In some embodiments, it is preferable to have the sound power generated by the golf club head divided by the sound power generated by the golf ball to be less than 1.10. In some embodiments, it is preferable to have the sound power generated by the golf club head divided by the sound power generated by the golf ball to be less than 1.00.

FIGS. 14A-L depict additional embodiments of an elastomer element 702, which can also be referred to as a deformable member. These embodiments are designed with variable compressive stiffness, spring rate, or flexural modulus. This can be achieved through various geometries as well as combinations of various co-molded materials of different durometers.

Figure 14A:
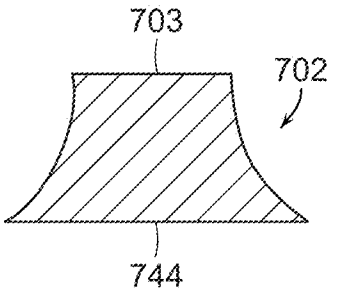
FIG. 14A depicts a cross sectional view of an elastomer element having a larger rear portion than front portion.
Figure 14B:
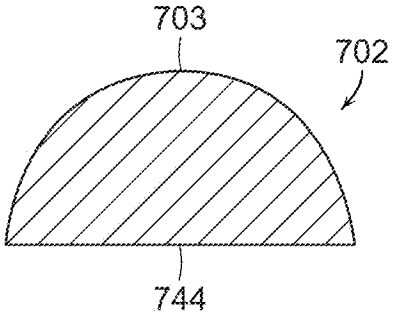
FIG. 14B depicts a cross sectional view of an elastomer element having a larger rear portion than front portion.
Figure 14C:
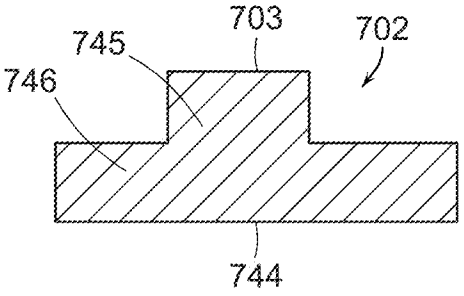
FIG. 14C depicts a cross sectional view of an elastomer element having a larger rear portion than front portion.
Figure 14D:
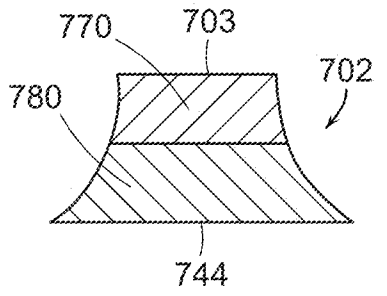
FIG. 14D depicts a cross sectional view of an elastomer element similar to that of FIG. 14A but includes a first material and a second material.
Figure 14E:
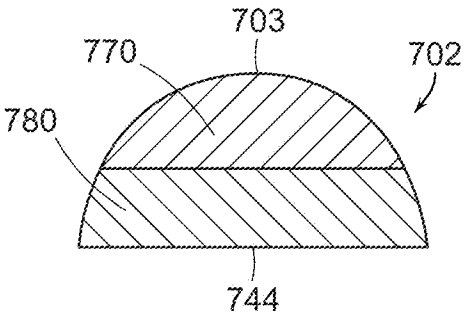
FIG. 14E depicts a cross sectional view of an elastomer element similar to that of FIG. 14B but includes a first material and a second material.
Figure 14F:
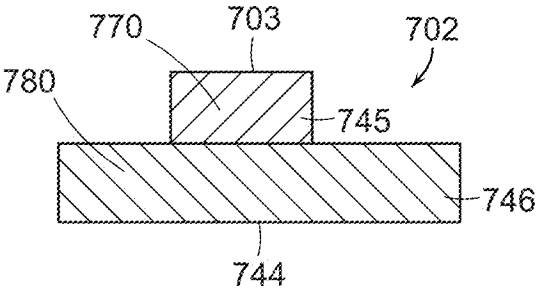
FIG. 14F depicts a cross sectional view of an elastomer element similar to that of FIG. 14C but includes a first material and a second material.

FIG. 14A illustrates a cross sectional view of an elastomer element 702 having a larger rear portion 744 than front portion 703. The front portion 703 and rear portion 744 are substantially planar. FIG. 14B illustrates a cross sectional view of an elastomer element 702 having a larger rear portion 744 than front portion 703. The rear portion 744 is substantially planar and the front portion 703 is hemispherical. FIG. 14C illustrates a cross sectional view of an elastomer element 702 having a larger rear portion 744 than front portion 703. The elastomer element 702 includes a front constant diameter region 746 and a rear constant diameter region 745, where the rear constant diameter region 746 has a larger diameter than the front constant diameter region 745. FIG. 14D illustrates a cross sectional view of an elastomer element 702 similar to that of FIG. 14A but includes a first material 770 and a second material 780. In one embodiment, the first material 770 can be stiffer than the second material 780. In an additional embodiment, the second material 780 can be stiffer than the first material 770. FIG. 14E illustrates a cross sectional view of an elastomer element 702 similar to that of FIG. 14B but includes a first material 770 and a second material 780. FIG. 14F illustrates a cross sectional view of an elastomer element 702 similar to that of FIG. 14C but includes a first material 770 and a second material 780.

Figure 14I:
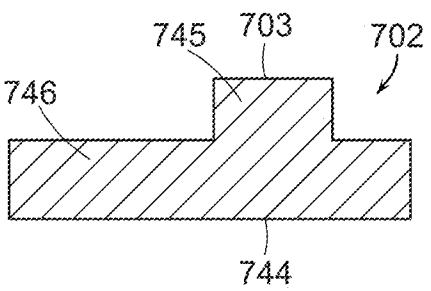
FIG. 14I depicts a cross sectional view of an elastomer element similar to that of FIG. 14C but the center of the front portion is offset from a center of the rear portion.
Figure 14H:
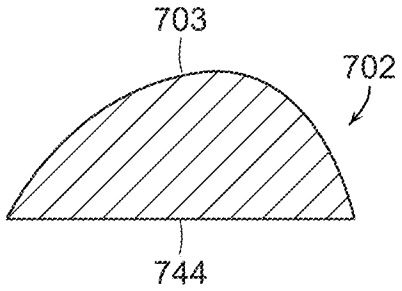
FIG. 14H depicts a cross sectional view of an elastomer element similar to that of FIG. 14B but the center of the front portion is offset from a center of the rear portion.
Figure 14G:
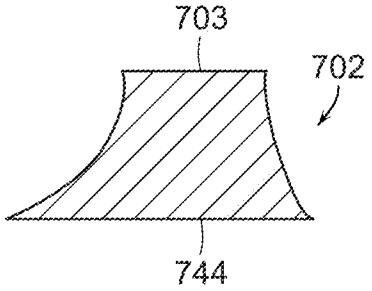
FIG. 14G depicts a cross sectional view of an elastomer element similar to that of FIG. 14A but the center of the front portion is offset from a center of the rear portion.
Figure 14L:
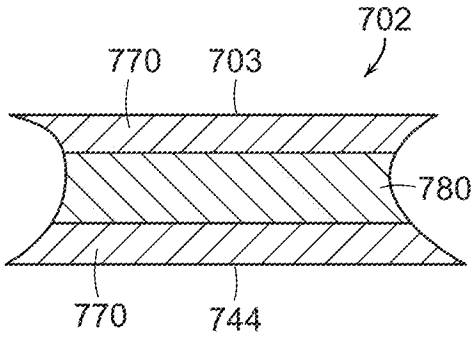
FIG. 14L depicts a cross sectional view of an elastomer element similar to that of FIG. 14J but includes a first material and a second material.
Figure 14K:
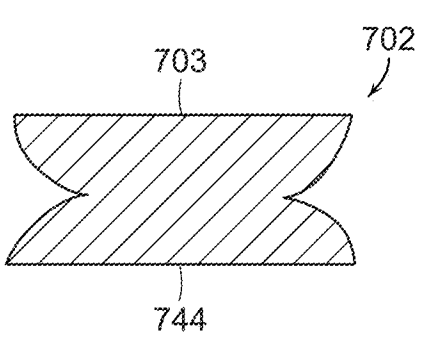
FIG. 14K depicts a cross sectional view of an elastomer element which necks down in diameter between the front portion and the rear portion.
Figure 14J:
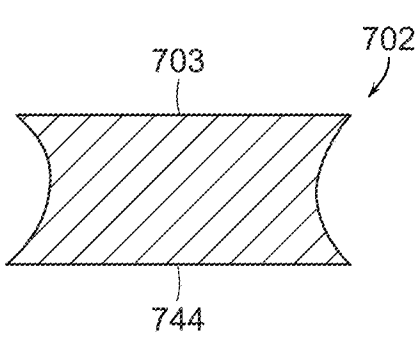
FIG. 14J depicts a cross sectional view of an elastomer element which necks down in diameter between the front portion and the rear portion.

FIG. 14G illustrates a cross sectional view of an elastomer element 702 similar to that of FIG. 14A but the center of the front portion 703 is offset from a center of the rear portion 744. The offset can be towards the topline, towards, the sole, towards the toe, towards the heel, or any combination thereof. FIG. 14H illustrates a cross sectional view of an elastomer element 702 similar to that of FIG. 14B but the center of the front portion 703 is offset from a center of the rear portion 744. FIG. 14I illustrates a cross sectional view of an elastomer element 702 similar to that of FIG. 14C but the center of the front portion 703 is offset from a center of the rear portion 744. FIG. 14J illustrates a cross sectional view of an elastomer element 702 which necks down in diameter between the front portion 703 and the rear portion 744. FIG. 14K illustrates a cross sectional view of an elastomer element 702 which necks down in diameter between the front portion 703 and the rear portion 744. FIG. 14L illustrates a cross sectional view of an elastomer element 702 similar to that of FIG. 14J but includes a first material 770 and a second material 780.

Any of these embodiments of elastomer element 702 described herein can be flipped, such that the rear portion 744 abuts the rear surface of the striking face rather than the front portion. Additionally, the embodiments illustrated in FIGS. 14A-14L are circular when viewed from a front view in a preferred embodiment. In other embodiments, the elastomer elements may comprise different shapes. In some embodiments, the flexural modulus of the first material can be greater than the flexural modulus of the second material.

Figure 15A:
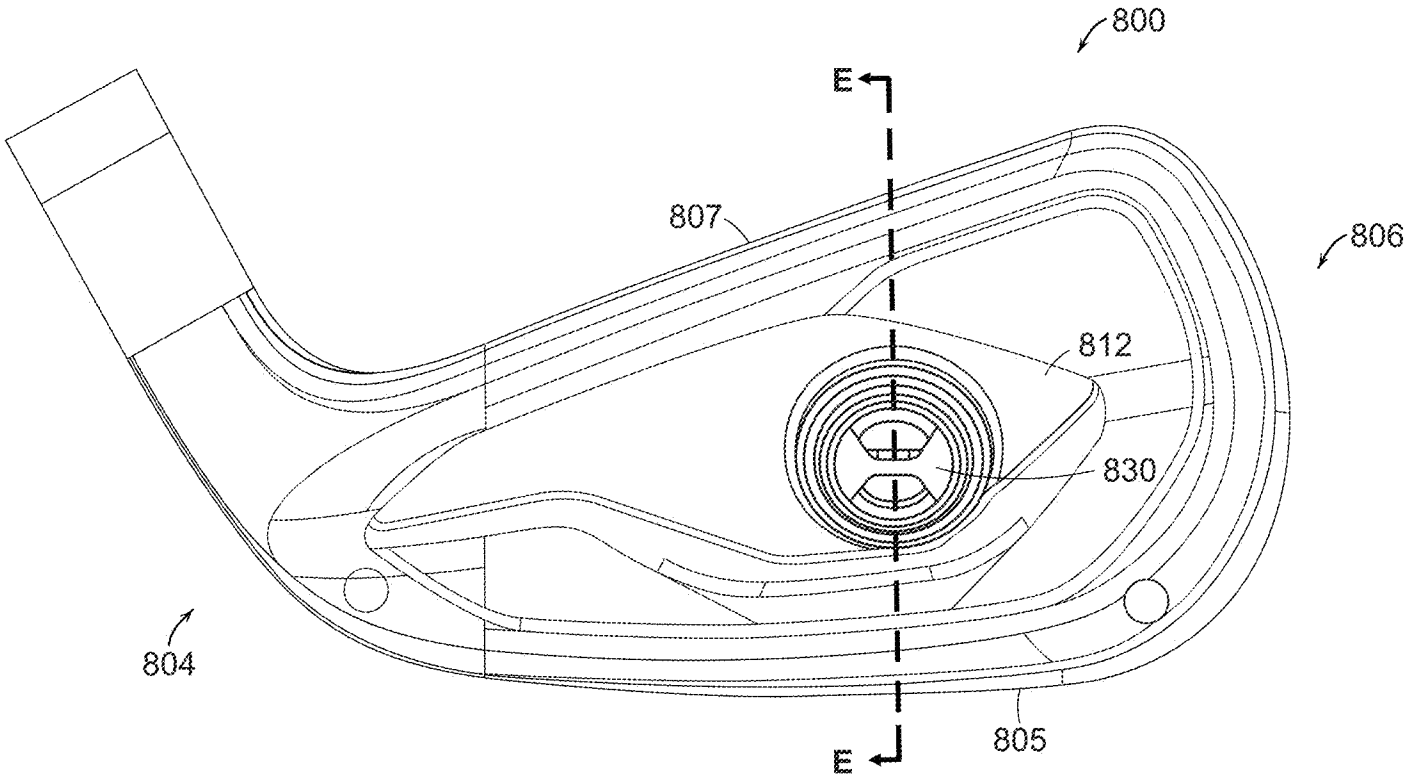
FIG. 15A depicts a rear view of the golf club head.
Figure 15B:
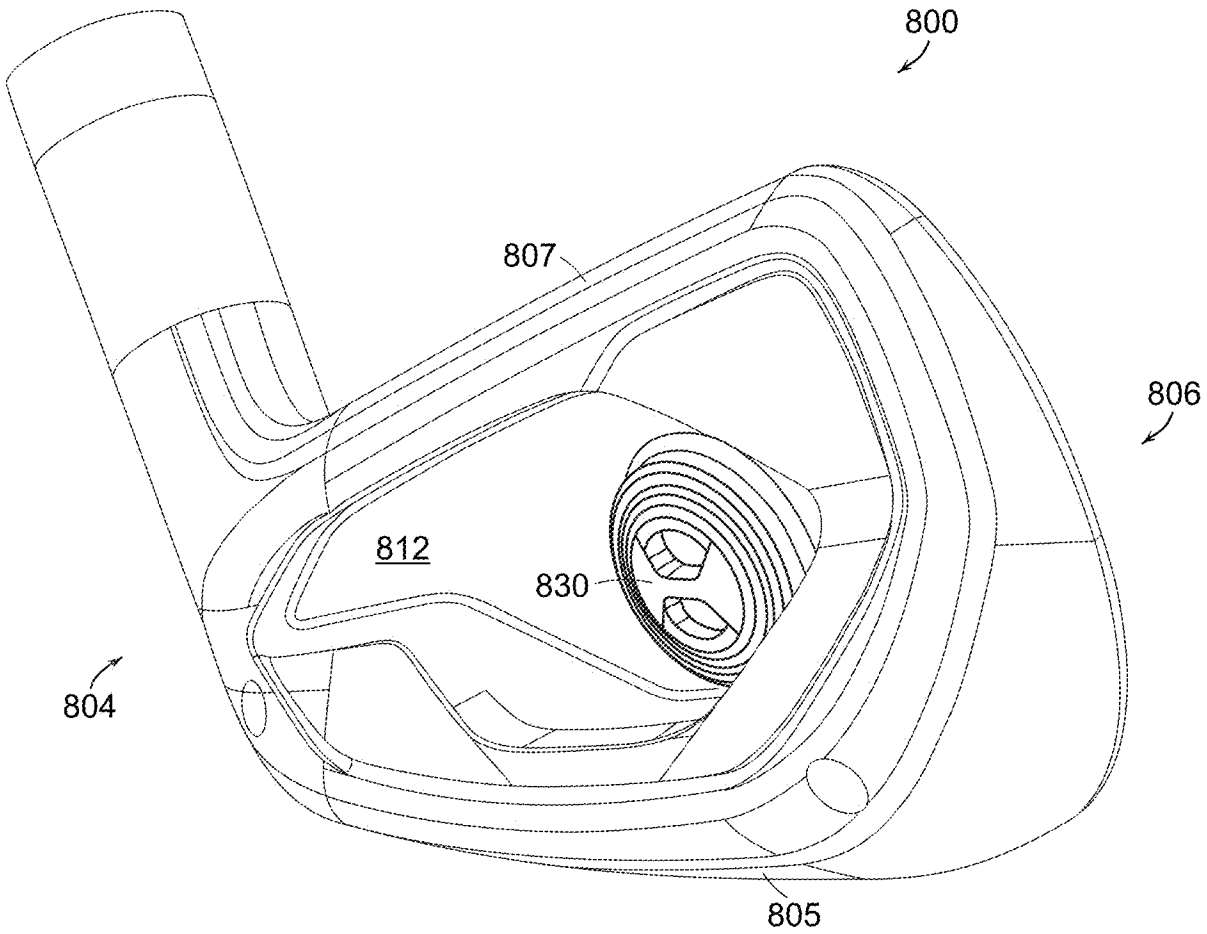
FIG. 15B depicts a perspective view of the golf club head of FIG. 15A.
Figure 15C:
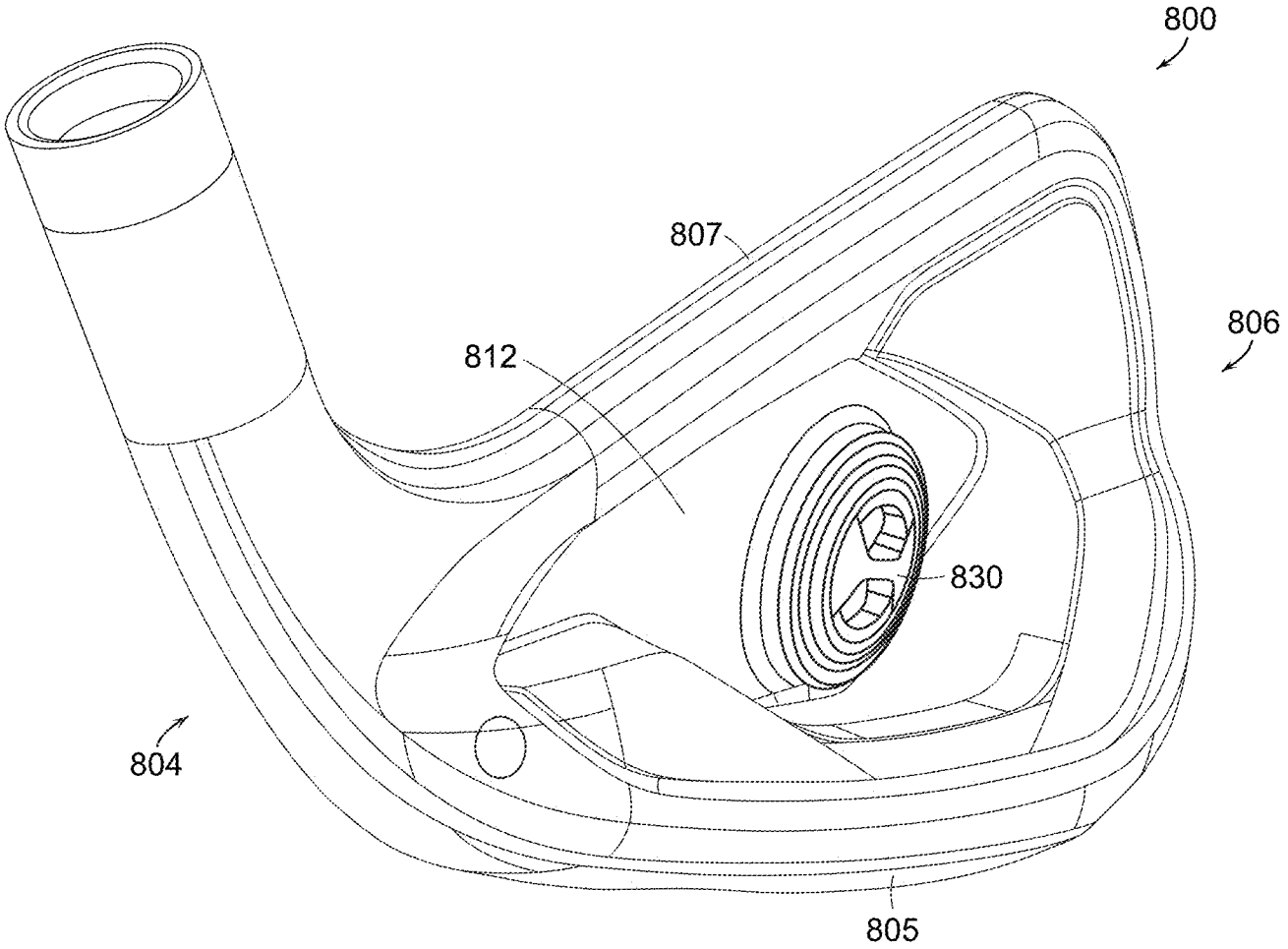
FIG. 15C depicts an additional perspective view of the golf club head of FIG. 15A.
Figure 16:
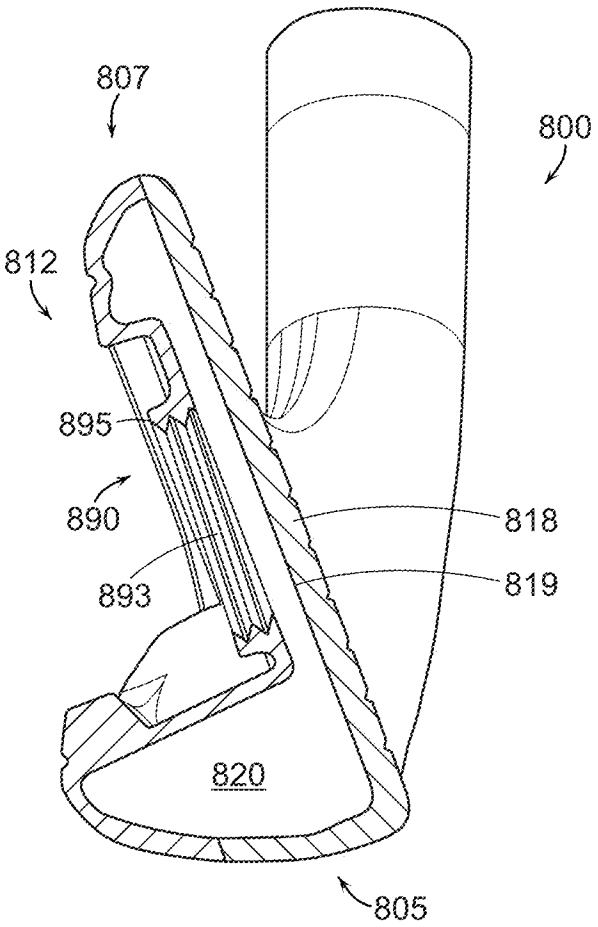
FIG. 16 depicts the section view E-E of the golf club head of FIG. 15D without the adjustment driver and elastomer element installed.
Figure 15D:
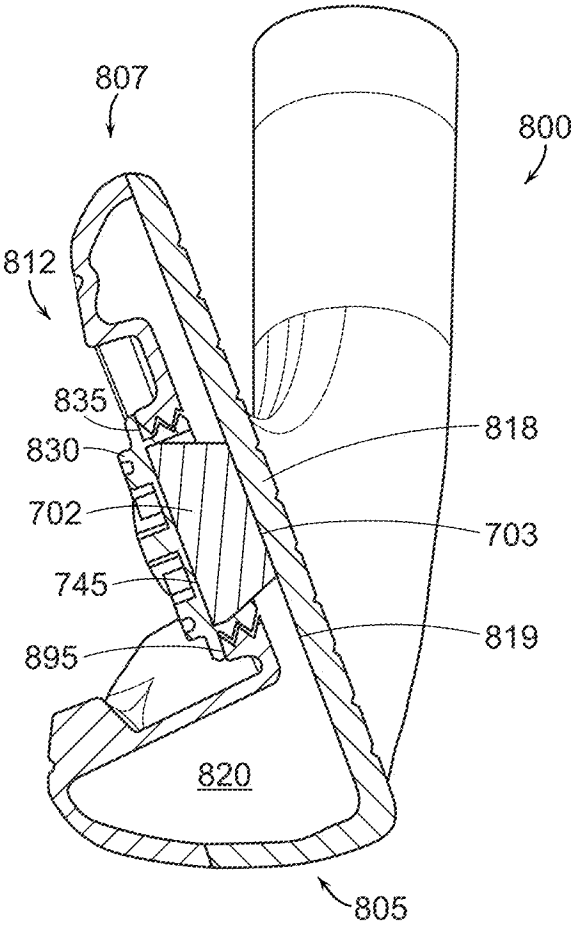
FIG. 15D depicts a section view E-E of the golf club head of FIG. 15A.
Figure 17C:
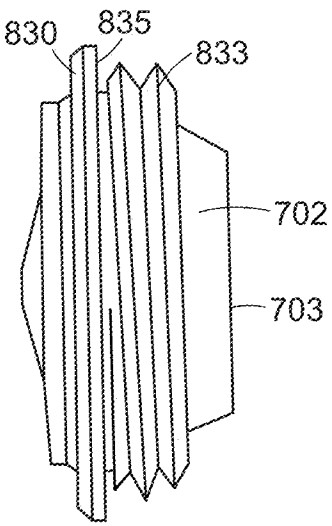
FIG. 17C depicts a side view of the adjustment driver and elastomer element of the golf club head of FIG. 15A.
Figure 17B:
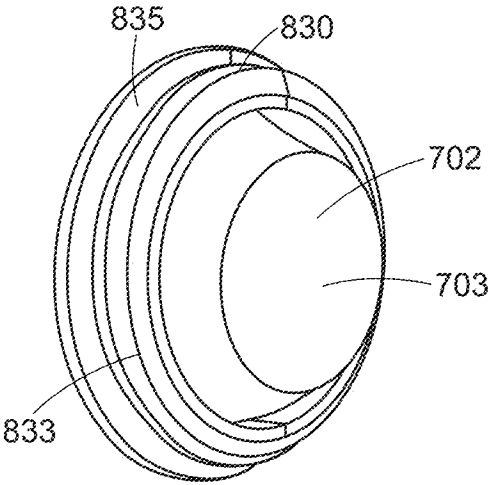
FIG. 17B depicts an additional perspective view of the adjustment driver and elastomer element of the golf club head of FIG. 15A.
Figure 17A:
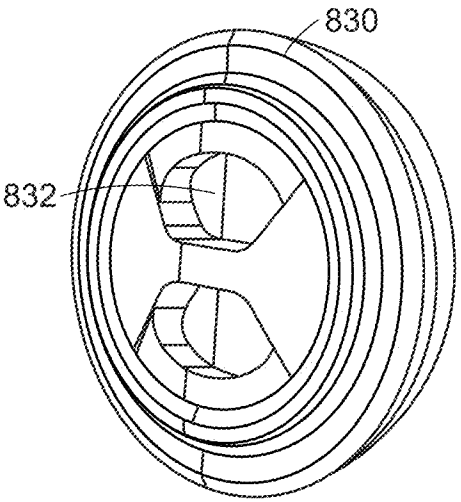
FIG. 17A depicts a perspective view of the adjustment driver and elastomer element of the golf club head of FIG. 15A.
Figure 17E:
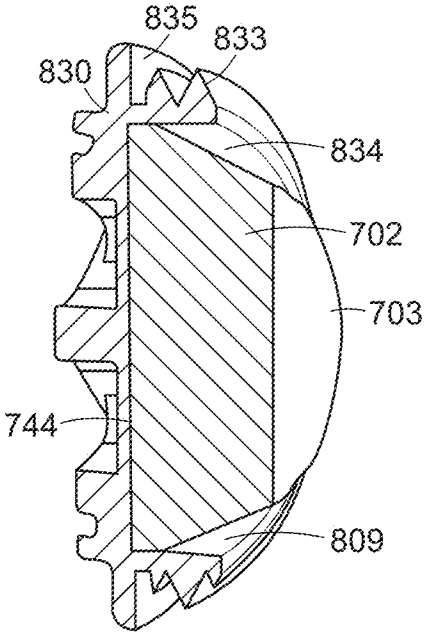
FIG. 17E depicts an additional perspective of the section view of the adjustment driver and elastomer element of FIG. 17A.
Figure 17D:
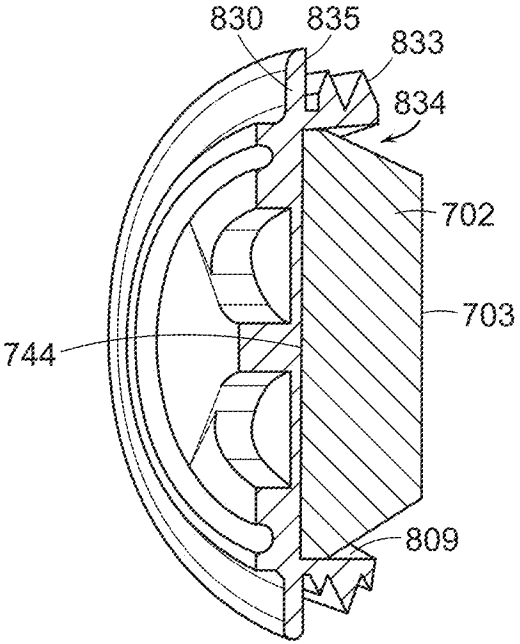
FIG. 17D depicts a section view of the adjustment driver and elastomer element of FIG. 17A.

FIGS. 15A-15D depict a golf club head 800 having an elastomer element 702. FIG. 15A depicts a rear view of the golf club head 800. FIG. 15B depicts a perspective view of the golf club head 800 of FIG. 15A. FIG. 15C depicts an additional perspective view of the golf club head 800 of FIG. 15A. FIG. 15D depicts a section view E-E of the golf club head 800 of FIG. 15A. FIG. 16 depicts the section view E-E of the golf club head 800 of FIG. 15D without the adjustment driver 830 and elastomer element 702 installed. FIG. 17A depicts a perspective view of the adjustment driver 830 and elastomer element 702 of the golf club head 800 of FIG. 15A. FIG. 17B depicts an additional perspective view of the adjustment driver 830 and elastomer element 702 of the golf club head 800 of FIG. 15A. FIG. 17C depicts a side view of the adjustment driver 830 and elastomer element 702 of the golf club head 800 of FIG. 15A. FIG. 17D depicts a section view of the adjustment driver 830 and elastomer element 702 of FIG. 17A. FIG. 17E depicts an additional perspective of the section view of the adjustment driver 830 and elastomer element 702 of FIG. 17A.

As illustrated in FIGS. 15D and 16, the golf club head 800 includes a striking face 818 having a rear surface 819. The golf club head 800 also includes a back portion 812 configured to support the elastomer element 702. The golf club head 800 is made with a hollow body construction and the back portion 812 covers a substantial portion of the back of the golf club head 800. The back portion 812 is located behind the striking face 818 and extends between the topline 807 and the sole 805 and from the heel 804 to the toe 806 forming a cavity 820. The elastomer element 702 is disposed within the cavity 820. As illustrated in FIG. 15 D. the striking face 818 can be formed separately and welded to the rest of the golf club head 800. More specifically, the separately formed striking face portion can include a portion of the sole, forming an L-shaped striking face portion. In other embodiments, the striking face 818 may be formed integrally with the rest of the golf club.

The golf club head 800 includes an adjustment driver 830 much like the adjustment driver 330 described earlier and illustrated in FIGS. 3A and 3B. The golf club head 800 also includes a deformable member 702 disposed between the striking face 818 and the adjustment driver 830. The deformable member 702 can take the form of any of the elastomer elements described herein. The adjustment driver 830 is configured to retain the elastomer element 702 between the adjustment driver 830 and the striking face 818, with the front portion 703 of the elastomer element 702 contacting the rear surface 819 of the striking face 818 and the rear portion 744 of the elastomer element 702 contacting the adjustment driver 830. The adjustment driver can include an interface 834 configured to retain the elastomer element 702. The interface 834 can include a recess with a lip 809 surrounding at least a portion of the elastomer element 702 as illustrated in FIGS. 15D and 17A-17E.

The golf club head 800 can include an adjustment receiver 890, much like the adjustment receiver 306 illustrated in FIGS. 3A and 3B. As illustrated in FIG. 16, the adjustment receiver 890 can include an aperture formed in the back portion 812 of the golf club head 800. The aperture can include a threaded portion 893. Additionally, the adjustment receiver 890 can include a receiver shelf 895 for the adjustment driver 830 to engage when it is installed in the adjustment receiver 890 as illustrated in FIG. 15D. The adjustment driver 830, as illustrated in FIGS. 15D and 17A-17E, can include a threaded portion 833 configured to engage the threaded portion 893 of the adjustment receiver 890. Additionally, the adjustment driver 830 can include a flange 835 configured to engage the receiver shelf 895 of the adjustment receiver 890 when the adjustment driver 830 is installed in the adjustment receiver 890. The receiver shelf 895 and flange 835 help to ensure the elastomer element properly and consistently engages the rear surface 819 of the striking face 818 and provides the support necessary for optimal performance. While the adjustment driver 330 discussed earlier is configured such that it may be adjusted after assembly, the preferred embodiment of the adjustment driver 830 illustrated in FIGS. 15A-15D and 17A-17E is configured to be installed to a set position during assembly and remain in that position. The receiver shelf 895 and flange 835 help to ensure the adjustment driver 830 is installed consistently and that the elastomer element properly and consistently engages the rear surface 819 of the striking face 818 and provides the support necessary for optimal performance. The adjustment driver 830 can also include a screw drive 832 configured to receive a tool and allow the adjustment driver 830 to be rotated relative to the golf club head 800. Finally, the adjustment driver 830 can have a mass. In some embodiments, the mass of the golf club head can be adjusted by swapping out the adjustment driver 830 for another adjustment driver 830 having a different mass. The difference in mass can be achieved through the use of different materials for different adjustment drivers such as aluminum, brass, polymers, steel, titanium, tungsten, etc. In another embodiment, not illustrated, mass elements could be added to the adjustment driver to change the mass. In one embodiment, mass elements could be added to the recess of the adjustment driver. Additionally, the mass element added to the recess could also be used to change the distance between the rear portion of the elastomer element and the rear surface of the striking face, altering the compression of the elastomer element.

Figure 18:
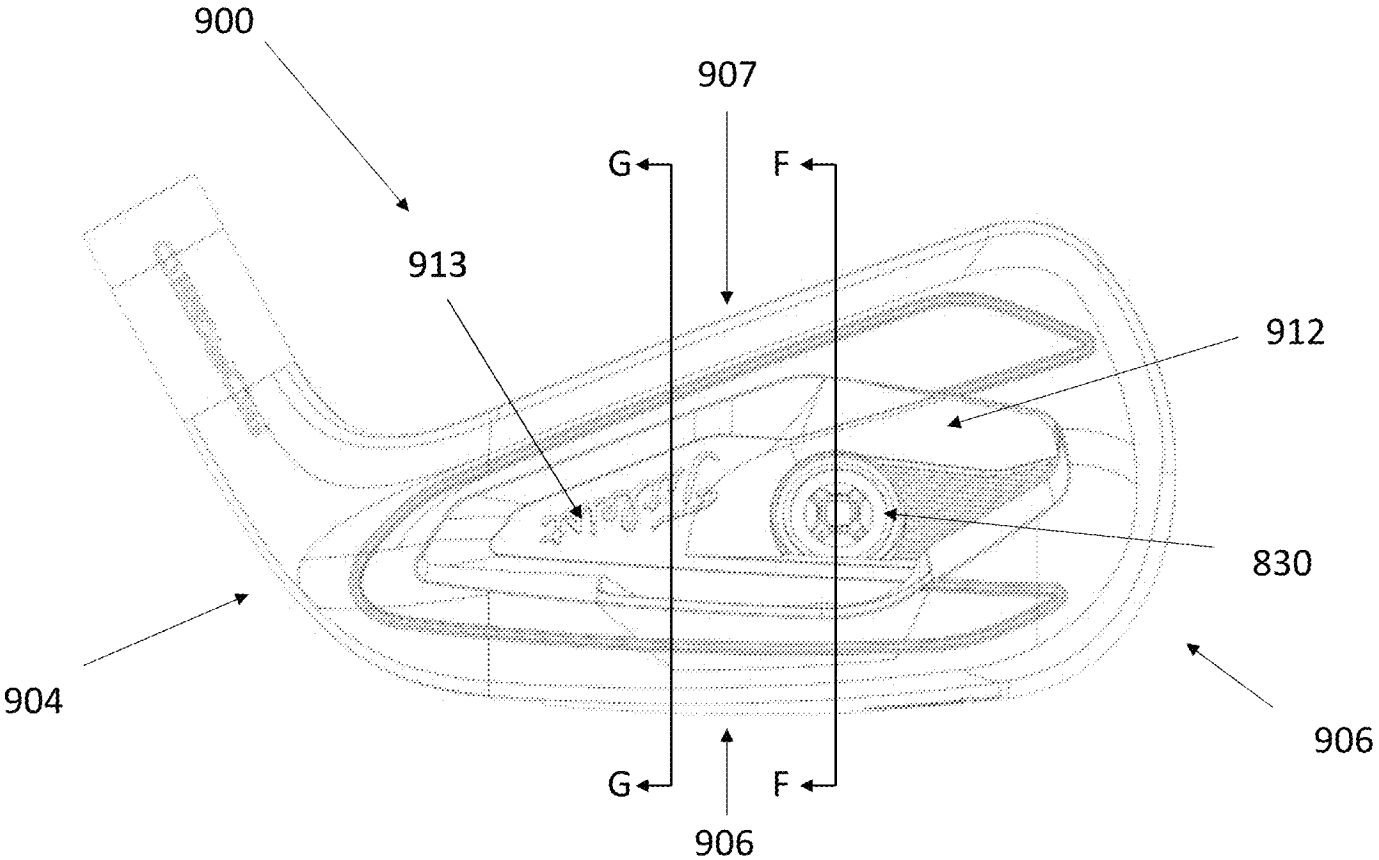
FIG. 18 depicts a rear view of the golf club head.
Figure 19:
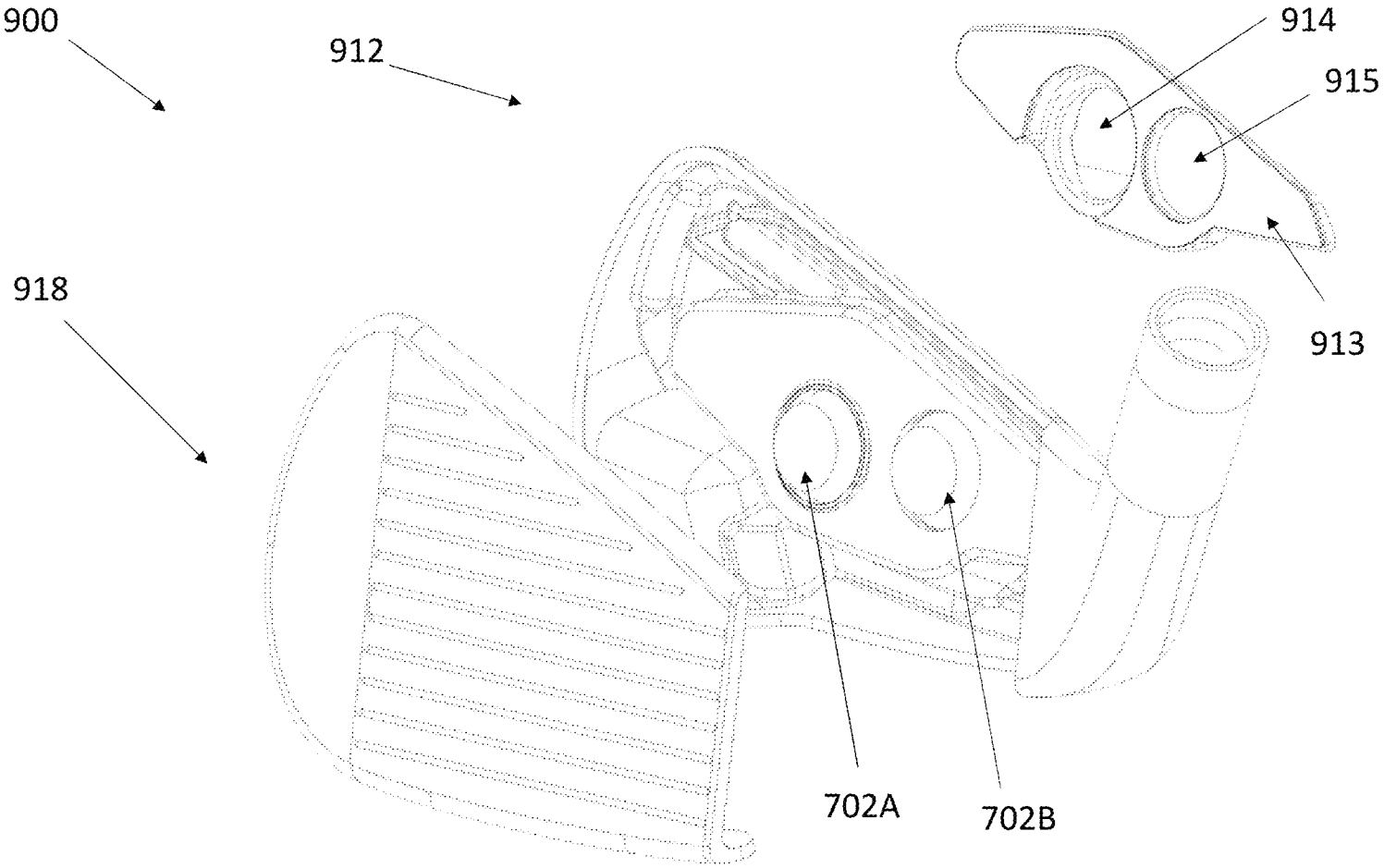
FIG. 19 depicts an exploded view of the golf club head of FIG. 18.
Figure 21:
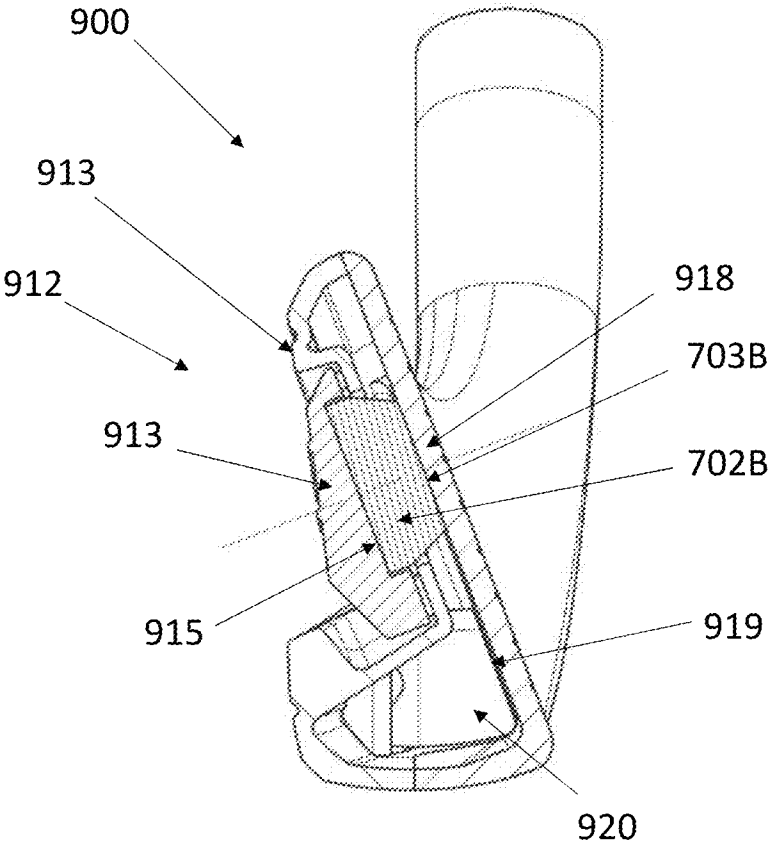
FIG. 21 depicts a section view G-G of the golf club head.
Figure 20:
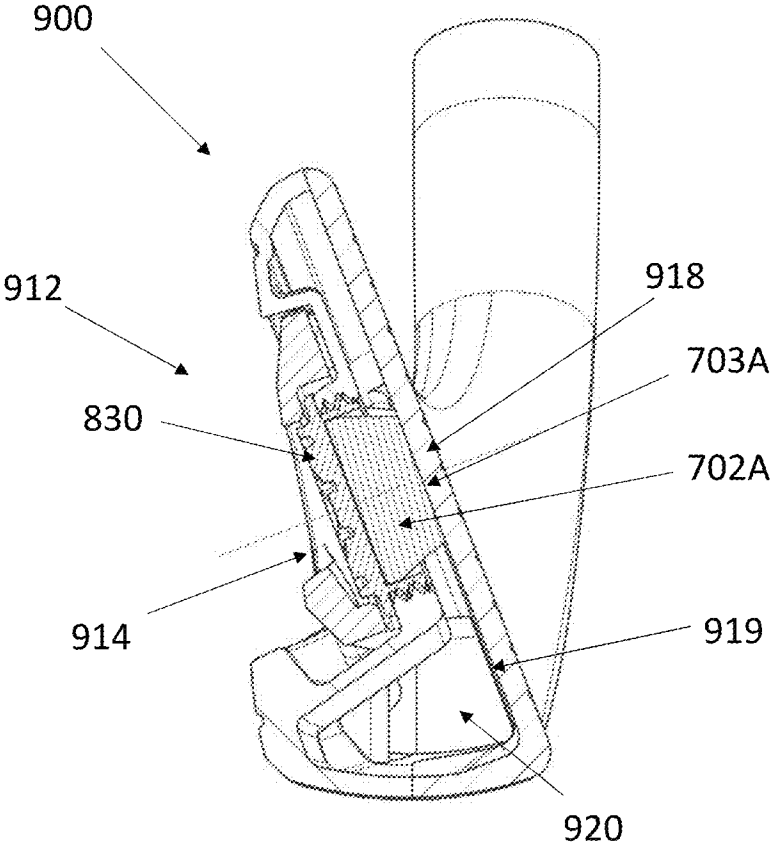
FIG. 20 depicts a section view F-F of the golf club head.
Figure 22:
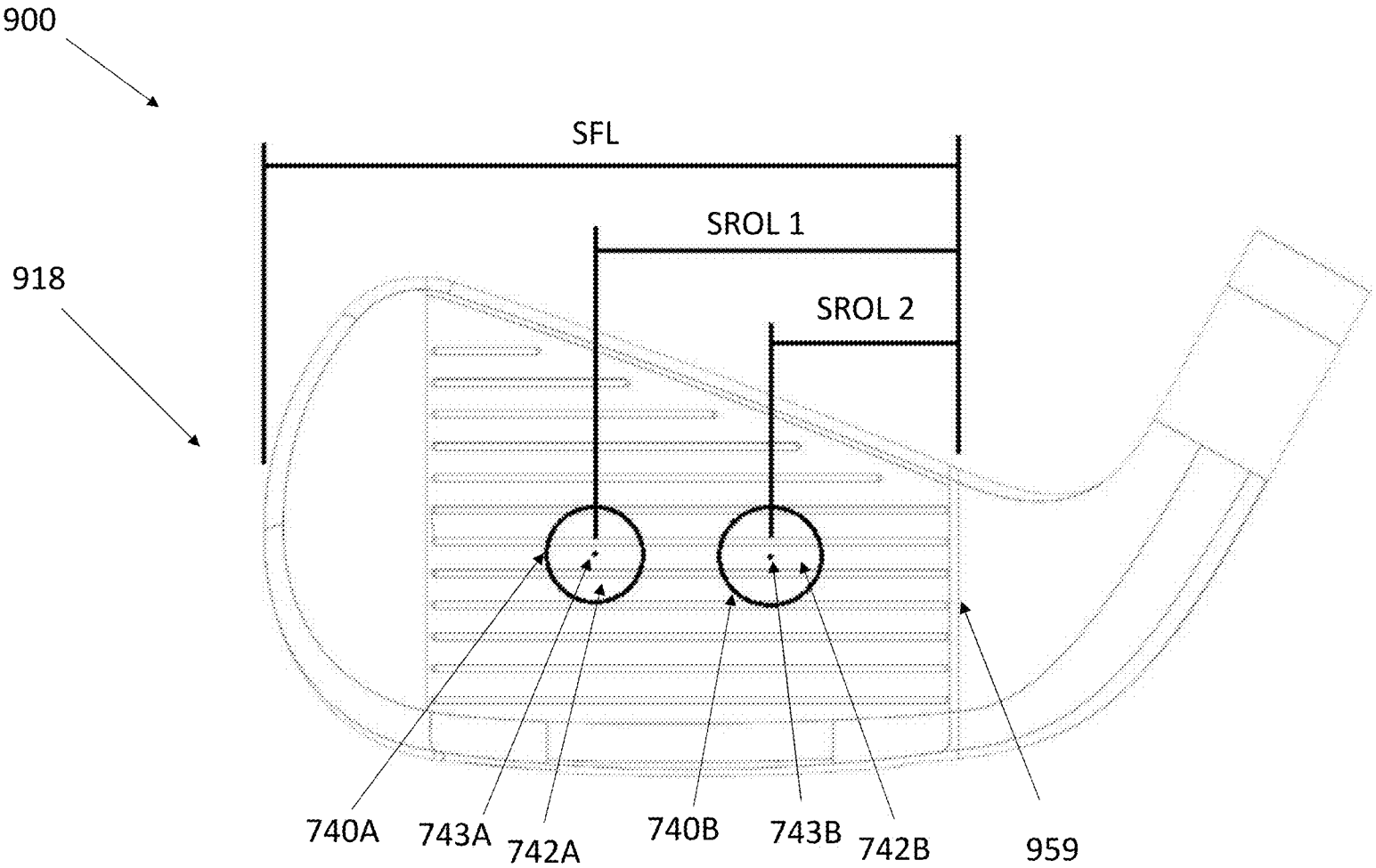
FIG. 22 depicts a frontal view of the golf club head of FIG. 18, including the supported regions.

FIGS. 18-22 depict a golf club head 900 similar to the golf club head 800 depicted in FIGS. 15A-15D. Golf club head 900 however includes a second deformable member 702B in addition to a first deformable member 702A. FIG. 18 depicts a rear view of the golf club head 900. FIG. 19 depicts an exploded view of the golf club head 900 of FIG. 18. FIG. 20 depicts a section view F-F of the golf club head 900. FIG. 21 depicts a section view G-G of the golf club head 900. FIG. 22 depicts a frontal view of the golf club head 900 of FIG. 18, including the supported regions.

As illustrated in FIGS. 18-22, the golf club head 900 includes a striking face 918 having a rear surface 919. The golf club head 900 also includes a back portion 912 configured to support the first deformable member 702A and the second deformable member 702B. The first deformable member 702A can be the same as the deformable member described earlier. The first deformable member 702A and a second deformable member 702B can each take the form of any of the elastomer elements described herein. They may take the same form, or they make take different forms. The golf club head 900 is made with a hollow body construction and the back portion 912 covers a substantial portion of the back of the golf club head 900. The back portion 912 is located behind the striking face 918 and extends between the topline 917 and the sole 905 from the heel 904 to the toe 906 forming a cavity 920. In the preferred illustrated embodiments the first deformable member 702A is spaced from and does not contact the second deformable member 702B. In an alternative embodiment, the first deformable member 702A may be spaced closely to and contact the second deformable member 702B.

Much like golf club head 800, the golf club head 900 includes an adjustment driver 830 configured to retain the first deformable member 702A. The front portion 703A of the first deformable member 702A contacts the rear surface 919 of the striking face 918. The back portion 912 of the golf club head 900 includes a back cover M. In the illustrated embodiment, the back cover 913 includes a recess 915 configured to retain the second deformable member 702B such that the front portion 703B of the second deformable member 702B contacts the rear surface 919 of the striking face 918. The back cover 913 also includes an aperture 914 for the adjustment driver 830. In one embodiment, the second deformable member is attached to the back cover 913 with an adhesive. Additionally, the back cover 913 can be attached to the rest of the golf club head 900 with an adhesive, which may include, for example, double sided tape. In one embodiment, the striking face 918 of the golf club head 900 is made from a high density material such as steel, whereas the back cover 913 is made from a low density material, such as plastic, which may include for example, acrylonitrile butadiene styrene. In an alternative embodiment, the back cover may also be made of a high density material.

As illustrated in FIG. 22, the striking face includes a plurality of supported regions. The first supported region 742A is defined by the portion of the rear surface 919 of the striking face 918 supported by the first deformable member 702A, which is defined by the area inside the first supported region perimeter 740A defined by the outer extent of the front portion 703A of the first deformable member 702A in contact with the rear surface 919 of the striking face 918. The second supported region 742B is defined by the portion of the rear surface 919 of the striking face 918 supported by the second deformable member 702B, which is defined by the area inside the second supported region perimeter 740B defined by the outer extent of the front portion 703B of the second deformable member 702B in contact with the rear surface 919 of the striking face 918. The first supported region 742A and second supported region 742B wouldn't normally be visible from the front of the golf club head 900 but was added in FIG. 22 for illustrative purposes.

The first geometric center 743A of the first supported region 742A is located a first supported region offset length SROL 1 toeward from the striking face heel reference plane 959, measured parallel to the ground plane and parallel to the striking face 918 with the golf club head 900 in an address position. The second geometric center 743B of the second supported region 742B is located a second supported region offset length SROL 2 toeward from the striking face heel reference plane 959, measured parallel to the ground plane and parallel to the striking face 918 with the golf club head 900 in an address position.

In a preferred embodiment, SROL 1 is approximately 36.0 mm and SROL 2 is approximately 17.6 mm. In a preferred embodiment SROL 1 is greater than SROL 2. In a preferred embodiment, SROL 1 divided by SROL2 is greater than 1.0. In a preferred embodiment, SROL 1 divided by SROL2 is greater than 1.25. In a preferred embodiment, SROL 1 divided by SROL2 is greater than 1.50. In a preferred embodiment, SROL 1 divided by SROL2 is greater than 1.75. In a preferred embodiment, SROL 1 divided by SROL2 is greater than 2.0. In an alternative embodiment, not illustrated, SROL 2 is greater than SROL 1.

In one embodiment, the first deformable member 702A is made of the same material as the second deformable member 702B and thus has the same hardness. In an additional embodiment, the first deformable member 702A is made of a material which has a greater hardness than the material of the second deformable member 702B. In an alternative embodiment, the material of the first deformable member 702A has a lower modulus than the material of the second deformable member 702B. In one embodiment, the first deformable member 702A has a Shore A 50 durometer and the second deformable member has a Shore A 10 durometer. In one embodiment, the first deformable member 702A has a Shore A durometer greater than 25 and the second deformable member has a Shore A durometer less than 25.

It should be noted that the first deformable member could be housed, structured, or supported similarly to the second deformable member and also the second deformable member could be housed, structured, or supported similarly to the first deformable member. Additionally, the first deformable member and second deformable member could be housed, structured, or supported in any fashion described throughout this disclosure.

Figure 24:
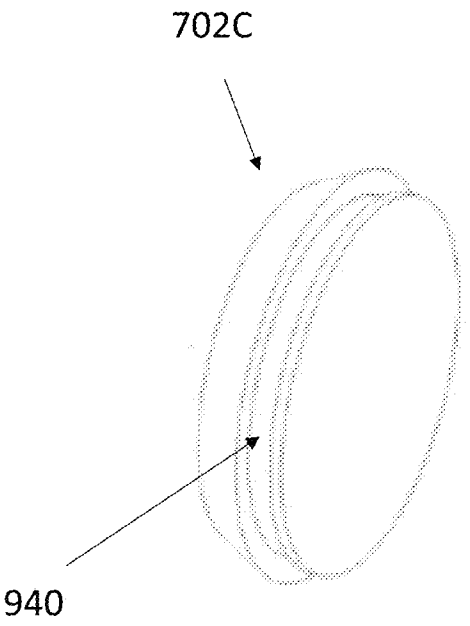
FIG. 24 depicts the second deformable member illustrated in FIG. 23.
Figure 23:
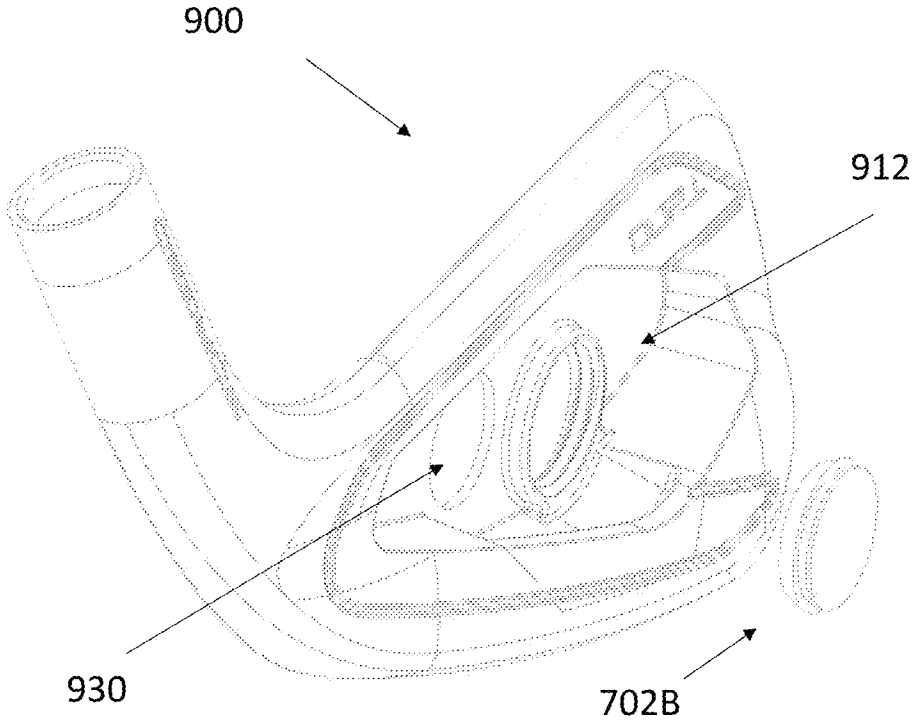
FIG. 23 depicts a perspective view of golf club head and an additional embodiment of the second deformable member.
Figure 25:
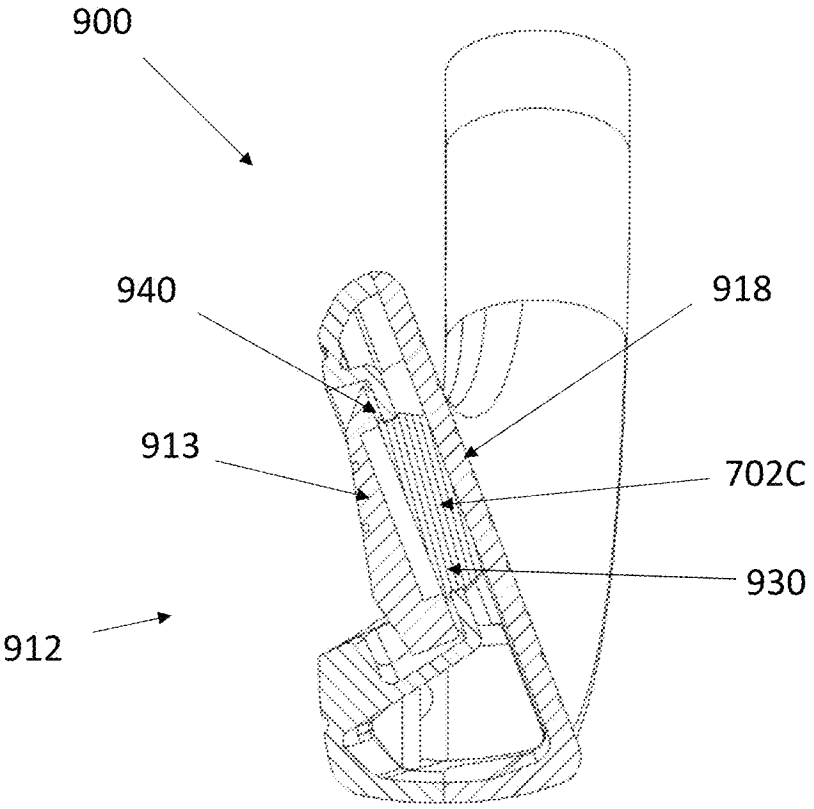
FIG. 25 depicts a section view F-F of the golf club head including the second deformable member illustrated in FIGS. 23 and 24.

FIG. 23 depicts a perspective view of golf club head 900 and an additional embodiment of the second deformable member 702C. The second deformable member 702C is illustrated in an exploded fashion behind the golf club head 900. FIG. 24 depicts the second deformable member 702C illustrated in FIG. 23. FIG. 25 depicts a section view F-F of the golf club head 900 including the second deformable member 702C illustrated in FIGS. 23 and 24. The back portion 912 of the golf club head 900 includes an aperture 930 configured to receive the second deformable member 702C, or alternatively the second deformable member 702B. The second deformable member 702C, as illustrated in FIGS. 23-25, includes an annular groove 940 formed therein configured to engage the perimeter of the aperture 930 of the back portion 912 of the golf club head 900 and secure the second deformable member 702C to the gold club head 900. Portions of the second deformable member 702C can be configured to deform as the second deformable member 702C is installed in the aperture 930 of the golf club head 900 until the groove 940 engages the aperture 930.

Additional embodiments of golf club heads will be described below which incorporate various damping elements, many of them applied to the back surface of the striking face. The damping elements described below can include any of the deformable members or elastomers described herein, including their materials, properties, geometry, and features, as well as the additional details which will be described below. The damping elements help reduce vibrations and improve the sound produced by the golf club head when it strikes a golf ball by making it more pleasing to the golfer's ear.

Figure 27:
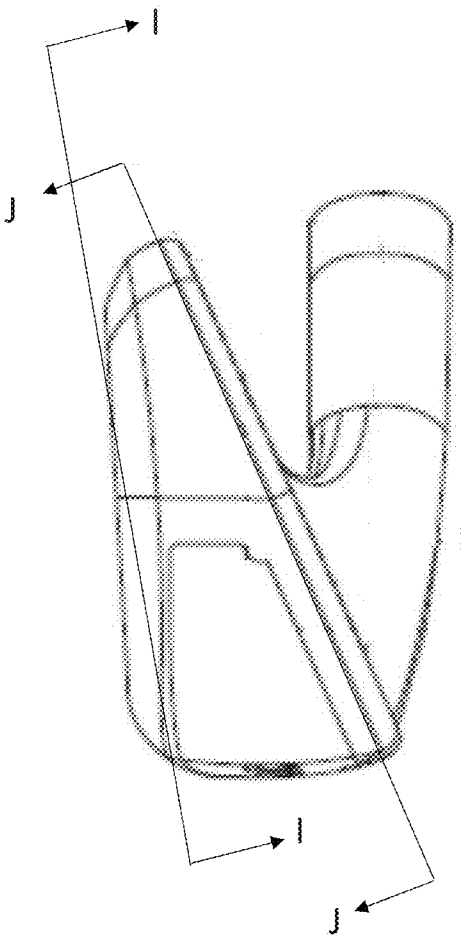
FIG. 27 depicts a side view of the golf club head of FIG. 26.
Figure 26:
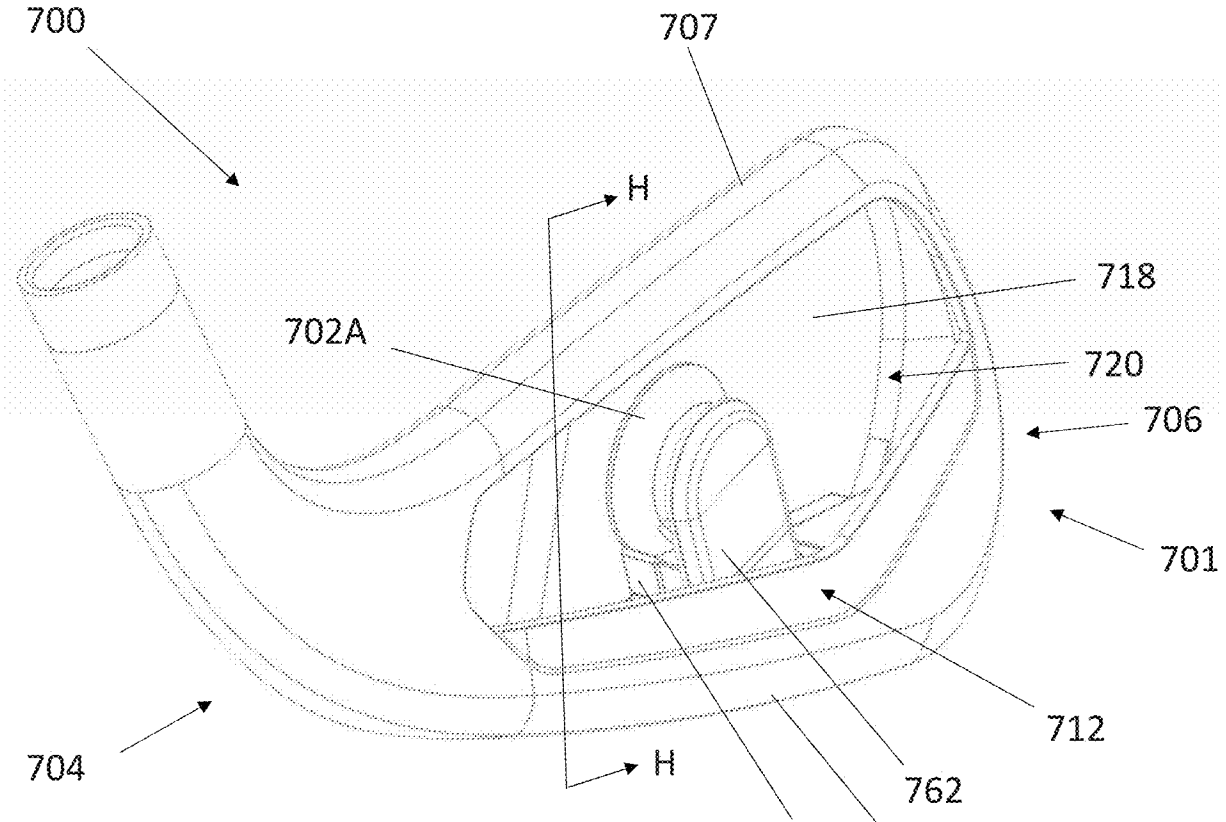
FIG. 26 depicts a perspective view of an additional embodiment of a golf club head.
Figure 29:
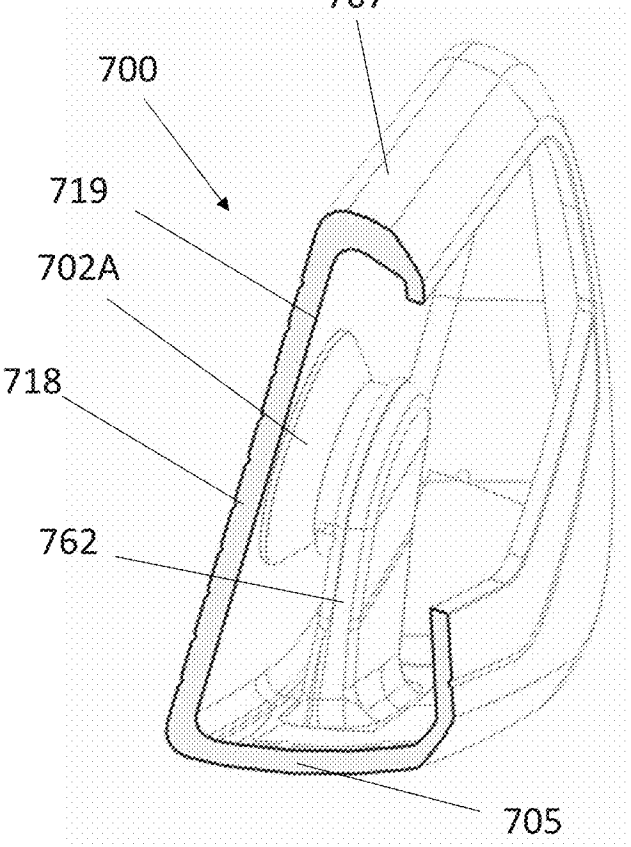
FIG. 29 depicts a section view H-H of the golf club head of FIG. 26 missing the weight member and the second damping element.
Figure 28:
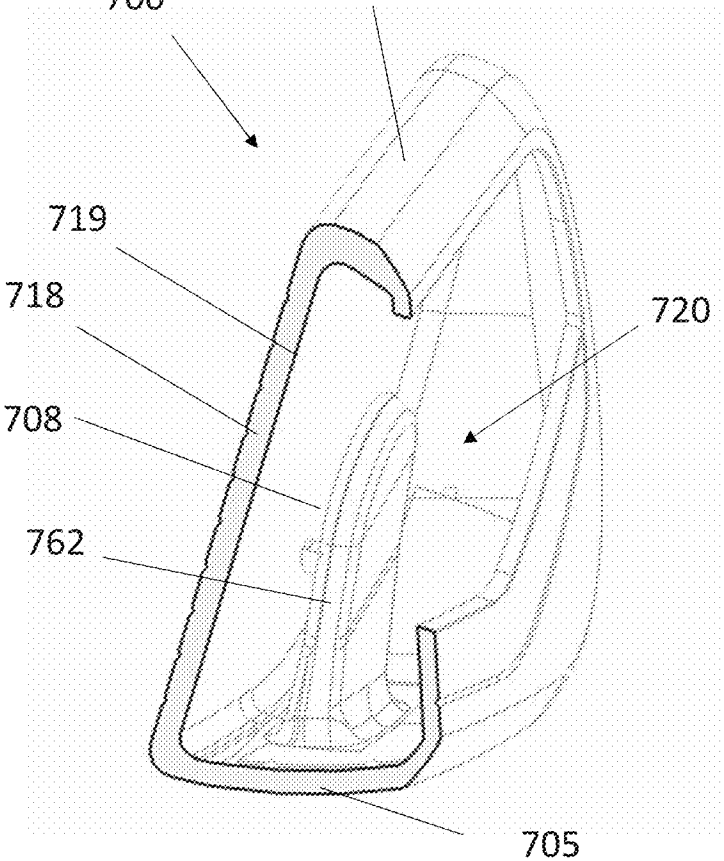
FIG. 28 depicts a section view H-H of the golf club head of FIG. 26 missing the weight member, the second damping element, and the first damping element.
Figure 31:
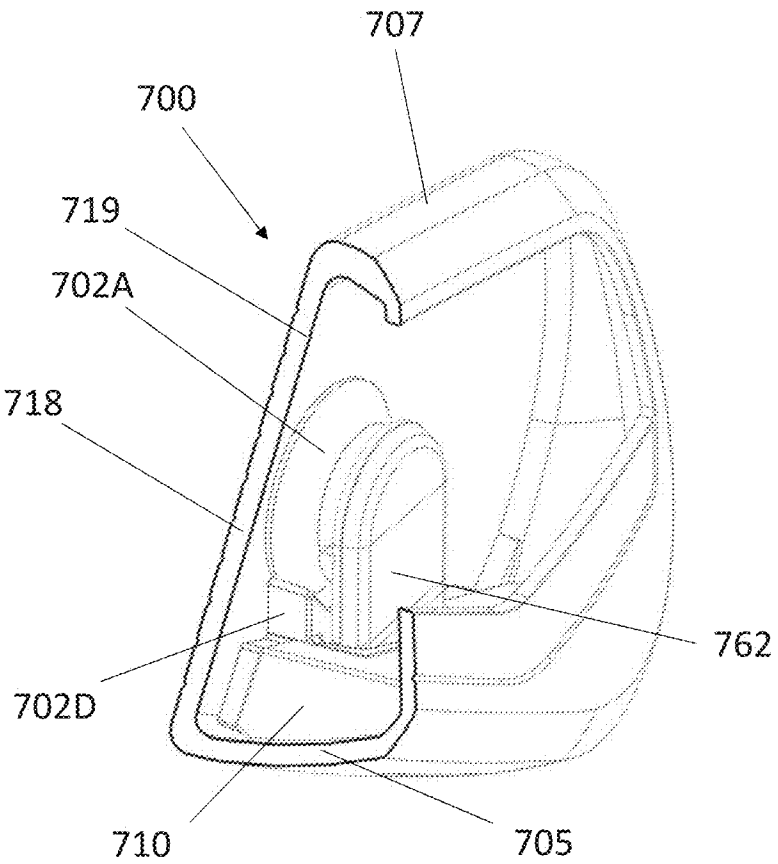
FIG. 31 depicts a section view H-H of the golf club head of FIG. 26.
Figure 30:
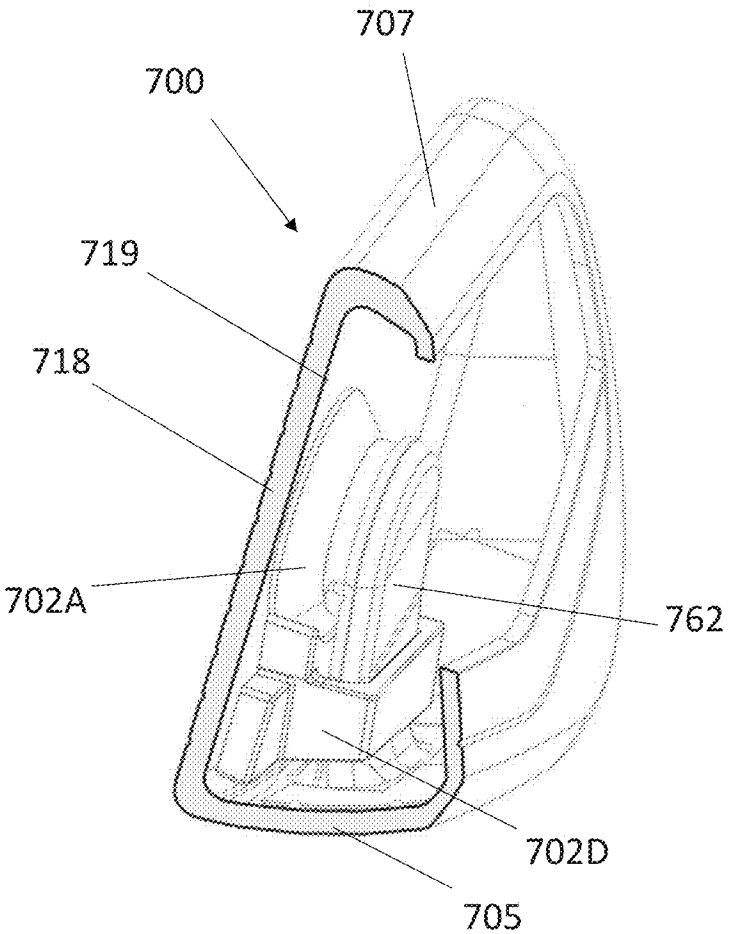
FIG. 30 depicts a section view H-H of the golf club head of FIG. 26 missing the weight member.
Figure 32:
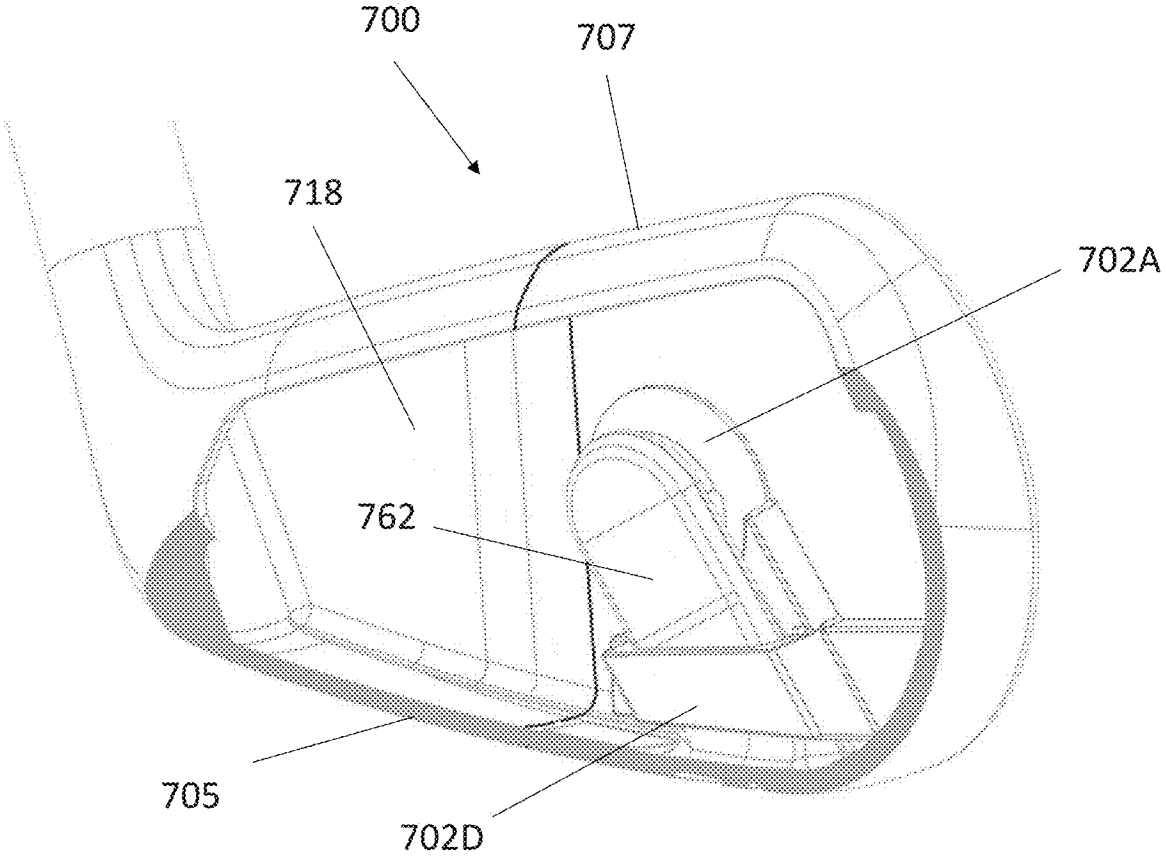
FIG. 32 depicts a section view I-I of the golf club head of FIG. 27 missing the weight member.
Figure 33:
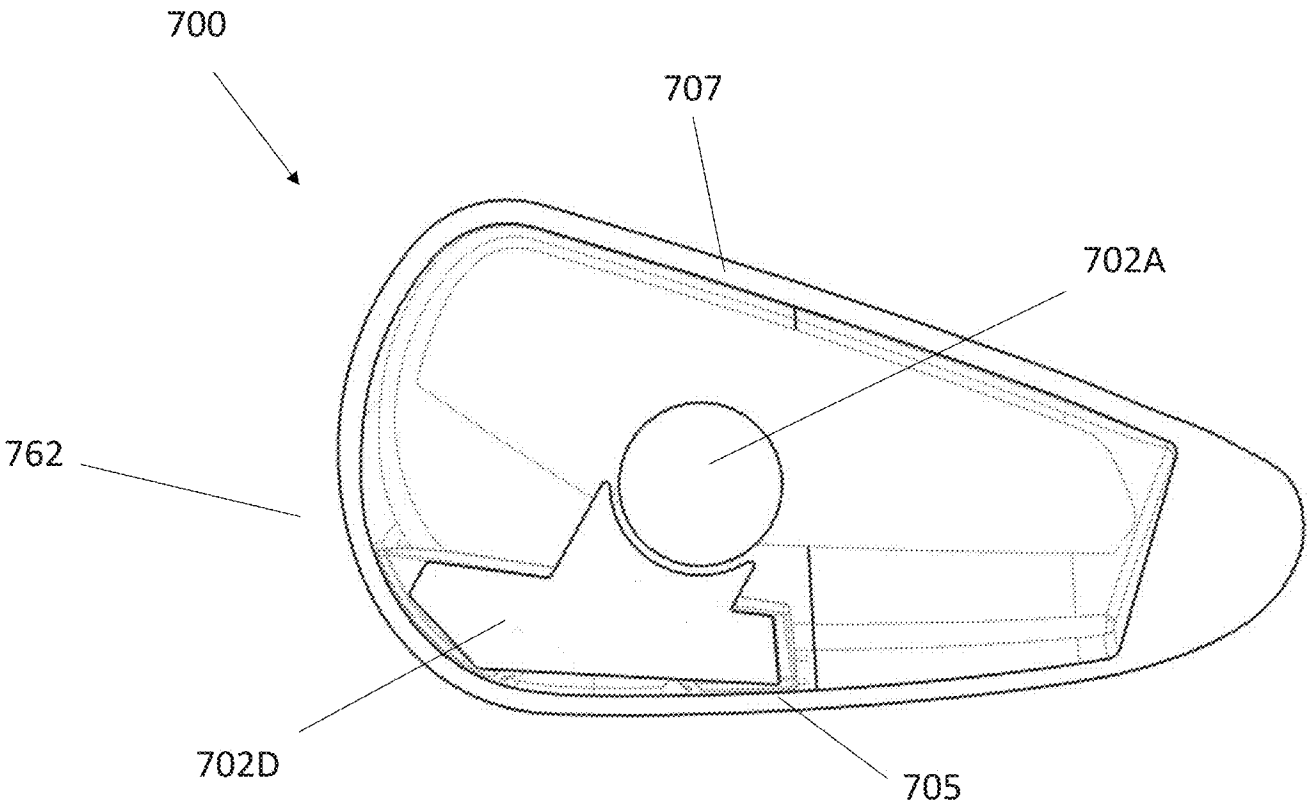
FIG. 33 depicts a section view J-J of the golf club head of FIG. 27.
Figure 35:
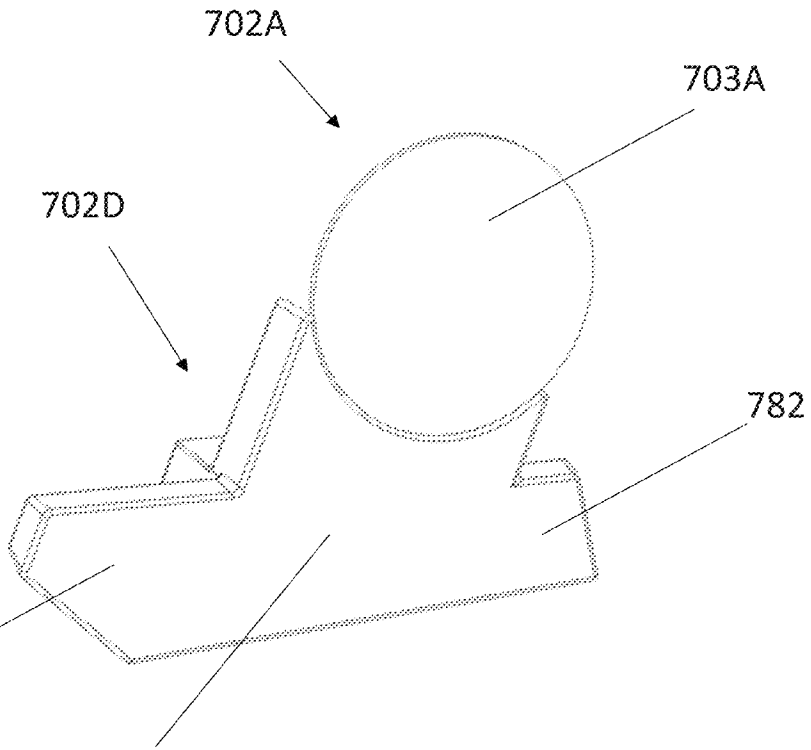
FIG. 35 depicts an additional perspective view of the first damping element and second damping element of the golf club head of FIG. 26.
Figure 34:
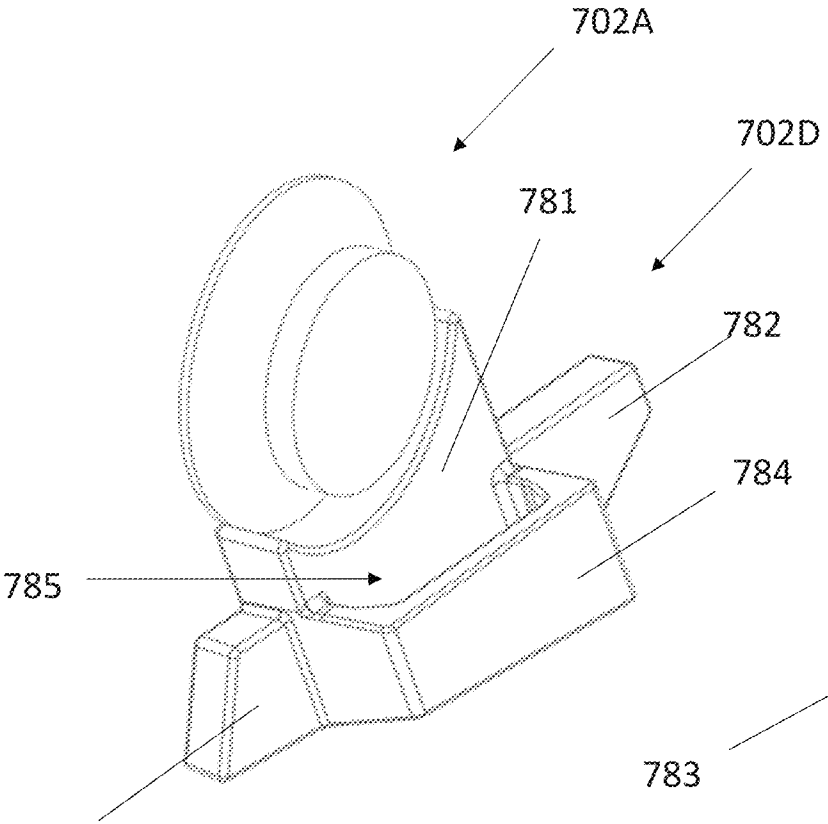
FIG. 34 depicts a perspective view of the first damping element and second damping element of the golf club head of FIG. 26.
Figure 37:
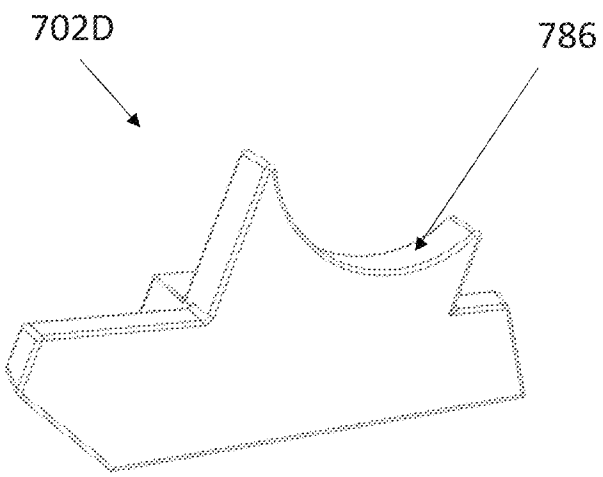
FIG. 37 depicts an additional perspective view of the second damping element of the golf club head of FIG. 26.
Figure 36:
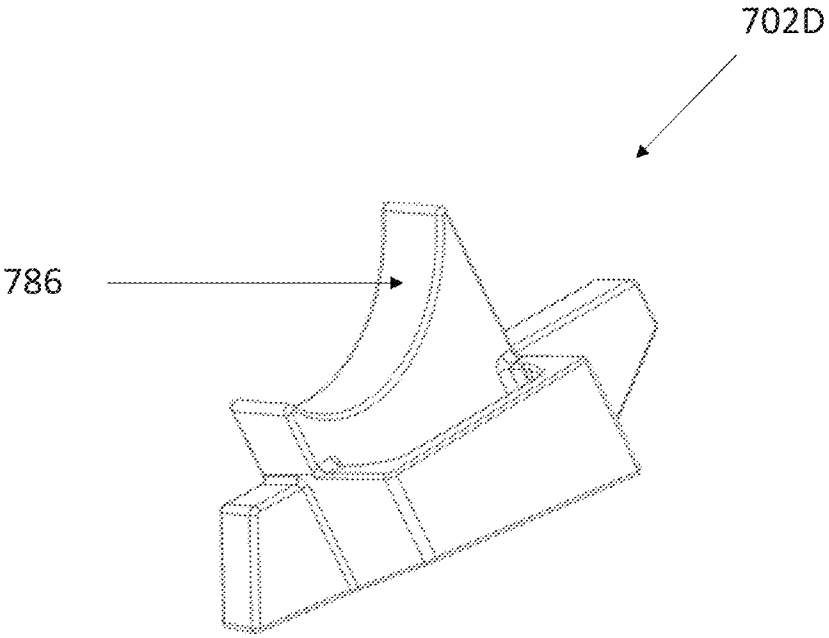
FIG. 36 depicts a perspective view of the second damping element of the golf club head of FIG. 26.

FIGS. 26-33 depict an additional embodiment of a golf club head 700 having a first damping element 702A and a second damping element 702D. FIG. 26 depicts a perspective view of the golf club head 700. FIG. 27 depicts a side view of the golf club head 700 of FIG. 26. FIG. 28 depicts a section view H-H of the golf club head 700 of FIG. 26 missing the weight member 710, the second damping element 702D, and the first damping element 702A. FIG. 29 depicts a section view H-H of the golf club head 700 of FIG. 26 missing the weight member 710 and the second damping element 702D. FIG. 30 depicts a section view H-H of the golf club head 700 of FIG. 26 missing the weight member 710. FIG. 31 depicts a section view H-H of the golf club head 700 of FIG. 26. FIG. 32 depicts a section view I-I of the golf club head 700 of FIG. 27 missing the weight member 710. FIG. 33 depicts a section view J-J of the golf club head 700 of FIG. 27. FIGS. 34 and 35 depict perspective views of the first damping element 702A and second damping element 702D. FIGS. 36 and 37 depict perspective views of the second damping element 702D.

The golf club head 700 illustrated in FIGS. 26-33 is an iron having a cavity back construction and includes a periphery portion 701 surrounding and extending rearward from the striking face 718. The periphery portion 701 includes the sole 705, the toe 706, and the topline 707. The periphery portion 701 can also include a weight member 710. The periphery portion can also include a back portion 712, which may partially enclose the cavity 720, as illustrated in FIG. 26. In other embodiments, the back portion can substantially enclose the cavity, as illustrated in FIG. 15A. The periphery portion 701 of the golf club head 700 can include a cantilever support arm affixed to and extending from the sole 705. As illustrated in FIG. 28, the support arm 762 can extend substantially parallel to the striking face 718. As illustrated in FIG. 29, the golf club head 700 can include a first damping element 702A disposed between the rear surface 719 of the striking face 718 and the cantilever support arm 762. As illustrated in FIG. 26, the first damping element 702A includes a front surface 703A which contacts a central portion of the striking face 718. The damping element 702A can support the striking face 718 and offer damping properties, as described above. In other embodiments, the back portion can substantially enclose the cavity, as illustrated in FIG. 15A. In such embodiments, the first damping element can be disposed between the rear surface of the striking face and the back portion.

As illustrated in FIGS. 26 and 30-33, the golf club head can include a second damping element 702D, which is shown along with the first damping element 702A in FIGS. 34 and 35, and in isolation in FIGS. 36 and 37. As illustrated, a portion of the second damping element 702D can be disposed between the rear surface 719 of the striking face 718 and the support arm 762. The second damping element 702D can be located further from the geometric center of the striking face 718 than the first damping element 702A. More specifically, the second damping element 702D can be located proximate the sole 705. The second damping element 702D includes a front surface 703B in contact with the rear surface 719 of the striking face 718 and a rear surface 781 in contact with the support arm 762. The second damping element 702D can include a toe portion 782 which extends toewards of the support arm 762. The second damping element 702D can include a heel portion 783 which extends heelwards of the support arm 762. The second damping element 702D can include a rear portion 784 which extends around the support arm 762, forming a cavity 785 configured to accept the support arm. In some embodiments, as illustrated in FIG. 705, the golf club head can include a weight member 710 located and spaced rearward of the support arm, and the rear portion 784 of the second damping element 702D can reside between the weight member 710 and the support arm 762. The weight member 710 can be formed integrally with another portion of the golf club head 700, or can be a different material bonded to the golf club head 700. The second damping element 702D can include a relief 786 formed in the top of the damping element 702D configured to complement the shape of the first damping element 702A. The second damping element 702D can be formed of an elastomeric material that is deformable and offers damping properties. In one embodiment, the first damping element 702A has a higher elastic modulus than the second damping element 702D. In an alternative embodiment, the second damping element 702D has a higher elastic modulus than the first damping element 702A. In yet another embodiment, the first damping element 702A has a substantially similar elastic modulus as the second damping element 702D.

In addition to the materials disclosed already, the damping elements, and more specifically the second damping element 702D can comprise a damping foam. In one embodiment, the second damping element 702D may be formed separately from the golf club head and subsequently installed. In another embodiment, the second damping element 702D can be co-molded with the golf club head so as to specifically fit the geometry of that particular club. In other embodiments, the second damping element 702D may be specifically chosen or formed to meet the specific geometry of a particular golf club head.

In an alternative embodiment, not illustrated, the first damping element 702A and second damping element 702D may be formed monolithically out of a single piece of material such that a single damping element includes the features of both the first and second damping elements. In yet another embodiment, more than one piece of material may comprise the first and/or second damping element.

Figure 39:
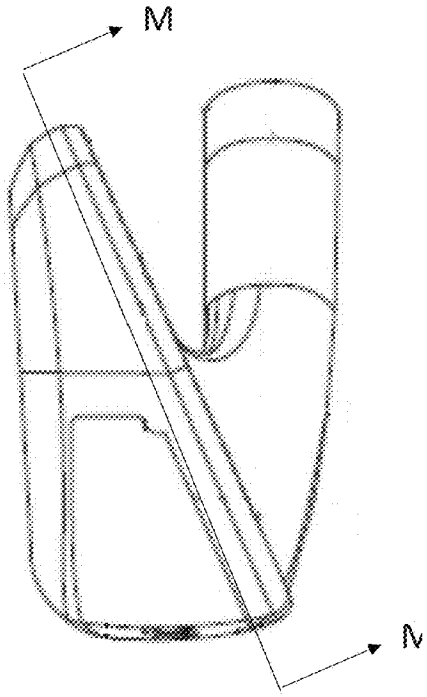
FIG. 39 depicts a side view of the golf club head of FIG. 38.
Figure 38:
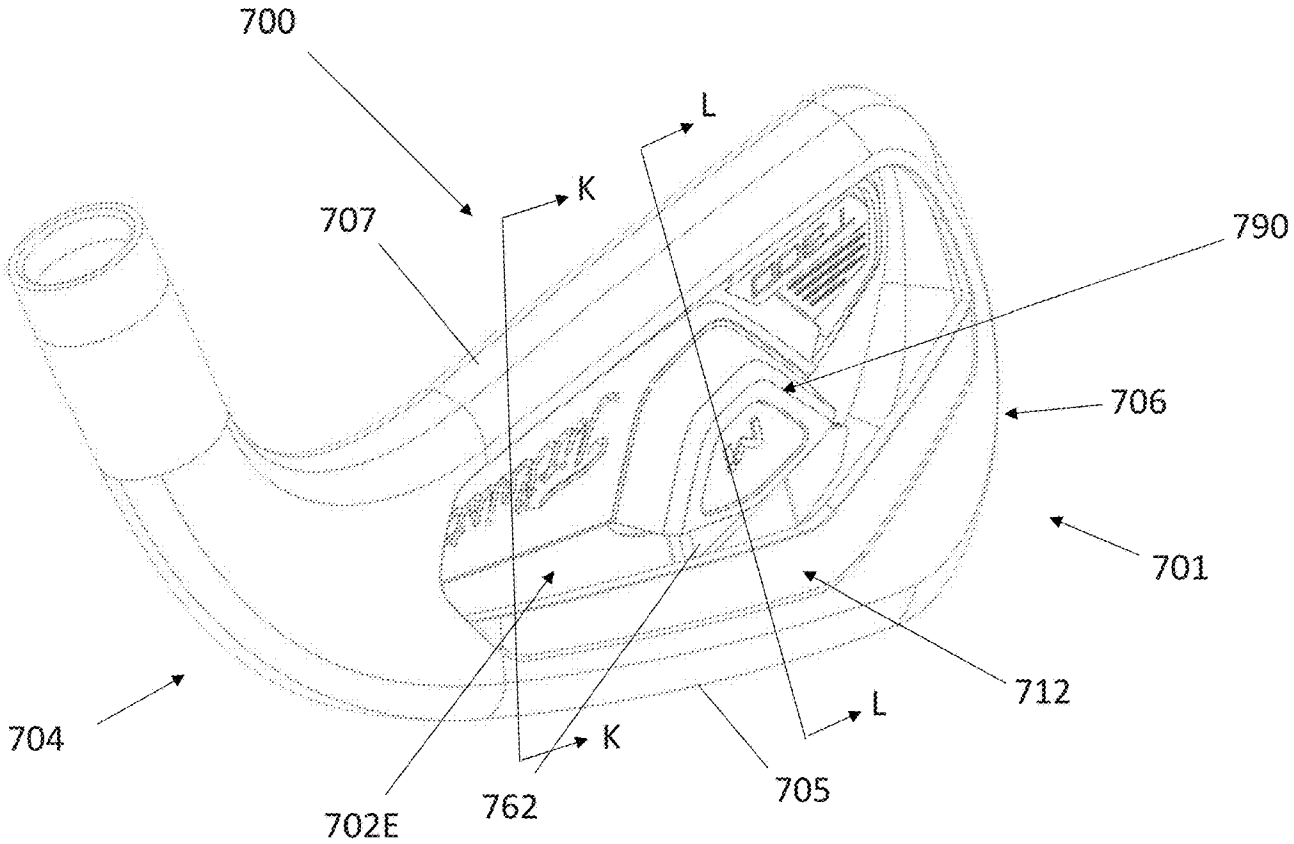
FIG. 38 depicts a perspective view of an additional embodiment of a golf club head.
Figure 40:
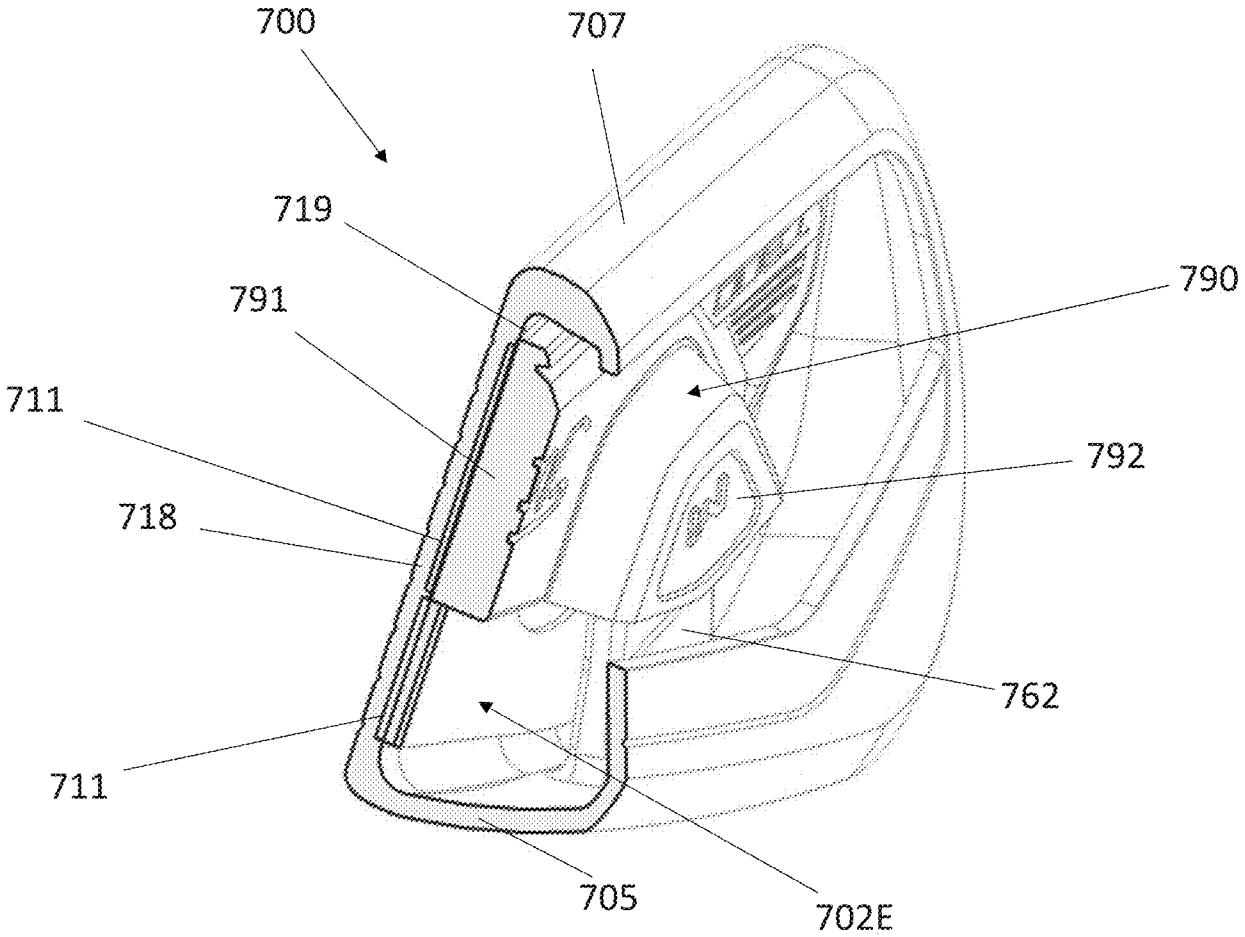
FIG. 40 depicts a section view K-K of the golf club head of FIG. 38.
Figure 42:
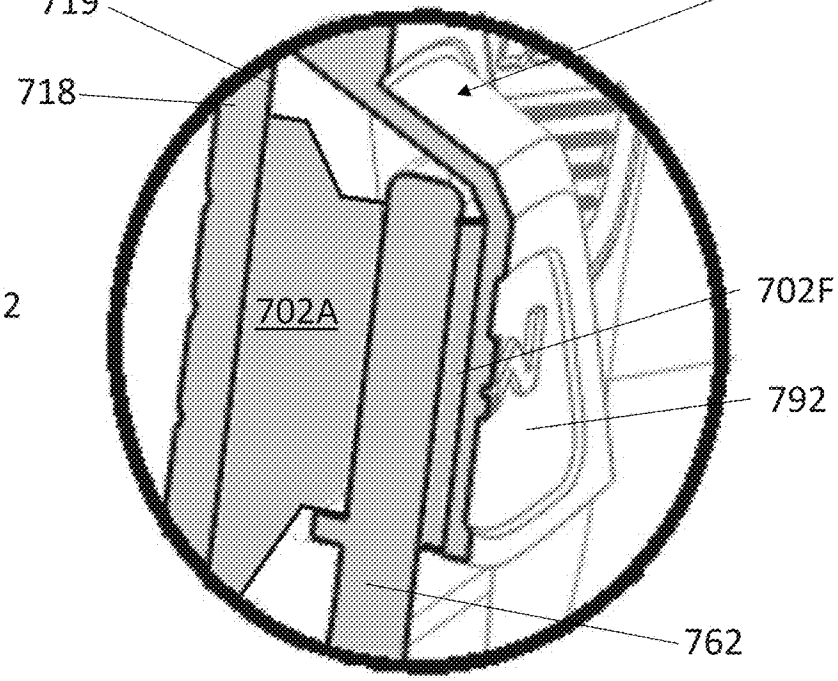
FIG. 42 depicts a detail view of FIG. 41.
Figure 41:
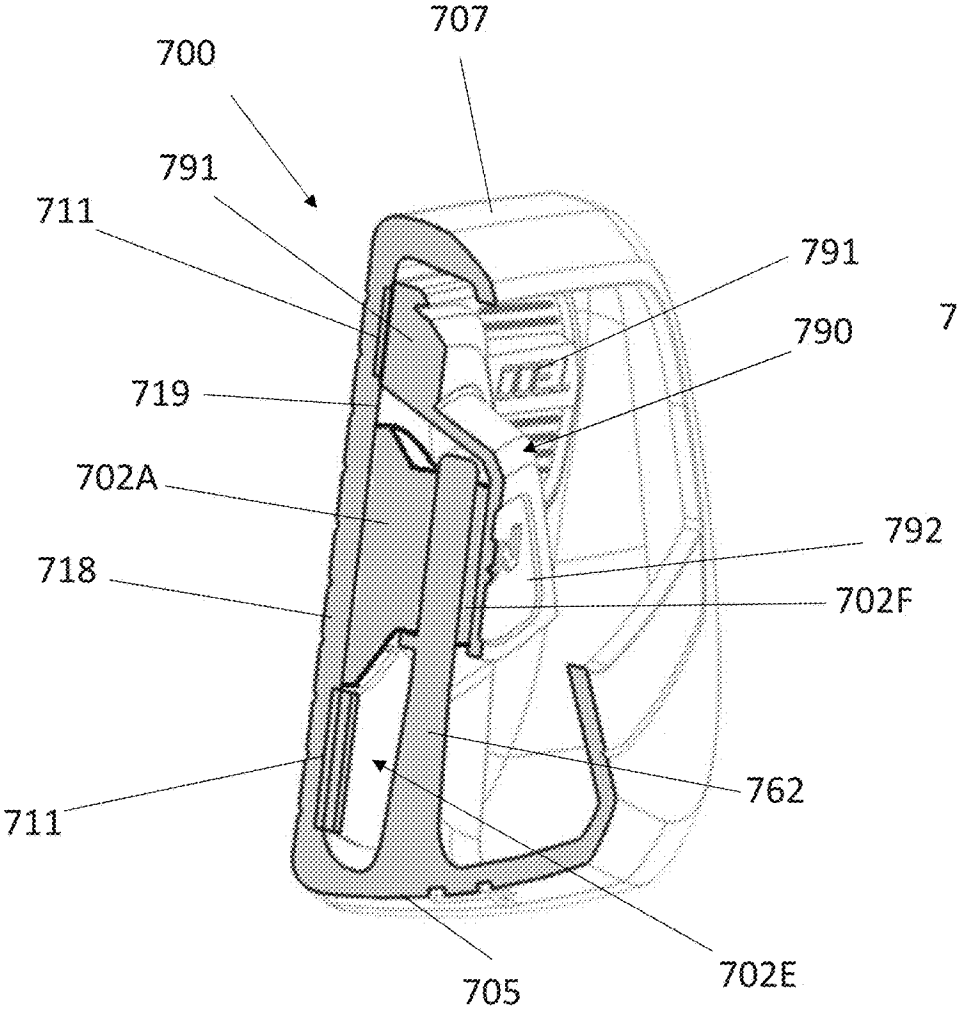
FIG. 41 depicts a section view L-L of the golf club head of FIG. 38.
Figure 43:
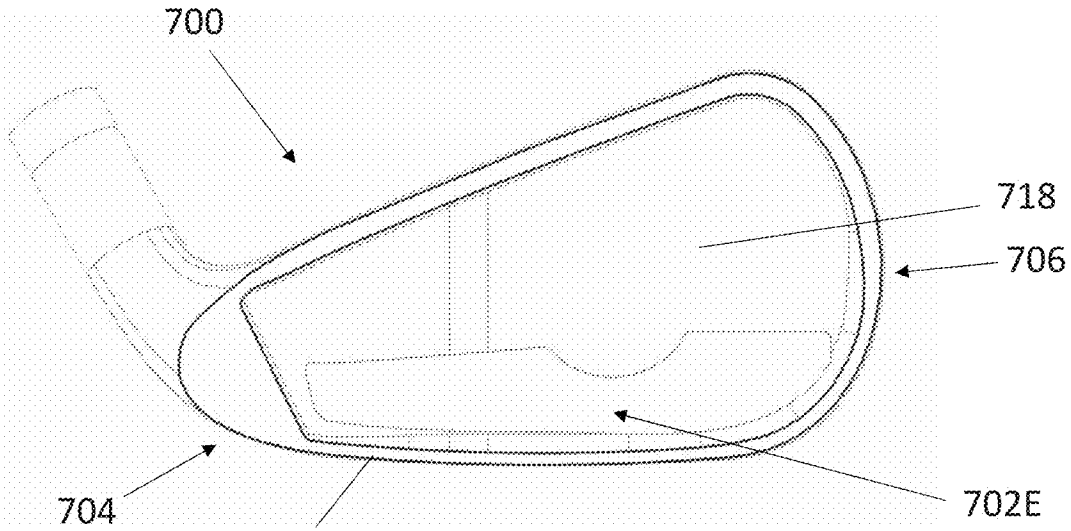
FIG. 43 depicts a section view M-M of the golf club head of FIG. 38 missing the first damping element.
Figure 44:
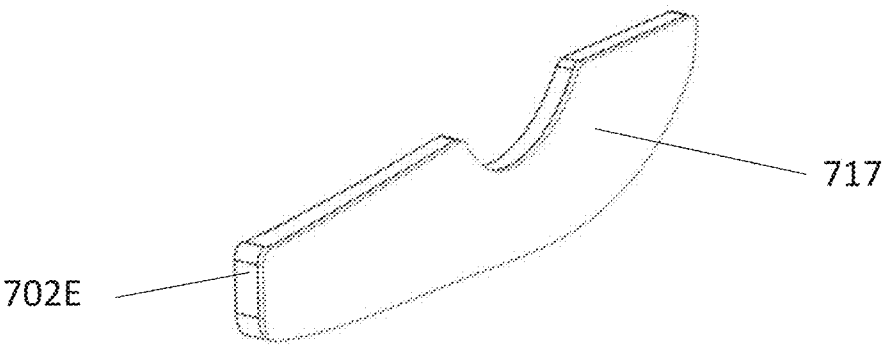
FIG. 44 depicts a perspective view of the second damping element of the golf club head of FIG. 38.

FIGS. 38-42 depict an additional embodiment of a golf club head 700 having a first damping element 702A and a second damping element 702E. FIG. 38 depicts a perspective view of the golf club head 700. FIG. 39 depicts a side view of the golf club head 700 of FIG. 38. FIG. 40 depicts a section view K-K of the golf club head 700 of FIG. 38. FIG. 41 depicts a section view L-L of the golf club head 700 of FIG. 38. FIG. 42 depicts a detail view of FIG. 41. FIG. 43 depicts a section view M-M of the golf club head 700 of FIG. 38 missing the first damping element 702A. FIG. 44 depicts a perspective view of the second damping element 702E of the golf club head 700 of FIG. 38.

The golf club head 700 illustrated in FIGS. 38-43 includes a first damping element 702A similar to the one described above and illustrated in FIGS. 26-33 and a different embodiment of a second damping element 702E than the golf club head illustrated in FIGS. 26-33. The second damping element 702E can be affixed to the rear surface 719 of the striking face 718. In some embodiments, the second damping element 702E can be affixed to the striking face via an adhesive 711. The adhesive 711 could be double sided tape, such as 3M Very High Bond tape, epoxy, glue, or a mechanical form of adhesion such as a fastener, rivet, or backing plate. As illustrated, at least a portion of the second damping element 702E can be located below the first damping element 702A. The second damping element 702E can extend toeward of the first damping element 702A and heelward of the first damping element 702A, and may extend substantially from the heel 704 to the toe 706, as illustrated in FIG. 43. The second damping element 702E can have a relief configured to complement the shape of the first damping element 702A. In an alternative embodiment the second damping element 702E may cover a majority of the rear surface 719 of said striking face 718 which isn't covered by the first damping element 702A.

As illustrated in FIG. 44, a cover 717 can be affixed to the outside surface of the second damping element 702E. The outside surface of the second damping element 702E is located on an opposite side of the second damping element 702E as the striking face 718. In one embodiment, the thickness of the cover 717 is less than the thickness of the second damping element 702E. In one embodiment, the elastic modulus of the cover 717 is higher than the elastic modulus of the second damping element 702E. In one embodiment, the hardness of the cover 717 is higher than the elastic modulus of the second damping element 702E.

The golf club head 700 of FIGS. 38-43 also includes a medallion 790 which improves the appearance of the gold club head 700. Additionally, the medallion 790 can add to the damping qualities of the golf club head 700. As illustrated in FIGS. 38, 40, 41, and 42, a first portion 791 of the medallion 790 is adhered to a rear surface 719 of the striking face 718 and a second portion 792 extends rearwards away from the striking face 718 and behind the support arm 762. In one embodiment, as illustrated in FIGS. 41 and 42, a third damping element 702F is disposed between a rear surface of the support arm 762 and the medallion 790.

Figure 46:
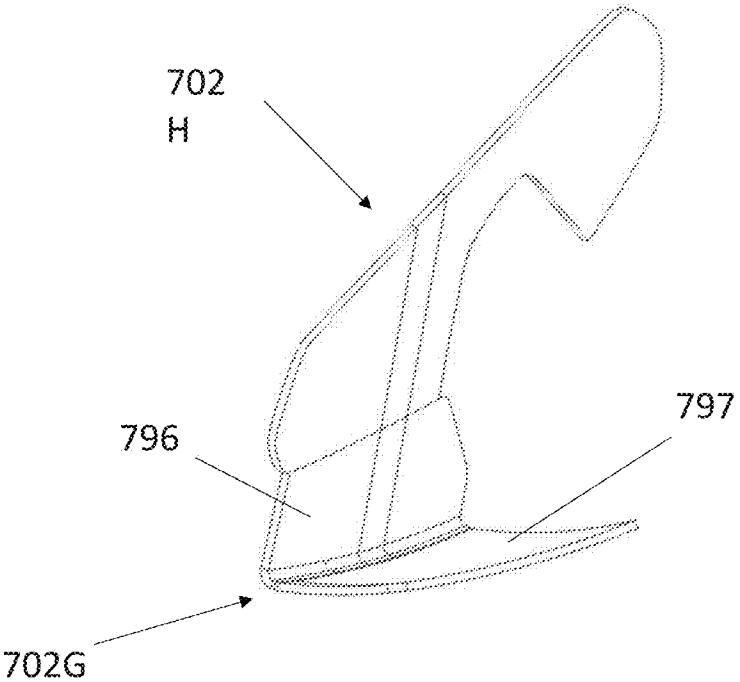
FIG. 46 depicts a perspective view of the second damping element and third damping element of the golf club head of FIG. 45.
Figure 45:
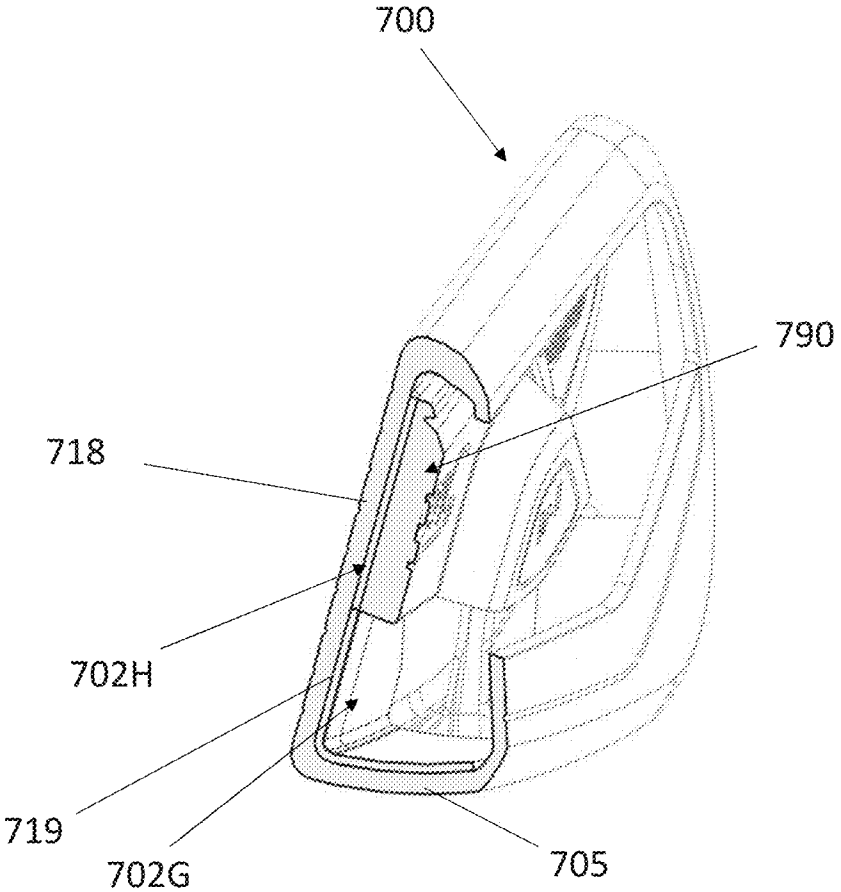
FIG. 45 depicts a section view of an additional embodiment of a golf club head.

FIG. 45 depicts a section view of an additional embodiment of the golf club head 700. FIG. 46 depicts a perspective view of the second damping element 702G and third damping element 702H of the golf club head 700 of FIG. 45. The golf club head 700 includes a first damping element hidden behind the medallion 790, a second damping element 702G and a third damping element 702H. The second damping element 702G is much like the damping element 702E of FIGS. 38-44 in that it has a first portion 796 which is disposed on the rear surface 719 of the striking face 718, except that it also has a second portion 797 which extends rearward from the striking face 718 along the sole 705 in this embodiment. In one embodiment, the golf club head 700 can also include a third damping element 702H, much like the second damping element 702F, except that it covers an upper portion of the rear surface 719 of the striking face 718. In one embodiment, the third damping element 702H is disposed between the rear surface 719 of the striking face 718 and the medallion 790. The third damping element 702H can include a relief configured to complement the shape of the first damping element 702A. In an alternative embodiment, not illustrated, the second damping element 702G and third damping element 702H may be formed monolithically out of a single piece of material such that a single damping element includes the features of both the second and third damping elements. In yet another embodiment, more than one piece of material may comprise the second and/or third damping element.

Additionally, each of the embodiments of golf club heads described herein, particularly in reference to FIGS. 26-46, may include the second damping elements and/or third damping elements described herein without including the first damping element. Additionally, any combination of damping elements described herein may be combined to form a single damping element combining the features of each damping element described herein.

One goal of the damping elements described herein is to dissipate energy of the golf club head after it strikes a golf ball. As the striking face and other portions of the golf club head vibrate, the damping element in contact with those surfaces can dissipate the energy. This can change the sound produced by the golf club head by reducing the loudness and/or duration of the sound produced when the golf club head strikes a golf ball. The damping elements, elastomers, and deformable members described herein can be formed of a viscoelastic material. Tan δ represents the ratio of the viscous to elastic response of a viscoelastic material, which is the energy dissipation potential of the material. The greater Tan δ, the more dissipative the material. More specifically, Tan δ=E"/E', where E" is the loss modulus and represents Energy dissipated by the system, and E' is the storage modulus and represents Energy stored elastically by the system. Tan δ varies depending on temperature and the frequency of vibration. The damping elements described herein are preferably formed of a viscoelastic material which has a peak Tan δ between 3 kHz and 9 kHz within a temperature range of 20° C. to 50° C., and more preferably between 5 kHz and 7 kHz. In some embodiments, the damping elements may be formed of different viscoelastic materials, wherein one damping element has a Tan δ which peaks at a higher frequency than another. In reference to specifically to the golf club head 700 of FIGS. 26-37, the first damping element 702A is formed of a first viscoelastic material, the second damping element 702D is formed of a second viscoelastic material, and the Tan δ of the first viscoelastic material peaks at a first frequency, the Tan δ of the second viscoelastic material peaks at a second frequency, and the first frequency is less than the second frequency. This particular arrangement allows the first damping element to be better able to dampen the striking face vibrations and the second damping element to be better able to dampen the support arm vibrations.

Figure 47:
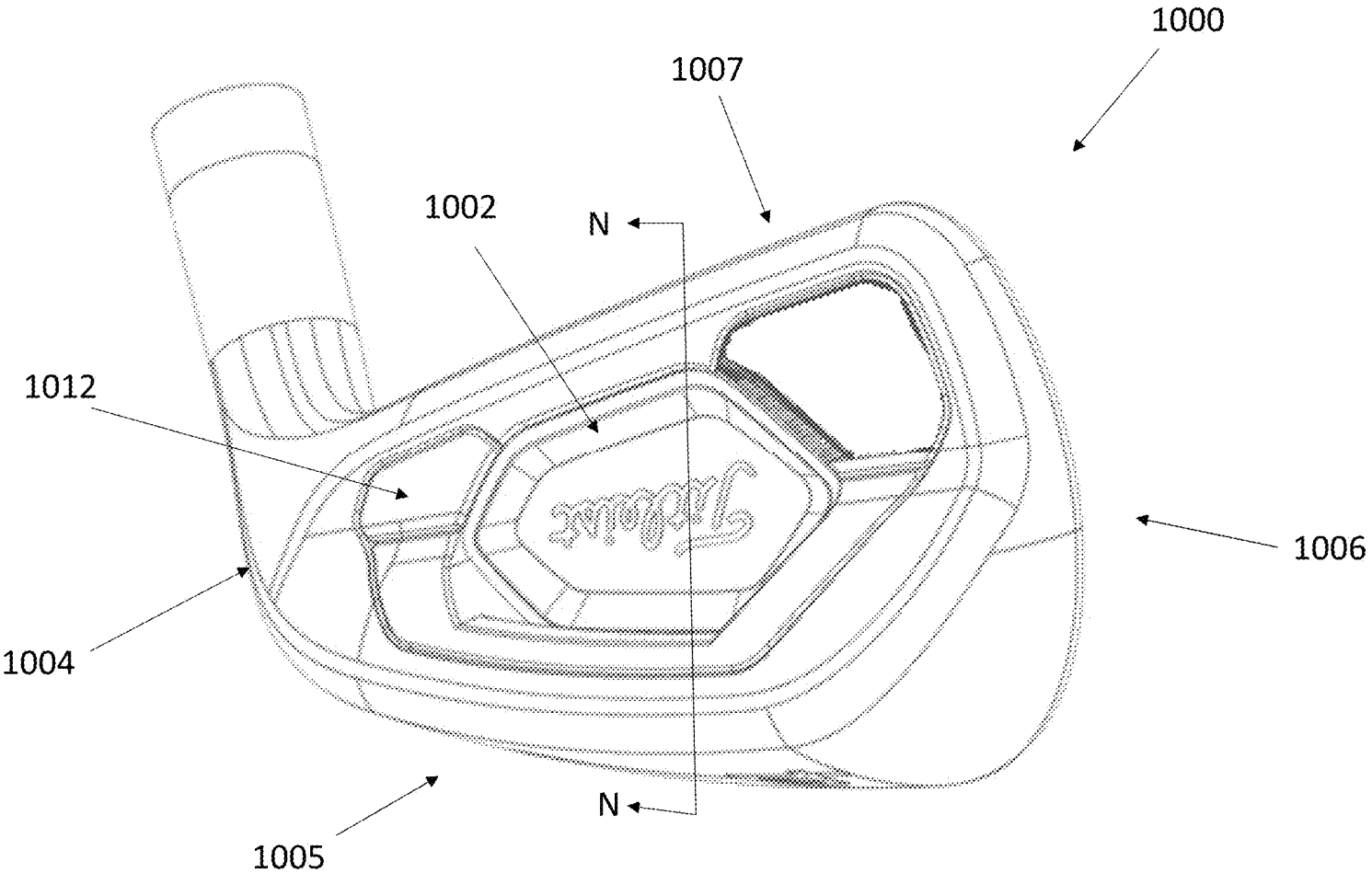
FIG. 47 depicts a perspective view of an additional embodiment of a golf club head.
Figure 49:
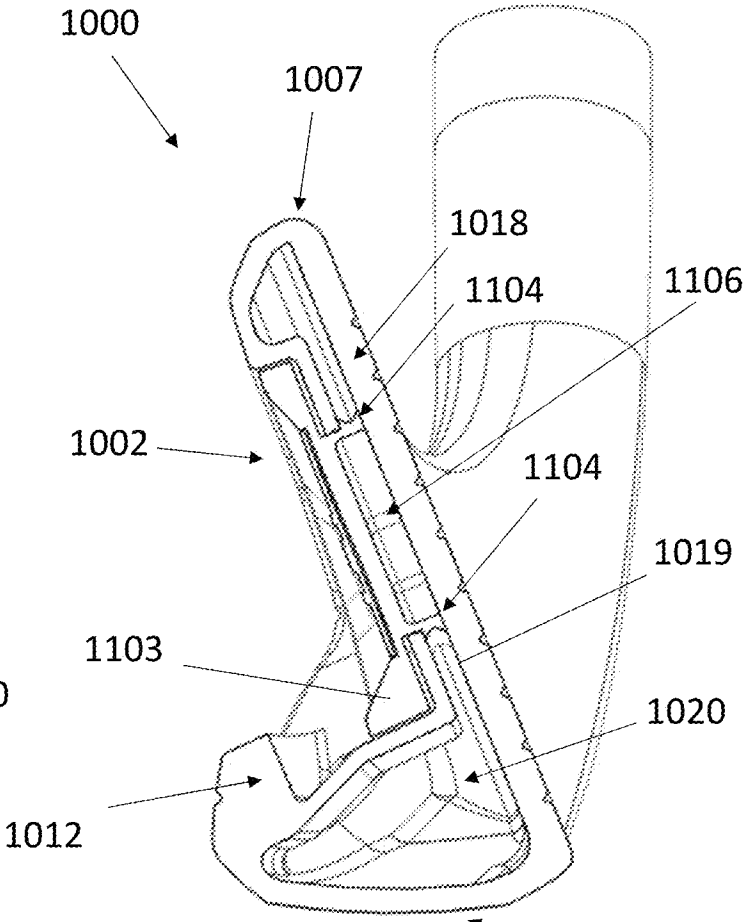
FIG. 49 depicts a side view of cross section N-N of the golf club head of FIG. 47.
Figure 48:
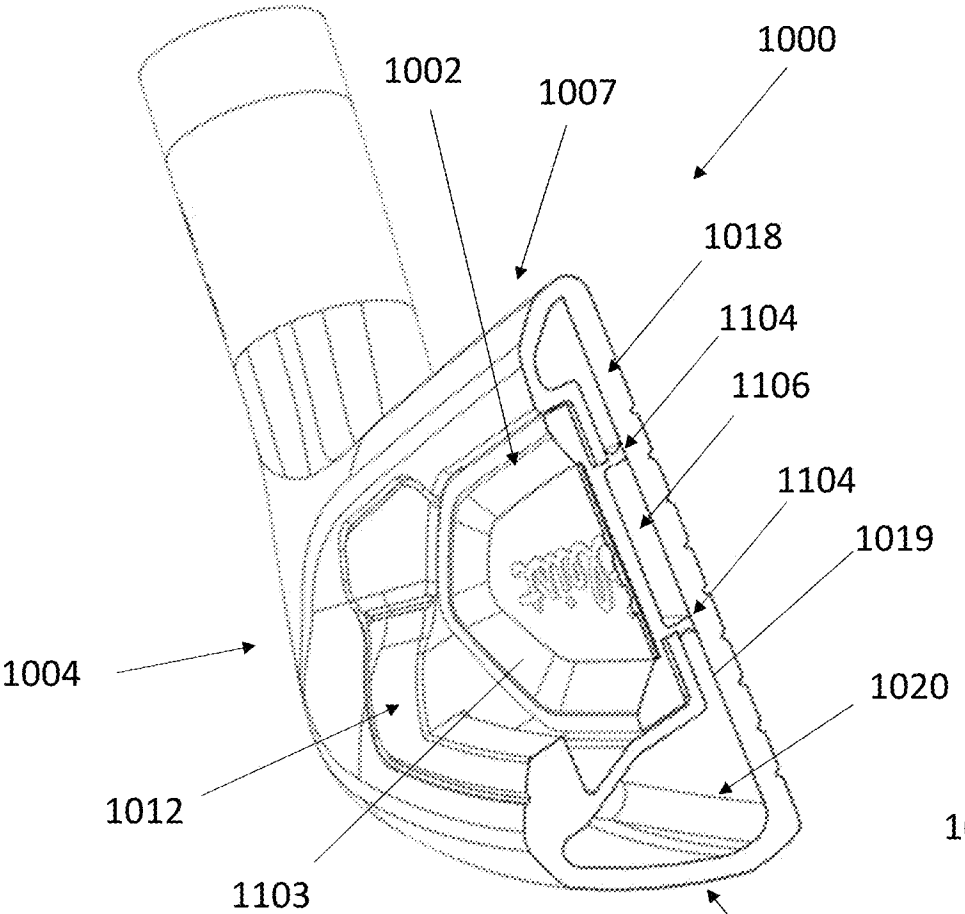
FIG. 48 depicts a perspective view of cross section N-N of the golf club head of FIG. 47.
Figure 50:
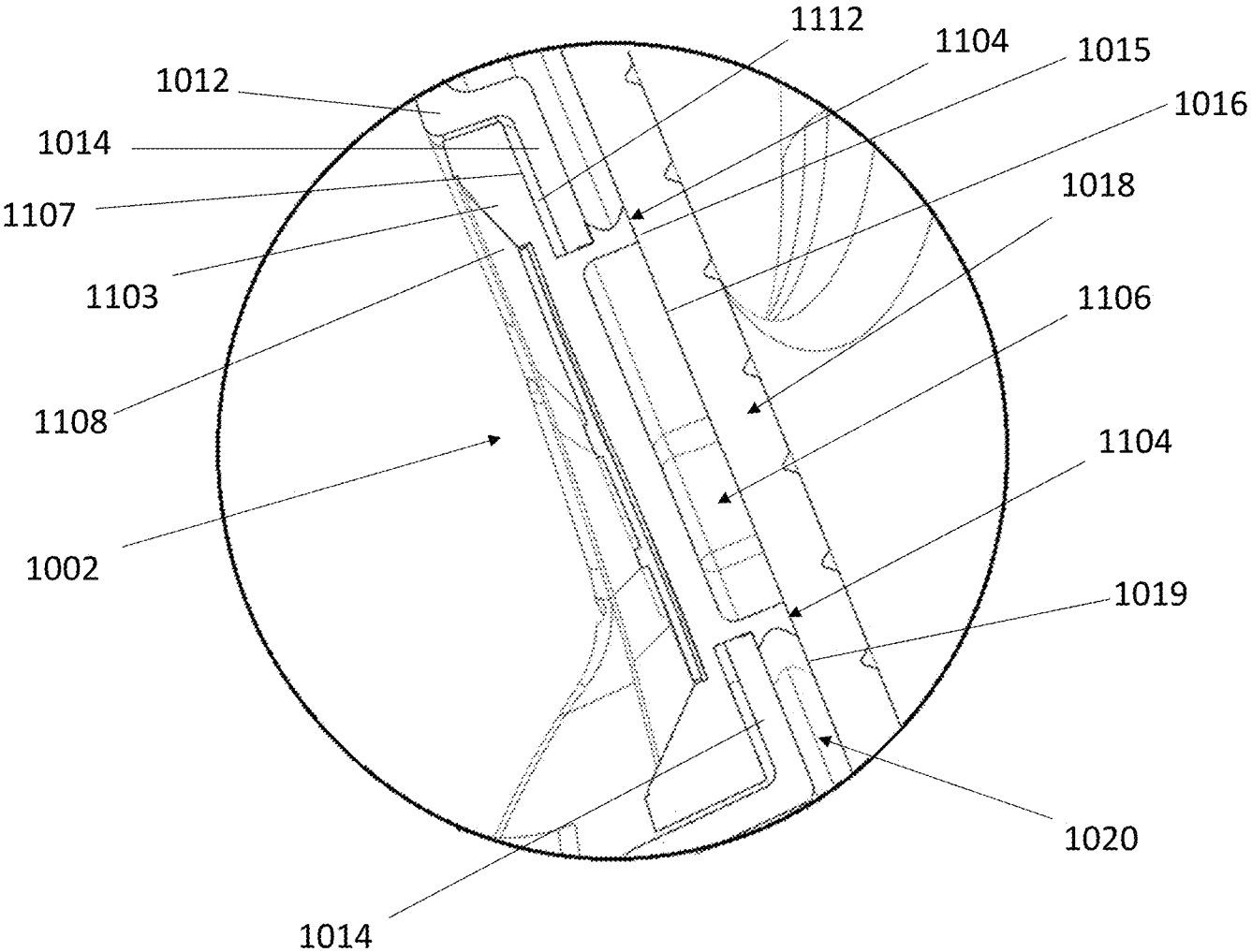
FIG. 50 depicts a detail view of the golf club head of FIG. 49.
Figure 51:
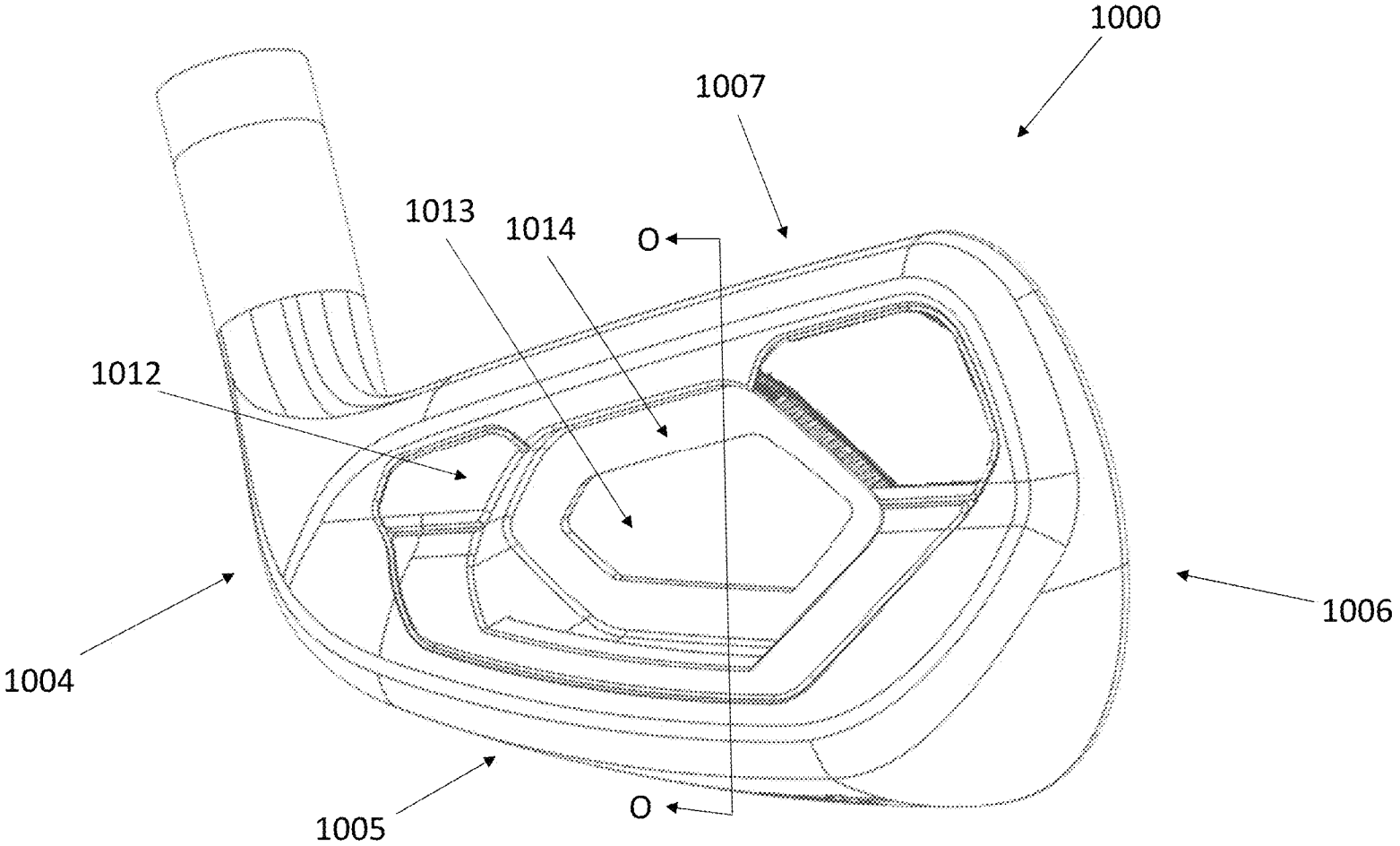
FIG. 51 depicts a perspective view of the golf club head of FIG. 47 missing the damping element.
Figure 53:
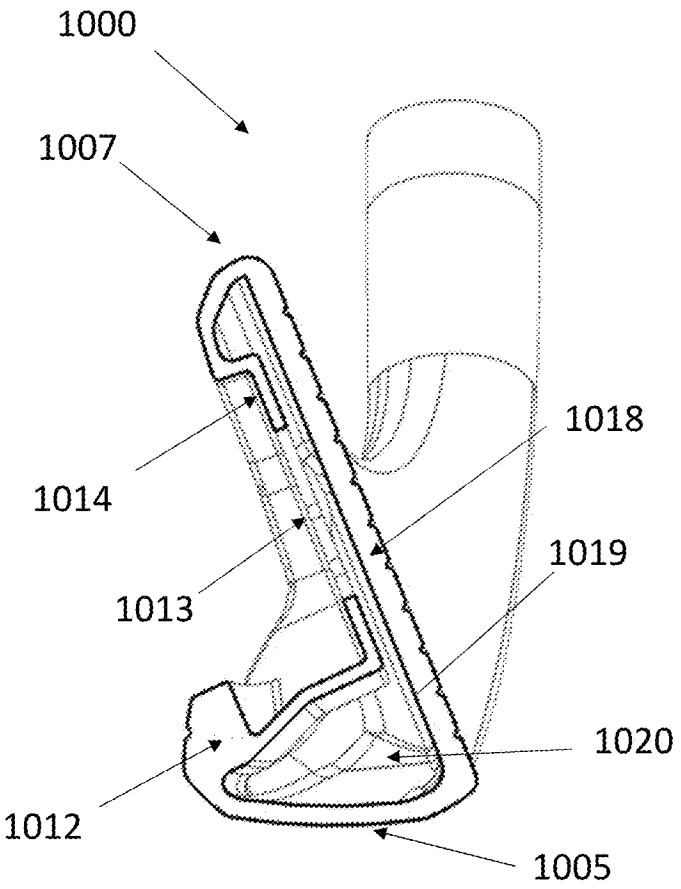
FIG. 53 depicts a side view of cross section O-O of the golf club head of FIG. 51.
Figure 52:
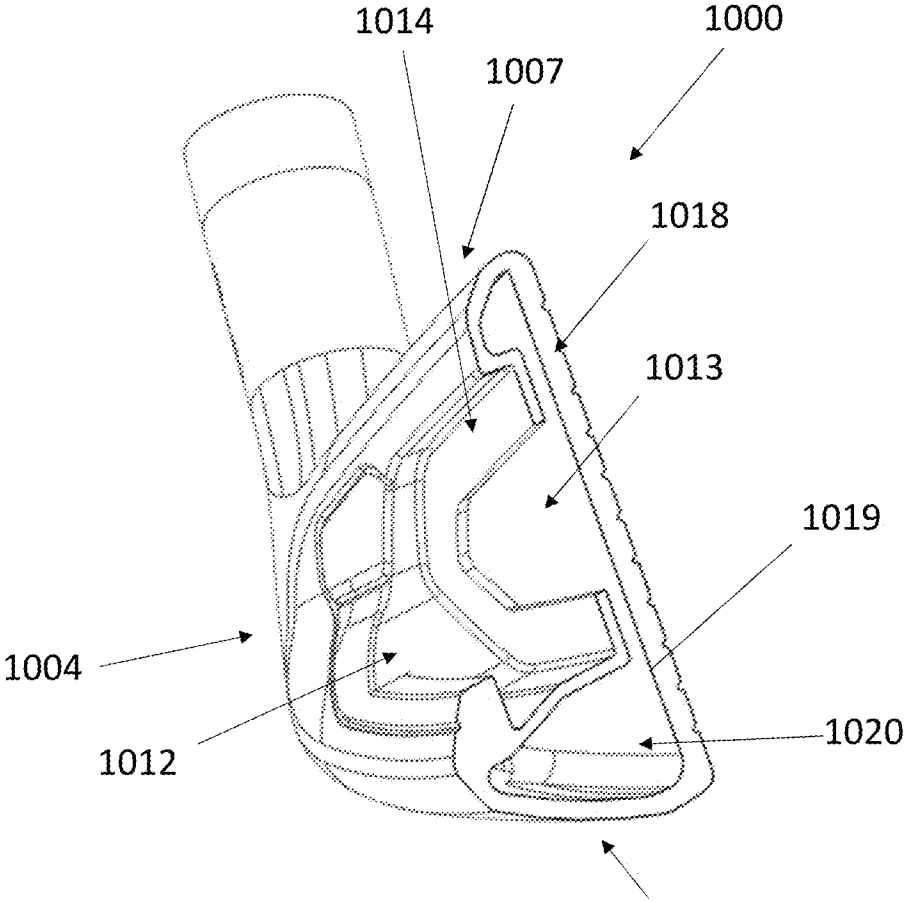
FIG. 52 depicts a perspective view of cross section O-O of the golf club head of FIG. 51.
Figure 55:
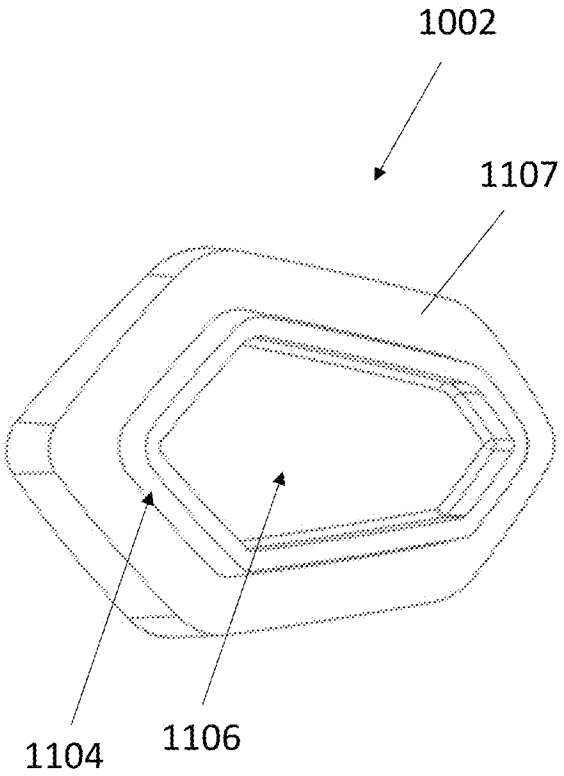
FIG. 55 depicts an additional perspective view of the damping element of the golf club head 1000 of FIG. 47.
Figure 54:
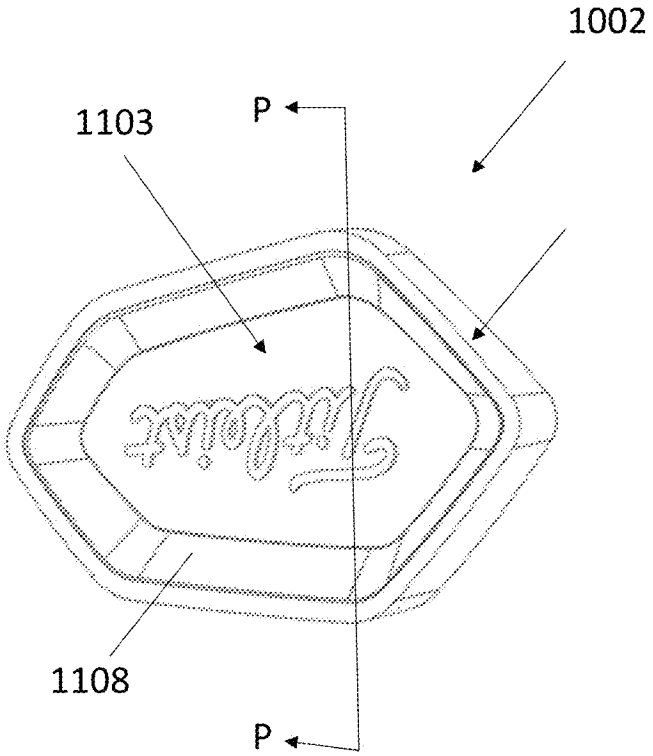
FIG. 54 depicts a perspective view of the damping element of the golf club head of FIG. 47.
Figure 57:
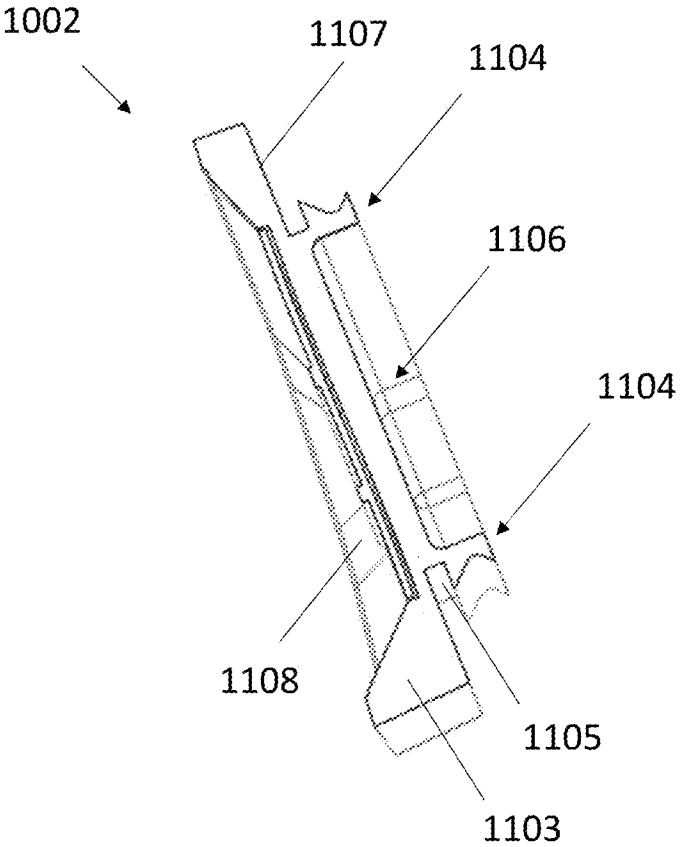
FIG. 57 depicts a side view of cross section P-P of the damping element of FIG. 54.
Figure 56:
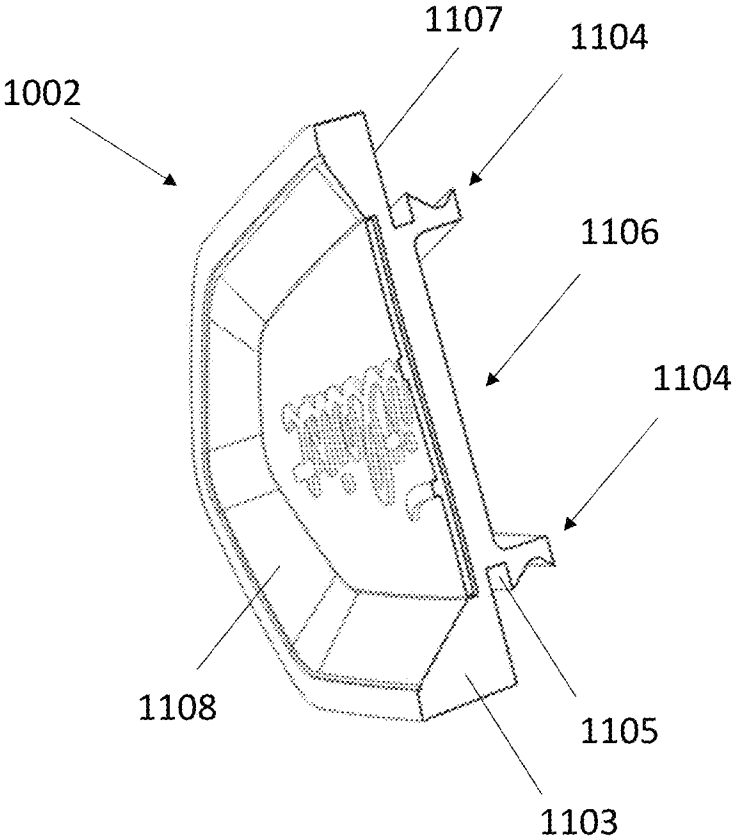
FIG. 56 depicts a perspective view of cross section P-P of the damping element of FIG. 54.
Figure 58:
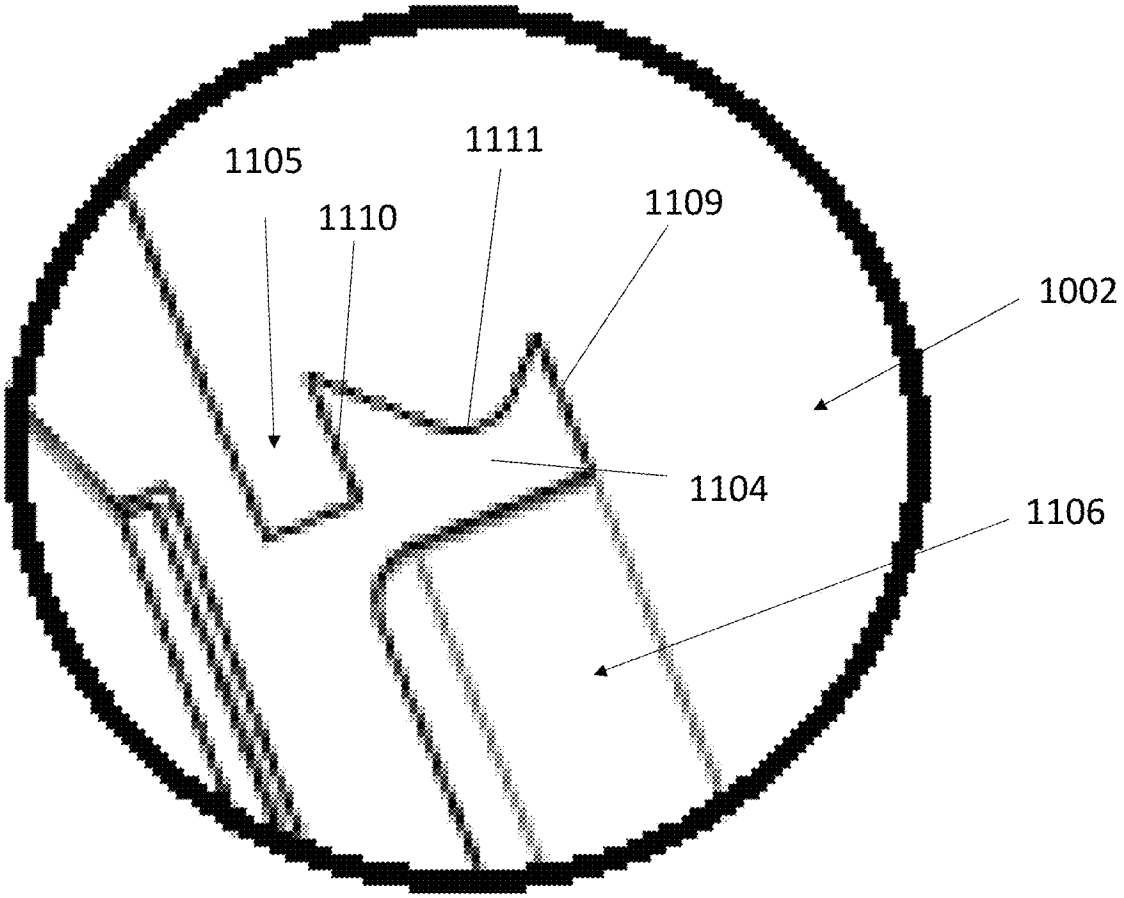
FIG. 58 depicts a detail view of the damping element of FIG. 57.

FIGS. 47-58 depict an additional embodiment of a golf club head 1000 including a damping element 1002. FIG. 47 depicts a perspective view of an additional embodiment of a golf club head 1000. FIG. 48 depicts a perspective view of cross section N-N of the golf club head 1000 of FIG. 47. FIG. 49 depicts a side view of cross section N-N of the golf club head 1000 of FIG. 47. FIG. 50 depicts a detail view of the golf club head 1000 of FIG. 49. FIG. 51 depicts a perspective view of the golf club head 1000 of FIG. 47 missing the damping element 1002. FIG. 52 depicts a perspective view of cross section O-O of the golf club head 1000 of FIG. 51. FIG. 53 depicts a side view of cross section O-O of the golf club head 1000 of FIG. 51. FIG. 54 depicts a perspective view of the damping element 1002 of the golf club head 1000 of FIG. 47. FIG. 55 depicts an additional perspective view of the damping element 1002 of the golf club head 1000 of FIG. 47. FIG. 56 depicts a perspective view of cross section P-P of the damping element 1002 of FIG. 54. FIG. 57 depicts a side view of cross section P-P of the damping element 1002 of FIG. 54. FIG. 58 depicts a detail view of the damping element 1002 of FIG. 57.

The golf club head 1000 includes a striking face 1018 having a rear surface 1019. The golf club head 1000 includes a back portion 1012 configured to support a damping element 1002. The illustrated golf club head 1000 is a hollow body construction and the back portion 1012 covers a substantial portion of the back of the golf club head 1000. The back portion 1012 is located behind the striking face 1018 and extends between the topline 1017 and the sole 1005 from the heel 1004 to the toe 1006 forming a cavity 1020.

As illustrated in FIGS. 51-53, the back portion 1012 of the golf club head 1000 can include an aperture 1013. The aperture 1013 can be surrounded by a shelf 1014. The aperture 103 is configured to receive the damping element 1002 and shelf 1014 is configured to engage and retain the damping element 1002 as illustrated in FIGS. 48-50.

As illustrated in FIGS. 54-57, the damping element 1002 includes an exterior portion 1103 and a damping portion 1104. The exterior portion 1103 resides primarily behind the back portion 1012 of the golf club head 1000. The damping portion 1104 resides primarily within the cavity 1020 of the golf club head 1000 and is configured to abut the rear surface 1019 of the striking face 1018 as illustrated in FIGS. 48-50. A channel 1105 is formed between the exterior portion 1103 and the damping portion 1104, the channel 1105 configured to engage the shelf 1014 of the rear portion 1012 of the golf club head 1000. As illustrated in FIGS. 48, 49, 55, and 57 the damping element 1002 can include a recess formed inside the damping portion 1104 and extending up to the exterior portion 1103. In an alternative embodiment, not illustrated, the damping element 1002 may not include the recess 1106.

The exterior portion 1103 of the damping element 1002 can include a flange surface 1107 configured to abut the shelf 1014 of the golf club head 1000. The exterior portion 1103 can also include an outside surface 1108 opposite the flange surface 1107. The outside surface 1108 can be exterior and thus be designed such that it is aesthetically appealing to the golfer and take the place of a conventional medallion. In some embodiments, as illustrated in FIG. 50, an adhesive 1112 can reside between said flange surface 1107 of said damping element 1002 and said shelf 1014 of said back portion 1012.

As illustrated in FIGS. 48-50, at least a portion of the damping portion 1104 of the damping element 1002 resides between the shelf 1014 and the rear surface 1019 of the striking face 1018, contacting both the shelf 1014 and the rear surface 1019. As illustrated in FIG. 58, the damping portion 1104 of the damping element 1002 can include a front surface 1109 configured to abut the rear surface 1019 of the striking face 1018 and a rear surface 1110 configured to abut the shelf 1014.

In the illustrated embodiments, the damping portion 1104 and the exterior portion 1103 of the damping element are formed monolithically and of the same material. In other, non-illustrated embodiments, the damping portion 1104 and exterior portion 1103 can be formed of different materials and affixed to one another. The damping portion 1104, and thus in the preferred embodiment, the damping element 1102 in its entirety, can be formed of any of the materials disclosed herein when referring to the damping elements, deformable members, and elastomers. Those materials may also include a silicone with a shore A durometer between approximately 50 and 70, which may also have an approximate compression set of 10%, 70 hours, at 212 degrees F., which may also have a tensile strength of approximately 1400 psi. The damping element 1102 is configured to deform as the striking face 1018 deforms upon impact with a golf ball, similar to the other damping elements, deformable members, and elastomers described herein. As illustrated in FIG. 58, the damping portion 1104 can also include relief 1111 configured to aid in the ability of the damping portion 1104 to deform and absorb energy during impact.

As illustrated in FIG. 50, the striking face can have a central unsupported area 1016 surrounded by a supported area 1015. The supported area 1015 is defined by the portion of the rear surface 1019 of the striking face 1018 in contact with the front surface 1109 of the damping portion 1104 of the damping element 1002. The central unsupported area 1016 is defined by the portion of the rear surface 1019 of the striking face 1018 located centrally of said supported area 1015.

In one embodiment, the central unsupported area 1016 can be greater than 100 $mm^2$. In an additional embodiment, the central unsupported area 1016 can be greater than 200 $mm^2$. In an additional embodiment, the central unsupported area 1016 can be greater than 300 $mm^2$. In an additional embodiment, the central unsupported area 1016 can be greater than 400 $mm^2$. In an additional embodiment, the central unsupported area 1016 can be greater than 500 $mm^2$. In one embodiment, the supported area 1015 can be less than 300 $mm^2$. In one embodiment, the supported area 1015 can be less than 250 $mm^2$. In an additional embodiment, the supported area 1015 can be less than 200 $mm^2$. In an additional embodiment, the supported area 1015 can be less than 150 $mm^2$. In an additional embodiment, the supported area 1015 can be less than 125 $mm^2$. In an additional embodiment, the supported area 1015 can be less than 100 $mm^2$. In one embodiment, a ratio of the central unsupported area 1016 divided by the supported area 1015 is greater than or equal to 1.0. In an additional embodiment, a ratio of the central unsupported area 1016 divided by the supported area 1015 is greater than or equal to 1.5. In one embodiment, a ratio of the central unsupported area 1016 divided by the supported area 1015 is greater than or equal to 2.0. In one embodiment, a ratio of the central unsupported area 1016 divided by the supported area 1015 is greater than or equal to 2.5. In one embodiment, a ratio of the central unsupported area 1016 divided by the supported area 1015 is greater than or equal to 3.0. In one embodiment, a ratio of the central unsupported area 1016 divided by the supported area 1015 is greater than or equal to 3.5. In one embodiment, a ratio of the central unsupported area 1016 divided by the supported area 1015 is greater than or equal to 4.0. In one embodiment, a ratio of the central unsupported area 1016 divided by the supported area 1015 is greater than or equal to 4.5. In one embodiment, a ratio of the central unsupported area 1016 divided by the supported area 1015 is greater than or equal to 5.0.

Figure 60:
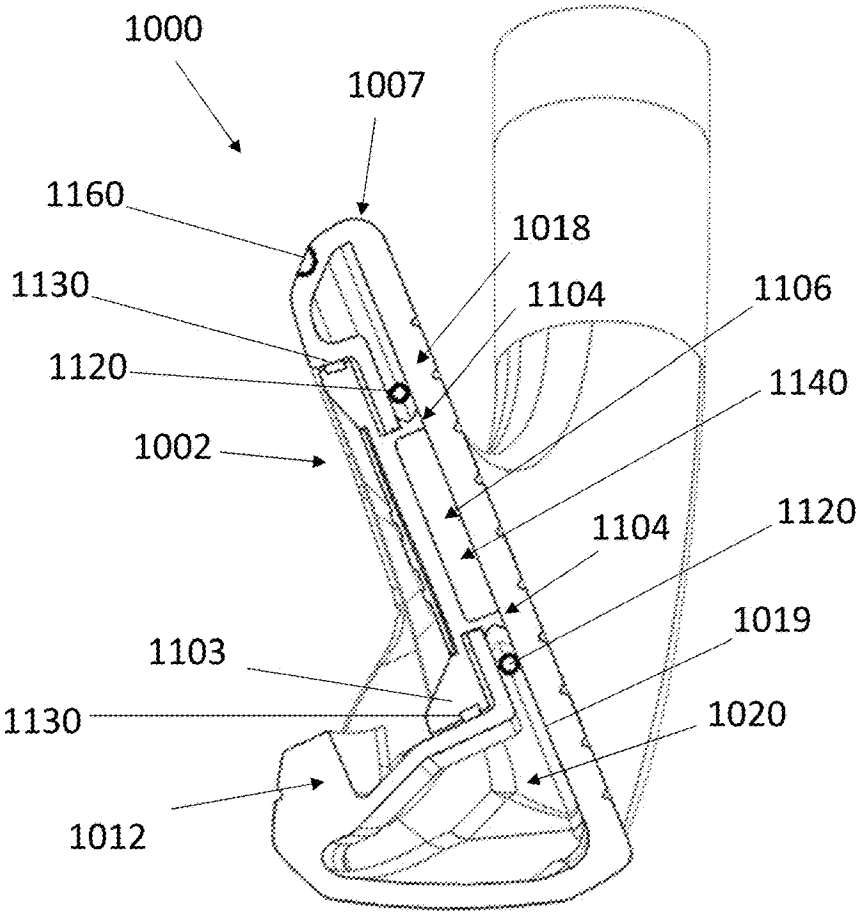
FIG. 60 depicts a side view of cross section Q-Q view of the golf club head of FIG. 59.
Figure 59:
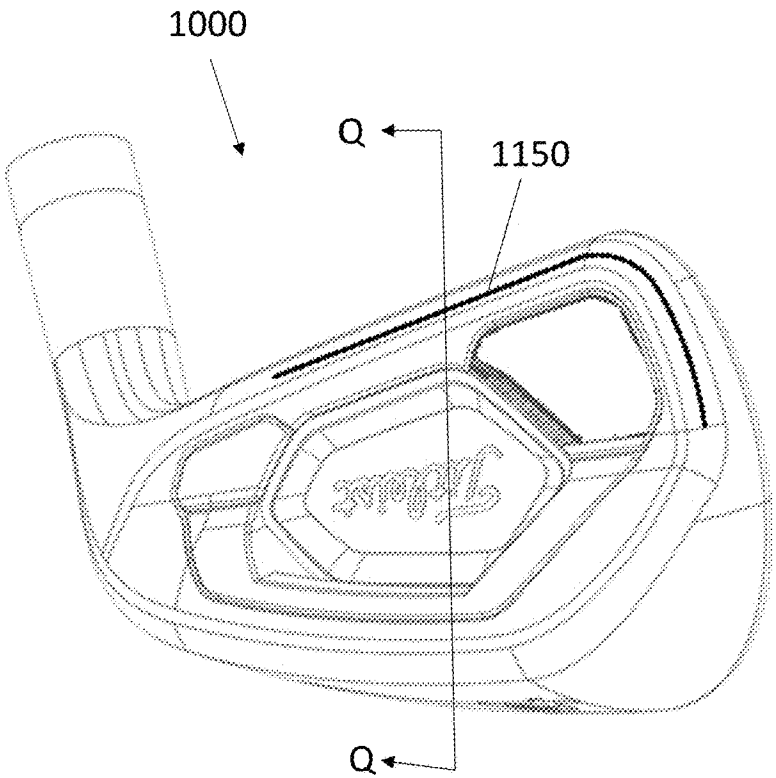
FIG. 59 depicts a perspective view of an additional embodiment of a golf club head.

FIG. 59 depicts a perspective view of an additional embodiment of a golf club head 1000. FIG. 60 depicts a side view of cross section Q-Q view of the golf club head 1000 of FIG. 59. The golf club head 100 illustrated in FIGS. 59 and 60 includes a few additional features. In one embodiment, the golf club head 1000 includes a second damping element 1120. In the illustrated embodiment, the second damping element 1120 is an o-ring shaped elastomer which resides between the striking face 1018 and the back portion 1012. The second damping element 1120 can form a continuous loop, surrounding the damping element 1002. In some embodiments, the back portion may include a relief configured to receive a portion of the second damping element.

In one embodiment, the golf club head can include a third damping element 1130. The third damping element can reside around the top (illustrated in FIG. 60), bottom (illustrated in FIG. 60), heel side (not illustrated), and toe side (not illustrated) of the exterior portion 1103 of the damping element 1102 between the exterior portion 1103 and the back portion 1012 of the golf club head.

In one embodiment, the golf club head 1000 includes a fourth damping element 1140. The fourth damping element 1140 can reside within the recess 1106 of the damping element 1102. In one embodiment, the fourth damping element 1140 can comprise hot melt. In another embodiment it could include an elastomer. In another embodiment it could include a rubber. In another embodiment it could include a foam. In another embodiment, the fourth damping element 1140 could be softer and thus have a lower hardness value than the damping element 1002. In one embodiment, the fourth damping element 1140 could be formed of a silicone.

In one embodiment, the golf club head 1000 includes a fifth damping element 1150. The golf club head can include a slot configured to receive the fifth damping element 1150 which is preferably a rubber. In one embodiment the slot can be formed in the back portion 1112 of the golf club head. In another embodiment the slot can be formed in one or more of the following: the back portion 1112, the topline 1007, the toe 1006, the sole 1005.

Figure 61:
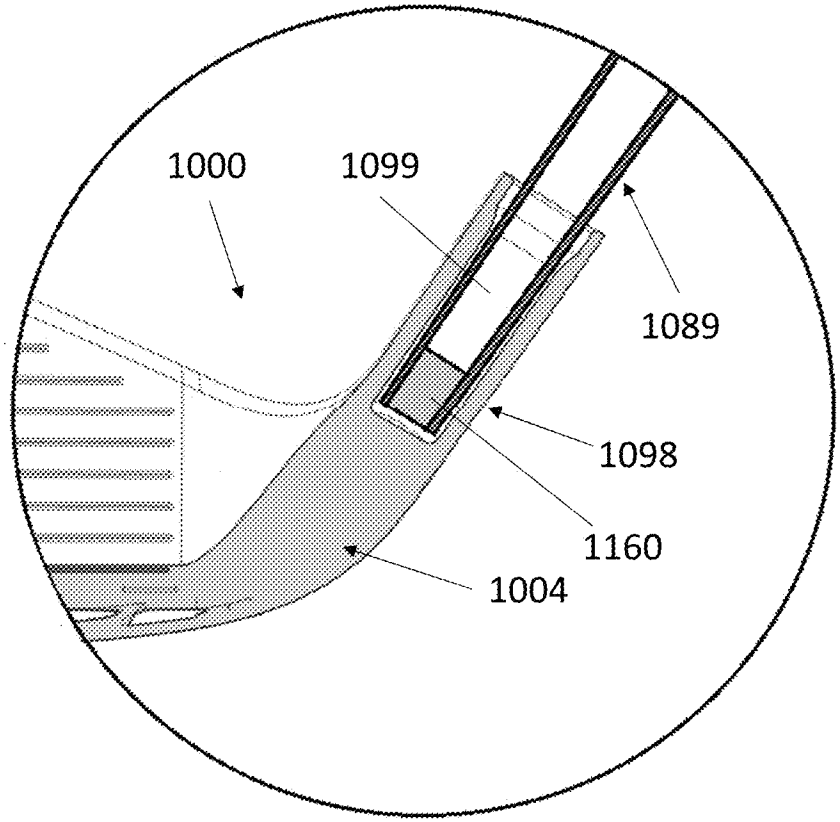
FIG. 61 depicts an additional cross section view of the golf club head of FIG. 59 including a golf club shaft and a sixth damping element.

FIG. 61 illustrates an additional cross section view of the golf club head 1000 of FIG. 59 including a golf club shaft 1089 and a sixth damping element 1160. The hosel 1098 of the golf club head includes a hosel bore 1099 configured to receive a shaft 1089. In one embodiment, the hosel bore 1099 can also receive a sixth damping element 1160 which can take the form of a plug as illustrated in FIG. 60.

Figure 63:
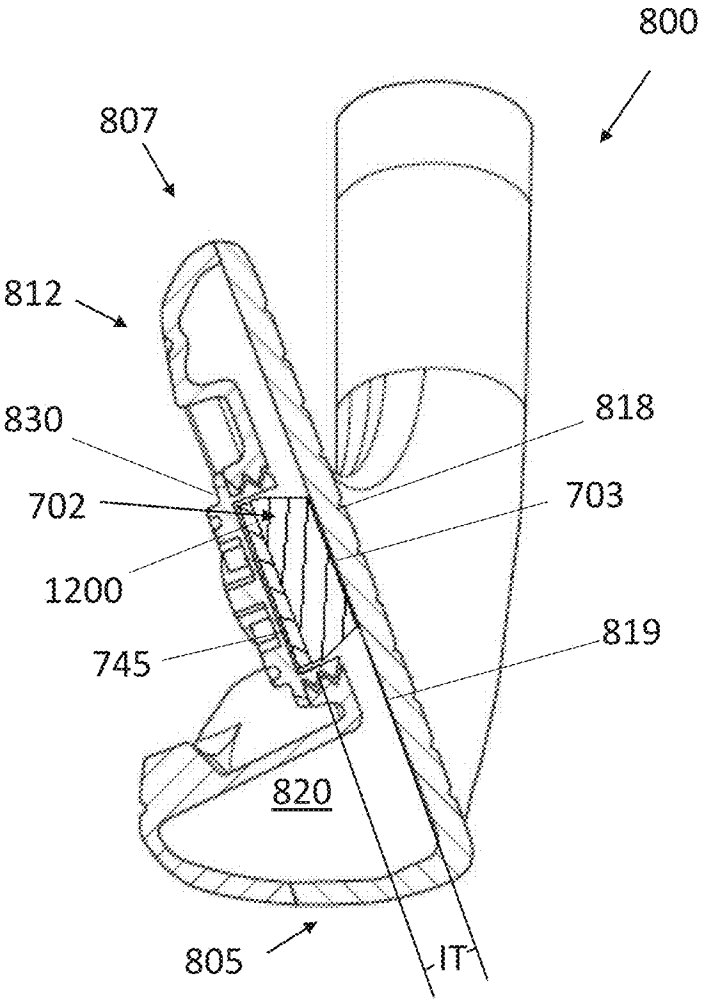
FIG. 63 depicts a section view E-E of the golf club head of FIG. 15A including an additional embodiment of a deformable member.
Figure 62:
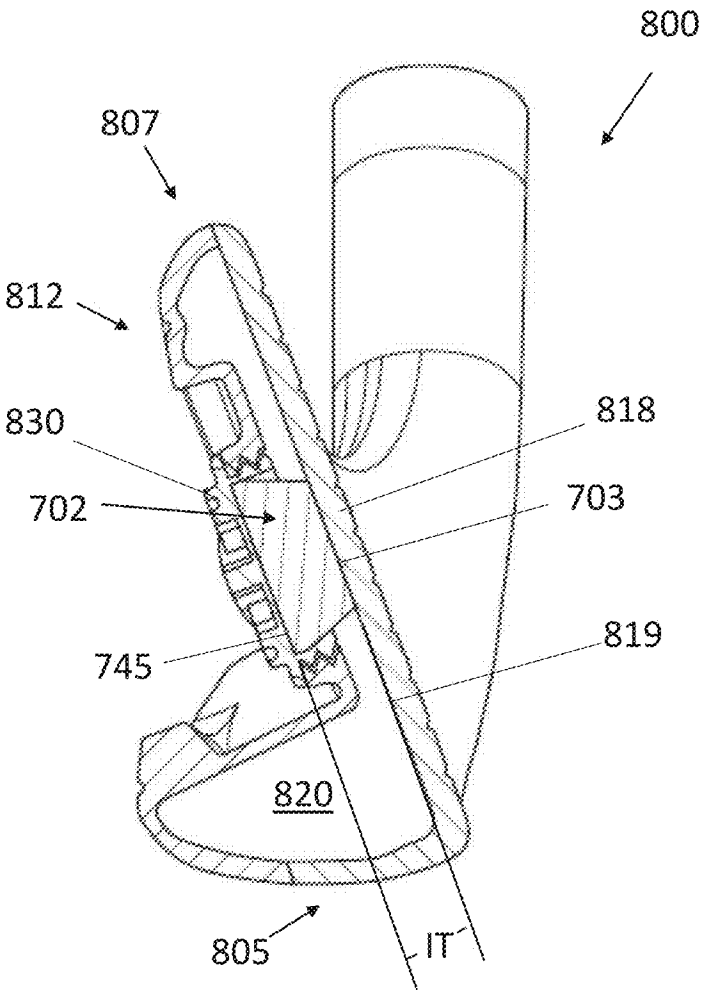
FIG. 62 depicts a section view E-E of the golf club head of FIG. 15A including an additional embodiment of a deformable member.
Figure 65:
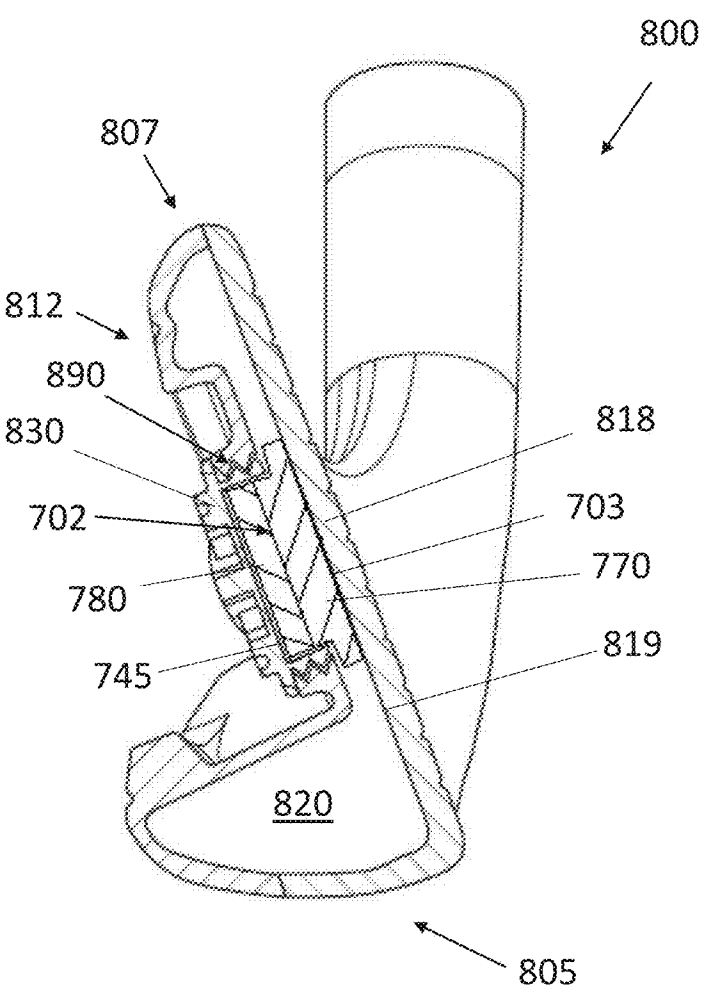
FIG. 65 depicts a section view E-E of the golf club head of FIG. 15A including an additional embodiment of a deformable member.
Figure 64:
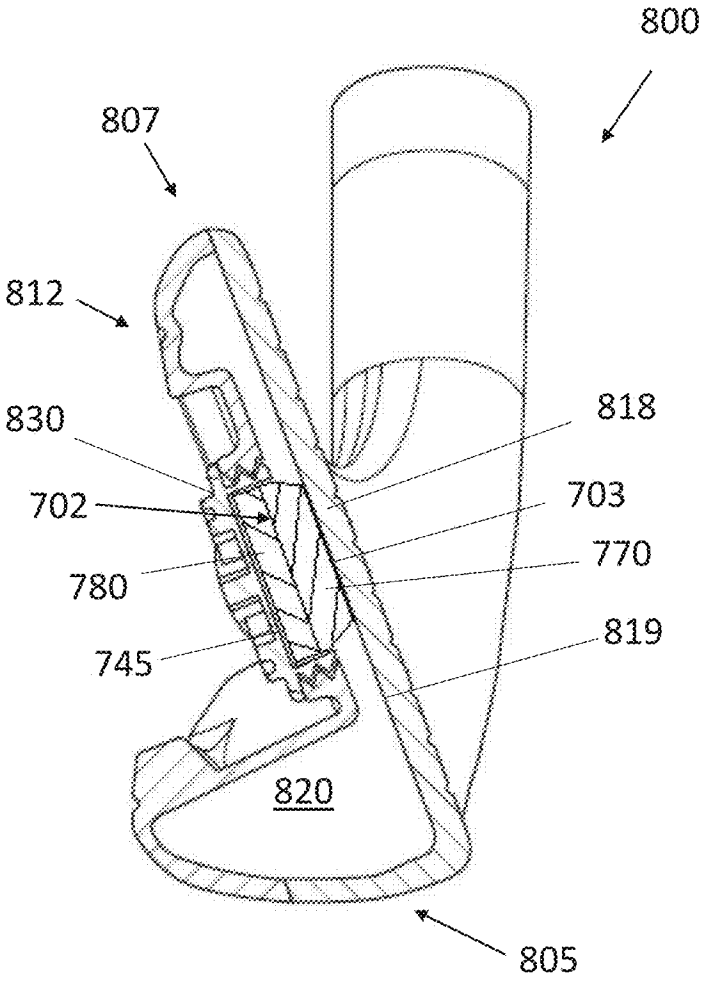
FIG. 64 depicts a section view E-E of the golf club head of FIG. 15A including an additional embodiment of a deformable member.
Figure 66:
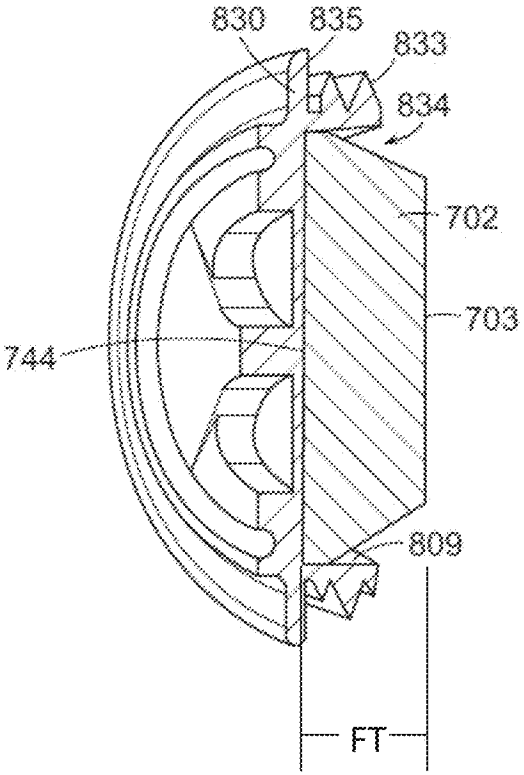
FIG. 66 depicts the deformable member and adjustment driver of the golf club head of FIG. 62.

FIGS. 62-65 depicts additional embodiments of the deformable member 702 of the golf club head 800 described above and illustrated in FIGS. 15A-17E. FIG. 62 depicts a section view E-E of the golf club head 800 of FIG. 15A including an additional embodiment of a deformable member 702. FIG. 63 depicts a section view E-E of the golf club head 800 of FIG. 15A including an additional embodiment of a deformable member 702. FIG. 64 depicts a section view E-E of the golf club head 800 of FIG. 15A including an additional embodiment of a deformable member 702. FIG. 65 depicts a section view E-E of the golf club head 800 of FIG. 15A including an additional embodiment of a deformable member 702. FIG. 66 depicts the deformable member 702 and adjustment driver 830 of the golf club head 800 of FIG. 62.

As illustrated in FIGS. 62-65 the golf club head 800 includes a striking face 818 having a rear surface 819. The golf club head 800 also includes a back portion 812 configured to support the deformable member 702. The golf club head 800 is made with a hollow body construction and the back portion 812 covers a substantial portion of the back of the golf club head 800. The back portion 812 is located behind the striking face 818 and extends between the topline 807 and the sole 805 and from the heel to the toe forming a cavity 820. The deformable member 702 is disposed within the cavity 820.

The back portion of the golf club head 800 includes an adjustment driver 830. The deformable member 702 is disposed between the striking face 818 and the adjustment driver 830. The adjustment driver 830 is configured to retain the elastomer element 702 between the adjustment driver 830 and the striking face 818, with the front portion 703 of the elastomer element 702 contacting the rear surface 819 of the striking face 818 and the rear portion 744 of the elastomer element 702 contacting the adjustment driver 830.

As illustrated in FIG. 66, the deformable member 702 has a free thickness FT. As illustrated in FIG. 62, the deformable member 702 has an installed thickness IT. In some embodiments, the free thickness FT and the installed thickness IT of the deformable member 702 can be substantially the same. In this case, there would be little to no preload of the deformable member 702 against the rear surface 819 of the striking face 818. In other embodiments, the installed thickness IT can be lower than the free thickness FT, creating a preload force on the rear surface 819 of the striking face 818. This preload force can change the coefficient of restitution of the striking face 818, a value that effects how fast a golf ball will leave the striking face when struck by the golf club head at a particular club head speed. In some embodiments, the back portion 812, including the adjustment driver 830, can be configured to have a particular installed thickness IT, to achieve a particular coefficient of restitution. Multiple versions of the adjustment driver 830 may be available to fine tune the coefficient of restitution to a desired value. In an additional embodiment, multiple versions of the deformable member 702 may be available with different free thicknesses FT, to achieve a particular coefficient of restitution. Alternatively, the material of the deformable member 702 could be altered to change its stiffness, thus altering the coefficient of restitution of the golf club head.

As illustrated in FIG. 63, the adjustment driver 830 can also include a spacer 1200 configured to alter the installed thickness IT of the deformable member 702. By changing the thickness of the spacer 1200, the installed thickness IT can be varied, thus varying the coefficient of restitution of the golf club head.

As illustrated in FIG. 64, the deformable member 702 can include a first material 770 and a second material 780. Multiple material deformable members were described above in reference to FIGS. 14D, 14E, 14F, and 14L. In the embodiment illustrated in FIG. 64 the first material 770 is in contact with the rear surface 819 of the striking face 818 and the second material 780 is in contact with the adjustment driver 830. In one embodiment, the first material can have a higher hardness than the second material. In another embodiment, the second material could have a higher hardness than the first material. In a preferred embodiment, the first material can have a Shore A hardness value which is less than the Shore A hardness value of the second material. In a more preferred embodiment, the first material can have a Shore A hardness value less than 50 and the second material can have a Shore A hardness value of greater than 15. In a more preferred embodiment, the first material can have a Shore A hardness value less than 40 and the second material can have a Shore A hardness value of greater than 25. In a more preferred embodiment, the first material can have a Shore A hardness value less than 30 and the second material can have a Shore A hardness value of greater than 35. In a more preferred embodiment, the first material can have a Shore A hardness value less than 20 and the second material can have a Shore A hardness value of greater than 40. In a more preferred embodiment, the first material can have a Shore A hardness value less than 15 and the second material can have a Shore A hardness value of greater than 45. By including multiple materials, not only can the face be supported and the coefficient of restitution be altered, but additional benefits including reduced vibration for better feel and sound can be attained.

As illustrated in FIG. 65, the golf club head 800 and deformable member 702 can be configured such that the deformable member 702 substantially deforms in shape when installed in the golf club head 800. Similar to the embodiment in FIG. 64, the deformable member 702 of FIG. 65 can include a first material 770 and a second material 770. The deformable member 702 has a substantial difference between the free thickness FT and the installed thickness IT such that the deformable member 702 is preloaded against the rear surface 819 of the striking face 818. In one embodiment, the free thickness FT of the deformable member is at least 5% larger than the installed thickness IT. In an additional embodiment, the free thickness FT of the deformable member is at least 10% larger than the installed thickness IT.

In an additional embodiment, the free thickness FT of the deformable member is at least 15% larger than the installed thickness IT. In an additional embodiment, the free thickness FT of the deformable member is at least 20% larger than the installed thickness IT. In some embodiments, as illustrated in FIG. 65, a portion of the deformable member 702 can deform such that the diameter of its front portion 703 abutting the rear surface 819 of the striking face 818 when installed in the golf blue had 800 is greater than the diameter of the adjustment receiver 890 through which the deformable member 702 was installed.

Figure 67:
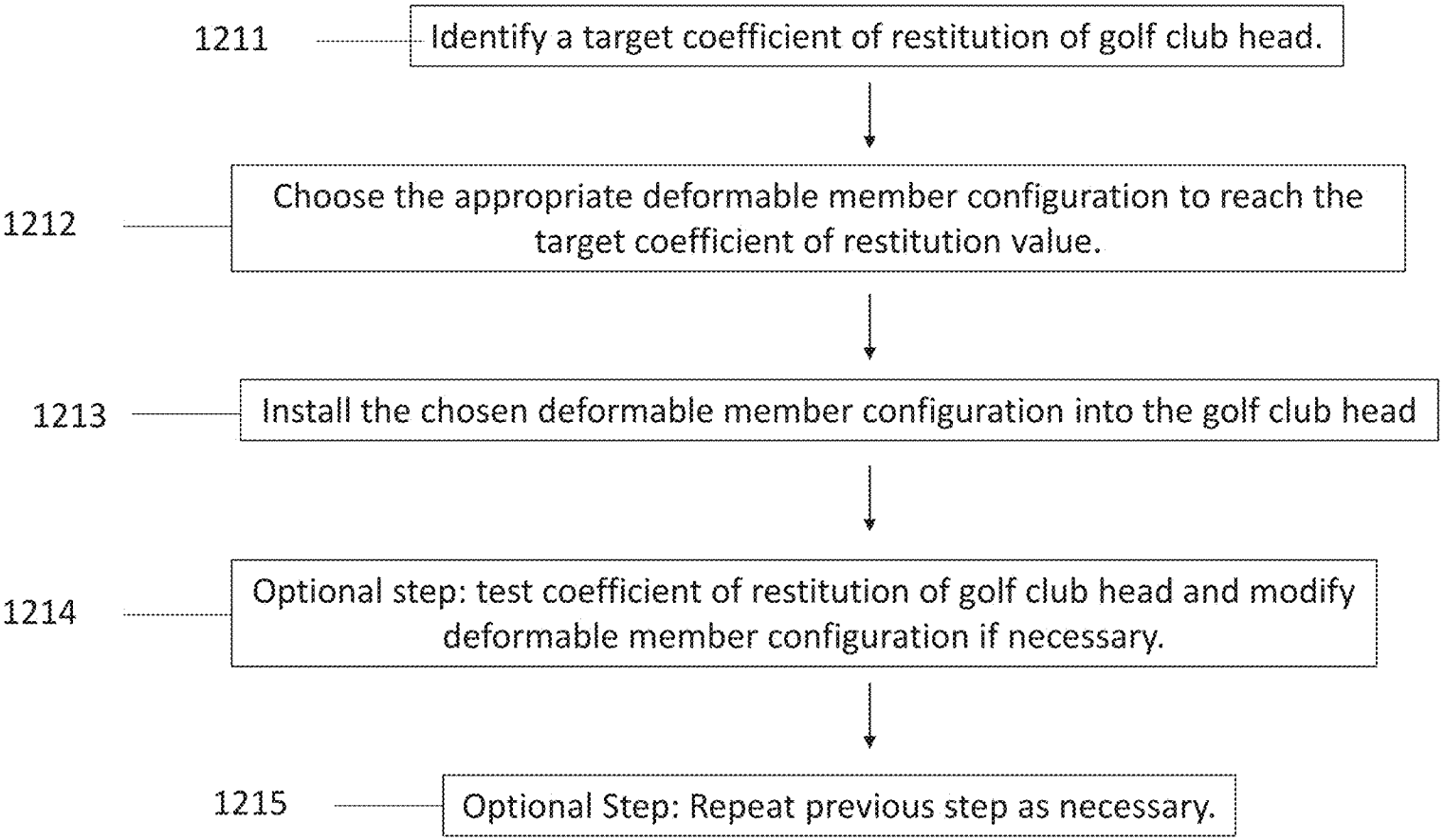
FIG. 67 depicts a method of manufacturing a golf club head.

One method of utilizing the embodiments described herein is outlined in FIG. 67. During construction of the golf club head 800, one can identify a target coefficient of restitution of the golf club head 1211, then they can choose appropriate deformable member configuration to reach the target coefficient of restitution value 1212, then they can install the chosen deformable member configuration into the golf club head 1213, then they can optionally test the coefficient of restitution of the golf club head and modify the deformable member configuration if necessary 1214, then they can optionally repeat the prior step as necessary 1215. Alternatively, rather than utilizing coefficient of restitution as a measurement and target value for the golf club head, the characteristic time can be utilized, which is analogous to the coefficient of restitution and easier to measure.

While the methods and deformable members 702 described above in reference to FIGS. 62-67 were illustrated and described in the context of the golf club head 800, they could be utilized in any of the golf club head embodiments described herein.

As noted above, the golf club head 700 illustrated in FIGS. 26-33 include a second damping element 702D. The second damping element 702D can be disposed between the rear surface 719 of the striking face 718 and the support arm 762. Additionally, there may be at least one weight member 710 and the second damping element 702D can be disposed between the rear surface 719 of the striking face 718 and the weight member 710 or between the support arm 762 and the weight member 710. It was also noted that the second damping element 702D could be formed separately from the golf club head and subsequently installed or it could be co-molded with the golf club head so as to specifically fit the geometry of the particular club. The co-molding process could include a pour-in filler material that sets after being inserted into the golf club head. The pour-in filler material could use a first ingredient and a second ingredient that begin to cure once mixed together and inserted into the golf club head. Additionally, the second damping element 702D could include a combination of both a pre-formed member installed into the golf club head in addition to a poured-in portion. The poured-in portion can aid in taking up any gaps between the pre-formed member and the striking face 718, the support arm 762, the weight member 710, or the back portion 712 of the golf club head 700. The poured-in portion could reduce any inconsistencies between clubs due to part and assembly tolerances and ensure flush contact with intended surfaces of the golf club head. Examples of pourable filler materials which could be used in a golf club head include Flex Seal™ liquid rubber or Dip Seal™ cellulose based plastic coating. In another embodiment, rather than a pour-in rubber material a foam material can be used. The foam could be pre-formed, a pour-in cast in place foam, or a combination of the two. Additionally, a pour-in cast in place foam could be used in addition to a pre-formed elastomer member, much like discussed above. An adhesive could be used in conjunction with any of the embodiments and combinations above to help secure the damping elements in place.

Figure 68:
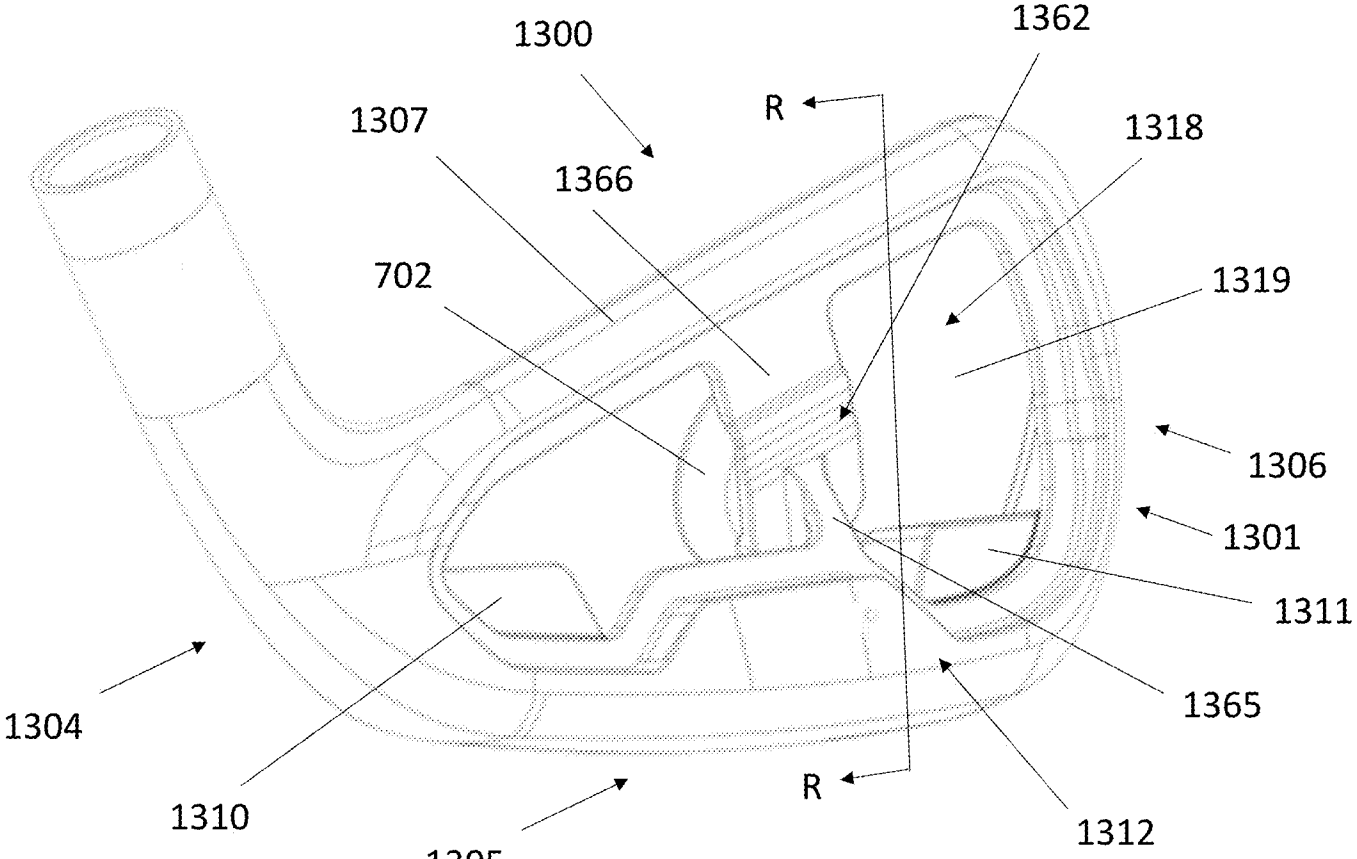
FIG. 68 depicts a perspective view of a golf club head.
Figure 70:
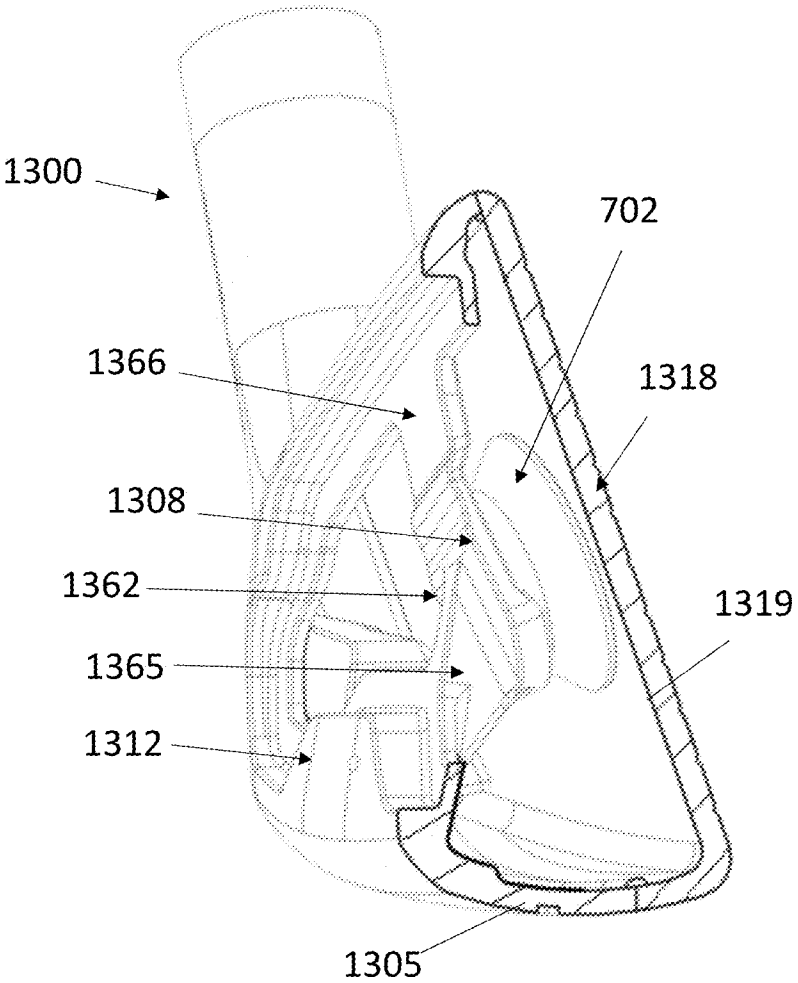
FIG. 70 depicts a perspective view of section view R-R of the golf club head of FIG. 69.
Figure 69:
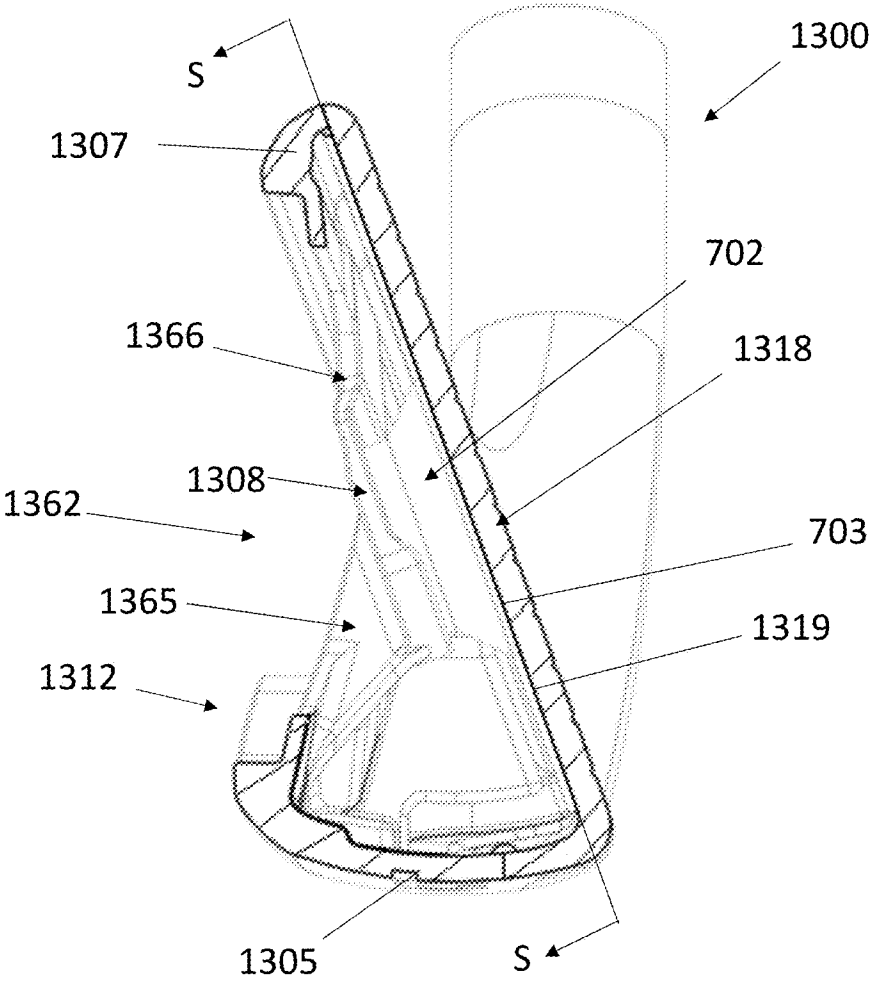
FIG. 69 depicts a section view R-R of the golf club head of FIG. 68 missing a weight member.
Figure 71:
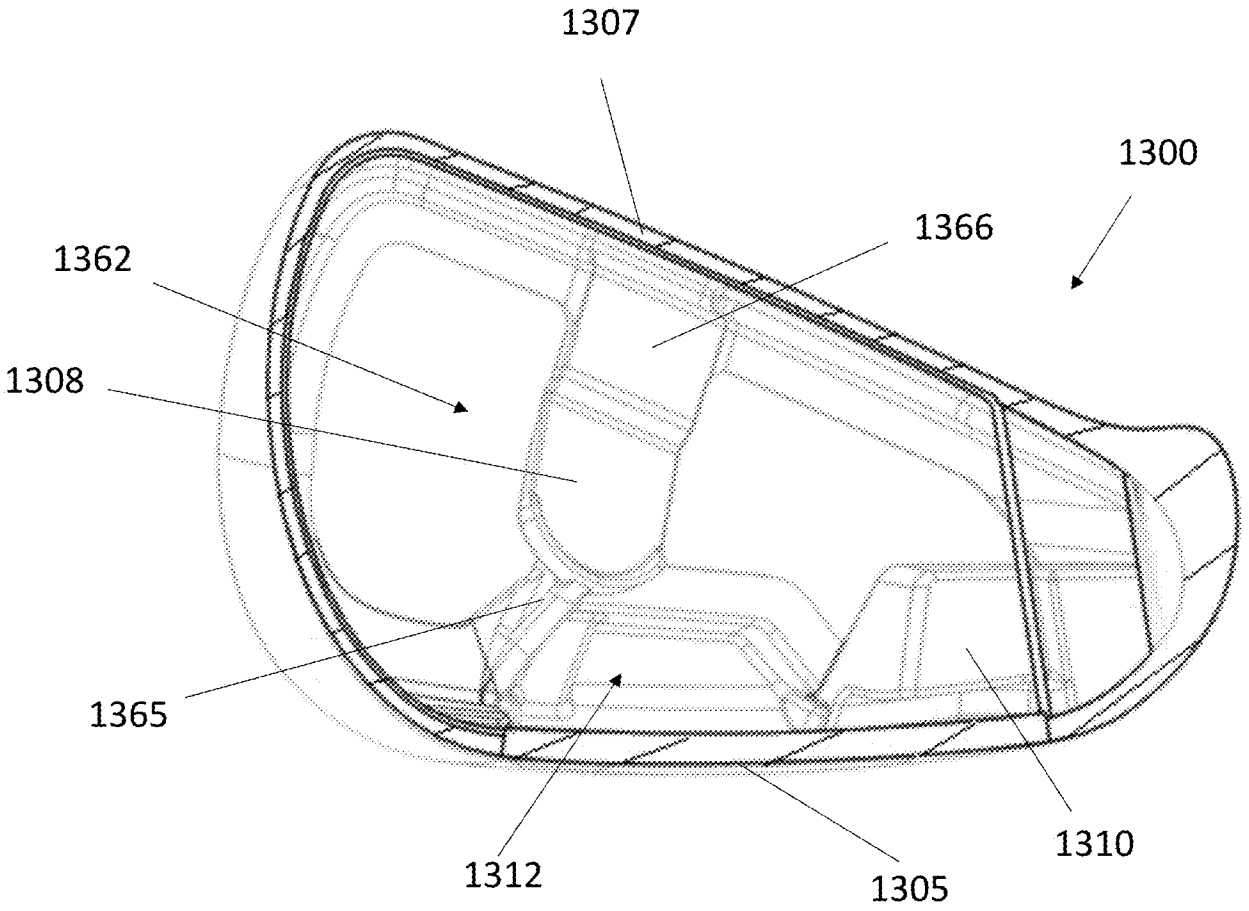
FIG. 71 depicts a section view S-S of the golf club head of FIG. 68 missing the weight member and damping element.

FIGS. 68-71 depict an additional embodiment of a golf club head 1300 having a damping element 702. FIG. 68 depicts a perspective view of a golf club head 1300. FIG. 69 depicts a section view R-R of the golf club head 1300 of FIG. 68 missing a weight member 1311. FIG. 70 depicts a perspective view of section view R-R of the golf club head 1300 of FIG. 69. FIG. 71 depicts a section view S-S of the golf club head 1300 of FIG. 68 missing the weight member 1311 and damping element 702. The golf club head 1300 of FIGS. 68-71 shares many features and qualities with the golf club head 700 depicted in FIGS. 26-33 and described above while incorporating some unique features.

The golf club head 1300 illustrated in FIGS. 68-71 is an iron having a cavity back construction and includes a periphery portion 1301 surrounding and extending rearward from the striking face 1318. The periphery portion 1301 includes the sole 1305, the toe 1306, the heel 1304, and the topline 1307. The periphery portion 701 can also include one or more weight members 1310, 1311. The periphery portion 1301 can also include a back portion 1312, which may partially enclose the cavity 1320. The periphery portion 1301 of the golf club head 1300 can include a support arm 1366. As illustrated in FIGS. 68-71, the support arm 1366 can extend from the sole 1305 to the topline 1307. The support arm 1366 can include a first portion 1365, a cradle 1308, and a second portion 1366. The first portion 1365 extends from the sole 1305. The first portion 1365 may be at least partially incorporated into the back portion 1312, as illustrated. The first portion 1365 is connected to the cradle 1308 which is configured to support a damping element 702 disposed between the rear surface 1319 of the striking face 1318 and the cradle 1308 of the support arm 1362. The second portion 1366 extends between the topline 1307 and the cradle 1308. The damping element 702 can support the striking face 1318 and offer damping properties, as discussed above. In other embodiments, the golf club head 1300 could also incorporate additional damping elements like the embodiments described above. In other embodiments, the back portion can substantially enclose the cavity. In other embodiments, an additional member such as a medallion can be affixed to the back portion of the golf club head. In some embodiments, the medallion can cover the support arm 1365 and damping element 702 from view.

As illustrated, the first portion 1365 is substantially thicker in a fore-aft direction than it is in the heel-toe direction and the second portion 1366 is substantially thicker in a heel-toe direction than it is in the fore-aft direction. In another embodiment, this could be reversed. In another embodiment, both the first portion 1365 and the second portion 1365 can be substantially thicker in a fore-aft direction than in the heel-toe direction. In another embodiment, both the first portion 1365 and the second portion 1365 can be substantially thicker in a heel-toe direction than it in the fore-aft direction.

Figure 72:
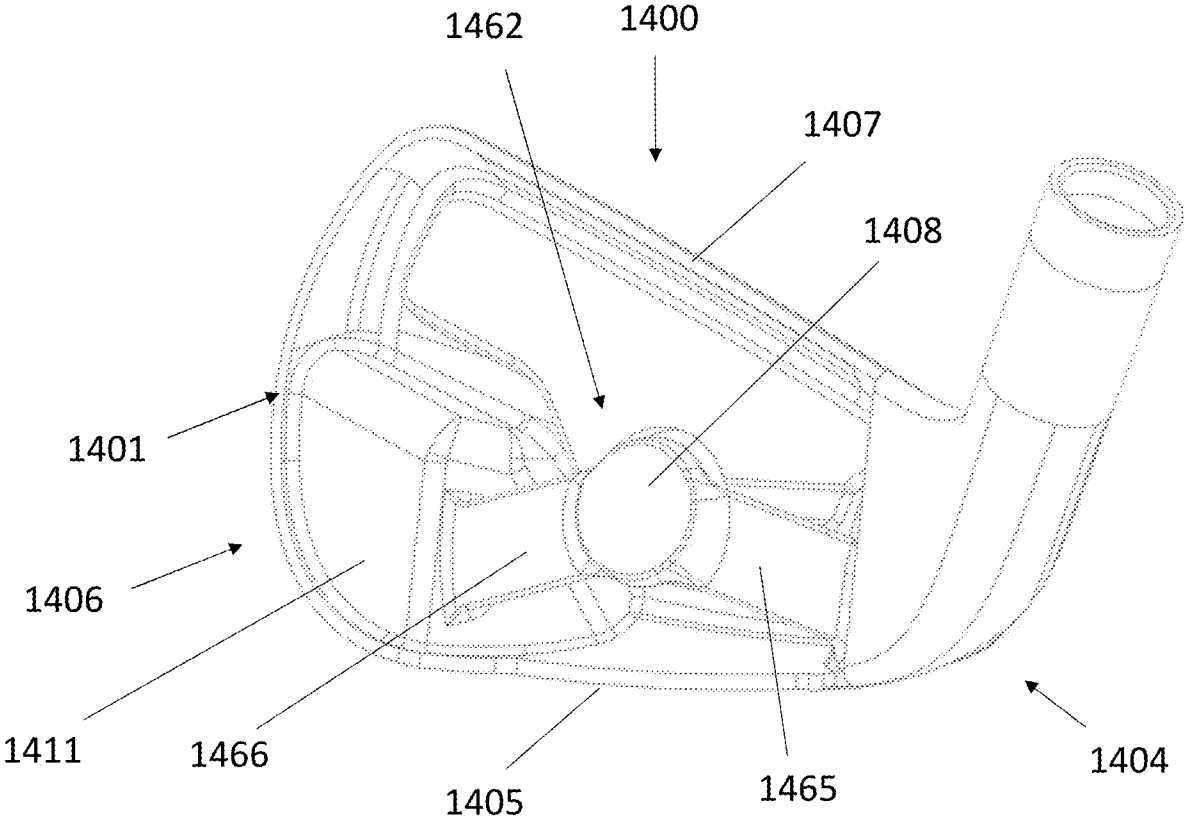
FIG. 72 depicts a perspective view golf club head missing the striking face and damping element.
Figure 73:
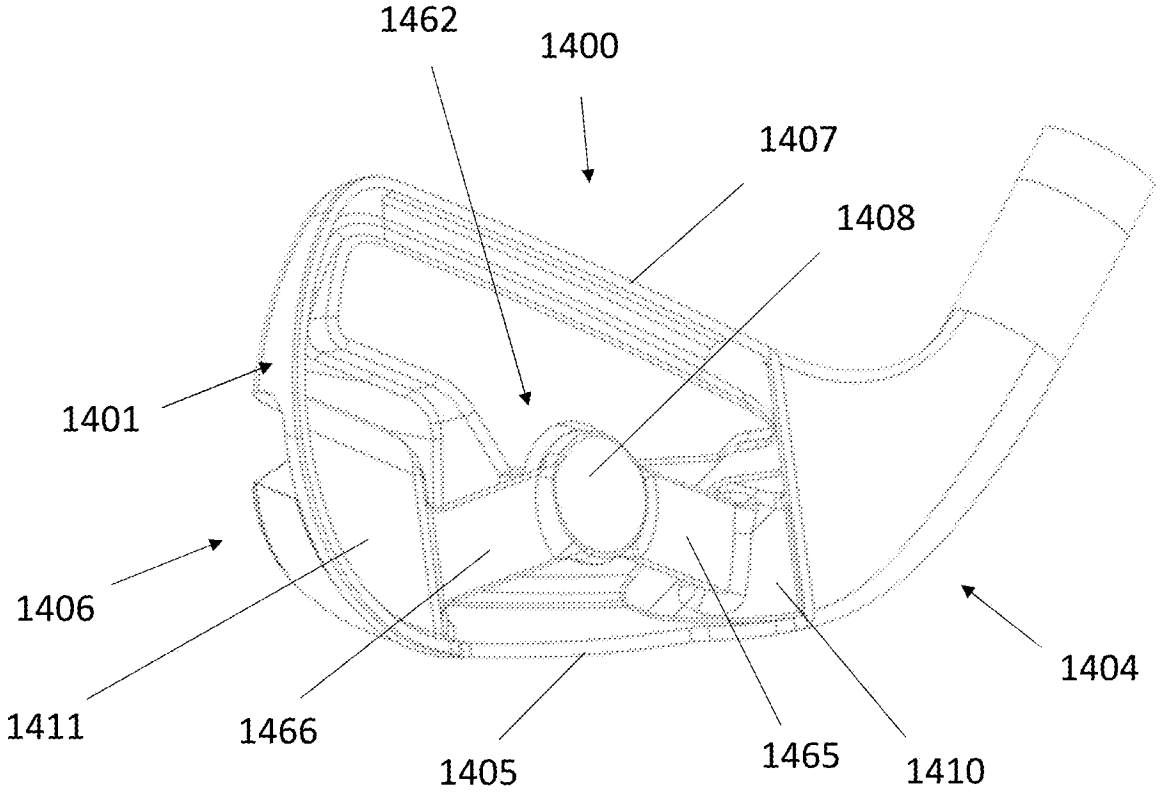
FIG. 73 depicts an additional perspective view of the golf club head of FIG. 72, also missing the striking face and damping element.

FIGS. 72 and 73 depict an additional embodiment of a golf club head 1400 which is an alternative construction to the golf club head 1300 depicted in FIGS. 68-71. FIG. 72 depicts a perspective view golf club head 1400 missing the striking face and damping element. FIG. 73 depicts an additional perspective view of the golf club head 1400 of FIG. 72, also missing the striking face and damping element. The golf club head 1400 of FIGS. 72 and 73 shares many features and qualities with the golf club head 1300 depicted in FIGS. 68-71 and described above. The primary difference between the embodiments is the support arm 1462. The golf club head 1400 includes a support arm 1462 that is arranged substantially horizontally as opposed to the substantially vertical support arm 1362 of the golf club head 1300. The first portion 1462 and second portion 1465 extend from the periphery portion 1401 and each connect to the cradle 1408 which is configured to support a damping element 702. The first portion 1465 extends from a heel side 1404 of the golf club head 1400. The heel side 1404 of the golf club head 1400 may include a weight member 1410 and the first portion 1465 can extend from the weight member 1410 toe-ward to the cradle 1408. The second portion 1466 extends from a toe side 1406 of the golf club head 1400. The toe side 1406 of the golf club head 1400 may include a weight member 1411 and the second portion 1466 can extend from the weight member 1411 heel-ward to the cradle 1408. In an alternative embodiment, the golf club head 1400 may not include a damping element. In such an embodiment, the support arm may contact the rear surface of the striking face directly. Alternatively, the support arm may be offset from the rear surface of the striking face a small distance, 0.5 mm for example, such that when a golf ball impacts the striking face it deflects into the support arm which then reduces the striking face deflection and supports it in a central location.

The first portion 1465 of the support arm is angled upwards from the heel side 1404 towards the cradle 1408 measured relative to the x-axis. In some embodiments, the first portion 1465 can be angled upwards greater than 5 degrees. In another embodiment, the first portion 1465 can be angled upwards greater than 10 degrees. In another embodiment, the first portion 1465 can be angled upwards greater than 15 degrees. In another embodiment, the first portion 1465 can be angled upwards greater than 20 degrees. In another embodiment, the first portion 1465 can be angled upwards greater than 25 degrees. In another embodiment, the first portion 1465 can be angled upwards greater than 30 degrees. The second portion 1466 of the support arm is angled upwards from the toe side 1406 towards the cradle 1408 measured relative to the x-axis. In some embodiments, the second portion 1466 can be angled upwards greater than 5 degrees. In another embodiment, the second portion 1466 can be angled upwards greater than 10 degrees. In another embodiment, the second portion 1466 can be angled upwards greater than 15 degrees. In another embodiment, the second portion 1466 can be angled upwards greater than 20 degrees. In another embodiment, the second portion 1466 can be angled upwards greater than 25 degrees. In another embodiment, second portion 1466 can be angled upwards greater than 30 degrees.

Figure 74:
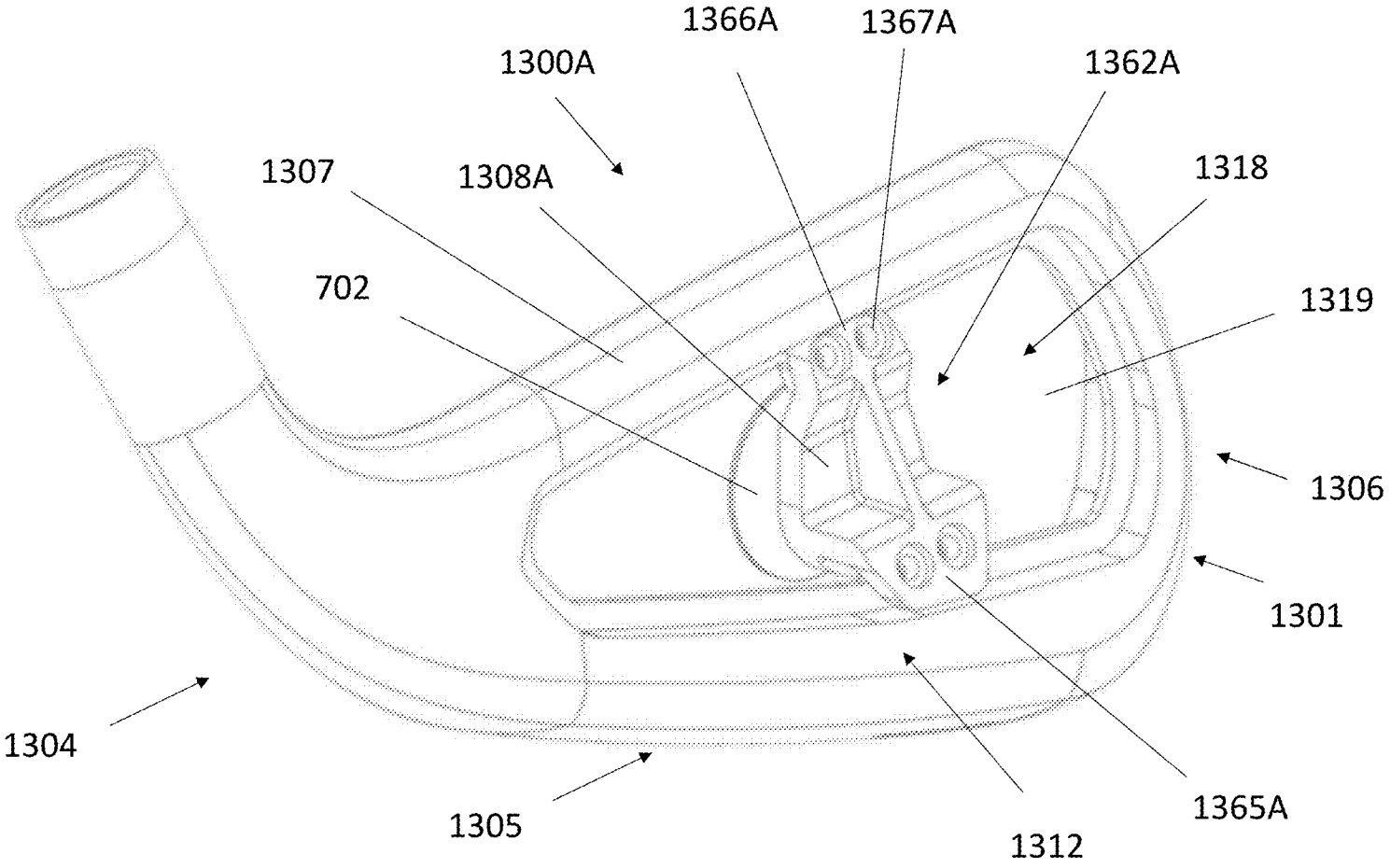
FIG. 74 depicts a perspective view of an additional embodiment of a golf club head.
Figure 76:
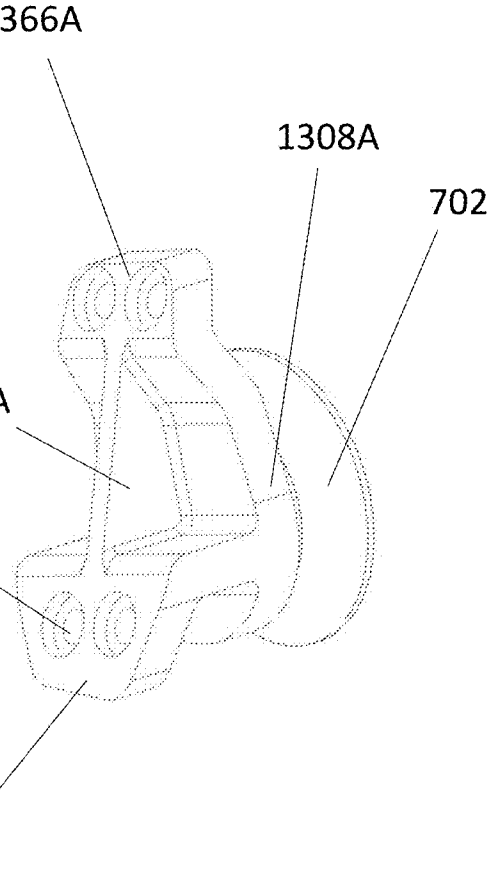
FIG. 76 depicts a perspective view of the support arm and damping element of the golf club head of FIG. 74.
Figure 75:
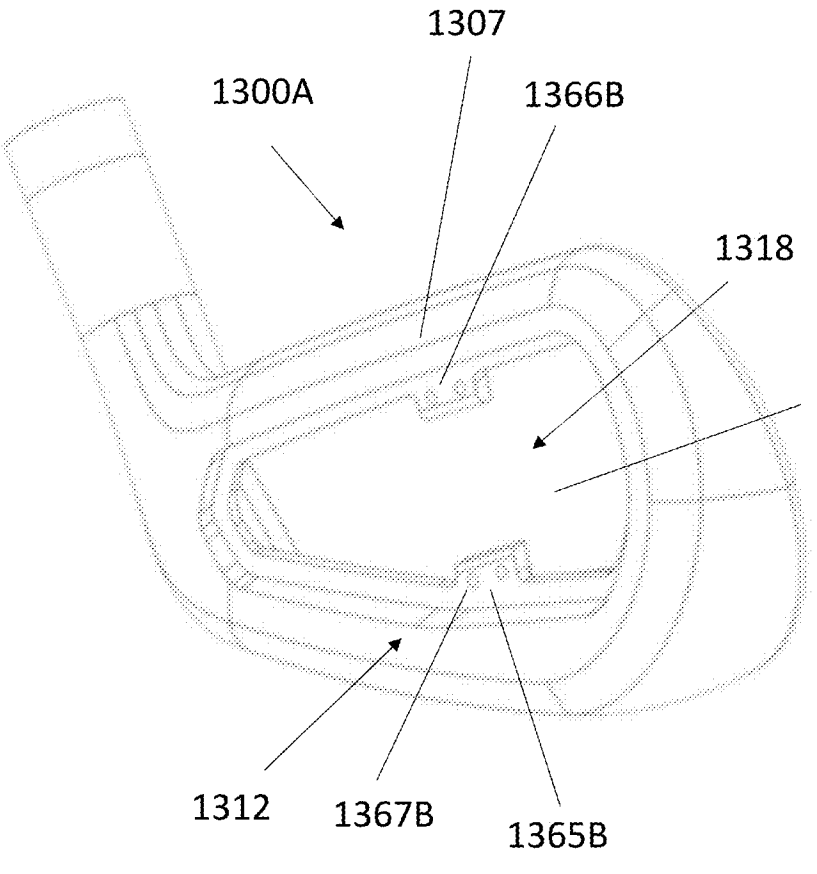
FIG. 75 depicts a perspective view of the golf club head of FIG. 74 missing the support arm and damping element.
Figure 78:
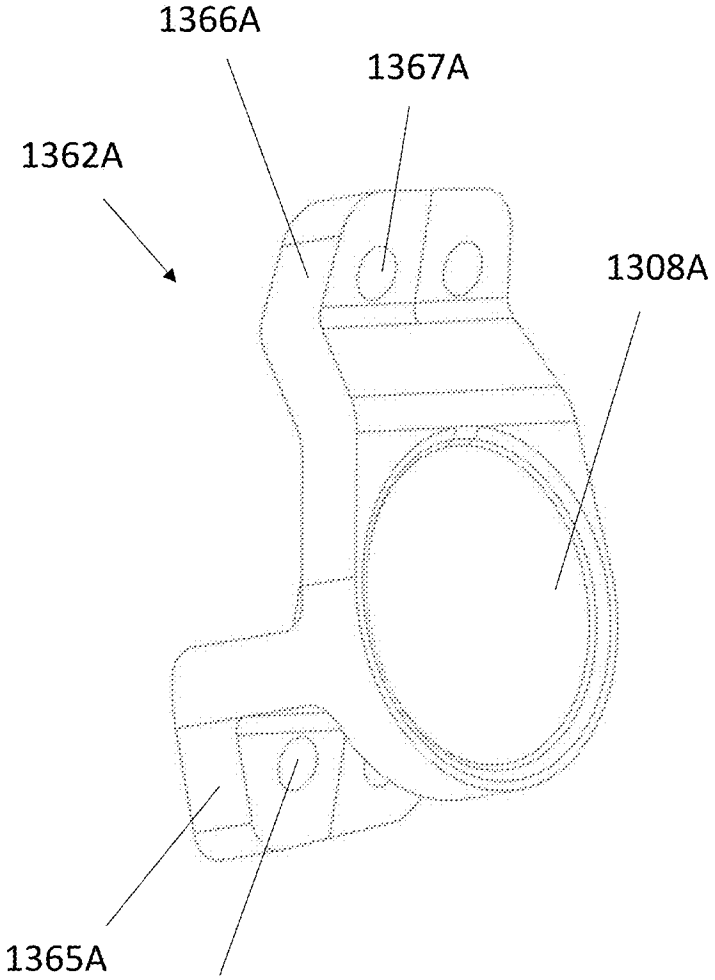
FIG. 78 depicts a perspective view of the support arm of the golf club head of FIG. 74.
Figure 77:
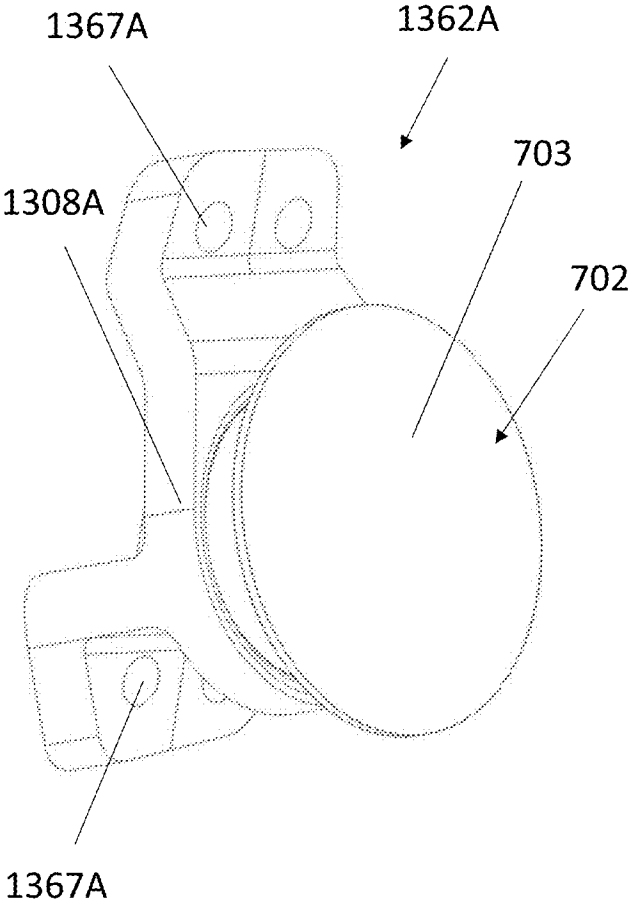
FIG. 77 depicts an additional perspective view of the support arm and damping element of the golf club head of FIG. 74.

FIG. 74 illustrates a perspective view of an additional embodiment of a golf club head 1300A. FIG. 75 illustrates a perspective view of the golf club head 1300A of FIG. 74 missing the support arm 1366A and damping element 702. FIG. 76 illustrates a perspective view of the support arm 1366A and damping element 702 of the golf club head 1300A of FIG. 74. FIG. 77 illustrates an additional perspective view of the support arm 1366A and damping element 702 of the golf club head 1300A of FIG. 74. FIG. 78 illustrates a perspective view of the support arm 1366A of the golf club head 1300A of FIG. 74.

Golf club head 1300A is substantially similar to the golf club head 1300 illustrated in FIGS. 68-71 including a damping element 702 and a support arm 1362A extending substantially vertically. Unlike the golf club head 1300 of FIGS. 68-71, golf club head 1300A of FIG. 74 includes a support arm 1362A which is manufactured separately from and affixed to the rest of the golf club head 1300A. As in earlier embodiments, the support arm 1362A is configured to support the damping element 702 which is in contact with the rear surface 1319 of the striking face 1318. The support arm 1362A includes a cradle 1308A in contact with the damping element 702. The support arm 1362A also includes a first portion 1365A extending from the cradle 1308A and towards the sole 1305. The first portion 1365A can be affixed to the back portion 1312. The support arm 1362A also includes a second portion 1366A extending from the cradle 1308A towards the topline 1207. The second portion 1365A can be affixed to the topline 1307. Additionally, the support arm 1362A can include a rib 1368A, as illustrated in FIG. 76, extending from the first portion 1365A to the second portion 1366A. The rib 1368A can also contact the cradle 1308A, increasing the stiffness of the support arm 1362A.

As illustrated in FIG. 75, the back portion 1312 can include a first portion mating member 1365B configured to engage the first portion 1365A of the support arm 1362A and the topline 1307 can include a second portion mating member 1366B configured to engage the second portion 1366A of the support arm 1362A. The support arm 1362A can be affixed to the periphery portion 1301 of the golf club head 1300A in a variety of ways which may include, for example, welding, brazing, adhesives, mechanical fasteners, interference fits, clips, deflectable members, etc. The first portion mating member 1365B and the second portion mating member 1366B can include a apertures 1367B configured to receive a fastener. Additionally, the first portion 1366A and second portion 1365A of the support arm 1362A can include apertures 1367A configured to receive a fastener. As illustrated in FIG. 74, the apertures 1367A can be aligned with the apertures 1367B and fasteners (not illustrated) such as a rivet or threaded fastener can be installed into the apertures 1367A, 1367B securing the support arm 1362A to the golf club head 1300A. The support arm 1362A can be affixed to the rear of the back portion 1312 and the topline 1307, as illustrated in FIG. 74, or in an alternative embodiment, the support arm 1362A can be affixed to a front side of the back portion 1312 and the topline 1307. Alternatively, the support arm 1362A could be installed on a front side of the topline 1307 and a rear side of the back portion 1312, or vice-versa. Additionally, the support arm 1362A could be secured to the sole 1305, or the toe 1306, or the heel 1304. In one embodiment, the position which the support arm is affixed to the golf club head may be adjustable such that the location of the damping element may be adjusted relative to the center of the striking face. Additionally, in an additional embodiment a medallion could be incorporated into the support arm and attached via the same affixation method as the support arm.

Figure 79:
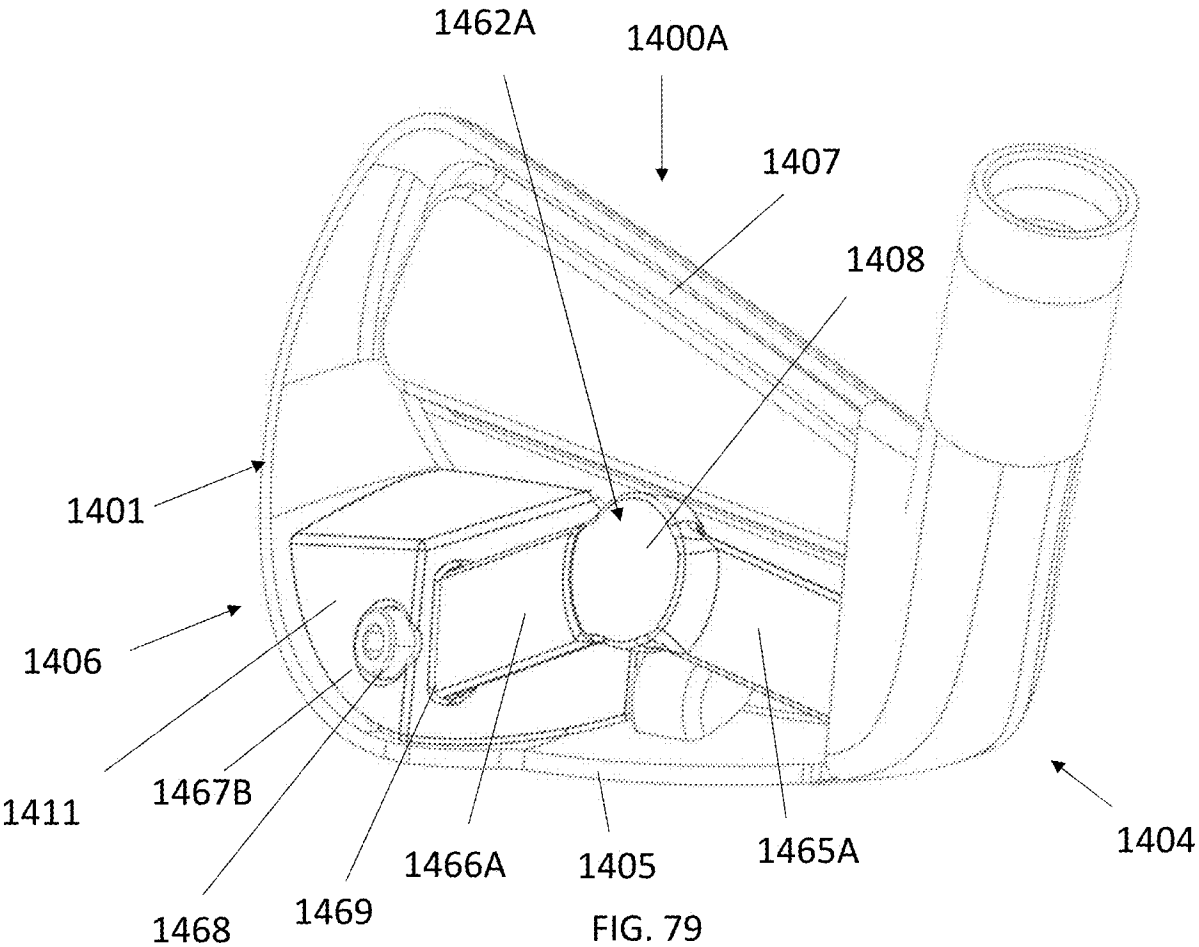
FIG. 79 depicts a perspective view of an additional embodiment of a golf club head missing the striking face and damping element for illustrative purposes.
Figure 80:
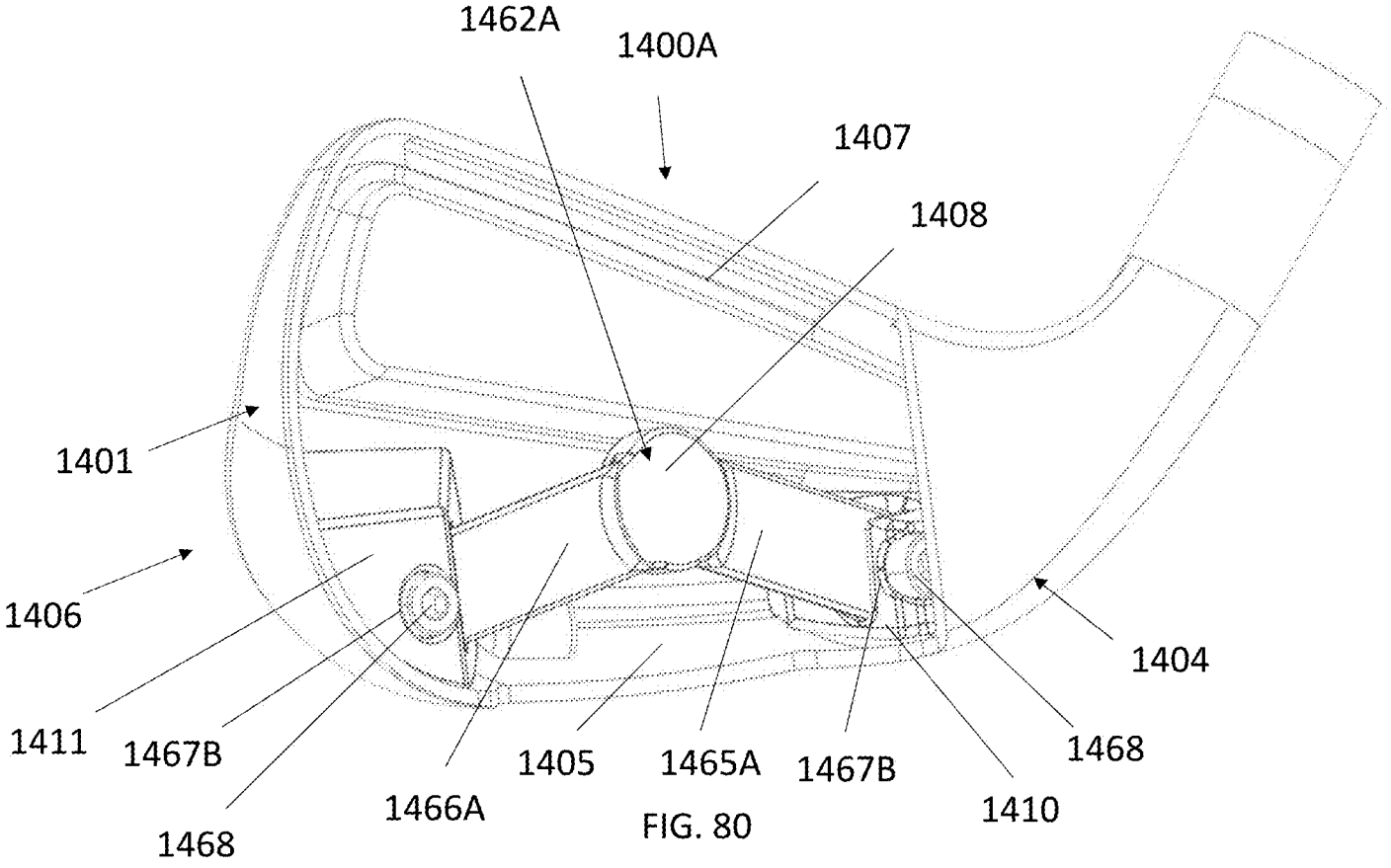
FIG. 80 depicts an additional perspective view of the golf club head of FIG. 79 missing the striking face and damping element.
Figure 82:
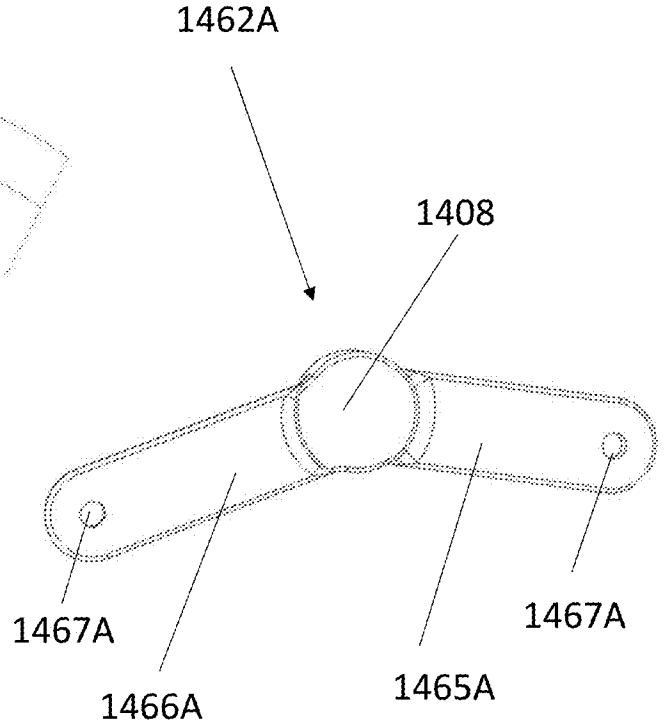
FIG. 82 depicts a perspective view of the support arm of the golf club head of FIG. 79.
Figure 81:
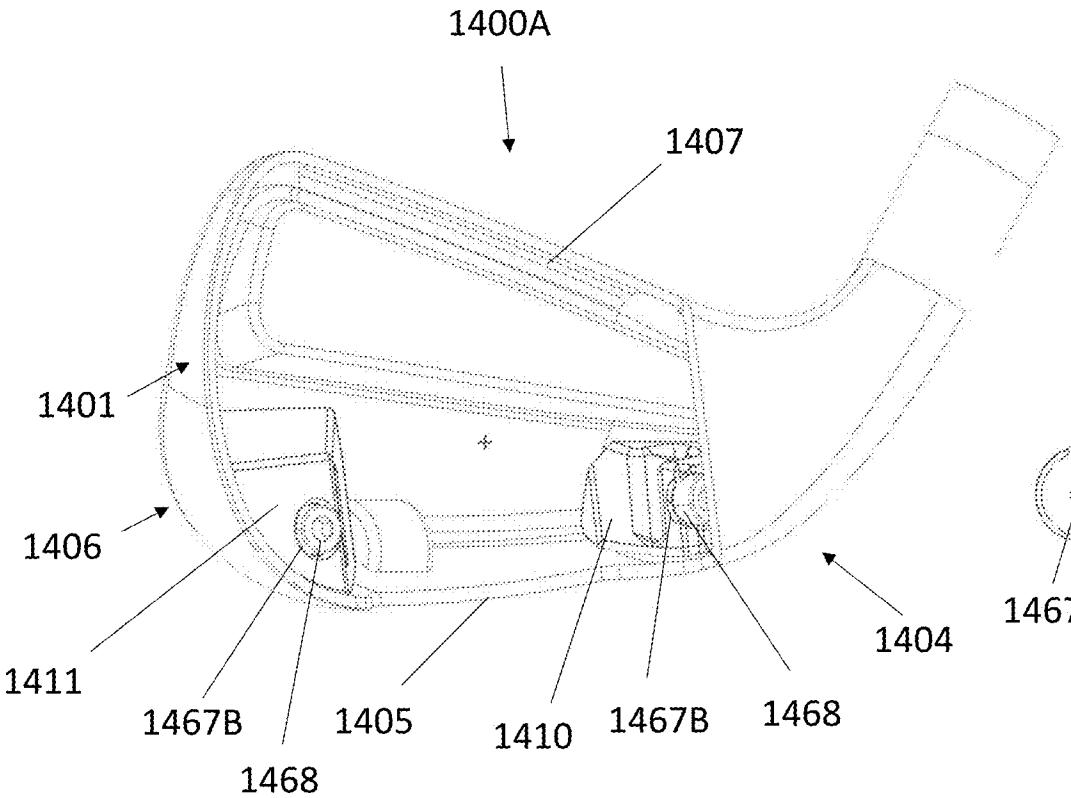
FIG. 81 depicts a perspective view of the golf club head of FIG. 79 further missing the support arm.
Figure 83:
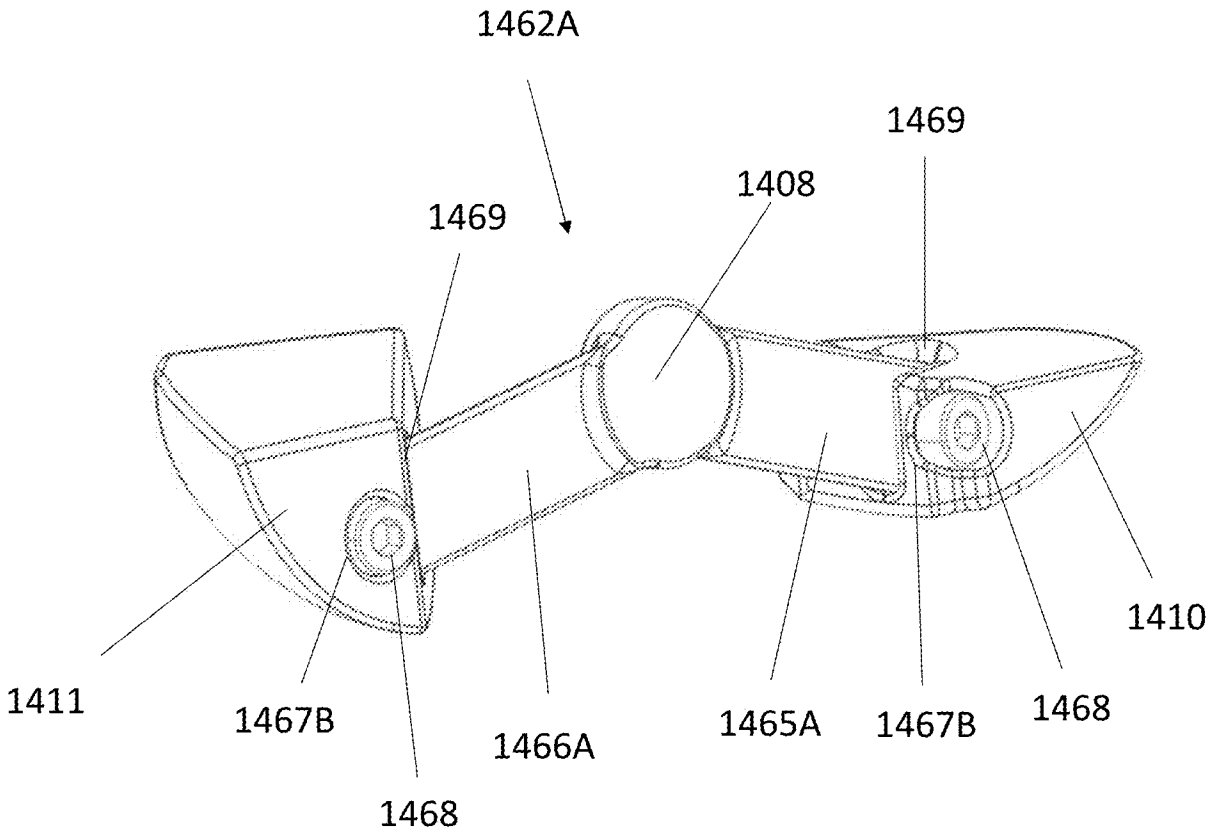

FIG. 79 illustrates a perspective view of an additional embodiment of a golf club head 1400A missing the striking face and damping element for illustrative purposes. FIG. 80 illustrates an additional perspective view of the golf club head 1400A of FIG. 79 missing the striking face and damping element. FIG. 81 illustrates a perspective view of the golf club head 1400A of FIG. 79 further missing the support arm 1462A. FIG. 82 illustrates a perspective view of the support arm 1462A of the golf club head 1400A of FIG. 79. FIG. 83 illustrates a perspective view of the support arm 1462A and weight members 1410, 1411 of the golf club head 1400A of FIG. 79.

Golf club head 1400A is substantially similar to the golf club head 1400 illustrated in FIGS. 72 and 73 including a damping element 702 and a support arm 1462A extending substantially horizontally. Unlike the golf club head 1400 of FIGS. 72 and 73, golf club head 1400A of FIG. 79 includes a support arm 1462A which is manufactured separately from and affixed to the rest of the golf club head 1400A.

As in earlier embodiments, the support arm 1462A is configured to support the damping element which is in contact with the rear surface of the striking face. The support arm 1462A includes a cradle 1408A in contact with the damping element. The support arm 1462A also includes a first portion 1465A extending from the cradle 1408A and towards the heel 1404. The support arm 1462A also includes a second portion 1466A extending from the cradle 1408A towards the toe 1406. The first portion 1465A and second portion 1466A can be affixed to the periphery portion 1401. The periphery portion can include support arm receptacles 1469 configured to engage the support arm 1462A. The periphery portion can include apertures 1467B configured to receive a fastener 1468. The support arm can include apertures 1467A configured to receive a fastener 1468. As illustrated, the first portion 1465A and second portion 1466A can be inserted into the support arm receptacles 1469 aligning the supper arm apertures 1467A with the periphery portion apertures 1467B and fasteners 1468 can be installed to secure the support arm 1462A and damping element (not illustrated) to the golf club head 1400A. In some embodiments, the apertures 1467B and support arm receptacles can be formed in a heel side weight member 1410 and toe side weight member 1411. The fastener can be a threaded fastener and one or more of the apertures 1467A, 1467B can include threads to engage the fastener.

Golf club head 1300A and golf club head 1400A include modular support arms 1362A and 1462A respectively, each of which offer advantages to support arms formed together with a golf club head. By securing the support arm to the golf club head, the support arms can be made from a different material of the golf club head which may include, for example, steel, aluminum, titanium, composites, etc. The support arm can be formed of materials of different density and/or different stiffness from the golf club head. The support arm can be manufactured via a variety of manufacturing techniques which may include, for example, casting, forging, stamping, machining, three dimensional printing, etc.

Additionally, a removeable support arm can allow for various damping elements to be installed in the golf club head, fine tuning the golf club head to maximize coefficient of restitution, or fine tuning the acoustic profile of the golf club head when impacting a golf ball.

Figure 85:
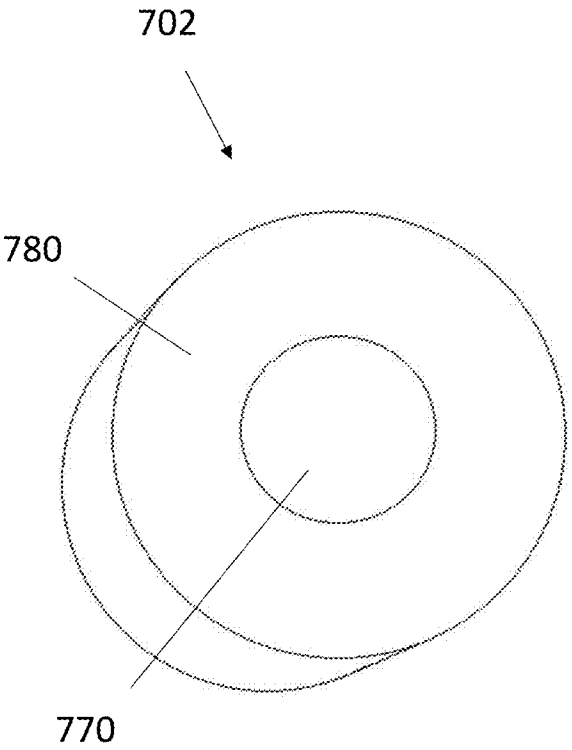
Figure 84:
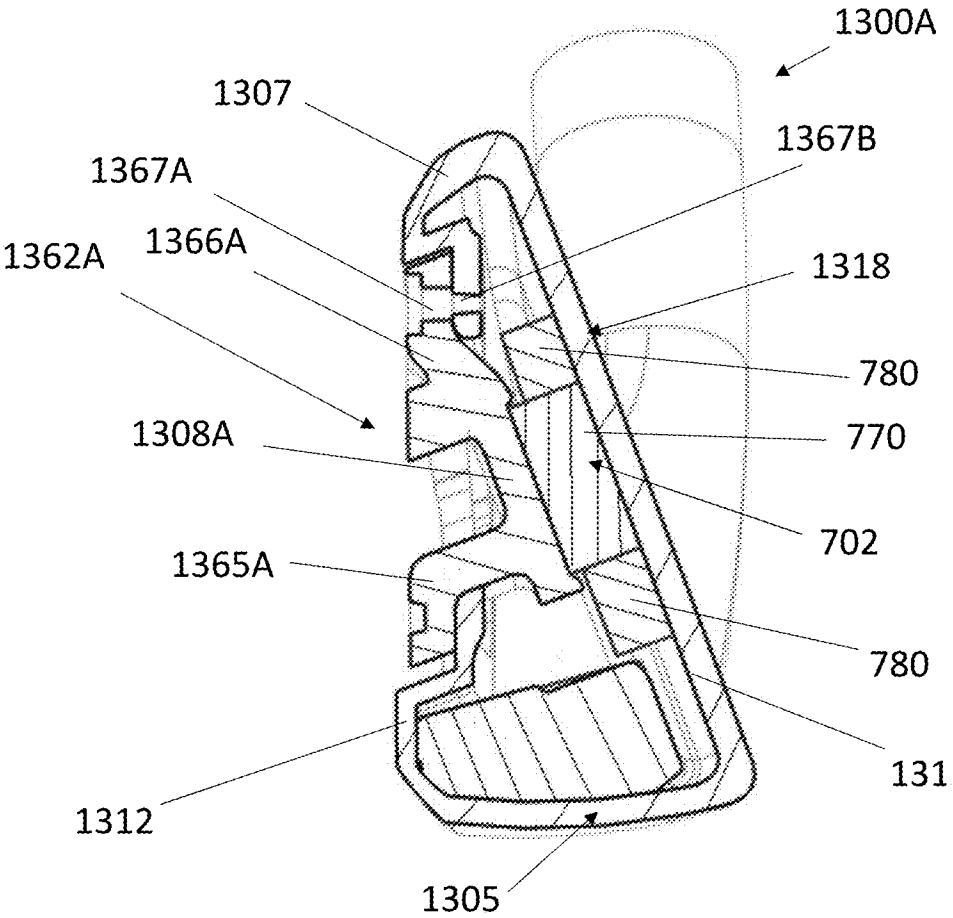

FIG. 84 illustrates a cross sectional view of the golf club head 1300A with an additional embodiment of a damping element 702. FIG. 85 illustrates a perspective view of the damping element 702 of the golf club head 1300A of FIG. 84. The damping element 702 illustrated in FIGS. 84 and 85 includes a first portion 770 and a second portion 780. The first portion 770 is centrally located and the second portion 780 at least partially surrounds the first portion 770. The first portion 770 is made of a first material having a first durometer. The second portion 780 is made of a second material having a second durometer. The first durometer is greater than the second durometer. The first portion 770 helps support the center of the striking face 1318 while the second portion aids in damping the vibrations of the striking face 1318. In the illustrated embodiment, the cradle 1308A supports the first portion 770 of the damping element. In other embodiments, the cradle 1308A could support both the first portion 770 and the second portion 780. The first portion 770 and second portion 780 could be made from one or more materials which may include, for example, elastomer, rubber, silicone, foam, etc.

In one embodiment, the first durometer can be greater than Shore 10A and less than Shore 95A. In an additional embodiment, the first durometer can be greater than Shore 20A and less than Shore 95A. In an additional embodiment, the first durometer can be greater than Shore 30A and less than Shore 95A. In an additional embodiment, the first durometer can be greater than Shore 40A and less than Shore 95A. In an additional embodiment, the first durometer can be greater than Shore 50A and less than Shore 95A. In an additional embodiment, the first durometer can be greater than Shore 60A and less than Shore 95A. In an additional embodiment, the first durometer can be greater than Shore 70A and less than Shore 95A. In an additional embodiment, the first durometer can be greater than Shore 80A and less than Shore 95A. In one embodiment, the first portion 770 is formed from an elastomer.

In one embodiment the second durometer can have a Shore 00 value greater than 10 and less than 100. In an additional embodiment, the second durometer can have a Shore 00 value greater than 20 and less than 100. In an additional embodiment, the second durometer can have a Shore 00 value greater than 30 and less than 100. In an additional embodiment, the second durometer can have a Shore 00 value greater than 40 and less than 100. In an additional embodiment, the second durometer can have a Shore 00 value greater than 50 and less than 100. In an additional embodiment, the second durometer can have a Shore 00 value greater than 60 and less than 100. In an additional embodiment, the second durometer can have a Shore 00 value greater than 70 and less than 100. In an additional embodiment, the second durometer can have a Shore 00 value greater than 80 and less than 100. In an additional embodiment, the second durometer can have an Asker C value greater than 10 and less than 90. In an additional embodiment, the second durometer can have an Asker C value greater than 20 and less than 90. In an additional embodiment, the second durometer can have an Asker C value greater than 30 and less than 90. In an additional embodiment, the second durometer can have an Asker C value greater than 40 and less than 90. In an additional embodiment, the second durometer can have an Asker C value greater than 50 and less than 90. In an additional embodiment, the second durometer can have an Asker C value greater than 60 and less than 90. In one embodiment, the second durometer is less than Shore 20A. In one embodiment, the second portion 780 is formed of a foam.

Figure 86:
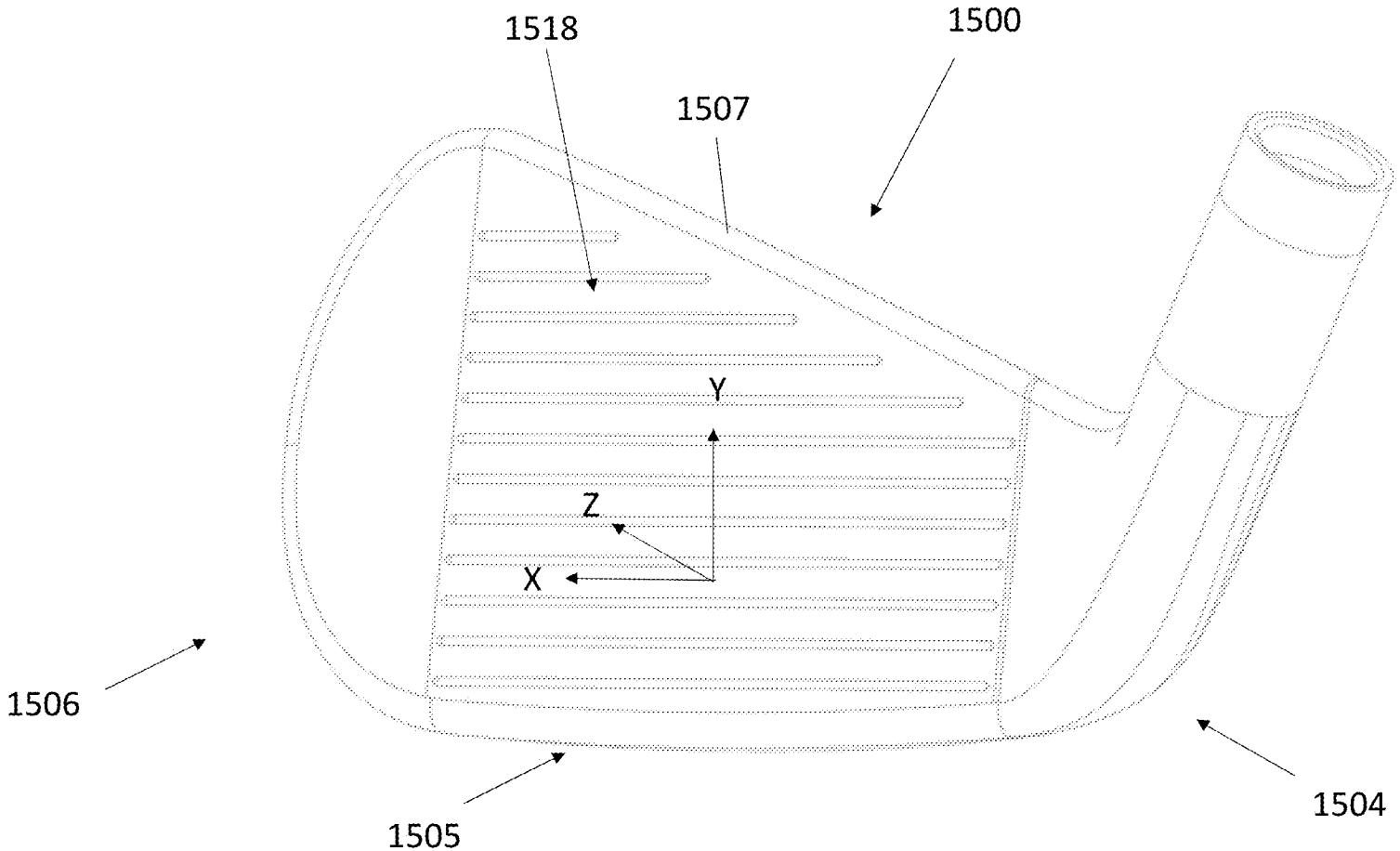
Figure 87:
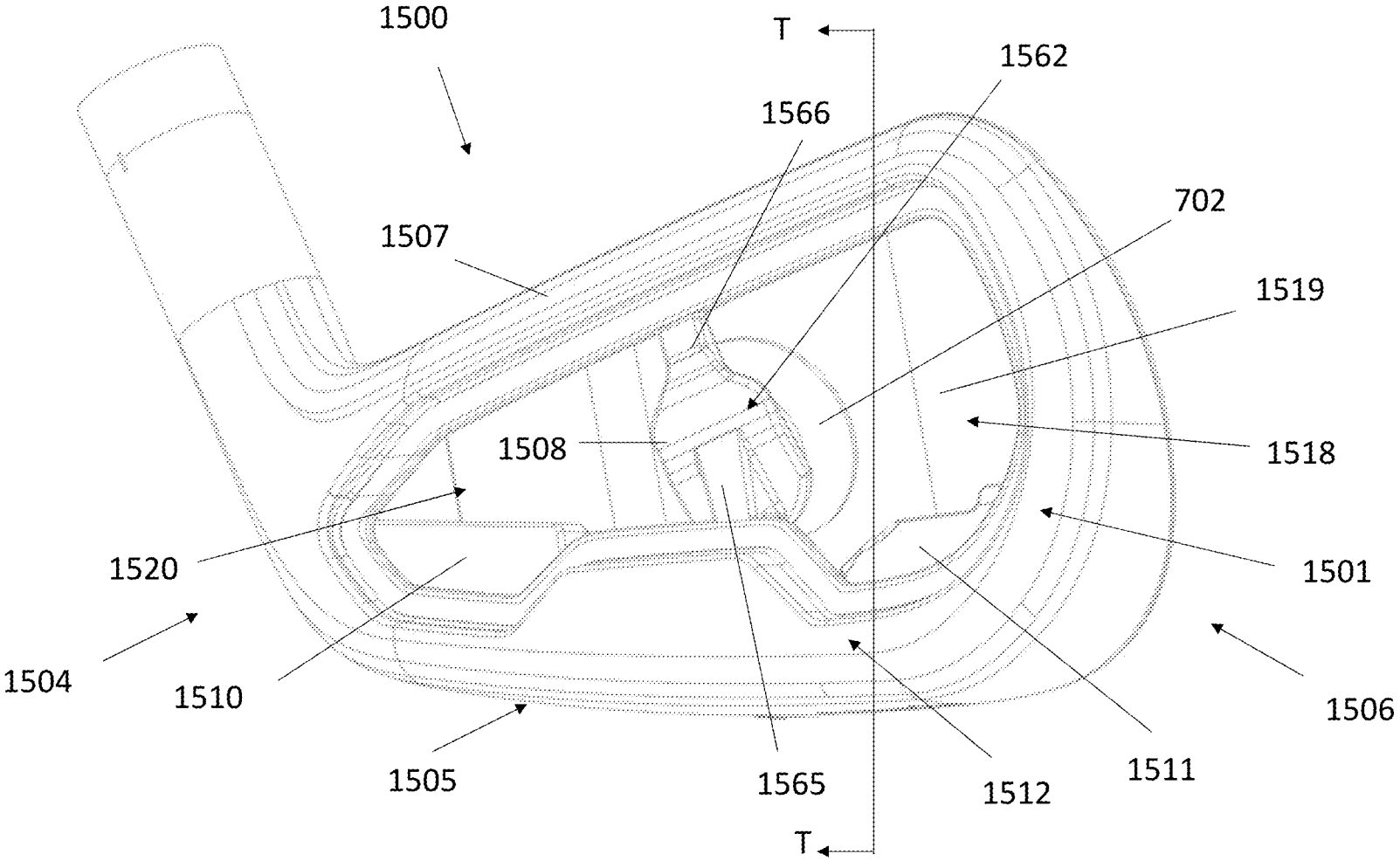
Figure 88:
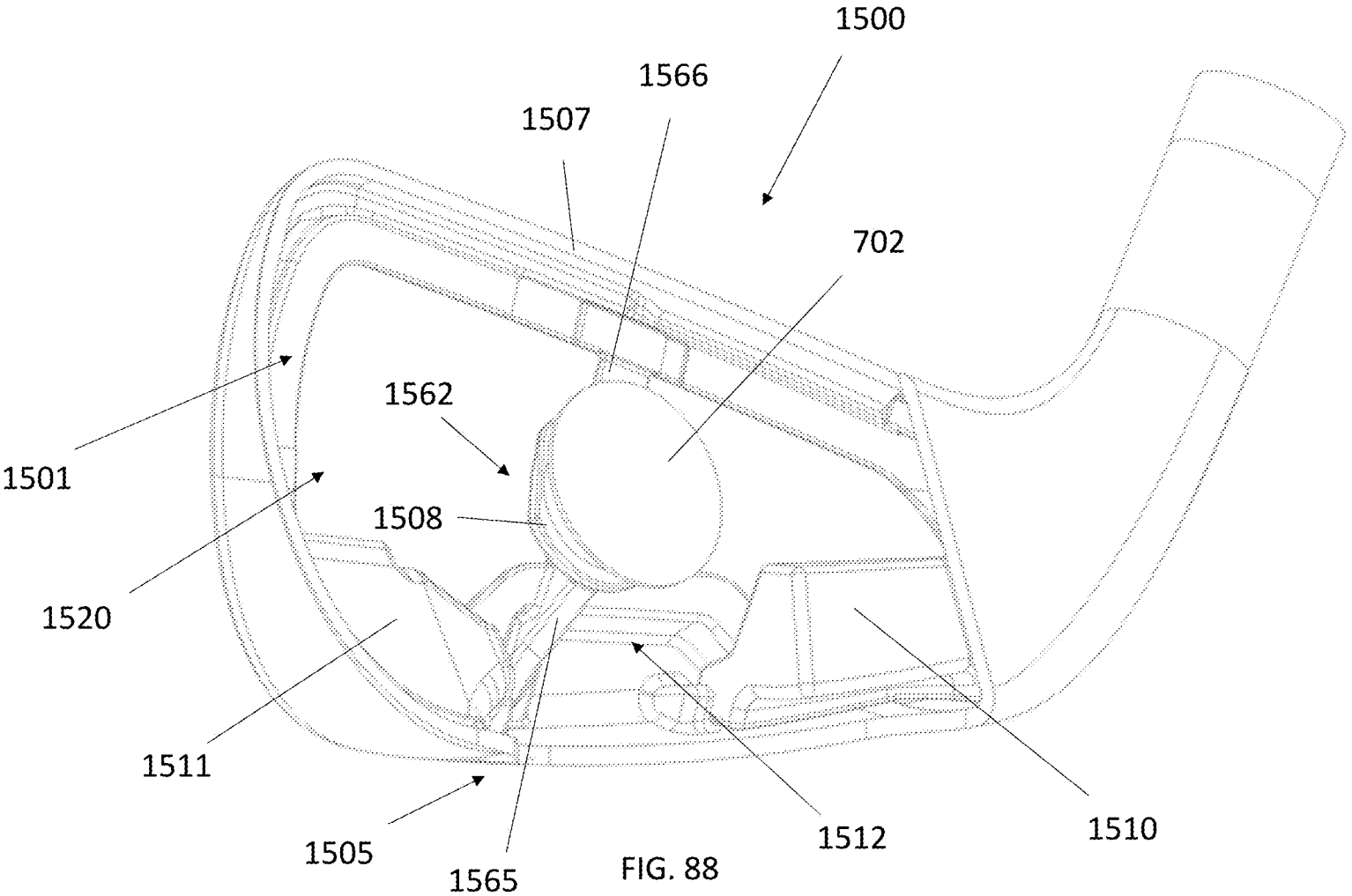
Figure 89:
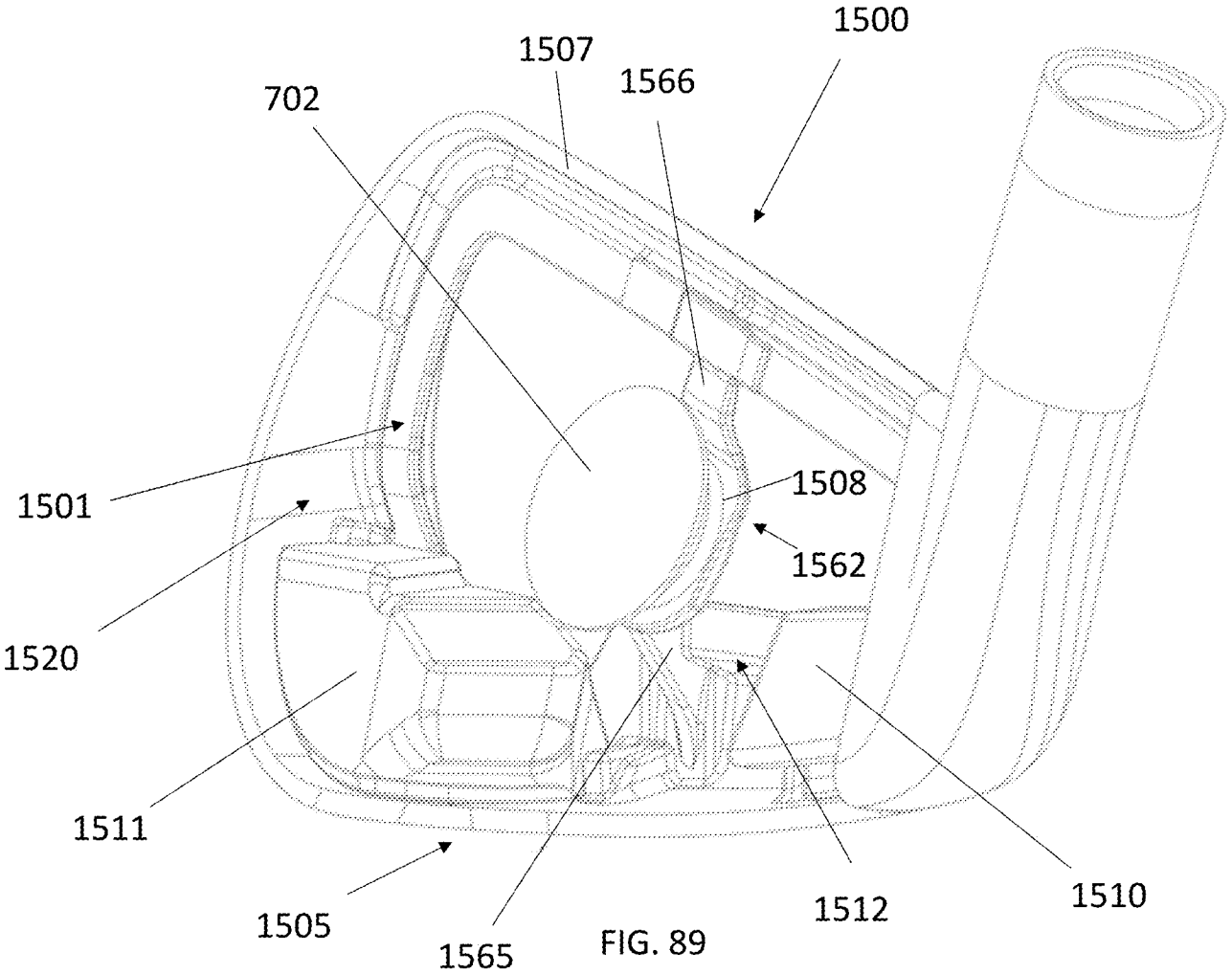
Figure 90:
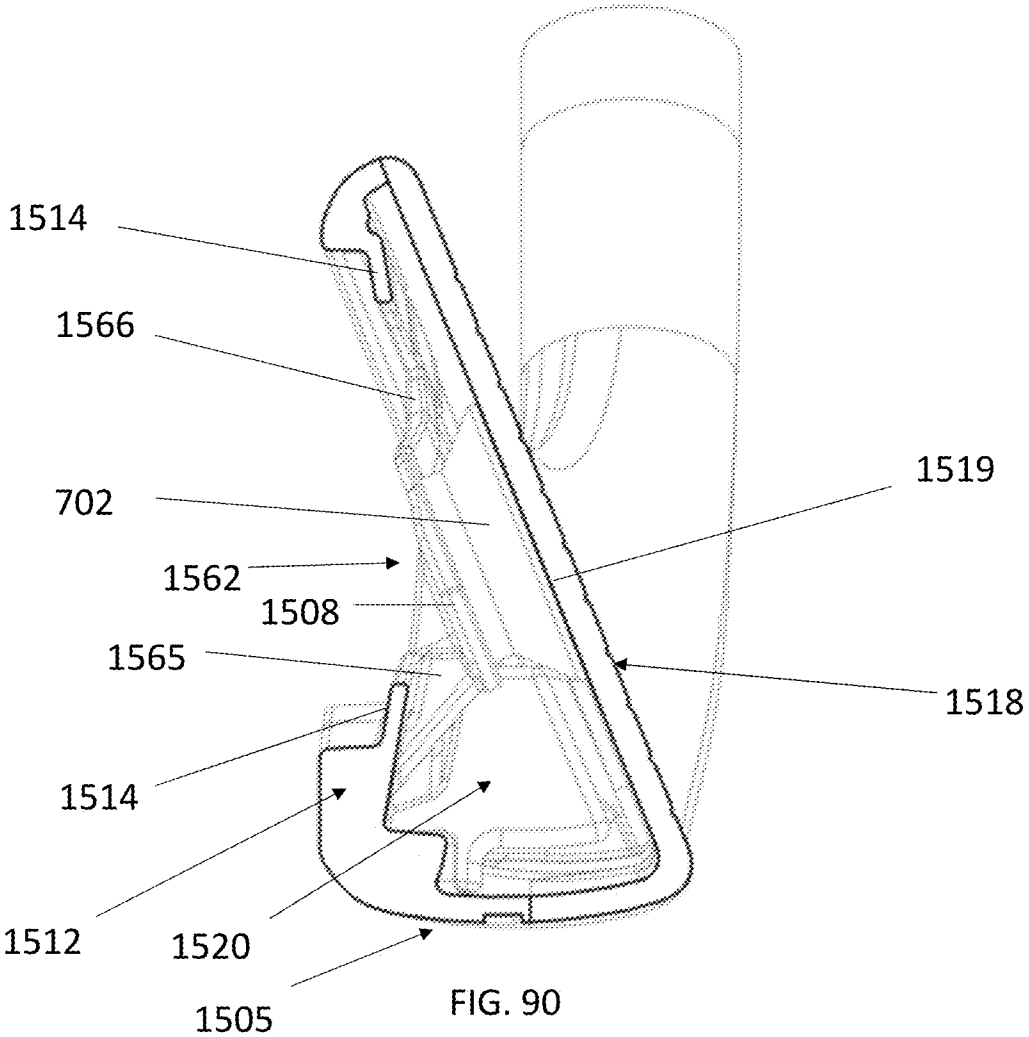

FIGS. 86-94 Depict an additional embodiment of a golf club head 1500 having a damping element 702. FIG. 86 depicts a perspective view of a golf club head 1500. FIG. 87 depicts an additional perspective view of the golf club head 1500 of FIG. 86. FIG. 88 depicts a perspective view of the golf club head 1500 of FIG. 86 missing the striking face. FIG. 89 depicts an additional perspective view of the golf club head 1500 of FIG. 86 missing the striking face. FIG. 90 depicts a cross sectional view T-T of the golf club head 1500 of FIG. 86.

The golf club head 1500 illustrated in FIGS. 86-90 is an iron having a cavity back construction and includes a periphery portion 1501 surrounding and extending rearward from the striking face 1518. The periphery portion 1501 includes the sole 1505, the toe 1506, the heel 1504, and the topline 1507. The periphery portion 1501 can also include a back portion 1512, which may partially enclose the cavity 1520. The periphery portion 1501 of the golf club head 1500 can include a support arm 1562. The support arm 1562 can extend from the sole 1505 to the topline 1507. In another embodiment, the support arm 1562 can extend from the back portion 1512 to the topline 1507. The support arm 1562 can include a first portion 1565, a cradle 1508, and a second portion 1566. The first portion 1565 extends from the sole 1505 or the back portion 1512, or both. The first portion 15165 is connected to the cradle 1508 which is configured to support a damping element 702 disposed between the rear surface 1519 of the striking face 1518 and the cradle 1508 of the support arm 1562. The second portion 1566 extends between the topline 1507 and the cradle 1508. The damping element 702 can support the striking face 1518 and offer damping properties, as discussed above.

As illustrated, the first portion 1565 is substantially thicker in a fore-aft direction than it is in the heel-toe direction and the second portion 1566 is substantially thicker in a heel-toe direction than it is in the fore-aft direction. Additionally, the cradle 1508 is thicker in a heel-toe direction than the second portion 1566. In another embodiment, this could be reversed. In another embodiment, both the first portion 1565 and the second portion 1565 can be substantially thicker in a fore-aft direction than in the heel-toe direction. In another embodiment, both the first portion 1565 and the second portion 1565 can be substantially thicker in a heel-toe direction than it in the fore-aft direction. In another embodiment the second portion 1566 could be thicker in a heel-toe direction than the cradle 1508.

Figure 91:
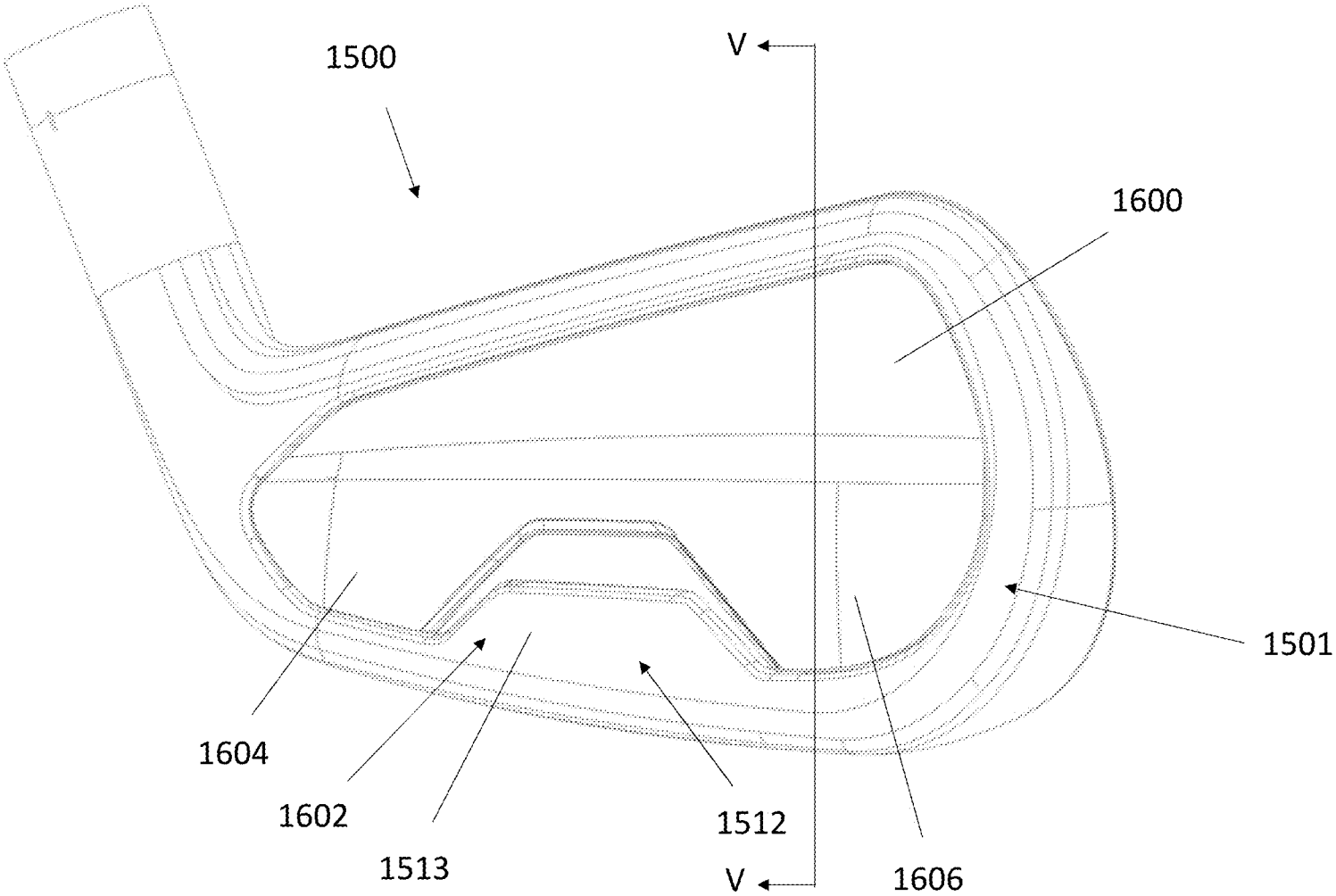
Figure 92:
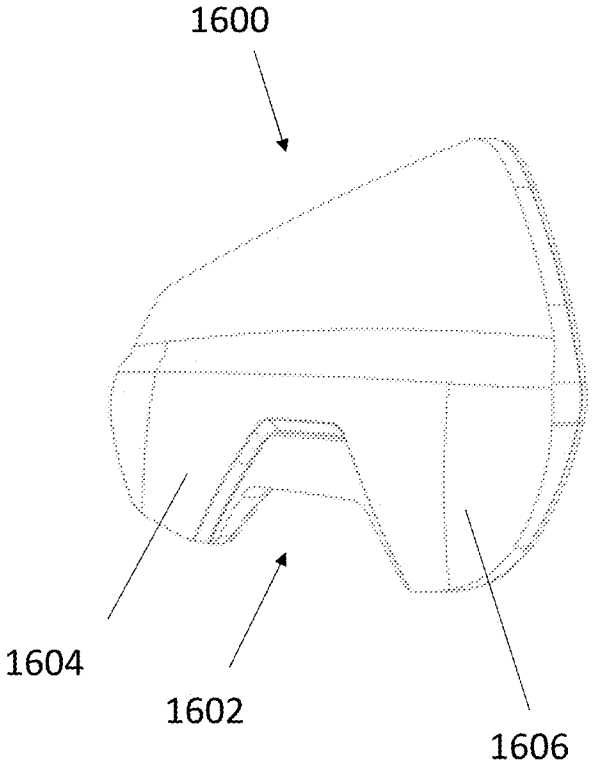

As illustrated in FIGS. 91-94 the golf club head 1500 can include a back cover affixed to the periphery portion 1501. FIG. 91 depicts a perspective view of the golf club head 1500 of FIG. 86 including a back cover 1600. FIG. 92 depicts a perspective view of the back cover 1600. FIG. 93 depicts an additional perspective view of the back cover 1600. FIG. 94 depicts a cross sectional view V-V of the golf club head 1500 of FIG. 92. As illustrated in FIG. 94 the periphery portion can include a shelf 1514 configured to accept the back cover 1600. The back cover 1600 can be affixed to the periphery portion 1501 in a variety of ways, which may include for example, adhesive, double sided tape, mechanical fasteners, interference fit, an undercut, epoxy, etc. As illustrated in FIGS. 91 to 93 the back cover can include a central recess 1602 with a heel side leg 1604 and a toe side leg 1606 extending downwards. The back portion 1512 of the periphery portion 1501 can include a central protrusion 1513 extending upwards further than the rest of the back portion 1512. As illustrated in FIG. 94, the first portion 1565 of the support arm 1562 can extend from the central protrusion 1513 of the back portion 1512. Additionally, the central protrusion 1513 can extend into the central recess 1602 of the back cover 1600.

Additionally, as illustrated in FIG. 93 the back cover can include a plurality of stiffening members 1610 configured to increase the stiffness of the back cover 1600 while maintaining its light weight. The back cover 1600 can include stiffening members extending vertically and stiffening members extending horizontally. The stiffening members 1610 generally protrude away from the back cover 1600 towards the interior cavity 1520 of the golf club head 1500.

The golf club head 1500 can include a variable face thickness geometry to further promote more uniform ball speed across the striking face of the golf club head. FIG. 95 depicts the golf club head 1500 of FIGS. 86-94 having a tapered heel portion 1540. FIG. 96 depicts a rear view of the striking face 1518 and damping element 702 of the golf club head 1500 of FIG. 95. FIG. 97 depicts a perspective view of the striking face 1518 and damping element 702 of FIG. 96. FIG. 98 depicts an additional perspective view of the striking face 1518 and damping element 702 of FIG. 96. FIG. 99 depicts a front view of the golf club head 1500 of FIG. 95 including the supported region 742.

As illustrated in FIG. 95 the golf club head 1500 includes a plurality of scorelines on the striking face 1518. A majority of the scorelines 1560 can be considered full length scorelines, each of them having the same length. Some of the scorelines don't extend as far heelward due to the sloped nature of the topline 1507 of iron type golf club heads and can be considered partial length scorelines. The center face plane 1521 extends parallel to the y-axis and the z-axis and is located equidistant between the heel-most extent and the toe-most extent of the full length scorelines 1560. The striking face 1518 can also include a sole return 1517 extending aft from the bottom of the striking face 1518 forming a portion of the sole 1505 of the golf club head.

As illustrated in FIGS. 96-98 the striking face 1518 can include a constant thickness portion 1530 and a tapered heel portion 1540. As illustrated, the constant thickness portion 1530 can have substantially constant thickness. The scorelines are not considered when measuring the thickness of the striking face and considering whether it is substantially constant in thickness. As illustrated above, the rear surface 1519 of the striking face 1518 can be supported by a damping element 702. In a preferred embodiment, the damping element 702 abuts the constant thickness portion 1530 of the striking face 1518. The tapered heel portion 1540 extends from a tapered heel portion thick end 1541 adjacent the constant thickness portion 1530 to a tapered heel portion thin end 1542 heelwards of the thick end 1541. In one embodiment, the thin end can be located heelwards of the heel-most extent of the full length scorelines 1560. In one embodiment, the tapered heel portion 1540 can taper at a substantially constant rate from the thick end 1541 to the thin end 1542. In other embodiments, the taper rate can be variable along the length of the tapered heel portion 1540. The constant thickness portion 1530 can extend above the tapered heel portion 1540. An upper heel chamfer 1544 can be formed between the tapered heel portion 1540 and the constant thickness portion 1530 above the tapered heel portion 1540. The constant thickness portion 1530 can extend below the tapered heel portion 1540. A lower heel chamfer 1543 can be formed between the tapered heel portion 1540 and the constant thickness portion 1530 below the tapered heel portion 1540.

The striking face 1518 can also include a tapered toe portion 1550. The tapered toe portion 1550 extends from a tapered toe portion thick end 1551 adjacent the constant thickness portion 1530 towards a tapered toe portion thin end 1552. In one embodiment the tapered toe portion thin end 1552 is located toeward of the toe-most extent of the full length scorelines 1560. In one embodiment the tapered toe portion thin end 1552 has a boundary which is arcuate in shape, as illustrated in FIGS. 96-98. In one embodiment, the constant thickness portion 1530 extends below the tapered toe portion 1550. In one embodiment, the constant thickness portion 1530 extends above the tapered toe portion 1550. In one embodiment, the constant thickness portion 1530 extends around a toe side of the tapered toe portion 1550. In on embodiment, not illustrated, a chamfer can be formed between the tapered toe portion 1550 and the constant thickness portion 1530.

In one embodiment, the constant thickness portion 1530 of the striking face 1518 has a thickness CT greater than 1.5 mm and less than 2.5 mm. In one embodiment, the constant thickness portion 1530 of the striking face 1518 has a thickness CT greater than 1.7 mm and less than 2.2 mm. In one embodiment the thick end 1541 of the tapered heel portion 1540 has a heel offset HO from the center face plane 1521 that is less than 20 mm and greater than 1 mm. In one embodiment the thick end 1541 of the tapered heel portion 1540 has a heel offset HO from the center face plane 1521 that is less than 15 mm. In one embodiment the thick end 1541 of the tapered heel portion 1540 has a heel offset HO from the center face plane 1521 that is less than 10 mm. In one embodiment the width HW of the tapered heel portion is greater than 5 mm and less than 30 mm. In one embodiment the width HW of the tapered heel portion is greater than 10 mm and less than 25 mm. In one embodiment the width HW of the tapered heel portion is greater than 15 mm and less than 20 mm. In one embodiment the height HH of the thick end 1542 tapered heel portion 1540 is greater than 20 mm and less than 40 mm. In one embodiment the height HH of the thick end 1542 tapered heel portion 1540 is greater than 25 mm and less than 40 mm. In one embodiment the height HH of the thick end 1542 tapered heel portion 1540 is greater than 30 mm and less than 40 mm. In one embodiment the height HH of the tapered heel portion 1540 decreases in a heelward direction. In one embodiment the tapered toe portion 1550 has a toe offset TO from the center face plane 1521 that is less than 40 mm. In one embodiment the tapered toe portion 1550 has a toe offset TO from the center face plane 1521 that is less than 30 mm. In one embodiment the tapered toe portion 1550 has a toe offset TO from the center face plane 1521 that is less than 15 mm. In one embodiment the damping element 702 has a damping offset DO toeward from the center face plane 1521 that is greater than 1 mm and less than 20 mm. In one embodiment the damping element 702 has a damping offset DO toeward from the center face plane 1521 that is greater than 1 mm and less than 15 mm. In one embodiment the damping element 702 has a damping offset DO toeward from the center face plane 1521 that is greater than 1 mm and less than 10 mm. In one embodiment the damping element 702 has a damping offset DO toeward from the center face plane 1521 that is greater than 1 mm and less than 5 mm. In another embodiment, the damping element 702 has a damping offset DO toeward from the center face plane 1521 that is greater than 5 mm. In another embodiment, the damping element 702 has a damping offset DO toeward from the center face plane 1521 that is greater than 10 mm. In another embodiment, the damping element 702 has a damping offset DO toeward from the center face plane 1521 that is greater than 15 mm. In one embodiment the tapered toe portion 1550 can have a decreasing thickness in the toeward direction with similar minimum thicknesses as the tapered heel portion 1540. In one embodiment the toe offset TO is greater than the heel offset HO. In one embodiment the toe offset TO is at least 125% of the heel offset HO. In one embodiment the toe offset TO is at least 150% of the heel offset HO. In one embodiment the toe offset TO is at least 175% of the heel offset HO. In one embodiment the toe offset TO is at least 200% of the heel offset HO.

FIGS. 100-107 depict an additional embodiment of a golf club head 1700. FIG. 100 depicts a perspective view of the golf club head 1700. FIG. 101 depicts a perspective view of the golf club head 1700 of FIG. 100 having a first damping element 702 and missing the support arm 1762. FIG. 102 depicts a perspective view of the golf club head 1700 of FIG. 101. FIG. 103 depicts an additional perspective view of the golf club head 1700 of FIG. 101. FIG. 104 depicts a perspective view of the golf club head 1700 of FIG. 100 including a first damping element 702 and a support arm 1762. FIG. 105 depicts an additional perspective view of the golf club head 1700 of FIG. 104.

The golf club head 1700 illustrated in FIGS. 100-107 is an iron having a cavity back construction and includes a periphery portion 1701 surrounding and extending rearward from the striking face 1718. The periphery portion 1701 includes the sole 1705, the toe 1706, the heel 1704, and the topline 1707. The periphery portion 1701 can also include a back portion 1712, which may partially enclose the cavity 1720.

As illustrated in FIGS. 104 and 105 the golf club head 1700 can include a support arm 1762. The support arm 1762 extends from the sole 1705 to the topline 1707. The support arm 1762 is configured to support the damping element 702 disposed between the rear surface 1719 of the striking face 1718 and the front surface ** of the support arm 1762. The support arm 1762 can be formed separately from the golf club head 1700 and subsequently affixed to the golf club head 1700. As illustrated in FIGS. 101-103, the golf club head can include one or more apertures 1796, 1798 configured to receive the support arm 1762. The topline 1707 can include a first aperture 1796 and the sole 1705 can include a second aperture 1798. As illustrated in FIGS. 104 and 105 the support arm 1762 can be configured to be installed through one of the apertures 1796, 1798 and reside within the apertures 1796, 1798. The support arm 1762 can be affixed to the golf club head in variety of ways, which may include, for example, welding, brazing, adhesives, mechanical fasteners, interference fits, etc. The support arm 1762** can be formed from a variety of materials, which may include, for example, steel, aluminum, magnesium, titanium, composite, carbon fiber composite, polymer, thermoplastic, thermoset, etc. In one embodiment the periphery portion of the golf club head can be formed of a first material and the support arm can be formed of a second material. In one embodiment the second material can have a lower density than the first material. In one embodiment, the second material can have a higher stiffness than the first material.

In other embodiments, the support arm 1762 could extend from only or any combination of the sole 1705, the topline 1707, the back portion 1712, the toe 1706, or the heel 1704. In other embodiments, apertures may be formed in any of the sole 1705, the topline 1707, the back portion 1712, the toe 1706, or the heel 1704. The golf club head may also include one or more weight members 1710.

FIG. 106 depicts a perspective view of the golf club head 1700 of FIG. 100 including a first damping element 702, a support arm 1762, and a second damping element 702K. FIG. 107 depicts an additional perspective view of the golf club head 1700 of FIG. 106 missing the striking face. FIG. 108 depicts a cross sectional view of the support arm 1762 and second damping element 702*k*.

As illustrated in FIGS. 106 and 107, the golf club head 1700 can also include a second damping element 702K. The second damping element 702K is affixed to the support arm 1762. The second damping element 702*k* can aid in damping vibrations of the support arm 1762. The second damping element 702K can also support the striking face 1718 and offer damping of the striking face 1718. The second damping element 702K can wrap around the support arm 1762. The second damping element 702K can include a void 1787 where the first damping element 702 resides. In one embodiment, the second damping element 702*k* could retain the first damping element 702 in place wherein the first damping element 702 abuts the edges of the void 1787. As illustrated in FIGS. 107 and 108, the second damping element 702*k* could partially wrap around the support arm 1762. The second damping element 702*k* can abut a front surface of the support arm 1762. The second damping element 702*k* can include a front surface 1781 in contact with the rear surface 1719 of the striking face 1718. The second damping element 702*k* can include a toe portion 1782 abutting a heel side of the support arm 1762 and a heel portion 1783 abutting a heel portion of the support arm 1762. The second damping element 702*k* can also include a rear portion 1784 abutting a rear portion of the support arm 1762. The second damping element 702*k* can also include a cavity 1785 configured to receive the support arm 1762. The second damping element 702*k* may also include a slit 1786 allowing it to be installed around the support arm 1762 after the support arm 1762 has been affixed to the golf club head 1700. The second damping element 702*k* can comprise any of the materials disclosed herein for any of the other damping elements.

In another embodiment, the second damping element 702*k* could completely surround the support arm 1762. In other embodiments, the second damping element 702*k* may just reside between the support arm 1762 and the striking face 1718.

FIG. 109 depicts cross section view of an additional embodiment of the golf club head 1700 of FIG. 104. The golf club head 1700 can include a third damping element 702L located beneath the topline 1707. The third damping element 702L can abut the rear surface 1719 of the striking face 1718. The third damping element 702L can also abut the back portion 1712. The third damping element 702L can comprise any of the materials disclosed herein for any of the other damping elements or may comprise for example, epoxy, adhesive polymer, hot melt, or a 3d printed component.

FIG. 110 depicts a front toe-side perspective exploded view of a golf club head 1800 according to some examples. In particular, the golf club head is depicted as a fairway-metal type golf club head in accordance with some non-limiting and non-exhaustive examples. In some other examples, the golf club head may be a driver, a hybrid type golf club head or an iron type golf club head having a cavity back construction. FIG. 111 depicts a rear toe-side perspective exploded view of a cross-section of the golf club head 1800 of FIG. 110 along line 111A-111A in FIG. 110. FIG. 112 depicts a rear heel-side perspective exploded view of the golf club head 1800 of FIG. 110. The golf club head 1800 may include some features similar to, or the same as, features of other golf club heads depicted and described herein.

Referring concurrently to FIGS. 110-112, the golf club head 1800 may include a striking face 1818 having a bottom edge 1818B, a top edge 1818T opposite to the bottom edge 1818B, a front surface 1818F (or exterior surface) facing the outside of the golf club head 1800 and configured to strike a golf ball, and a rear surface 1818R (or interior surface) opposite to the front surface 1818F. In some examples, the striking face 1818 has a plurality of score lines (or grooves) in the front surface 1818F that are configured to assist in imparting spin to a golf ball when the golf ball is struck by the striking face 1818. The plurality of score lines may extend along a toe-heel direction and may be arranged from the bottom edge 1818B to the top edge 1818T. In some other examples, the striking face 1818 has no grooves in the front surface 1818F. The striking face 1818 may be fabricated separately and attached to the golf club head 1800, for example, by welding or an adhesive. In some other examples, the striking face 1818 may be integrally formed with the golf club head 1800.

The golf club head 1800 may include a periphery portion 1801 surrounding and extending rearward from the striking face 1818. The periphery portion 1801 may include a heel 1804, a toe 1806, a sole 1805 coupled between the heel 1804 and toe 1806 and extending rearward from the bottom edge 1818B, and a crown 1812 coupled between the heel 1804 and toe 1806 and extending rearward from the top edge 1818T. The crown 1812 and the sole 1805 may be joined (e.g., meet) at a skirt 1811 of the golf club head 1800.

The golf club head 1800 may include a body 1840 including the periphery portion 1801 and the striking face 1818, and the body 1840 may have an outer surface 1840S at least partially facing the outside of the golf club head 1800.

The golf club head 1800 may have a cavity 1820 at least partially enclosed by the striking face 1818 and the periphery portion 1801. For example, the cavity 1820 may be at least partially enclosed by at least one of the striking face 1818, the sole 1805, the crown 1812, the toe 1806, or the heel 1804. The rear surface 1818R of the striking face 1818 may at least partially face the cavity 1820.

In some examples, the crown 1812 includes a crown cover 1812C that defines at least part of the crown 1812 and is configured (e.g., shaped and sized) to cover an access opening 1830 in the golf club head 1800 that exposes the cavity 1820 to the outside of the golf club head 1800. The golf club head 1800 may be manufactured to have the access opening 1830 to provide access to the cavity 1820 and to components of the golf club head 1800 in the cavity 1820 from the outside. After adjustments are made to the golf club head 1800 through the access opening 1830, the crown cover 1812C may be attached (e.g., by welding, an adhesive, etc.) to the body 1840 to cover the access opening 1830 and at least partially enclose the cavity 1820.

The outer surface 1840S of the body 1840 may have a recessed surface 1812R that is adjacent to the access opening 1830 and is recessed from an adjacent portion of the outer surface 1840S adjacent to the recessed surface 1812R. The recessed surface 1812R, which may comprise part of the crown 1812, may at least partially (e.g., entirely) surround the access opening 1830 and may be shaped and sized to at least partially receive the crown cover 1812C. For example, the recessed surface 1812R may form a shallow pocket in the outer surface 1840S, and the crown cover 1812C may be at least partially fitted into the shallow pocket when it is attached to the body 1840. The crown cover 1812C may be level and continuous with the adjacent portion of the outer surface 1840S when the crown cover 1812C is at least partially fitted into the shallow pocket and attached to the body 1840. For example, a thickness of a portion of the crown cover 1812C that is configured to rest on the recessed surface 1812R when the crown cover 1812C is at least partially fitted into the shallow pocket may be substantially the same as a distance by which the recessed surface 1812R is recessed from the adjacent portion of the outer surface 1840S.

The golf club head 1800 may include a hosel 1898 disposed at the heel 1804 and configured to receive a golf club shaft (not shown). The hosel 1898 may include an external upper hosel portion 1898E protruding outwardly from the golf club head 1800 and having an opening 1898O shaped and sized to receive at least part of the shaft into the golf club head 1800 (e.g., into the cavity 1820). In some examples, the hosel 1898 may include an internal lower hosel portion 1898I that is at least partially disposed within the cavity 1820. The internal lower hosel portion 1898I may protrude into the cavity 1820 and have a second opening, schematically shown by two dashed lines in FIG. 111 as 1898O2, shaped and sized to receive at least part of the shaft. The second opening 1898O2 in the internal lower hosel portion 1898I may be aligned with the opening 1898O in the external upper hosel portion 1898E so that the shaft can be guided through both the opening 1898O in the external upper hosel portion 1898E and the second opening 1898O2 in the internal lower hosel portion 1898I.

The golf club head 1800 may include a support arm 1862 at least partially extending into the cavity 1820, and a damping element 1865 positioned between the support arm 1862 and the rear surface 1818R of the striking face 1818. The damping element 1865 may provide improved stiffness to the striking face 1818, for example, when the striking face 1818 strikes a golf ball. This can help to keep the striking face 1818 from flattening when striking the golf ball, increase ball speed across the striking face 1818, improve uniformity of ball speed across the striking face 1818, and improve the sound and feel of the golf club head 1800 when striking the golf ball. Because the damping element 1865 improves the stiffness to the striking face 1818, a thickness of the striking face 1818 can be reduced to decrease the mass of the golf club head 1800. Reducing the mass of the golf club head 1800 can improve performance characteristics of the golf club head 1800, including ball speed and carry distance.

A thickness of the striking face 1818, for example, an average thickness of the striking face 1818 or a thickness of the striking face 1818 at a center (e.g., geometric center) of the striking face 1818, may be less than 3.0 millimeters, less than 2.8 millimeters, less than 2.5 millimeters, less than 2.3 millimeters, less than 2.0 millimeters, less than 1.8 millimeters, or less than 1.5 millimeters. In some examples, the thickness of the striking face 1818 may be within a range of 2.5 millimeters to 3.0 millimeters. The thickness of the striking face 1818 may be measured from the front surface 1818F to the rear surface 1818R, for example, along a direction normal to the front surface 1818F at a point on the front surface 1818F from which the thickness is being measured. In examples, a thickness of a striking face at the center (e.g., geometric center) of the striking face of a fairway-metal or hybrid type golf club head that does not include a damping element positioned between a support arm and a rear surface of the striking face can be 4.5 millimeters or more. In contrast, according to some non-limiting and non-exhaustive examples, the thickness of the striking face of fairway-metal or hybrid type golf club heads at the center of the striking face may be less than 4.5 millimeters, for example, 3.0 millimeters or less, which can allow for the mass of the golf club head to be reduced and performance characteristics of the golf club head, including ball speed and carry distance, to be improved compared to other golf club heads.

The damping element 1865 may have some features (e.g., shape, size, position, material, etc.) similar to, or the same as, the features of damping elements and elastomer elements depicted and described in the present application.

The damping element 1865 may be different in material from the striking face 1818 and the support arm 1862. In some examples, the damping element 1865 comprises a polymer, for example, an elastomer.

The damping element 1865 may have a front surface 1865F facing, and in contact (e.g., direct contact) with, the rear surface 1818R of the striking face 1818, and a rear surface 1865R opposite to the front surface 1865F. The damping element 1865 (e.g., the front surface 1865F and the rear surface 1865R of the damping element 1865) may have any suitable shape, such as a circle, oval, or oblong shape. In some examples, the front surface 1865F and the rear surface 1865R are the same in shape and size (e.g., planar area). In some other examples, the area of the front surface 1865F may be different from the area of the rear surface 1865R in at least one of shape or size. A thickness of the damping element 1865 may be uniform or nonuniform over the damping element 1865. For example, a thickness of the damping element 1865 may be greater at one end (e.g., one of a heel-side end and a toe-side end) of the damping element 1865 than at another end (e.g., another one of the heel-side end and the toe-side end) of the damping element 1865. In the non-limiting and non-exhaustive example depicted, the thickness of the damping element 1865 is greatest at the heel-side end of the damping element 1865, and the thickness of the damping element 1865 tapers in a heel-to-toe direction so that the thickness of the damping element 1865 is smallest at the toe-side end of the damping element 1865.

The damping element 1865 may be positioned at any suitable position on the rear surface 1818R of the striking face 1818. In the non-limiting and non-exhaustive example depicted, the damping element 1865 is positioned to cover the center (e.g., geometric center) of the striking face 1818. In some examples, the striking face 1818 has the plurality of score lines in the front surface 1818F of the striking face 1818, and the damping element 1865 may be positioned to cover a center of one or more of the score lines (e.g., a third score line or a fifth score line positioned from the bottom edge 1818B). In some examples, the damping element 1865 may be centered at the center of the striking face 1818. In some other examples, the damping element 1865 may be centered toe-ward or heel-ward from the center of the striking face 1818. The damping element 1865 does not cover the center of the striking face 1818 in some examples.

The support arm 1862 may extend at least partially through the cavity 1820 from the periphery portion 1801. For example, the support arm 1862 may extend at least partially through the cavity 1820 from at least one of the sole 1805, the crown 1812, or the hosel 1898. In the non-limiting and non-exhaustive example depicted, the support arm 1862 extends at least partially through the cavity 1820 from the internal lower hosel portion 1898I of the hosel 1898. In some other examples, the support arm 1862 may extend at least partially through the cavity 1820 from the sole 1805 or from the crown 1812. The support arm 1862 may be cantilevered such that it extends only part way through the cavity 1820. In some other examples, the support arm 1862 may extend all the way through the cavity 1820. For example, the support arm 1862 may extend all the way through the cavity 1820 from the sole 1805 to the crown 1812.

In some examples, the support arm 1862 is integrally formed with the body 1840 of the golf club head 1800 and includes a same material as the body 1840 of the golf club head 1800. In some other examples, the support arm 1862 is attached to the body 1840 of the golf club head 1800, for example, via an adhesive r welding.

The support arm 1862 may include a base arm member 1862B and a flat support member 1862F. The base arm member 1862B may extend along a longitudinal axis 1862L at least partially through the cavity 1820 from the body 1840 (e.g., from the periphery portion 1801), and the flat support member 1862F may be integrally formed with, or attached to, the base arm member 1862B. For example, the flat support member 1862F may be attached to the base arm member 1862B by welding or an adhesive. In the example illustrated in FIGS. 110-112, the longitudinal axis 1862L is illustrated as extending from the internal lower hosel portion 1898I towards the toe 1806. In some examples, the flat support member 1862F does not directly contact any of the sole 1805, the crown 1812, or the hosel 1898 (e.g., the internal lower hosel portion 1898I). The flat support member 1862F may be positioned between the base arm member 1862B and the damping element 1865. In some examples, the flat support member 1862F may have a shape substantially the same as a shape of the damping element 1865 (e.g., a shape of the rear surface 1865R of the damping element 1865) to provide uniform support and/or pressure over the damping element 1865.

A compression plate 1864 may be positioned between the support arm 1862 (e.g., the flat support member 1862F) and the damping element 1865. In some examples, the compression plate 1864 includes titanium. The compression plate 1864 may include other materials, such as other metals, in some other examples. The compression plate 1864 may be attached to the support arm 1862 by a gasket 1863. The gasket 1863 may be, for example, an adhesive. In some examples, the compression plate 1864 is in contact (e.g., direct contact) with the damping element 1865 (e.g., the rear surface 1865R of the damping element 1865) and is adapted to apply pressure to the damping element 1865 so that the damping element 1865 is compressed between the compression plate 1864 and the rear surface 1818R of the striking face 1818. In some examples, a shape of the compression plate 1864 may be substantially the same as a shape of the damping element 1865 (e.g., a shape of the rear surface 1865R of the damping element 1865) so that the compression plate 1864 is adapted to apply a substantially uniform pressure over the damping element 1865. Providing uniform pressure to the damping element 1865 can improve performance characteristics of the golf club head, such as uniformity of ball speed and uniformity of carry distance across the striking face 1818.

The golf club head 1800 may include a compression adjustment mechanism configured to controllably adjust the compression of the damping element 1865 against the rear surface 1818R of the striking face 1818. The compression adjustment mechanism may include any features similar to, or the same as, other adjustment mechanisms depicted and described herein (e.g., the adjustment mechanism including the adjustment receiver 306 and the adjustment driver 330, the adjustment mechanism including the adjustment receiver 406 and the adjustment driver 430, the adjustment driver 830, etc.).

In some examples, the compression adjustment mechanism may include an adjustment driver 1870 configured to apply an adjustable pressure to the damping element 1865, for example, via the compression plate 1864. Adjustment driver 1870 is depicted only conceptually in FIGS. 110-112; however, adjustment driver 1870 may take the form of one or more of the adjustment driver(s) described elsewhere in this application, such as adjustment driver 330, adjustment driver 430, adjustment driver 830, etc. In the example depicted in FIGS. 110-112, the compression adjustment mechanism is entirely within the cavity. The compression adjustment mechanism may include an adjustment receiver configured to receive at least part of the adjustment driver 1870. For example, the adjustment receiver may include an aperture opening 1862O in the support arm 1862, for example, in the flat support member 1862F, that is shaped and sized to receive at least part of the adjustment driver 1870. In the example depicted in FIGS. 110-112, the aperture opening 1862O is separated from the base arm member 1862B. The adjustment driver 1870 may be movable and selectively positionable through the aperture opening 1862O along a driver axis 1870L in order to apply a selectable pressure to the damping element 1865. For example, an end of the adjustment driver 1870 may contact (e.g., directly contact) a surface of the compression plate 1864 opposite to a surface of the compression plate 1864 in contact with the damping element 1865, and the compression in the damping element 1865 may be controlled by applying an adjustable force to the compression plate 1864 from the adjustment driver 1870. In the example depicted in FIGS. 110-112, the driver axis 1870L of the adjustment driver 1870 and the longitudinal axis 1862L of base arm member 1862B are illustrated as being oriented along different directions.

In some examples, the adjustment driver 1870 includes a head and a shaft extending from the head, and the aperture opening 1862O may be shaped and sized to receive at least part of the shaft of the adjustment driver 1870. The shaft of the adjustment driver 1870 may be threaded, and the aperture opening 1862O may be threaded so that the adjustment driver 1870 can engage with the aperture opening 1862O. The adjustment driver 1870 may be controllably positioned using a tool configured to engage with the adjustment driver 1870. For example, the tool may engage with the head (e.g., a torx of the head) of the adjustment driver 1870.

In some examples, the golf club head 1800 has an adjustment opening 1850 exposing the cavity 1820 to the outside of the golf club head 1800. The adjustment opening 1850 may provide access to the cavity 1820 and components within the cavity 1820 from outside of the golf club head 1800. This can allow for adjustments to be made to the golf club head 1800, or for components to be inserted into the cavity 1820 and positioned inside the cavity 1820, even after the striking face 1818 is attached to the body 1840 and the crown cover 1812C is attached to the body 1840.

The adjustment opening 1850 may be shaped and sized to at least partially receive a tool configured to adjust one more components inside the cavity 1820, such as the compression adjustment mechanism (e.g., the adjustment driver 1870). In some examples, the adjustment opening 1850 may be shaped and sized so that one or more components of the golf club head 1800, such as the adjustment driver 1870, can be moved between the cavity 1820 and the outside of the golf club head 1800 through the adjustment opening 1850. In the non-limiting and non-exhaustive example depicted, the adjustment opening 1850 is provided in the hosel 1898. In some other examples, the adjustment opening 1850 may be positioned at least partially in at least one of the hosel 1898, the sole 1805, or the crown 1812. For example, the adjustment opening 1850 may be provided at least partially in a portion of the skirt 1811 that is rearmost to the striking face 1818.

The adjustment opening 1850 may be at least partially covered by at least one of a cap, a weight, or a medallion. During manufacture of the golf club head 1800, the striking face 1818 may be attached to the body 1840 and the crown cover 1812C may be attached to the body 1840, a stiffness and/or CT of the striking face 1818 may be measured, the adjustment driver 1870 may be adjusted through the adjustment opening 1850 in response to the results of the stiffness and/or characteristic time (CT) measurements, and then the adjustment opening 1850 may be at least partially covered by, for example, a cap to seal off the cavity 1820 from the outside of the golf club head 1800. The cavity 1820 is entirely sealed off from the outside of the golf club head in some examples. Covering the adjustment opening 1850 allows the cavity 1820 to be sealed off from the outside of the golf club head 1800 to reduce the likelihood of dirt or other matter from entering the cavity 1820.

In some examples a method of manufacturing a golf club head, for example, the golf club head 1800, includes one or more (e.g., all) of the following processes. The striking face may be attached to the body (e.g., by welding) and the golf club head may be polished. A first CT test may be performed to measure a first CT of the golf club head without a damping element. A damping element is selected based on the first CT. For example, a desired thickness and durometer of a damping element may be determined, and a suitable damping element may be selected based on the desired thickness and durometer. The selected damping element may then be inserted into the cavity of the golf club head, for example, through an access opening in the crown and positioned between the striking face and a support arm. At least one of a compression plate, a gasket, or an adjustable driver may also be inserted and positioned into the cavity. A second CT test may be performed to measure a second CT of the golf club head with the damping element. In some examples, based on the second CT, the damping element may be removed, and a replacement damping element may be selected based on the second CT and positioned in the cavity between the striking face and the support arm. In some other examples, based on the second CT, an adjustment driver may be adjusted using a tool to adjust a compression of the damping element. A crown cover may be attached to the golf club head to cover the access opening in the crown.

The golf club head may have an adjustment opening at least partially in at least one of a hosel, a sole, or the crown of the golf club head. The adjustment opening may be shaped and sized to receive the adjustment driver or the tool for adjusting the adjustment driver. In some examples, the adjustment driver may be inserted into, and positioned in, the cavity of the golf club head through the adjustment opening. The adjustment driver, once positioned in the cavity, may be adjusted via a tool through the adjustment opening. For example, a third CT test may be performed to measure a third CT of the golf club head after the crown cover is attached to the golf club head, and the adjustment driver may be adjusted through the adjustment opening and through the adjustment opening, e.g., in order to make final adjustments to the assembled club to maximize performance while still complying with CT regulations.

Although specific embodiments and aspects were described herein and specific examples were provided, the scope of the invention is not limited to those specific embodiments and examples. One skilled in the art will recognize other embodiments or improvements that are within the scope and spirit of the present invention. Therefore, the specific structure, acts, or media are disclosed only as illustrative embodiments. The scope of the invention is defined by the following claims and any equivalents therein.

The invention claimed is:

1. A golf club head, comprising:

a striking face having a bottom edge, a top edge opposite to the bottom edge, a front surface configured to strike a golf ball, and a rear surface opposite to the front surface;

a sole extending rearward from the bottom edge of the striking face;

a crown extending rearward from the top edge of the striking face and joined to the sole along a skirt of the golf club head;

a cavity at least partially enclosed by the striking face, the sole, and the crown, the cavity being entirely sealed off from outside of the golf club head;

a hosel disposed at a heel and comprising:

an external upper hosel portion that protrudes outwardly from the golf club head and has a first opening shaped and sized to receive at least part of a golf club shaft into the cavity, and an internal lower hosel portion that protrudes into the cavity and has a second opening that is aligned with the first opening and shaped and sized to receive at least part of the golf club shaft;

a support arm extending at least partially through the cavity from the internal lower hosel portion, and spaced apart from the striking face; and an elastomer element positioned between the support arm and the rear surface of the striking face, the elastomer element covering, and directly contacting, a center of the striking face; and an adjustment mechanism entirely within the cavity and configured to adjust a compression of the elastomer element against the rear surface of the striking face, wherein the support arm comprises a base arm member and a flat support member that is attached to the base arm member, positioned between the elastomer element and the base arm member, and is spaced apart from the crown and the hosel, the base arm member and the flat support member both being entirely within the cavity.

2. The golf club head of claim 1, wherein the adjustment mechanism comprises an adjustable driver.

3. The golf club head of claim 2, wherein the support arm has an aperture hole shaped and sized to receive at least part of the adjustable driver.

4. The golf club head of claim 2, further comprising a compression plate between the elastomer element and the support arm, wherein the adjustment driver is selectively positionable to apply a controllable force to the compression plate.

5. The golf club head of claim 4, wherein the flat support member has an aperture hole shaped and sized to receive at least part of the adjustable driver, the aperture hole being separated from the base arm member.

6. The golf club head of claim 1, wherein a thickness of the striking face is less than 3.0 mm.

7. A golf club head, comprising:

a heel;

a toe;

a striking face coupled between the heel and the toe, and having a front surface configured to strike a golf ball, and a rear surface opposite to the front surface;

a sole extending rearward from the striking face;

a crown extending rearward from the striking face and joined to the sole along a skirt of the golf club head;

a cavity at least partially enclosed by the striking face, the sole, and the crown;

a hosel disposed at the heel and comprising:

an external upper hosel portion that protrudes outwardly from the golf club head and has a first opening shaped and sized to receive at least part of a golf club shaft into the cavity, and an internal lower hosel portion that protrudes into the cavity and has a second opening that is aligned with the first opening and shaped and sized to receive at least part of the golf club shaft;

a support arm extending at least partially through the cavity from the internal lower hosel portion, and spaced apart from the striking face, wherein a longitudinal axis of the support arm extends from the internal lower hosel portion towards the toe; and a damping element positioned between the support arm and the rear surface of the striking face.

8. The golf club head of claim 7, wherein the support arm is cantilevered in the cavity.

9. The golf club head of claim 7, wherein a front surface of the damping element is in contact with the rear surface of the striking face and has a circular shape.

10. The golf club head of claim 7, further comprising a compression plate between the damping element and the support arm.

11. The golf club head of claim 10, wherein the compression plate comprises titanium.

12. The golf club head of claim 10, wherein the support arm comprises a base arm member and a flat support member attached to the base arm member and positioned between the compression plate and the base arm member, and wherein the golf club head further comprises an adhesive between the flat support member and the compression plate to secure the flat support member to the compression plate.

13. The golf club head of claim 7, wherein a thickness of the striking face is within a range of 2.5 mm to 3.0 mm.

14. A golf club head, comprising:

a heel;

a toe;

a striking face coupled between the heel and the toe, and having a front surface configured to strike a golf ball and a rear surface opposite to the front surface;

a sole extending rearward from the striking face;

a crown coupled between the striking face and the sole;

a cavity at least partially enclosed by the striking face, the sole, and the crown;

a hosel disposed at the heel and comprising:

an external upper hosel portion that protrudes outwardly from the golf club head and has a first opening shaped and sized to receive at least part of a golf club shaft into the cavity, and an internal lower hosel portion that protrudes into the cavity and has a second opening that is aligned with the first opening and shaped and sized to receive at least part of the golf club shaft;

a support arm extending at least partially through the cavity from the internal lower hosel portion, wherein a longitudinal axis of the support arm extends from the internal lower hosel portion towards the toe;

a damping element positioned between the support arm and the rear surface of the striking face; and an adjustable driver moveable along a driver axis and configured to adjust compression of the damping element against the rear surface of the striking face, the driver axis and the longitudinal axis of the support arm being oriented along different directions.

15. The golf club head of claim 14, wherein a thickness of the striking face is less than 3.0 mm.

16. The golf club head of claim 14, wherein the damping element comprises a polymer.

17. The golf club head of claim 14, wherein the golf club head comprises a body comprising the toe, the heel, the striking face, the sole, the crown, and the hosel, and having a third opening shaped and sized to at least partially receive a tool configured to adjust the adjustable driver.

18. The golf club head of claim 17, wherein the third opening is in at least one of the hosel, the sole, or the crown, and the third opening is at least partially covered by a cap, a weight, or a medallion.

* * * * *